US007928929B2

(12) United States Patent
Shishido et al.

(10) Patent No.: US 7,928,929 B2
(45) Date of Patent: Apr. 19, 2011

(54) DISPLAY DEVICE AND DRIVING METHOD THEREOF

(75) Inventors: Hideaki Shishido, Kanagawa (JP); Hajime Kimura, Kanagawa (JP); Shunpei Yamazaki, Tokyo (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1233 days.

(21) Appl. No.: 11/467,072

(22) Filed: Aug. 24, 2006

(65) Prior Publication Data

US 2007/0046591 A1 Mar. 1, 2007

(30) Foreign Application Priority Data

Aug. 24, 2005 (JP) ..... 2005-242295

(51) Int. Cl.
*G09G 3/28* (2006.01)

(52) U.S. Cl. ..... 345/63; 345/89; 345/690

(58) Field of Classification Search ..... 345/690, 345/63, 77, 89, 76, 82
See application file for complete search history.

(56) References Cited

U.S. PATENT DOCUMENTS 6,016,133 A 1/2000 Nito et al.
6,094,187 A * 7/2000 Jones et al. ..... 345/690
6,144,364 A 11/2000 Otobe et al.
6,222,512 B1 4/2001 Tajima et al.
6,249,265 B1 6/2001 Tajima et al.
6,292,159 B1 9/2001 Someya et al.
6,310,588 B1 10/2001 Kawahara et al.
6,417,835 B1 7/2002 Otobe et al.
6,448,960 B1 9/2002 Shigeta
6,518,941 B1 2/2003 Kimura
6,563,486 B2 5/2003 Otobe et al.
6,873,310 B2 3/2005 Matsueda
6,954,190 B2 10/2005 Komiya
6,965,389 B1 11/2005 Masuji et al.
(Continued)

FOREIGN PATENT DOCUMENTS

EP 0 893 916 1/1999
(Continued)

OTHER PUBLICATIONS

K. Kang et al., "A New 42-in. AC PDP Using MAoD II Driving Scheme," SID 01 Digest: *Society for Information Display 2001 International Symposium Digest of Technical Papers*, vol. XXXII, Jun. 2001, pp. 1130-1133.

(Continued)

*Primary Examiner* — Amare Mengistu
*Assistant Examiner* — Koosha Sharifi
(74) *Attorney, Agent, or Firm* — Fish & Richardson P.C.

(57) ABSTRACT

A pixel is divided into m (m is an integer of m≧2) sub-pixels, and an area ratio of an s-th (s is an integer of 1 to m) sub-pixel is to be $2^{s-1}$. Also, k (k is an integer of k≧2) sub-frame groups including a plurality of sub-frames are provided in one frame, along with dividing one frame into n (n is an integer of n≧2) sub-frames, so that a ratio of a lighting period length of a t-th (t is an integer of 1 to n) sub-frame is $2^{(t-1)m}$. Further, each of the n sub-frames is divided into k sub-frames each having a lighting period length that is about 1/k of each of the n sub-frames, and one of these is provided in each of the k sub-frame groups.

28 Claims, 68 Drawing Sheets

U.S. PATENT DOCUMENTS

| | | | | |
|---|---|---|---|---|
| 6,989,845 | B1 | 1/2006 | Okamoto et al. | |
| 7,053,868 | B1 | 5/2006 | Kojima et al. | |
| 7,173,612 | B2 | 2/2007 | Nanno et al. | |
| 7,388,562 | B2 | 6/2008 | Koyama et al. | |
| 2001/0006377 | A1 | 7/2001 | Kasahara et al. | |
| 2001/0022565 | A1 | 9/2001 | Kimura | |
| 2001/0045923 | A1 | 11/2001 | Otobe et al. | |
| 2002/0036625 | A1 * | 3/2002 | Nakamura | 345/204 |
| 2002/0041278 | A1 | 4/2002 | Matsueda | |
| 2002/0047822 | A1 | 4/2002 | Senda et al. | |
| 2002/0130826 | A1 | 9/2002 | Otobe et al. | |
| 2003/0030601 | A1 | 2/2003 | Komiya | |
| 2003/0071772 | A1 | 4/2003 | Kimura | |
| 2004/0263434 | A1 | 12/2004 | Otobe et al. | |
| 2005/0212740 | A1 | 9/2005 | Miyagawa | |
| 2006/0152439 | A1 | 7/2006 | Kojima et al. | |
| 2007/0001954 | A1 | 1/2007 | Shishido et al. | |

FOREIGN PATENT DOCUMENTS

| | | | |
|---|---|---|---|
| EP | 0 982 708 | | 3/2000 |
| EP | 1 083 539 | A2 | 3/2001 |
| EP | 1 085 495 | | 3/2001 |
| EP | 1 193 675 | | 4/2002 |
| EP | 1 207 512 | A1 | 5/2002 |
| EP | 1 231 593 | | 8/2002 |
| EP | 1 962 262 | A2 | 8/2008 |
| JP | 2639311 | | 8/1997 |
| JP | 10-091118 | A | 4/1998 |
| JP | 10-307561 | | 11/1998 |
| JP | 11-073158 | | 3/1999 |
| JP | 2903984 | | 6/1999 |
| JP | 2000-206922 | | 7/2000 |
| JP | 3075335 | | 8/2000 |
| JP | 2001-051641 | A | 2/2001 |
| JP | 2001-109452 | A | 4/2001 |
| JP | 2001-125526 | | 5/2001 |
| JP | 2001-324958 | | 11/2001 |
| JP | 2002-236469 | A | 8/2002 |
| JP | 3322809 | | 9/2002 |
| JP | 2003-029708 | A | 1/2003 |
| JP | 2003-036051 | A | 2/2003 |
| JP | 2003-099000 | A | 4/2003 |
| JP | 2003168109 | A | 6/2003 |
| JP | 2004-020991 | A | 1/2004 |
| JP | 3486884 | B2 | 1/2004 |
| JP | 3489884 | | 1/2004 |
| JP | 3585369 | | 11/2004 |
| JP | 2005-024805 | A | 1/2005 |
| JP | 2005-275315 | A | 10/2005 |
| WO | 95/27970 | A1 | 10/1995 |
| WO | 01/73737 | A1 | 10/2001 |

OTHER PUBLICATIONS

Partial European Search Report (Application No. 06017281.4), dated Dec. 15, 2006, 5 pages.

European Search Report (Application No. 06017281.4) dated Apr. 2, 2007, 15 pages.

Hideaki Shishido et al.; "Display Device and Driving Method of Display Device"; U.S. Appl. No. 11/427,427, filed Jun. 29, 2006.

Official Communication (European Patent Application No. 06017281.4) dated Oct. 26, 2010, 8 pages.

* cited by examiner

FIG. 1

Sub-frame Group

Gray Scale

Sub-frame Lighting Period

Area of Sub-pixels

Light Emission Intensity

| | SFG1 | | | | | | SFG2 | | | | | |
|---|---|---|---|---|---|---|---|---|---|---|---|---|
| | SF11 | | SF12 | | SF13 | | SF21 | | SF22 | | SF23 | |
| | 0.5 | | 2 | | 8 | | 0.5 | | 2 | | 8 | |
| | SP1 | SP2 | SP1 | SP2 | SP1 | SP2 | SP1 | SP2 | SP1 | SP2 | SP1 | SP2 |
| | 1 | 2 | 1 | 2 | 1 | 2 | 1 | 2 | 1 | 2 | 1 | 2 |
| | 0.5 | 1 | 2 | 4 | 8 | 16 | 0.5 | 1 | 2 | 4 | 8 | 16 |
| 0 | × | × | × | × | × | × | × | × | × | × | × | × |
| 1 | ○ | × | × | × | × | × | ○ | × | × | × | × | × |
| 2 | × | ○ | × | × | × | × | × | ○ | × | × | × | × |
| 3 | ○ | ○ | × | × | × | × | ○ | ○ | × | × | × | × |
| 4 | × | × | ○ | × | × | × | × | × | ○ | × | × | × |
| 5 | ○ | × | ○ | × | × | × | ○ | × | ○ | × | × | × |
| 6 | × | ○ | ○ | × | × | × | × | ○ | ○ | × | × | × |
| 7 | ○ | ○ | ○ | × | × | × | ○ | ○ | ○ | × | × | × |
| 8 | × | × | × | ○ | × | × | × | × | × | ○ | × | × |
| 9 | ○ | × | × | ○ | × | × | ○ | × | × | ○ | × | × |
| 10 | × | ○ | × | ○ | × | × | × | ○ | × | ○ | × | × |
| 11 | ○ | ○ | × | ○ | × | × | ○ | ○ | × | ○ | × | × |
| 12 | × | × | ○ | ○ | × | × | × | × | ○ | ○ | × | × |
| 13 | ○ | × | ○ | ○ | × | × | ○ | × | ○ | ○ | × | × |
| 14 | × | ○ | ○ | ○ | × | × | × | ○ | ○ | ○ | × | × |
| 15 | ○ | ○ | ○ | ○ | × | × | ○ | ○ | ○ | ○ | × | × |
| 16 | × | × | × | × | ○ | × | × | × | × | × | ○ | × |
| 17 | ○ | × | × | × | ○ | × | ○ | × | × | × | ○ | × |
| 18 | × | ○ | × | × | ○ | × | × | ○ | × | × | ○ | × |
| 19 | ○ | ○ | × | × | ○ | × | ○ | ○ | × | × | ○ | × |
| 20 | × | × | ○ | × | ○ | × | × | × | ○ | × | ○ | × |
| 21 | ○ | × | ○ | × | ○ | × | ○ | × | ○ | × | ○ | × |
| 22 | × | ○ | ○ | × | ○ | × | × | ○ | ○ | × | ○ | × |
| 23 | ○ | ○ | ○ | × | ○ | × | ○ | ○ | ○ | × | ○ | × |
| 24 | × | × | × | ○ | ○ | × | × | × | × | ○ | ○ | × |
| 25 | ○ | × | × | ○ | ○ | × | ○ | × | × | ○ | ○ | × |
| 26 | × | ○ | × | ○ | ○ | × | × | ○ | × | ○ | ○ | × |
| 27 | ○ | ○ | × | ○ | ○ | × | ○ | ○ | × | ○ | ○ | × |
| 28 | × | × | ○ | ○ | ○ | × | × | × | ○ | ○ | ○ | × |
| 29 | ○ | × | ○ | ○ | ○ | × | ○ | × | ○ | ○ | ○ | × |
| 30 | × | ○ | ○ | ○ | ○ | × | × | ○ | ○ | ○ | ○ | × |
| 31 | ○ | ○ | ○ | ○ | ○ | × | ○ | ○ | ○ | ○ | ○ | × |
| 32 | × | × | × | × | × | ○ | × | × | × | × | × | ○ |
| 33 | ○ | × | × | × | × | ○ | ○ | × | × | × | × | ○ |
| 34 | × | ○ | × | × | × | ○ | × | ○ | × | × | × | ○ |
| 35 | ○ | ○ | × | × | × | ○ | ○ | ○ | × | × | × | ○ |
| 36 | × | × | ○ | × | × | ○ | × | × | ○ | × | × | ○ |
| 37 | ○ | × | ○ | × | × | ○ | ○ | × | ○ | × | × | ○ |
| 38 | × | ○ | ○ | × | × | ○ | × | ○ | ○ | × | × | ○ |
| 39 | ○ | ○ | ○ | × | × | ○ | ○ | ○ | ○ | × | × | ○ |
| 40 | × | × | × | ○ | × | ○ | × | × | × | ○ | × | ○ |
| 41 | ○ | × | × | ○ | × | ○ | ○ | × | × | ○ | × | ○ |
| 42 | × | ○ | × | ○ | × | ○ | × | ○ | × | ○ | × | ○ |
| 43 | ○ | ○ | × | ○ | × | ○ | ○ | ○ | × | ○ | × | ○ |
| 44 | × | × | ○ | ○ | × | ○ | × | × | ○ | ○ | × | ○ |
| 45 | ○ | × | ○ | ○ | × | ○ | ○ | × | ○ | ○ | × | ○ |
| 46 | × | ○ | ○ | ○ | × | ○ | × | ○ | ○ | ○ | × | ○ |
| 47 | ○ | ○ | ○ | ○ | × | ○ | ○ | ○ | ○ | ○ | × | ○ |
| 48 | × | × | × | × | ○ | ○ | × | × | × | × | ○ | ○ |
| 49 | ○ | × | × | × | ○ | ○ | ○ | × | × | × | ○ | ○ |
| 50 | × | ○ | × | × | ○ | ○ | × | ○ | × | × | ○ | ○ |
| 51 | ○ | ○ | × | × | ○ | ○ | ○ | ○ | × | × | ○ | ○ |
| 52 | × | × | ○ | × | ○ | ○ | × | × | ○ | × | ○ | ○ |
| 53 | ○ | × | ○ | × | ○ | ○ | ○ | × | ○ | × | ○ | ○ |
| 54 | × | ○ | ○ | × | ○ | ○ | × | ○ | ○ | × | ○ | ○ |
| 55 | ○ | ○ | ○ | × | ○ | ○ | ○ | ○ | ○ | × | ○ | ○ |
| 56 | × | × | × | ○ | ○ | ○ | × | × | × | ○ | ○ | ○ |
| 57 | ○ | × | × | ○ | ○ | ○ | ○ | × | × | ○ | ○ | ○ |
| 58 | × | ○ | × | ○ | ○ | ○ | × | ○ | × | ○ | ○ | ○ |
| 59 | ○ | ○ | × | ○ | ○ | ○ | ○ | ○ | × | ○ | ○ | ○ |
| 60 | × | × | ○ | ○ | ○ | ○ | × | × | ○ | ○ | ○ | ○ |
| 61 | ○ | × | ○ | ○ | ○ | ○ | ○ | × | ○ | ○ | ○ | ○ |
| 62 | × | ○ | ○ | ○ | ○ | ○ | × | ○ | ○ | ○ | ○ | ○ |
| 63 | ○ | ○ | ○ | ○ | ○ | ○ | ○ | ○ | ○ | ○ | ○ | ○ |

○ : Lighted
× : Not Lighted

FIG. 3

| | SFG1 | | | | | | | | SFG2 | | | | | | | |
|---|---|---|---|---|---|---|---|---|---|---|---|---|---|---|---|---|
| | SF11 | | SF12 | | SF13 | | SF14 | | SF21 | | SF22 | | SF23 | | SF24 | |
| | 0.5 | | 2 | | 4 | | 4 | | 0.5 | | 2 | | 4 | | 4 | |
| | SP1 | SP2 | SP1 | SP2 | SP1 | SP2 | SP1 | SP2 | SP1 | SP2 | SP1 | SP2 | SP1 | SP2 | SP1 | SP2 |
| | 1 | 2 | 1 | 2 | 1 | 2 | 1 | 2 | 1 | 2 | 1 | 2 | 1 | 2 | 1 | 2 |
| | 0.5 | 1 | 2 | 4 | 4 | 8 | 4 | 8 | 0.5 | 1 | 2 | 4 | 4 | 8 | 4 | 8 |
| 0 | × | × | × | × | × | × | × | × | × | × | × | × | × | × | × | × |
| 1 | ○ | × | × | × | × | × | × | × | ○ | × | × | × | × | × | × | × |
| 2 | × | ○ | × | × | × | × | × | × | × | ○ | × | × | × | × | × | × |
| 3 | ○ | ○ | × | × | × | × | × | × | ○ | ○ | × | × | × | × | × | × |
| 4 | × | × | ○ | × | × | × | × | × | × | × | ○ | × | × | × | × | × |
| 5 | ○ | × | ○ | × | × | × | × | × | ○ | × | ○ | × | × | × | × | × |
| 6 | × | ○ | ○ | × | × | × | × | × | × | ○ | ○ | × | × | × | × | × |
| 7 | ○ | ○ | ○ | × | × | × | × | × | ○ | ○ | ○ | × | × | × | × | × |
| 8 | × | × | × | ○ | × | × | × | × | × | × | × | ○ | × | × | × | × |
| 9 | ○ | × | × | ○ | × | × | × | × | ○ | × | × | ○ | × | × | × | × |
| 10 | × | ○ | × | ○ | × | × | × | × | × | ○ | × | ○ | × | × | × | × |
| 11 | ○ | ○ | × | ○ | × | × | × | × | ○ | ○ | × | ○ | × | × | × | × |
| 12 | × | × | ○ | ○ | × | × | × | × | × | × | ○ | ○ | × | × | × | × |
| 13 | ○ | × | ○ | ○ | × | × | × | × | ○ | × | ○ | ○ | × | × | × | × |
| 14 | × | ○ | ○ | ○ | × | × | × | × | × | ○ | ○ | ○ | × | × | × | × |
| 15 | ○ | ○ | ○ | ○ | × | × | × | × | ○ | ○ | ○ | ○ | × | × | × | × |
| 16 | × | × | × | × | ○ | × | ○ | × | × | × | × | × | ○ | × | ○ | × |
| 17 | ○ | × | × | × | ○ | × | ○ | × | ○ | × | × | × | ○ | × | ○ | × |
| 18 | × | ○ | × | × | ○ | × | ○ | × | × | ○ | × | × | ○ | × | ○ | × |
| 19 | ○ | ○ | × | × | ○ | × | ○ | × | ○ | ○ | × | × | ○ | × | ○ | × |
| 20 | × | × | ○ | × | ○ | × | ○ | × | × | × | ○ | × | ○ | × | ○ | × |
| 21 | ○ | × | ○ | × | ○ | × | ○ | × | ○ | × | ○ | × | ○ | × | ○ | × |
| 22 | × | ○ | ○ | × | ○ | × | ○ | × | × | ○ | ○ | × | ○ | × | ○ | × |
| 23 | ○ | ○ | ○ | × | ○ | × | ○ | × | ○ | ○ | ○ | × | ○ | × | ○ | × |
| 24 | × | × | × | ○ | ○ | × | ○ | × | × | × | × | ○ | ○ | × | ○ | × |
| 25 | ○ | × | × | ○ | ○ | × | ○ | × | ○ | × | × | ○ | ○ | × | ○ | × |
| 26 | × | ○ | × | ○ | ○ | × | ○ | × | × | ○ | × | ○ | ○ | × | ○ | × |
| 27 | ○ | ○ | × | ○ | ○ | × | ○ | × | ○ | ○ | × | ○ | ○ | × | ○ | × |
| 28 | × | × | ○ | ○ | ○ | × | ○ | × | × | × | ○ | ○ | ○ | × | ○ | × |
| 29 | ○ | × | ○ | ○ | ○ | × | ○ | × | ○ | × | ○ | ○ | ○ | × | ○ | × |
| 30 | × | ○ | ○ | ○ | ○ | × | ○ | × | × | ○ | ○ | ○ | ○ | × | ○ | × |
| 31 | ○ | ○ | ○ | ○ | ○ | × | ○ | × | ○ | ○ | ○ | ○ | ○ | × | ○ | × |
| 32 | × | × | × | × | × | ○ | × | ○ | × | × | × | × | × | ○ | × | ○ |
| 33 | ○ | × | × | × | × | ○ | × | ○ | ○ | × | × | × | × | ○ | × | ○ |
| 34 | × | ○ | × | × | × | ○ | × | ○ | × | ○ | × | × | × | ○ | × | ○ |
| 35 | ○ | ○ | × | × | × | ○ | × | ○ | ○ | ○ | × | × | × | ○ | × | ○ |
| 36 | × | × | ○ | × | × | ○ | × | ○ | × | × | ○ | × | × | ○ | × | ○ |
| 37 | ○ | × | ○ | × | × | ○ | × | ○ | ○ | × | ○ | × | × | ○ | × | ○ |
| 38 | × | ○ | ○ | × | × | ○ | × | ○ | × | ○ | ○ | × | × | ○ | × | ○ |
| 39 | ○ | ○ | ○ | × | × | ○ | × | ○ | ○ | ○ | ○ | × | × | ○ | × | ○ |
| 40 | × | × | × | ○ | × | ○ | × | ○ | × | × | × | ○ | × | ○ | × | ○ |
| 41 | ○ | × | × | ○ | × | ○ | × | ○ | ○ | × | × | ○ | × | ○ | × | ○ |
| 42 | × | ○ | × | ○ | × | ○ | × | ○ | × | ○ | × | ○ | × | ○ | × | ○ |
| 43 | ○ | ○ | × | ○ | × | ○ | × | ○ | ○ | ○ | × | ○ | × | ○ | × | ○ |
| 44 | × | × | ○ | ○ | × | ○ | × | ○ | × | × | ○ | ○ | × | ○ | × | ○ |
| 45 | ○ | × | ○ | ○ | × | ○ | × | ○ | ○ | × | ○ | ○ | × | ○ | × | ○ |
| 46 | × | ○ | ○ | ○ | × | ○ | × | ○ | × | ○ | ○ | ○ | × | ○ | × | ○ |
| 47 | ○ | ○ | ○ | ○ | × | ○ | × | ○ | ○ | ○ | ○ | ○ | × | ○ | × | ○ |
| 48 | × | × | × | × | ○ | ○ | ○ | ○ | × | × | × | × | ○ | ○ | ○ | ○ |
| 49 | ○ | × | × | × | ○ | ○ | ○ | ○ | ○ | × | × | × | ○ | ○ | ○ | ○ |
| 50 | × | ○ | × | × | ○ | ○ | ○ | ○ | × | ○ | × | × | ○ | ○ | ○ | ○ |
| 51 | ○ | ○ | × | × | ○ | ○ | ○ | ○ | ○ | ○ | × | × | ○ | ○ | ○ | ○ |
| 52 | × | × | ○ | × | ○ | ○ | ○ | ○ | × | × | ○ | × | ○ | ○ | ○ | ○ |
| 53 | ○ | × | ○ | × | ○ | ○ | ○ | ○ | ○ | × | ○ | × | ○ | ○ | ○ | ○ |
| 54 | × | ○ | ○ | × | ○ | ○ | ○ | ○ | × | ○ | ○ | × | ○ | ○ | ○ | ○ |
| 55 | ○ | ○ | ○ | × | ○ | ○ | ○ | ○ | ○ | ○ | ○ | × | ○ | ○ | ○ | ○ |
| 56 | × | × | × | ○ | ○ | ○ | ○ | ○ | × | × | × | ○ | ○ | ○ | ○ | ○ |
| 57 | ○ | × | × | ○ | ○ | ○ | ○ | ○ | ○ | × | × | ○ | ○ | ○ | ○ | ○ |
| 58 | × | ○ | × | ○ | ○ | ○ | ○ | ○ | × | ○ | × | ○ | ○ | ○ | ○ | ○ |
| 59 | ○ | ○ | × | ○ | ○ | ○ | ○ | ○ | ○ | ○ | × | ○ | ○ | ○ | ○ | ○ |
| 60 | × | × | ○ | ○ | ○ | ○ | ○ | ○ | × | × | ○ | ○ | ○ | ○ | ○ | ○ |
| 61 | ○ | × | ○ | ○ | ○ | ○ | ○ | ○ | ○ | × | ○ | ○ | ○ | ○ | ○ | ○ |
| 62 | × | ○ | ○ | ○ | ○ | ○ | ○ | ○ | × | ○ | ○ | ○ | ○ | ○ | ○ | ○ |
| 63 | ○ | ○ | ○ | ○ | ○ | ○ | ○ | ○ | ○ | ○ | ○ | ○ | ○ | ○ | ○ | ○ |

○ : Lighted
× : Not Lighted

FIG. 5

| | SFG1 | | | | | | | | SFG2 | | | | | | | |
|---|---|---|---|---|---|---|---|---|---|---|---|---|---|---|---|---|
| | SF11 | | SF12 | | SF13 | | SF14 | | SF21 | | SF22 | | SF23 | | SF24 | |
| | 0.5 | | 2 | | 4 | | 4 | | 0.5 | | 2 | | 4 | | 4 | |
| | SP1 | SP2 | SP1 | SP2 | SP1 | SP2 | SP1 | SP2 | SP1 | SP2 | SP1 | SP2 | SP1 | SP2 | SP1 | SP2 |
| | 1 | 2 | 1 | 2 | 1 | 2 | 1 | 2 | 1 | 2 | 1 | 2 | 1 | 2 | 1 | 2 |
| | 0.5 | 1 | 2 | 4 | 4 | 8 | 4 | 8 | 0.5 | 1 | 2 | 4 | 4 | 8 | 4 | 8 |
| 0 | × | × | × | × | × | × | × | × | × | × | × | × | × | × | × | × |
| 1 | ○ | × | × | × | × | × | × | × | ○ | × | × | × | × | × | × | × |
| 2 | × | ○ | × | × | × | × | × | × | × | ○ | × | × | × | × | × | × |
| 3 | ○ | ○ | × | × | × | × | × | × | ○ | ○ | × | × | × | × | × | × |
| 4 | × | × | ○ | × | × | × | × | × | × | × | ○ | × | × | × | × | × |
| 5 | ○ | × | ○ | × | × | × | × | × | ○ | × | ○ | × | × | × | × | × |
| 6 | × | ○ | ○ | × | × | × | × | × | × | ○ | ○ | × | × | × | × | × |
| 7 | ○ | ○ | ○ | × | × | × | × | × | ○ | ○ | ○ | × | × | × | × | × |
| 8 | × | × | × | ○ | × | × | × | × | × | × | × | ○ | × | × | × | × |
| 9 | ○ | × | × | ○ | × | × | × | × | ○ | × | × | ○ | × | × | × | × |
| 10 | × | ○ | × | ○ | × | × | × | × | × | ○ | × | ○ | × | × | × | × |
| 11 | ○ | ○ | × | ○ | × | × | × | × | ○ | ○ | × | ○ | × | × | × | × |
| 12 | × | × | ○ | ○ | × | × | × | × | × | × | ○ | ○ | × | × | × | × |
| 13 | ○ | × | ○ | ○ | × | × | × | × | ○ | × | ○ | ○ | × | × | × | × |
| 14 | × | ○ | ○ | ○ | × | × | × | × | × | ○ | ○ | ○ | × | × | × | × |
| 15 | ○ | ○ | ○ | ○ | × | × | × | × | ○ | ○ | ○ | ○ | × | × | × | × |
| 16 | × | × | × | × | ○ | × | ○ | × | × | × | × | × | ○ | × | ○ | × |
| 17 | ○ | × | × | × | ○ | × | ○ | × | ○ | × | × | × | ○ | × | ○ | × |
| 18 | × | ○ | × | × | ○ | × | ○ | × | × | ○ | × | × | ○ | × | ○ | × |
| 19 | ○ | ○ | × | × | ○ | × | ○ | × | ○ | ○ | × | × | ○ | × | ○ | × |
| 20 | × | × | ○ | × | ○ | × | ○ | × | × | × | ○ | × | ○ | × | ○ | × |
| 21 | ○ | × | ○ | × | ○ | × | ○ | × | ○ | × | ○ | × | ○ | × | ○ | × |
| 22 | × | ○ | ○ | × | ○ | × | ○ | × | × | ○ | ○ | × | ○ | × | ○ | × |
| 23 | ○ | ○ | ○ | × | ○ | × | ○ | × | ○ | ○ | ○ | × | ○ | × | ○ | × |
| 24 | × | × | × | ○ | ○ | × | ○ | × | × | × | × | ○ | ○ | × | ○ | × |
| 25 | ○ | × | × | ○ | ○ | × | ○ | × | ○ | × | × | ○ | ○ | × | ○ | × |
| 26 | × | ○ | × | ○ | ○ | × | ○ | × | × | ○ | × | ○ | ○ | × | ○ | × |
| 27 | ○ | ○ | × | ○ | ○ | × | ○ | × | ○ | ○ | × | ○ | ○ | × | ○ | × |
| 28 | × | × | ○ | ○ | ○ | × | ○ | × | × | × | ○ | ○ | ○ | × | ○ | × |
| 29 | ○ | × | ○ | ○ | ○ | × | ○ | × | ○ | × | ○ | ○ | ○ | × | ○ | × |
| 30 | × | ○ | ○ | ○ | ○ | × | ○ | × | × | ○ | ○ | ○ | ○ | × | ○ | × |
| 31 | ○ | ○ | ○ | ○ | × | ○ | × | × | ○ | ○ | ○ | ○ | × | ○ | × | × |
| 32 | × | × | × | × | × | ○ | × | ○ | × | × | × | × | × | ○ | × | ○ |
| 33 | ○ | × | × | × | × | ○ | × | ○ | ○ | × | × | × | × | ○ | × | ○ |
| 34 | × | ○ | × | × | × | ○ | × | ○ | × | ○ | × | × | × | ○ | × | ○ |
| 35 | ○ | ○ | × | × | × | ○ | × | ○ | ○ | ○ | × | × | × | ○ | × | ○ |
| 36 | × | × | ○ | × | × | ○ | × | ○ | × | × | ○ | × | × | ○ | × | ○ |
| 37 | ○ | × | ○ | × | × | ○ | × | ○ | ○ | × | ○ | × | × | ○ | × | ○ |
| 38 | × | ○ | ○ | × | × | ○ | × | ○ | × | ○ | ○ | × | × | ○ | × | ○ |
| 39 | ○ | ○ | ○ | × | × | ○ | × | ○ | ○ | ○ | ○ | × | × | ○ | × | ○ |
| 40 | × | × | × | ○ | × | ○ | × | ○ | × | × | × | ○ | × | ○ | × | ○ |
| 41 | ○ | × | × | ○ | × | ○ | × | ○ | ○ | × | × | ○ | × | ○ | × | ○ |
| 42 | × | ○ | × | ○ | × | ○ | × | ○ | × | ○ | × | ○ | × | ○ | × | ○ |
| 43 | ○ | ○ | × | ○ | × | ○ | × | ○ | ○ | ○ | × | ○ | × | ○ | × | ○ |
| 44 | × | × | ○ | ○ | × | ○ | × | ○ | × | × | ○ | ○ | × | ○ | × | ○ |
| 45 | ○ | × | ○ | ○ | × | ○ | × | ○ | ○ | × | ○ | ○ | × | ○ | × | ○ |
| 46 | × | ○ | ○ | ○ | × | ○ | × | ○ | × | ○ | ○ | ○ | × | ○ | × | ○ |
| 47 | ○ | ○ | ○ | ○ | × | ○ | × | ○ | ○ | ○ | ○ | ○ | × | ○ | × | ○ |
| 48 | × | × | × | × | ○ | ○ | ○ | ○ | × | × | × | × | ○ | ○ | ○ | ○ |
| 49 | ○ | × | × | × | ○ | ○ | ○ | ○ | ○ | × | × | × | ○ | ○ | ○ | ○ |
| 50 | × | ○ | × | × | ○ | ○ | ○ | ○ | × | ○ | × | × | ○ | ○ | ○ | ○ |
| 51 | ○ | ○ | × | × | ○ | ○ | ○ | ○ | ○ | ○ | × | × | ○ | ○ | ○ | ○ |
| 52 | × | × | ○ | × | ○ | ○ | ○ | ○ | × | × | ○ | × | ○ | ○ | ○ | ○ |
| 53 | ○ | × | ○ | × | ○ | ○ | ○ | ○ | ○ | × | ○ | × | ○ | ○ | ○ | ○ |
| 54 | × | ○ | ○ | × | ○ | ○ | ○ | ○ | × | ○ | ○ | × | ○ | ○ | ○ | ○ |
| 55 | ○ | ○ | ○ | × | ○ | ○ | ○ | ○ | ○ | ○ | ○ | × | ○ | ○ | ○ | ○ |
| 56 | × | × | × | ○ | ○ | ○ | ○ | ○ | × | × | × | ○ | ○ | ○ | ○ | ○ |
| 57 | ○ | × | × | ○ | ○ | ○ | ○ | ○ | ○ | × | × | ○ | ○ | ○ | ○ | ○ |
| 58 | × | ○ | × | ○ | ○ | ○ | ○ | ○ | × | ○ | × | ○ | ○ | ○ | ○ | ○ |
| 59 | ○ | ○ | × | ○ | ○ | ○ | ○ | ○ | ○ | ○ | × | ○ | ○ | ○ | ○ | ○ |
| 60 | × | × | ○ | ○ | ○ | ○ | ○ | ○ | × | × | ○ | ○ | ○ | ○ | ○ | ○ |
| 61 | ○ | × | ○ | ○ | ○ | ○ | ○ | ○ | ○ | × | ○ | ○ | ○ | ○ | ○ | ○ |
| 62 | × | ○ | ○ | ○ | ○ | ○ | ○ | ○ | × | ○ | ○ | ○ | ○ | ○ | ○ | ○ |
| 63 | ○ | ○ | ○ | ○ | ○ | ○ | ○ | ○ | ○ | ○ | ○ | ○ | ○ | ○ | ○ | ○ |

○ : Lighted
× : Not Lighted

FIG. 7

| | SFG1 | | | | | | | | SFG2 | | | | | | | |
|---|---|---|---|---|---|---|---|---|---|---|---|---|---|---|---|---|
| | SF11 | | SF12 | | SF13 | | SF14 | | SF21 | | SF22 | | SF23 | | SF24 | |
| | 0.5 | | 4 | | 2 | | 4 | | 0.5 | | 4 | | 2 | | 4 | |
| | SP1 | SP2 | SP1 | SP2 | SP1 | SP2 | SP1 | SP2 | SP1 | SP2 | SP1 | SP2 | SP1 | SP2 | SP1 | SP2 |
| | 1 | 2 | 1 | 2 | 1 | 2 | 1 | 2 | 1 | 2 | 1 | 2 | 1 | 2 | 1 | 2 |
| | 0.5 | 1 | 4 | 8 | 2 | 4 | 4 | 8 | 0.5 | 1 | 4 | 8 | 2 | 4 | 4 | 8 |
| 0 | × | × | × | × | × | × | × | × | × | × | × | × | × | × | × | × |
| 1 | ○ | × | × | × | × | × | × | × | ○ | × | × | × | × | × | × | × |
| 2 | × | ○ | × | × | × | × | × | × | × | ○ | × | × | × | × | × | × |
| 3 | ○ | ○ | × | × | × | × | × | × | ○ | ○ | × | × | × | × | × | × |
| 4 | × | × | × | × | ○ | × | × | × | × | × | × | × | ○ | × | × | × |
| 5 | ○ | × | × | × | ○ | × | × | × | ○ | × | × | × | ○ | × | × | × |
| 6 | × | ○ | × | × | ○ | × | × | × | × | ○ | × | × | ○ | × | × | × |
| 7 | ○ | ○ | × | × | ○ | × | × | × | ○ | ○ | × | × | ○ | × | × | × |
| 8 | × | × | × | × | × | ○ | × | × | × | × | × | × | × | ○ | × | × |
| 9 | ○ | × | × | × | × | ○ | × | × | ○ | × | × | × | × | ○ | × | × |
| 10 | × | ○ | × | × | × | ○ | × | × | × | ○ | × | × | × | ○ | × | × |
| 11 | ○ | ○ | × | × | × | ○ | × | × | ○ | ○ | × | × | × | ○ | × | × |
| 12 | × | × | × | × | ○ | ○ | × | × | × | × | × | × | ○ | ○ | × | × |
| 13 | ○ | × | × | × | ○ | ○ | × | × | ○ | × | × | × | ○ | ○ | × | × |
| 14 | × | ○ | × | × | ○ | ○ | × | × | × | ○ | × | × | ○ | ○ | × | × |
| 15 | ○ | ○ | × | × | ○ | ○ | × | × | ○ | ○ | × | × | ○ | ○ | × | × |
| 16 | × | × | ○ | × | × | × | ○ | × | × | × | ○ | × | × | × | ○ | × |
| 17 | ○ | × | ○ | × | × | × | ○ | × | ○ | × | ○ | × | × | × | ○ | × |
| 18 | × | ○ | ○ | × | × | × | ○ | × | × | ○ | ○ | × | × | × | ○ | × |
| 19 | ○ | ○ | ○ | × | × | × | ○ | × | ○ | ○ | ○ | × | × | × | ○ | × |
| 20 | × | × | ○ | × | ○ | × | ○ | × | × | × | ○ | × | ○ | × | ○ | × |
| 21 | ○ | × | ○ | × | ○ | × | ○ | × | ○ | × | ○ | × | ○ | × | ○ | × |
| 22 | × | ○ | ○ | × | ○ | × | ○ | × | × | ○ | ○ | × | ○ | × | ○ | × |
| 23 | ○ | ○ | ○ | × | ○ | × | ○ | × | ○ | ○ | ○ | × | ○ | × | ○ | × |
| 24 | × | × | ○ | × | × | ○ | ○ | × | × | × | ○ | × | × | ○ | ○ | × |
| 25 | ○ | × | ○ | × | × | ○ | ○ | × | ○ | × | ○ | × | × | ○ | ○ | × |
| 26 | × | ○ | ○ | × | × | ○ | ○ | × | × | ○ | ○ | × | × | ○ | ○ | × |
| 27 | ○ | ○ | ○ | × | × | ○ | ○ | × | ○ | ○ | ○ | × | × | ○ | ○ | × |
| 28 | × | × | ○ | × | ○ | ○ | ○ | × | × | × | ○ | × | ○ | ○ | ○ | × |
| 29 | ○ | × | ○ | × | ○ | ○ | ○ | × | ○ | × | ○ | × | ○ | ○ | ○ | × |
| 30 | × | ○ | ○ | × | ○ | ○ | ○ | × | × | ○ | ○ | × | ○ | ○ | ○ | × |
| 31 | ○ | ○ | × | ○ | ○ | ○ | × | × | ○ | ○ | × | ○ | ○ | ○ | × | × |
| 32 | × | × | × | ○ | × | × | × | ○ | × | × | × | ○ | × | × | × | ○ |
| 33 | ○ | × | × | ○ | × | × | × | ○ | ○ | × | × | ○ | × | × | × | ○ |
| 34 | × | ○ | × | ○ | × | × | × | ○ | × | ○ | × | ○ | × | × | × | ○ |
| 35 | ○ | ○ | × | ○ | × | × | × | ○ | ○ | ○ | × | ○ | × | × | × | ○ |
| 36 | × | × | × | ○ | ○ | × | × | ○ | × | × | × | ○ | ○ | × | × | ○ |
| 37 | ○ | × | × | ○ | ○ | × | × | ○ | ○ | × | × | ○ | ○ | × | × | ○ |
| 38 | × | ○ | × | ○ | ○ | × | × | ○ | × | ○ | × | ○ | ○ | × | × | ○ |
| 39 | ○ | ○ | × | ○ | ○ | × | × | ○ | ○ | ○ | × | ○ | ○ | × | × | ○ |
| 40 | × | × | × | ○ | × | ○ | × | ○ | × | × | × | ○ | × | ○ | × | ○ |
| 41 | ○ | × | × | ○ | × | ○ | × | ○ | ○ | × | × | ○ | × | ○ | × | ○ |
| 42 | × | ○ | × | ○ | × | ○ | × | ○ | × | ○ | × | ○ | × | ○ | × | ○ |
| 43 | ○ | ○ | × | ○ | × | ○ | × | ○ | ○ | ○ | × | ○ | × | ○ | × | ○ |
| 44 | × | × | × | ○ | ○ | ○ | × | ○ | × | × | × | ○ | ○ | ○ | × | ○ |
| 45 | ○ | × | × | ○ | ○ | ○ | × | ○ | ○ | × | × | ○ | ○ | ○ | × | ○ |
| 46 | × | ○ | × | ○ | ○ | ○ | × | ○ | × | ○ | × | ○ | ○ | ○ | × | ○ |
| 47 | ○ | ○ | × | ○ | ○ | ○ | × | ○ | ○ | ○ | × | ○ | ○ | ○ | × | ○ |
| 48 | × | × | ○ | ○ | × | × | ○ | ○ | × | × | ○ | ○ | × | × | ○ | ○ |
| 49 | ○ | × | ○ | ○ | × | × | ○ | ○ | ○ | × | ○ | ○ | × | × | ○ | ○ |
| 50 | × | ○ | ○ | ○ | × | × | ○ | ○ | × | ○ | ○ | ○ | × | × | ○ | ○ |
| 51 | ○ | ○ | ○ | ○ | × | × | ○ | ○ | ○ | ○ | ○ | ○ | × | × | ○ | ○ |
| 52 | × | × | ○ | ○ | ○ | × | ○ | ○ | × | × | ○ | ○ | ○ | × | ○ | ○ |
| 53 | ○ | × | ○ | ○ | ○ | × | ○ | ○ | ○ | × | ○ | ○ | ○ | × | ○ | ○ |
| 54 | × | ○ | ○ | ○ | ○ | × | ○ | ○ | × | ○ | ○ | ○ | ○ | × | ○ | ○ |
| 55 | ○ | ○ | ○ | ○ | ○ | × | ○ | ○ | ○ | ○ | ○ | ○ | ○ | × | ○ | ○ |
| 56 | × | × | ○ | ○ | × | ○ | ○ | ○ | × | × | ○ | ○ | × | ○ | ○ | ○ |
| 57 | ○ | × | ○ | ○ | × | ○ | ○ | ○ | ○ | × | ○ | ○ | × | ○ | ○ | ○ |
| 58 | × | ○ | ○ | ○ | × | ○ | ○ | ○ | × | ○ | ○ | ○ | × | ○ | ○ | ○ |
| 59 | ○ | ○ | ○ | ○ | × | ○ | ○ | ○ | ○ | ○ | ○ | ○ | × | ○ | ○ | ○ |
| 60 | × | × | ○ | ○ | ○ | ○ | ○ | ○ | × | × | ○ | ○ | ○ | ○ | ○ | ○ |
| 61 | ○ | × | ○ | ○ | ○ | ○ | ○ | ○ | ○ | × | ○ | ○ | ○ | ○ | ○ | ○ |
| 62 | × | ○ | ○ | ○ | ○ | ○ | ○ | ○ | × | ○ | ○ | ○ | ○ | ○ | ○ | ○ |
| 63 | ○ | ○ | ○ | ○ | ○ | ○ | ○ | ○ | ○ | ○ | ○ | ○ | ○ | ○ | ○ | ○ |

○ : Lighted
× : Not Lighted

FIG. 9

| | SFG1 | | | | | | SFG2 | | | | | |
|---|---|---|---|---|---|---|---|---|---|---|---|---|
| | SF11 | | | SF12 | | | SF21 | | | SF22 | | |
| | 0.5 | | | 4 | | | 0.5 | | | 4 | | |
| | SP1 | SP2 | SP3 | SP1 | SP2 | SP3 | SP1 | SP2 | SP3 | SP1 | SP2 | SP3 |
| | 1 | 2 | 4 | 1 | 2 | 4 | 1 | 2 | 4 | 1 | 2 | 4 |
| | 0.5 | 1 | 2 | 4 | 8 | 16 | 0.5 | 1 | 2 | 4 | 8 | 16 |
| 0 | × | × | × | × | × | × | × | × | × | × | × | × |
| 1 | ○ | × | × | × | × | × | ○ | × | × | × | × | × |
| 2 | × | ○ | × | × | × | × | × | ○ | × | × | × | × |
| 3 | ○ | ○ | × | × | × | × | ○ | ○ | × | × | × | × |
| 4 | × | × | ○ | × | × | × | × | × | ○ | × | × | × |
| 5 | ○ | × | ○ | × | × | × | ○ | × | ○ | × | × | × |
| 6 | × | ○ | ○ | × | × | × | × | ○ | ○ | × | × | × |
| 7 | ○ | ○ | ○ | × | × | × | ○ | ○ | ○ | × | × | × |
| 8 | × | × | × | ○ | × | × | × | × | × | ○ | × | × |
| 9 | ○ | × | × | ○ | × | × | ○ | × | × | ○ | × | × |
| 10 | × | ○ | × | ○ | × | × | × | ○ | × | ○ | × | × |
| 11 | ○ | ○ | × | ○ | × | × | ○ | ○ | × | ○ | × | × |
| 12 | × | × | ○ | ○ | × | × | × | × | ○ | ○ | × | × |
| 13 | ○ | × | ○ | ○ | × | × | ○ | × | ○ | ○ | × | × |
| 14 | × | ○ | ○ | ○ | × | × | × | ○ | ○ | ○ | × | × |
| 15 | ○ | ○ | ○ | ○ | × | × | ○ | ○ | ○ | ○ | × | × |
| 16 | × | × | × | × | ○ | × | × | × | × | × | ○ | × |
| 17 | ○ | × | × | × | ○ | × | ○ | × | × | × | ○ | × |
| 18 | × | ○ | × | × | ○ | × | × | ○ | × | × | ○ | × |
| 19 | ○ | ○ | × | × | ○ | × | ○ | ○ | × | × | ○ | × |
| 20 | × | × | ○ | × | ○ | × | × | × | ○ | × | ○ | × |
| 21 | ○ | × | ○ | × | ○ | × | ○ | × | ○ | × | ○ | × |
| 22 | × | ○ | ○ | × | ○ | × | × | ○ | ○ | × | ○ | × |
| 23 | ○ | ○ | ○ | × | ○ | × | ○ | ○ | ○ | × | ○ | × |
| 24 | × | × | × | ○ | ○ | × | × | × | × | ○ | ○ | × |
| 25 | ○ | × | × | ○ | ○ | × | ○ | × | × | ○ | ○ | × |
| 26 | × | ○ | × | ○ | ○ | × | × | ○ | × | ○ | ○ | × |
| 27 | ○ | ○ | × | ○ | ○ | × | ○ | ○ | × | ○ | ○ | × |
| 28 | × | × | ○ | ○ | ○ | × | × | × | ○ | ○ | ○ | × |
| 29 | ○ | × | ○ | ○ | ○ | × | ○ | × | ○ | ○ | ○ | × |
| 30 | × | ○ | ○ | ○ | ○ | × | × | ○ | ○ | ○ | ○ | × |
| 31 | ○ | ○ | ○ | ○ | ○ | × | ○ | ○ | ○ | ○ | ○ | × |
| 32 | × | × | × | × | × | ○ | × | × | × | × | × | ○ |
| 33 | ○ | × | × | × | × | ○ | ○ | × | × | × | × | ○ |
| 34 | × | ○ | × | × | × | ○ | × | ○ | × | × | × | ○ |
| 35 | ○ | ○ | × | × | × | ○ | ○ | ○ | × | × | × | ○ |
| 36 | × | × | ○ | × | × | ○ | × | × | ○ | × | × | ○ |
| 37 | ○ | × | ○ | × | × | ○ | ○ | × | ○ | × | × | ○ |
| 38 | × | ○ | ○ | × | × | ○ | × | ○ | ○ | × | × | ○ |
| 39 | ○ | ○ | ○ | × | × | ○ | ○ | ○ | ○ | × | × | ○ |
| 40 | × | × | × | ○ | × | ○ | × | × | × | ○ | × | ○ |
| 41 | ○ | × | × | ○ | × | ○ | ○ | × | × | ○ | × | ○ |
| 42 | × | ○ | × | ○ | × | ○ | × | ○ | × | ○ | × | ○ |
| 43 | ○ | ○ | × | ○ | × | ○ | ○ | ○ | × | ○ | × | ○ |
| 44 | × | × | ○ | ○ | × | ○ | × | × | ○ | ○ | × | ○ |
| 45 | ○ | × | ○ | ○ | × | ○ | ○ | × | ○ | ○ | × | ○ |
| 46 | × | ○ | ○ | ○ | × | ○ | × | ○ | ○ | ○ | × | ○ |
| 47 | ○ | ○ | ○ | ○ | × | ○ | ○ | ○ | ○ | ○ | × | ○ |
| 48 | × | × | × | × | ○ | ○ | × | × | × | × | ○ | ○ |
| 49 | ○ | × | × | × | ○ | ○ | ○ | × | × | × | ○ | ○ |
| 50 | × | ○ | × | × | ○ | ○ | × | ○ | × | × | ○ | ○ |
| 51 | ○ | ○ | × | × | ○ | ○ | ○ | ○ | × | × | ○ | ○ |
| 52 | × | × | ○ | × | ○ | ○ | × | × | ○ | × | ○ | ○ |
| 53 | ○ | × | ○ | × | ○ | ○ | ○ | × | ○ | × | ○ | ○ |
| 54 | × | ○ | ○ | × | ○ | ○ | × | ○ | ○ | × | ○ | ○ |
| 55 | ○ | ○ | ○ | × | ○ | ○ | ○ | ○ | ○ | × | ○ | ○ |
| 56 | × | × | × | ○ | ○ | ○ | × | × | × | ○ | ○ | ○ |
| 57 | ○ | × | × | ○ | ○ | ○ | ○ | × | × | ○ | ○ | ○ |
| 58 | × | ○ | × | ○ | ○ | ○ | × | ○ | × | ○ | ○ | ○ |
| 59 | ○ | ○ | × | ○ | ○ | ○ | ○ | ○ | × | ○ | ○ | ○ |
| 60 | × | × | ○ | ○ | ○ | ○ | × | × | ○ | ○ | ○ | ○ |
| 61 | ○ | × | ○ | ○ | ○ | ○ | ○ | × | ○ | ○ | ○ | ○ |
| 62 | × | ○ | ○ | ○ | ○ | ○ | × | ○ | ○ | ○ | ○ | ○ |
| 63 | ○ | ○ | ○ | ○ | ○ | ○ | ○ | ○ | ○ | ○ | ○ | ○ |

○ : Lighted
× : Not Lighted

FIG. 11

| | SFG1 | | | | | | | | | SFG2 | | | | | | | | |
|---|---|---|---|---|---|---|---|---|---|---|---|---|---|---|---|---|---|---|
| | SF11 | | | SF12 | | | SF13 | | | SF21 | | | SF22 | | | SF23 | | |
| | 0.5 | | | 2 | | | 2 | | | 0.5 | | | 2 | | | 2 | | |
| | SP1 | SP2 | SP3 | SP1 | SP2 | SP3 | SP1 | SP2 | SP3 | SP1 | SP2 | SP3 | SP1 | SP2 | SP3 | SP1 | SP2 | SP3 |
| | 1 | 2 | 4 | 1 | 2 | 4 | 1 | 2 | 4 | 1 | 2 | 4 | 1 | 2 | 4 | 1 | 2 | 4 |
| | 0.5 | 1 | 2 | 2 | 4 | 8 | 2 | 4 | 8 | 0.5 | 1 | 2 | 2 | 4 | 8 | 2 | 4 | 8 |
| 0 | × | × | × | × | × | × | × | × | × | × | × | × | × | × | × | × | × | × |
| 1 | ○ | × | × | × | × | × | × | × | × | ○ | × | × | × | × | × | × | × | × |
| 2 | × | ○ | × | × | × | × | × | × | × | × | ○ | × | × | × | × | × | × | × |
| 3 | ○ | ○ | × | × | × | × | × | × | × | ○ | ○ | × | × | × | × | × | × | × |
| 4 | × | × | ○ | × | × | × | × | × | × | × | × | ○ | × | × | × | × | × | × |
| 5 | ○ | × | ○ | × | × | × | × | × | × | ○ | × | ○ | × | × | × | × | × | × |
| 6 | × | ○ | ○ | × | × | × | × | × | × | × | ○ | ○ | × | × | × | × | × | × |
| 7 | ○ | ○ | ○ | × | × | × | × | × | × | ○ | ○ | ○ | × | × | × | × | × | × |
| 8 | × | × | × | ○ | × | × | ○ | × | × | × | × | × | ○ | × | × | ○ | × | × |
| 9 | ○ | × | × | ○ | × | × | ○ | × | × | ○ | × | × | ○ | × | × | ○ | × | × |
| 10 | × | ○ | × | ○ | × | × | ○ | × | × | × | ○ | × | ○ | × | × | ○ | × | × |
| 11 | ○ | ○ | × | ○ | × | × | ○ | × | × | ○ | ○ | × | ○ | × | × | ○ | × | × |
| 12 | × | × | ○ | ○ | × | × | ○ | × | × | × | × | ○ | ○ | × | × | ○ | × | × |
| 13 | ○ | × | ○ | ○ | × | × | ○ | × | × | ○ | × | ○ | ○ | × | × | ○ | × | × |
| 14 | × | ○ | ○ | ○ | × | × | ○ | × | × | × | ○ | ○ | ○ | × | × | ○ | × | × |
| 15 | ○ | ○ | ○ | ○ | × | × | ○ | × | × | ○ | ○ | ○ | ○ | × | × | ○ | × | × |
| 16 | × | × | × | × | ○ | × | × | ○ | × | × | × | × | × | ○ | × | × | ○ | × |
| 17 | ○ | × | × | × | ○ | × | × | ○ | × | ○ | × | × | × | ○ | × | × | ○ | × |
| 18 | × | ○ | × | × | ○ | × | × | ○ | × | × | ○ | × | × | ○ | × | × | ○ | × |
| 19 | ○ | ○ | × | × | ○ | × | × | ○ | × | ○ | ○ | × | × | ○ | × | × | ○ | × |
| 20 | × | × | ○ | × | ○ | × | × | ○ | × | × | × | ○ | × | ○ | × | × | ○ | × |
| 21 | ○ | × | ○ | × | ○ | × | × | ○ | × | ○ | × | ○ | × | ○ | × | × | ○ | × |
| 22 | × | ○ | ○ | × | ○ | × | × | ○ | × | × | ○ | ○ | × | ○ | × | × | ○ | × |
| 23 | ○ | ○ | ○ | × | ○ | × | × | ○ | × | ○ | ○ | ○ | × | ○ | × | × | ○ | × |
| 24 | × | × | × | ○ | ○ | × | ○ | ○ | × | × | × | × | ○ | ○ | × | ○ | ○ | × |
| 25 | ○ | × | × | ○ | ○ | × | ○ | ○ | × | ○ | × | × | ○ | ○ | × | ○ | ○ | × |
| 26 | × | ○ | × | ○ | ○ | × | ○ | ○ | × | × | ○ | × | ○ | ○ | × | ○ | ○ | × |
| 27 | ○ | ○ | × | ○ | ○ | × | ○ | ○ | × | ○ | ○ | × | ○ | ○ | × | ○ | ○ | × |
| 28 | × | × | ○ | ○ | ○ | × | ○ | ○ | × | × | × | ○ | ○ | ○ | × | ○ | ○ | × |
| 29 | ○ | × | ○ | ○ | ○ | × | ○ | ○ | × | ○ | × | ○ | ○ | ○ | × | ○ | ○ | × |
| 30 | × | ○ | ○ | ○ | ○ | × | ○ | ○ | × | × | ○ | ○ | ○ | ○ | × | ○ | ○ | × |
| 31 | ○ | ○ | ○ | ○ | ○ | × | ○ | ○ | × | ○ | ○ | ○ | ○ | ○ | × | ○ | ○ | × |
| 32 | × | × | × | × | × | ○ | × | × | ○ | × | × | × | × | × | ○ | × | × | ○ |
| 33 | ○ | × | × | × | × | ○ | × | × | ○ | ○ | × | × | × | × | ○ | × | × | ○ |
| 34 | × | ○ | × | × | × | ○ | × | × | ○ | × | ○ | × | × | × | ○ | × | × | ○ |
| 35 | ○ | ○ | × | × | × | ○ | × | × | ○ | ○ | ○ | × | × | × | ○ | × | × | ○ |
| 36 | × | × | ○ | × | × | ○ | × | × | ○ | × | × | ○ | × | × | ○ | × | × | ○ |
| 37 | ○ | × | ○ | × | × | ○ | × | × | ○ | ○ | × | ○ | × | × | ○ | × | × | ○ |
| 38 | × | ○ | ○ | × | × | ○ | × | × | ○ | × | ○ | ○ | × | × | ○ | × | × | ○ |
| 39 | ○ | ○ | ○ | × | × | ○ | × | × | ○ | ○ | ○ | ○ | × | × | ○ | × | × | ○ |
| 40 | × | × | × | ○ | × | ○ | ○ | × | ○ | × | × | × | ○ | × | ○ | ○ | × | ○ |
| 41 | ○ | × | × | ○ | × | ○ | ○ | × | ○ | ○ | × | × | ○ | × | ○ | ○ | × | ○ |
| 42 | × | ○ | × | ○ | × | ○ | ○ | × | ○ | × | ○ | × | ○ | × | ○ | ○ | × | ○ |
| 43 | ○ | ○ | × | ○ | × | ○ | ○ | × | ○ | ○ | ○ | × | ○ | × | ○ | ○ | × | ○ |
| 44 | × | × | ○ | ○ | × | ○ | ○ | × | ○ | × | × | ○ | ○ | × | ○ | ○ | × | ○ |
| 45 | ○ | × | ○ | ○ | × | ○ | ○ | × | ○ | ○ | × | ○ | ○ | × | ○ | ○ | × | ○ |
| 46 | × | ○ | ○ | ○ | × | ○ | ○ | × | ○ | × | ○ | ○ | ○ | × | ○ | ○ | × | ○ |
| 47 | ○ | ○ | ○ | ○ | × | ○ | ○ | × | ○ | ○ | ○ | ○ | ○ | × | ○ | ○ | × | ○ |
| 48 | × | × | × | × | ○ | ○ | × | ○ | ○ | × | × | × | × | ○ | ○ | × | ○ | ○ |
| 49 | ○ | × | × | × | ○ | ○ | × | ○ | ○ | ○ | × | × | × | ○ | ○ | × | ○ | ○ |
| 50 | × | ○ | × | × | ○ | ○ | × | ○ | ○ | × | ○ | × | × | ○ | ○ | × | ○ | ○ |
| 51 | ○ | ○ | × | × | ○ | ○ | × | ○ | ○ | ○ | ○ | × | × | ○ | ○ | × | ○ | ○ |
| 52 | × | × | ○ | × | ○ | ○ | × | ○ | ○ | × | × | ○ | × | ○ | ○ | × | ○ | ○ |
| 53 | ○ | × | ○ | × | ○ | ○ | × | ○ | ○ | ○ | × | ○ | × | ○ | ○ | × | ○ | ○ |
| 54 | × | ○ | ○ | × | ○ | ○ | × | ○ | ○ | × | ○ | ○ | × | ○ | ○ | × | ○ | ○ |
| 55 | ○ | ○ | ○ | × | ○ | ○ | × | ○ | ○ | ○ | ○ | ○ | × | ○ | ○ | × | ○ | ○ |
| 56 | × | × | × | ○ | ○ | ○ | ○ | ○ | ○ | × | × | × | ○ | ○ | ○ | ○ | ○ | ○ |
| 57 | ○ | × | × | ○ | ○ | ○ | ○ | ○ | ○ | ○ | × | × | ○ | ○ | ○ | ○ | ○ | ○ |
| 58 | × | ○ | × | ○ | ○ | ○ | ○ | ○ | ○ | × | ○ | × | ○ | ○ | ○ | ○ | ○ | ○ |
| 59 | ○ | ○ | × | ○ | ○ | ○ | ○ | ○ | ○ | ○ | ○ | × | ○ | ○ | ○ | ○ | ○ | ○ |
| 60 | × | × | ○ | ○ | ○ | ○ | ○ | ○ | ○ | × | × | ○ | ○ | ○ | ○ | ○ | ○ | ○ |
| 61 | ○ | × | ○ | ○ | ○ | ○ | ○ | ○ | ○ | ○ | × | ○ | ○ | ○ | ○ | ○ | ○ | ○ |
| 62 | × | ○ | ○ | ○ | ○ | ○ | ○ | ○ | ○ | × | ○ | ○ | ○ | ○ | ○ | ○ | ○ | ○ |
| 63 | ○ | ○ | ○ | ○ | ○ | ○ | ○ | ○ | ○ | ○ | ○ | ○ | ○ | ○ | ○ | ○ | ○ | ○ |

○ : Lighted
× : Not Lighted

FIG. 13

| | SFG1 | | | | | | | | | SFG2 | | | | | | | | |
|---|---|---|---|---|---|---|---|---|---|---|---|---|---|---|---|---|---|---|
| | SF11 | | | SF12 | | | SF13 | | | SF21 | | | SF22 | | | SF23 | | |
| | 0.5 | | | 2 | | | 2 | | | 0.5 | | | 2 | | | 2 | | |
| | SP1 | SP2 | SP3 | SP1 | SP2 | SP3 | SP1 | SP2 | SP3 | SP1 | SP2 | SP3 | SP1 | SP2 | SP3 | SP1 | SP2 | SP3 |
| | 1 | 2 | 4 | 1 | 2 | 4 | 1 | 2 | 4 | 1 | 2 | 4 | 1 | 2 | 4 | 1 | 2 | 4 |
| | 0.5 | 1 | 2 | 2 | 4 | 8 | 2 | 4 | 8 | 0.5 | 1 | 2 | 2 | 4 | 8 | 2 | 4 | 8 |
| 0 | × | × | × | × | × | × | × | × | × | × | × | × | × | × | × | × | × | × |
| 1 | ○ | × | × | × | × | × | × | × | × | ○ | × | × | × | × | × | × | × | × |
| 2 | × | ○ | × | × | × | × | × | × | × | × | ○ | × | × | × | × | × | × | × |
| 3 | ○ | ○ | × | × | × | × | × | × | × | ○ | ○ | × | × | × | × | × | × | × |
| 4 | × | × | ○ | × | × | × | × | × | × | × | × | ○ | × | × | × | × | × | × |
| 5 | ○ | × | ○ | × | × | × | × | × | × | ○ | × | ○ | × | × | × | × | × | × |
| 6 | × | ○ | ○ | × | × | × | × | × | × | × | ○ | ○ | × | × | × | × | × | × |
| 7 | ○ | ○ | ○ | × | × | × | × | × | × | ○ | ○ | ○ | × | × | × | × | × | × |
| 8 | × | × | × | ○ | × | × | ○ | × | × | × | × | × | ○ | × | × | ○ | × | × |
| 9 | ○ | × | × | ○ | × | × | ○ | × | × | ○ | × | × | ○ | × | × | ○ | × | × |
| 10 | × | ○ | × | ○ | × | × | ○ | × | × | × | ○ | × | ○ | × | × | ○ | × | × |
| 11 | ○ | ○ | × | ○ | × | × | ○ | × | × | ○ | ○ | × | ○ | × | × | ○ | × | × |
| 12 | × | × | ○ | ○ | × | × | ○ | × | × | × | × | ○ | ○ | × | × | ○ | × | × |
| 13 | ○ | × | ○ | ○ | × | × | ○ | × | × | ○ | × | ○ | ○ | × | × | ○ | × | × |
| 14 | × | ○ | ○ | ○ | × | × | ○ | × | × | × | ○ | ○ | ○ | × | × | ○ | × | × |
| 15 | ○ | ○ | ○ | ○ | × | × | ○ | × | × | ○ | ○ | ○ | ○ | × | × | ○ | × | × |
| 16 | × | × | × | × | ○ | × | × | ○ | × | × | × | × | × | ○ | × | × | ○ | × |
| 17 | ○ | × | × | × | ○ | × | × | ○ | × | ○ | × | × | × | ○ | × | × | ○ | × |
| 18 | × | ○ | × | × | ○ | × | × | ○ | × | × | ○ | × | × | ○ | × | × | ○ | × |
| 19 | ○ | ○ | × | × | ○ | × | × | ○ | × | ○ | ○ | × | × | ○ | × | × | ○ | × |
| 20 | × | × | ○ | × | ○ | × | × | ○ | × | × | × | ○ | × | ○ | × | × | ○ | × |
| 21 | ○ | × | ○ | × | ○ | × | × | ○ | × | ○ | × | ○ | × | ○ | × | × | ○ | × |
| 22 | × | ○ | ○ | × | ○ | × | × | ○ | × | × | ○ | ○ | × | ○ | × | × | ○ | × |
| 23 | ○ | ○ | ○ | × | ○ | × | × | ○ | × | ○ | ○ | ○ | × | ○ | × | × | ○ | × |
| 24 | × | × | × | ○ | ○ | × | ○ | ○ | × | × | × | × | ○ | ○ | × | ○ | ○ | × |
| 25 | ○ | × | × | ○ | ○ | × | ○ | ○ | × | ○ | × | × | ○ | ○ | × | ○ | ○ | × |
| 26 | × | ○ | × | ○ | ○ | × | ○ | ○ | × | × | ○ | × | ○ | ○ | × | ○ | ○ | × |
| 27 | ○ | ○ | × | ○ | ○ | × | ○ | ○ | × | ○ | ○ | × | ○ | ○ | × | ○ | ○ | × |
| 28 | × | × | ○ | ○ | ○ | × | ○ | ○ | × | × | × | ○ | ○ | ○ | × | ○ | ○ | × |
| 29 | ○ | × | ○ | ○ | ○ | × | ○ | ○ | × | ○ | × | ○ | ○ | ○ | × | ○ | ○ | × |
| 30 | × | ○ | ○ | ○ | ○ | × | ○ | ○ | × | × | ○ | ○ | ○ | ○ | × | ○ | ○ | × |
| 31 | ○ | ○ | ○ | × | ○ | ○ | × | × | × | ○ | ○ | ○ | × | ○ | ○ | × | × | × |
| 32 | × | × | × | × | × | ○ | × | × | ○ | × | × | × | × | × | ○ | × | × | ○ |
| 33 | ○ | × | × | × | × | ○ | × | × | ○ | ○ | × | × | × | × | ○ | × | × | ○ |
| 34 | × | ○ | × | × | × | ○ | × | × | ○ | × | ○ | × | × | × | ○ | × | × | ○ |
| 35 | ○ | ○ | × | × | × | ○ | × | × | ○ | ○ | ○ | × | × | × | ○ | × | × | ○ |
| 36 | × | × | ○ | × | × | ○ | × | × | ○ | × | × | ○ | × | × | ○ | × | × | ○ |
| 37 | ○ | × | ○ | × | × | ○ | × | × | ○ | ○ | × | ○ | × | × | ○ | × | × | ○ |
| 38 | × | ○ | ○ | × | × | ○ | × | × | ○ | × | ○ | ○ | × | × | ○ | × | × | ○ |
| 39 | ○ | ○ | ○ | × | × | ○ | × | × | ○ | ○ | ○ | ○ | × | × | ○ | × | × | ○ |
| 40 | × | × | × | ○ | × | ○ | ○ | × | ○ | × | × | × | ○ | × | ○ | ○ | × | ○ |
| 41 | ○ | × | × | ○ | × | ○ | ○ | × | ○ | ○ | × | × | ○ | × | ○ | ○ | × | ○ |
| 42 | × | ○ | × | ○ | × | ○ | ○ | × | ○ | × | ○ | × | ○ | × | ○ | ○ | × | ○ |
| 43 | ○ | ○ | × | ○ | × | ○ | ○ | × | ○ | ○ | ○ | × | ○ | × | ○ | ○ | × | ○ |
| 44 | × | × | ○ | ○ | × | ○ | ○ | × | ○ | × | × | ○ | ○ | × | ○ | ○ | × | ○ |
| 45 | ○ | × | ○ | ○ | × | ○ | ○ | × | ○ | ○ | × | ○ | ○ | × | ○ | ○ | × | ○ |
| 46 | × | ○ | ○ | ○ | × | ○ | ○ | × | ○ | × | ○ | ○ | ○ | × | ○ | ○ | × | ○ |
| 47 | ○ | ○ | ○ | ○ | × | ○ | ○ | × | ○ | ○ | ○ | ○ | ○ | × | ○ | ○ | × | ○ |
| 48 | × | × | × | × | ○ | ○ | × | ○ | ○ | × | × | × | × | ○ | ○ | × | ○ | ○ |
| 49 | ○ | × | × | × | ○ | ○ | × | ○ | ○ | ○ | × | × | × | ○ | ○ | × | ○ | ○ |
| 50 | × | ○ | × | × | ○ | ○ | × | ○ | ○ | × | ○ | × | × | ○ | ○ | × | ○ | ○ |
| 51 | ○ | ○ | × | × | ○ | ○ | × | ○ | ○ | ○ | ○ | × | × | ○ | ○ | × | ○ | ○ |
| 52 | × | × | ○ | × | ○ | ○ | × | ○ | ○ | × | × | ○ | × | ○ | ○ | × | ○ | ○ |
| 53 | ○ | × | ○ | × | ○ | ○ | × | ○ | ○ | ○ | × | ○ | × | ○ | ○ | × | ○ | ○ |
| 54 | × | ○ | ○ | × | ○ | ○ | × | ○ | ○ | × | ○ | ○ | × | ○ | ○ | × | ○ | ○ |
| 55 | ○ | ○ | ○ | × | ○ | ○ | × | ○ | ○ | ○ | ○ | ○ | × | ○ | ○ | × | ○ | ○ |
| 56 | × | × | × | ○ | ○ | ○ | ○ | ○ | ○ | × | × | × | ○ | ○ | ○ | ○ | ○ | ○ |
| 57 | ○ | × | × | ○ | ○ | ○ | ○ | ○ | ○ | ○ | × | × | ○ | ○ | ○ | ○ | ○ | ○ |
| 58 | × | ○ | × | ○ | ○ | ○ | ○ | ○ | ○ | × | ○ | × | ○ | ○ | ○ | ○ | ○ | ○ |
| 59 | ○ | ○ | × | ○ | ○ | ○ | ○ | ○ | ○ | ○ | ○ | × | ○ | ○ | ○ | ○ | ○ | ○ |
| 60 | × | × | ○ | ○ | ○ | ○ | ○ | ○ | ○ | × | × | ○ | ○ | ○ | ○ | ○ | ○ | ○ |
| 61 | ○ | × | ○ | ○ | ○ | ○ | ○ | ○ | ○ | ○ | × | ○ | ○ | ○ | ○ | ○ | ○ | ○ |
| 62 | × | ○ | ○ | ○ | ○ | ○ | ○ | ○ | ○ | × | ○ | ○ | ○ | ○ | ○ | ○ | ○ | ○ |
| 63 | ○ | ○ | ○ | ○ | ○ | ○ | ○ | ○ | ○ | ○ | ○ | ○ | ○ | ○ | ○ | ○ | ○ | ○ |

○ : Lighted
× : Not Lighted

FIG. 15

| | SFG1 | | | | | | SFG2 | | | | | | SFG3 | | | | | | SFG4 | | | | | |
|---|---|---|---|---|---|---|---|---|---|---|---|---|---|---|---|---|---|---|---|---|---|---|---|---|
| | SF11 | | SF12 | | SF13 | | SF21 | | SF22 | | SF23 | | SF31 | | SF32 | | SF33 | | SF41 | | SF42 | | SF43 | |
| | 0.25 | | 1 | | 4 | | 0.25 | | 1 | | 4 | | 0.25 | | 1 | | 4 | | 0.25 | | 1 | | 4 | |
| | SP1 | SP2 | SP1 | SP2 | SP1 | SP2 | SP1 | SP2 | SP1 | SP2 | SP1 | SP2 | SP1 | SP2 | SP1 | SP2 | SP1 | SP2 | SP1 | SP2 | SP1 | SP2 | SP1 | SP2 |
| | 1 | 2 | 1 | 2 | 1 | 2 | 1 | 2 | 1 | 2 | 1 | 2 | 1 | 2 | 1 | 2 | 1 | 2 | 1 | 2 | 1 | 2 | 1 | 2 |
| | 0.25 | 0.5 | 1 | 2 | 4 | 8 | 0.25 | 0.5 | 1 | 2 | 4 | 8 | 0.25 | 0.5 | 1 | 2 | 4 | 8 | 0.25 | 0.5 | 1 | 2 | 4 | 8 |
| 0 | × | × | × | × | × | × | × | × | × | × | × | × | × | × | × | × | × | × | × | × | × | × | × | × |
| 1 | ○ | × | × | × | × | × | ○ | × | × | × | × | × | ○ | × | × | × | × | × | ○ | × | × | × | × | × |
| 2 | × | ○ | × | × | × | × | × | ○ | × | × | × | × | × | ○ | × | × | × | × | × | ○ | × | × | × | × |
| 3 | ○ | ○ | × | × | × | × | ○ | ○ | × | × | × | × | ○ | ○ | × | × | × | × | ○ | ○ | × | × | × | × |
| 4 | × | × | ○ | × | × | × | × | × | ○ | × | × | × | × | × | ○ | × | × | × | × | × | ○ | × | × | × |
| 5 | ○ | × | ○ | × | × | × | ○ | × | ○ | × | × | × | ○ | × | ○ | × | × | × | ○ | × | ○ | × | × | × |
| 6 | × | ○ | ○ | × | × | × | × | ○ | ○ | × | × | × | × | ○ | ○ | × | × | × | × | ○ | ○ | × | × | × |
| 7 | ○ | ○ | ○ | × | × | × | ○ | ○ | ○ | × | × | × | ○ | ○ | ○ | × | × | × | ○ | ○ | ○ | × | × | × |
| 8 | × | × | × | ○ | × | × | × | × | × | ○ | × | × | × | × | × | ○ | × | × | × | × | × | ○ | × | × |
| 9 | ○ | × | × | ○ | × | × | ○ | × | × | ○ | × | × | ○ | × | × | ○ | × | × | ○ | × | × | ○ | × | × |
| 10 | × | ○ | × | ○ | × | × | × | ○ | × | ○ | × | × | × | ○ | × | ○ | × | × | × | ○ | × | ○ | × | × |
| 11 | ○ | ○ | × | ○ | × | × | ○ | ○ | × | ○ | × | × | ○ | ○ | × | ○ | × | × | ○ | ○ | × | ○ | × | × |
| 12 | × | × | ○ | ○ | × | × | × | × | ○ | ○ | × | × | × | × | ○ | ○ | × | × | × | × | ○ | ○ | × | × |
| 13 | ○ | × | ○ | ○ | × | × | ○ | × | ○ | ○ | × | × | ○ | × | ○ | ○ | × | × | ○ | × | ○ | ○ | × | × |
| 14 | × | ○ | ○ | ○ | × | × | × | ○ | ○ | ○ | × | × | × | ○ | ○ | ○ | × | × | × | ○ | ○ | ○ | × | × |
| 15 | ○ | ○ | ○ | ○ | × | × | ○ | ○ | ○ | ○ | × | × | ○ | ○ | ○ | ○ | × | × | ○ | ○ | ○ | ○ | × | × |
| 16 | × | × | × | × | ○ | × | × | × | × | × | ○ | × | × | × | × | × | ○ | × | × | × | × | × | ○ | × |
| 17 | ○ | × | × | × | ○ | × | ○ | × | × | × | ○ | × | ○ | × | × | × | ○ | × | ○ | × | × | × | ○ | × |
| 18 | × | ○ | × | × | ○ | × | × | ○ | × | × | ○ | × | × | ○ | × | × | ○ | × | × | ○ | × | × | ○ | × |
| 19 | ○ | ○ | × | × | ○ | × | ○ | ○ | × | × | ○ | × | ○ | ○ | × | × | ○ | × | ○ | ○ | × | × | ○ | × |
| 20 | × | × | ○ | × | ○ | × | × | × | ○ | × | ○ | × | × | × | ○ | × | ○ | × | × | × | ○ | × | ○ | × |
| 21 | ○ | × | ○ | × | ○ | × | ○ | × | ○ | × | ○ | × | ○ | × | ○ | × | ○ | × | ○ | × | ○ | × | ○ | × |
| 22 | × | ○ | ○ | × | ○ | × | × | ○ | ○ | × | ○ | × | × | ○ | ○ | × | ○ | × | × | ○ | ○ | × | ○ | × |
| 23 | ○ | ○ | ○ | × | ○ | × | ○ | ○ | ○ | × | ○ | × | ○ | ○ | ○ | × | ○ | × | ○ | ○ | ○ | × | ○ | × |
| 24 | × | × | × | ○ | ○ | × | × | × | × | ○ | ○ | × | × | × | × | ○ | ○ | × | × | × | × | ○ | ○ | × |
| 25 | ○ | × | × | ○ | ○ | × | ○ | × | × | ○ | ○ | × | ○ | × | × | ○ | ○ | × | ○ | × | × | ○ | ○ | × |
| 26 | × | ○ | × | ○ | ○ | × | × | ○ | × | ○ | ○ | × | × | ○ | × | ○ | ○ | × | × | ○ | × | ○ | ○ | × |
| 27 | ○ | ○ | × | ○ | ○ | × | ○ | ○ | × | ○ | ○ | × | ○ | ○ | × | ○ | ○ | × | ○ | ○ | × | ○ | ○ | × |
| 28 | × | × | ○ | ○ | ○ | × | × | × | ○ | ○ | ○ | × | × | × | ○ | ○ | ○ | × | × | × | ○ | ○ | ○ | × |
| 29 | ○ | × | ○ | ○ | ○ | × | ○ | × | ○ | ○ | ○ | × | ○ | × | ○ | ○ | ○ | × | ○ | × | ○ | ○ | ○ | × |
| 30 | × | ○ | ○ | ○ | ○ | × | × | ○ | ○ | ○ | ○ | × | × | ○ | ○ | ○ | ○ | × | × | ○ | ○ | ○ | ○ | × |
| 31 | ○ | ○ | ○ | ○ | ○ | × | ○ | ○ | ○ | ○ | ○ | × | ○ | ○ | ○ | ○ | ○ | × | ○ | ○ | ○ | ○ | ○ | × |
| 32 | × | × | × | × | × | ○ | × | × | × | × | × | ○ | × | × | × | × | × | ○ | × | × | × | × | × | ○ |
| 33 | ○ | × | × | × | × | ○ | ○ | × | × | × | × | ○ | ○ | × | × | × | × | ○ | ○ | × | × | × | × | ○ |
| 34 | × | ○ | × | × | × | ○ | × | ○ | × | × | × | ○ | × | ○ | × | × | × | ○ | × | ○ | × | × | × | ○ |
| 35 | ○ | ○ | × | × | × | ○ | ○ | ○ | × | × | × | ○ | ○ | ○ | × | × | × | ○ | ○ | ○ | × | × | × | ○ |
| 36 | × | × | ○ | × | × | ○ | × | × | ○ | × | × | ○ | × | × | ○ | × | × | ○ | × | × | ○ | × | × | ○ |
| 37 | ○ | × | ○ | × | × | ○ | ○ | × | ○ | × | × | ○ | ○ | × | ○ | × | × | ○ | ○ | × | ○ | × | × | ○ |
| 38 | × | ○ | ○ | × | × | ○ | × | ○ | ○ | × | × | ○ | × | ○ | ○ | × | × | ○ | × | ○ | ○ | × | × | ○ |
| 39 | ○ | ○ | ○ | × | × | ○ | ○ | ○ | ○ | × | × | ○ | ○ | ○ | ○ | × | × | ○ | ○ | ○ | ○ | × | × | ○ |
| 40 | × | × | × | ○ | × | ○ | × | × | × | ○ | × | ○ | × | × | × | ○ | × | ○ | × | × | × | ○ | × | ○ |
| 41 | ○ | × | × | ○ | × | ○ | ○ | × | × | ○ | × | ○ | ○ | × | × | ○ | × | ○ | ○ | × | × | ○ | × | ○ |
| 42 | × | ○ | × | ○ | × | ○ | × | ○ | × | ○ | × | ○ | × | ○ | × | ○ | × | ○ | × | ○ | × | ○ | × | ○ |
| 43 | ○ | ○ | × | ○ | × | ○ | ○ | ○ | × | ○ | × | ○ | ○ | ○ | × | ○ | × | ○ | ○ | ○ | × | ○ | × | ○ |
| 44 | × | × | ○ | ○ | × | ○ | × | × | ○ | ○ | × | ○ | × | × | ○ | ○ | × | ○ | × | × | ○ | ○ | × | ○ |
| 45 | ○ | × | ○ | ○ | × | ○ | ○ | × | ○ | ○ | × | ○ | ○ | × | ○ | ○ | × | ○ | ○ | × | ○ | ○ | × | ○ |
| 46 | × | ○ | ○ | ○ | × | ○ | × | ○ | ○ | ○ | × | ○ | × | ○ | ○ | ○ | × | ○ | × | ○ | ○ | ○ | × | ○ |
| 47 | ○ | ○ | ○ | ○ | × | ○ | ○ | ○ | ○ | ○ | × | ○ | ○ | ○ | ○ | ○ | × | ○ | ○ | ○ | ○ | ○ | × | ○ |
| 48 | × | × | × | × | ○ | ○ | × | × | × | × | ○ | ○ | × | × | × | × | ○ | ○ | × | × | × | × | ○ | ○ |
| 49 | ○ | × | × | × | ○ | ○ | ○ | × | × | × | ○ | ○ | ○ | × | × | × | ○ | ○ | ○ | × | × | × | ○ | ○ |
| 50 | × | ○ | × | × | ○ | ○ | × | ○ | × | × | ○ | ○ | × | ○ | × | × | ○ | ○ | × | ○ | × | × | ○ | ○ |
| 51 | ○ | ○ | × | × | ○ | ○ | ○ | ○ | × | × | ○ | ○ | ○ | ○ | × | × | ○ | ○ | ○ | ○ | × | × | ○ | ○ |
| 52 | × | × | ○ | × | ○ | ○ | × | × | ○ | × | ○ | ○ | × | × | ○ | × | ○ | ○ | × | × | ○ | × | ○ | ○ |
| 53 | ○ | × | ○ | × | ○ | ○ | ○ | × | ○ | × | ○ | ○ | ○ | × | ○ | × | ○ | ○ | ○ | × | ○ | × | ○ | ○ |
| 54 | × | ○ | ○ | × | ○ | ○ | × | ○ | ○ | × | ○ | ○ | × | ○ | ○ | × | ○ | ○ | × | ○ | ○ | × | ○ | ○ |
| 55 | ○ | ○ | ○ | × | ○ | ○ | ○ | ○ | ○ | × | ○ | ○ | ○ | ○ | ○ | × | ○ | ○ | ○ | ○ | ○ | × | ○ | ○ |
| 56 | × | × | × | ○ | ○ | ○ | × | × | × | ○ | ○ | ○ | × | × | × | ○ | ○ | ○ | × | × | × | ○ | ○ | ○ |
| 57 | ○ | × | × | ○ | ○ | ○ | ○ | × | × | ○ | ○ | ○ | ○ | × | × | ○ | ○ | ○ | ○ | × | × | ○ | ○ | ○ |
| 58 | × | ○ | × | ○ | ○ | ○ | × | ○ | × | ○ | ○ | ○ | × | ○ | × | ○ | ○ | ○ | × | ○ | × | ○ | ○ | ○ |
| 59 | ○ | ○ | × | ○ | ○ | ○ | ○ | ○ | × | ○ | ○ | ○ | ○ | ○ | × | ○ | ○ | ○ | ○ | ○ | × | ○ | ○ | ○ |
| 60 | × | × | ○ | ○ | ○ | ○ | × | × | ○ | ○ | ○ | ○ | × | × | ○ | ○ | ○ | ○ | × | × | ○ | ○ | ○ | ○ |
| 61 | ○ | × | ○ | ○ | ○ | ○ | ○ | × | ○ | ○ | ○ | ○ | ○ | × | ○ | ○ | ○ | ○ | ○ | × | ○ | ○ | ○ | ○ |
| 62 | × | ○ | ○ | ○ | ○ | ○ | × | ○ | ○ | ○ | ○ | ○ | × | ○ | ○ | ○ | ○ | ○ | × | ○ | ○ | ○ | ○ | ○ |
| 63 | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ |

○ : Lighted
× : Not Lighted

FIG. 17

| | SFG1 | | | | | | | | SFG2 | | | | | | | |
|---|---|---|---|---|---|---|---|---|---|---|---|---|---|---|---|---|
| | SF11 | | SF12 | | SF13 | | SF14 | | SF21 | | SF22 | | SF23 | | SF24 | |
| | 0.5 | | 2 | | 8 | | 32 | | 0.5 | | 2 | | 8 | | 32 | |
| | SP1 | SP2 | SP1 | SP2 | SP1 | SP2 | SP1 | SP2 | SP1 | SP2 | SP1 | SP2 | SP1 | SP2 | SP1 | SP2 |
| | 1 | 2 | 1 | 2 | 1 | 2 | 1 | 2 | 1 | 2 | 1 | 2 | 1 | 2 | 1 | 2 |
| | 0.5 | 1 | 2 | 4 | 8 | 16 | 32 | 64 | 0.5 | 1 | 2 | 4 | 8 | 16 | 32 | 64 |
| 0 | × | × | × | × | × | × | × | × | × | × | × | × | × | × | × | × |
| 1 | ○ | × | × | × | × | × | × | × | ○ | × | × | × | × | × | × | × |
| 2 | × | ○ | × | × | × | × | × | × | × | ○ | × | × | × | × | × | × |
| 3 | ○ | ○ | × | × | × | × | × | × | ○ | ○ | × | × | × | × | × | × |
| 4 | × | × | ○ | × | × | × | × | × | × | × | ○ | × | × | × | × | × |
| 5 | ○ | × | ○ | × | × | × | × | × | ○ | × | ○ | × | × | × | × | × |
| 6 | × | ○ | ○ | × | × | × | × | × | × | ○ | ○ | × | × | × | × | × |
| 7 | ○ | ○ | ○ | × | × | × | × | × | ○ | ○ | ○ | × | × | × | × | × |
| 8 | × | × | × | ○ | × | × | × | × | × | × | × | ○ | × | × | × | × |
| 9 | ○ | × | × | ○ | × | × | × | × | ○ | × | × | ○ | × | × | × | × |
| 10 | × | ○ | × | ○ | × | × | × | × | × | ○ | × | ○ | × | × | × | × |
| 11 | ○ | ○ | × | ○ | × | × | × | × | ○ | ○ | × | ○ | × | × | × | × |
| 12 | × | × | ○ | ○ | × | × | × | × | × | × | ○ | ○ | × | × | × | × |
| 13 | ○ | × | ○ | ○ | × | × | × | × | ○ | × | ○ | ○ | × | × | × | × |
| 14 | × | ○ | ○ | ○ | × | × | × | × | × | ○ | ○ | ○ | × | × | × | × |
| 15 | ○ | ○ | ○ | ○ | × | × | × | × | ○ | ○ | ○ | ○ | × | × | × | × |
| 16 | × | × | × | × | ○ | × | × | × | × | × | × | × | ○ | × | × | × |
| 17 | ○ | × | × | × | ○ | × | × | × | ○ | × | × | × | ○ | × | × | × |
| 18 | × | ○ | × | × | ○ | × | × | × | × | ○ | × | × | ○ | × | × | × |
| 19 | ○ | ○ | × | × | ○ | × | × | × | ○ | ○ | × | × | ○ | × | × | × |
| 20 | × | × | ○ | × | ○ | × | × | × | × | × | ○ | × | ○ | × | × | × |
| 21 | ○ | × | ○ | × | ○ | × | × | × | ○ | × | ○ | × | ○ | × | × | × |
| 22 | × | ○ | ○ | × | ○ | × | × | × | × | ○ | ○ | × | ○ | × | × | × |
| 23 | ○ | ○ | ○ | × | ○ | × | × | × | ○ | ○ | ○ | × | ○ | × | × | × |
| 24 | × | × | × | ○ | ○ | × | × | × | × | × | × | ○ | ○ | × | × | × |
| 25 | ○ | × | × | ○ | ○ | × | × | × | ○ | × | × | ○ | ○ | × | × | × |
| 26 | × | ○ | × | ○ | ○ | × | × | × | × | ○ | × | ○ | ○ | × | × | × |
| 27 | ○ | ○ | × | ○ | ○ | × | × | × | ○ | ○ | × | ○ | ○ | × | × | × |
| 28 | × | × | ○ | ○ | ○ | × | × | × | × | × | ○ | ○ | ○ | × | × | × |
| 29 | ○ | × | ○ | ○ | ○ | × | × | × | ○ | × | ○ | ○ | ○ | × | × | × |
| 30 | × | ○ | ○ | ○ | ○ | × | × | × | × | ○ | ○ | ○ | ○ | × | × | × |
| 31 | ○ | ○ | ○ | ○ | ○ | × | × | × | ○ | ○ | ○ | ○ | ○ | × | × | × |
| 32 | × | × | × | × | × | ○ | × | × | × | × | × | × | × | ○ | × | × |
| 33 | ○ | × | × | × | × | ○ | × | × | ○ | × | × | × | × | ○ | × | × |
| 34 | × | ○ | × | × | × | ○ | × | × | × | ○ | × | × | × | ○ | × | × |
| 35 | ○ | ○ | × | × | × | ○ | × | × | ○ | ○ | × | × | × | ○ | × | × |
| 36 | × | × | ○ | × | × | ○ | × | × | × | × | ○ | × | × | ○ | × | × |
| 37 | ○ | × | ○ | × | × | ○ | × | × | ○ | × | ○ | × | × | ○ | × | × |
| 38 | × | ○ | ○ | × | × | ○ | × | × | × | ○ | ○ | × | × | ○ | × | × |
| 39 | ○ | ○ | ○ | × | × | ○ | × | × | ○ | ○ | ○ | × | × | ○ | × | × |
| 40 | × | × | × | ○ | × | ○ | × | × | × | × | × | ○ | × | ○ | × | × |
| 41 | ○ | × | × | ○ | × | ○ | × | × | ○ | × | × | ○ | × | ○ | × | × |
| 42 | × | ○ | × | ○ | × | ○ | × | × | × | ○ | × | ○ | × | ○ | × | × |
| 43 | ○ | ○ | × | ○ | × | ○ | × | × | ○ | ○ | × | ○ | × | ○ | × | × |
| 44 | × | × | ○ | ○ | × | ○ | × | × | × | × | ○ | ○ | × | ○ | × | × |
| 45 | ○ | × | ○ | ○ | × | ○ | × | × | ○ | × | ○ | ○ | × | ○ | × | × |
| 46 | × | ○ | ○ | ○ | × | ○ | × | × | × | ○ | ○ | ○ | × | ○ | × | × |
| 47 | ○ | ○ | ○ | ○ | × | ○ | × | × | ○ | ○ | ○ | ○ | × | ○ | × | × |
| 48 | × | × | × | × | ○ | ○ | × | × | × | × | × | × | ○ | ○ | × | × |
| 49 | ○ | × | × | × | ○ | ○ | × | × | ○ | × | × | × | ○ | ○ | × | × |
| 50 | × | ○ | × | × | ○ | ○ | × | × | × | ○ | × | × | ○ | ○ | × | × |
| 51 | ○ | ○ | × | × | ○ | ○ | × | × | ○ | ○ | × | × | ○ | ○ | × | × |
| 52 | × | × | ○ | × | ○ | ○ | × | × | × | × | ○ | × | ○ | ○ | × | × |
| 53 | ○ | × | ○ | × | ○ | ○ | × | × | ○ | × | ○ | × | ○ | ○ | × | × |
| 54 | × | ○ | ○ | × | ○ | ○ | × | × | × | ○ | ○ | × | ○ | ○ | × | × |
| 55 | ○ | ○ | ○ | × | ○ | ○ | × | × | ○ | ○ | ○ | × | ○ | ○ | × | × |
| 56 | × | × | × | ○ | ○ | ○ | × | × | × | × | × | ○ | ○ | ○ | × | × |
| 57 | ○ | × | × | ○ | ○ | ○ | × | × | ○ | × | × | ○ | ○ | ○ | × | × |
| 58 | × | ○ | × | ○ | ○ | ○ | × | × | × | ○ | × | ○ | ○ | ○ | × | × |
| 59 | ○ | ○ | × | ○ | ○ | ○ | × | × | ○ | ○ | × | ○ | ○ | ○ | × | × |
| 60 | × | × | ○ | ○ | ○ | ○ | × | × | × | × | ○ | ○ | ○ | ○ | × | × |
| 61 | ○ | × | ○ | ○ | ○ | ○ | × | × | ○ | × | ○ | ○ | ○ | ○ | × | × |
| 62 | × | ○ | ○ | ○ | ○ | ○ | × | × | × | ○ | ○ | ○ | ○ | ○ | × | × |
| 63 | ○ | ○ | ○ | ○ | ○ | ○ | × | × | ○ | ○ | ○ | ○ | ○ | ○ | × | × |

○ : Lighted
× : Not Lighted

FIG. 18

| | SFG1 | | | | | | | | SFG2 | | | | | | | |
|---|---|---|---|---|---|---|---|---|---|---|---|---|---|---|---|---|
| | SF11 | | SF12 | | SF13 | | SF14 | | SF21 | | SF22 | | SF23 | | SF24 | |
| | 0.5 | | 2 | | 8 | | 32 | | 0.5 | | 2 | | 8 | | 32 | |
| | SP1 | SP2 | SP1 | SP2 | SP1 | SP2 | SP1 | SP2 | SP1 | SP2 | SP1 | SP2 | SP1 | SP2 | SP1 | SP2 |
| | 1 | 2 | 1 | 2 | 1 | 2 | 1 | 2 | 1 | 2 | 1 | 2 | 1 | 2 | 1 | 2 |
| | 0.5 | 1 | 2 | 4 | 8 | 16 | 32 | 64 | 0.5 | 1 | 2 | 4 | 8 | 16 | 32 | 64 |
| 64 | × | × | × | × | × | × | ○ | × | × | × | × | × | × | × | ○ | × |
| 65 | ○ | × | × | × | × | × | ○ | × | ○ | × | × | × | × | × | ○ | × |
| 66 | × | ○ | × | × | × | × | ○ | × | × | ○ | × | × | × | × | ○ | × |
| 67 | ○ | ○ | × | × | × | × | ○ | × | ○ | ○ | × | × | × | × | ○ | × |
| 68 | × | × | ○ | × | × | × | ○ | × | × | × | ○ | × | × | × | ○ | × |
| 69 | ○ | × | ○ | × | × | × | ○ | × | ○ | × | ○ | × | × | × | ○ | × |
| 70 | × | ○ | ○ | × | × | × | ○ | × | × | ○ | ○ | × | × | × | ○ | × |
| 71 | ○ | ○ | ○ | × | × | × | ○ | × | ○ | ○ | ○ | × | × | × | ○ | × |
| 72 | × | × | × | ○ | × | × | ○ | × | × | × | × | ○ | × | × | ○ | × |
| 73 | ○ | × | × | ○ | × | × | ○ | × | ○ | × | × | ○ | × | × | ○ | × |
| 74 | × | ○ | × | ○ | × | × | ○ | × | × | ○ | × | ○ | × | × | ○ | × |
| 75 | ○ | ○ | × | ○ | × | × | ○ | × | ○ | ○ | × | ○ | × | × | ○ | × |
| 76 | × | × | ○ | ○ | × | × | ○ | × | × | × | ○ | ○ | × | × | ○ | × |
| 77 | ○ | × | ○ | ○ | × | × | ○ | × | ○ | × | ○ | ○ | × | × | ○ | × |
| 78 | × | ○ | ○ | ○ | × | × | ○ | × | × | ○ | ○ | ○ | × | × | ○ | × |
| 79 | ○ | ○ | ○ | ○ | × | × | ○ | × | ○ | ○ | ○ | ○ | × | × | ○ | × |
| 80 | × | × | × | × | ○ | × | ○ | × | × | × | × | × | ○ | × | ○ | × |
| 81 | ○ | × | × | × | ○ | × | ○ | × | ○ | × | × | × | ○ | × | ○ | × |
| 82 | × | ○ | × | × | ○ | × | ○ | × | × | ○ | × | × | ○ | × | ○ | × |
| 83 | ○ | ○ | × | × | ○ | × | ○ | × | ○ | ○ | × | × | ○ | × | ○ | × |
| 84 | × | × | ○ | × | ○ | × | ○ | × | × | × | ○ | × | ○ | × | ○ | × |
| 85 | ○ | × | ○ | × | ○ | × | ○ | × | ○ | × | ○ | × | ○ | × | ○ | × |
| 86 | × | ○ | ○ | × | ○ | × | ○ | × | × | ○ | ○ | × | ○ | × | ○ | × |
| 87 | ○ | ○ | ○ | × | ○ | × | ○ | × | ○ | ○ | ○ | × | ○ | × | ○ | × |
| 88 | × | × | × | ○ | ○ | × | ○ | × | × | × | × | ○ | ○ | × | ○ | × |
| 89 | ○ | × | × | ○ | ○ | × | ○ | × | ○ | × | × | ○ | ○ | × | ○ | × |
| 90 | × | ○ | × | ○ | ○ | × | ○ | × | × | ○ | × | ○ | ○ | × | ○ | × |
| 91 | ○ | ○ | × | ○ | ○ | × | ○ | × | ○ | ○ | × | ○ | ○ | × | ○ | × |
| 92 | × | × | ○ | ○ | ○ | × | ○ | × | × | × | ○ | ○ | ○ | × | ○ | × |
| 93 | ○ | × | ○ | ○ | ○ | × | ○ | × | ○ | × | ○ | ○ | ○ | × | ○ | × |
| 94 | × | ○ | ○ | ○ | ○ | × | ○ | × | × | ○ | ○ | ○ | ○ | × | ○ | × |
| 95 | ○ | ○ | ○ | ○ | ○ | × | ○ | × | ○ | ○ | ○ | ○ | ○ | × | ○ | × |
| 96 | × | × | × | × | × | ○ | ○ | × | × | × | × | × | × | ○ | ○ | × |
| 97 | ○ | × | × | × | × | ○ | ○ | × | ○ | × | × | × | × | ○ | ○ | × |
| 98 | × | ○ | × | × | × | ○ | ○ | × | × | ○ | × | × | × | ○ | ○ | × |
| 99 | ○ | ○ | × | × | × | ○ | ○ | × | ○ | ○ | × | × | × | ○ | ○ | × |
| 100 | × | × | ○ | × | × | ○ | ○ | × | × | × | ○ | × | × | ○ | ○ | × |
| 101 | ○ | × | ○ | × | × | ○ | ○ | × | ○ | × | ○ | × | × | ○ | ○ | × |
| 102 | × | ○ | ○ | × | × | ○ | ○ | × | × | ○ | ○ | × | × | ○ | ○ | × |
| 103 | ○ | ○ | ○ | × | × | ○ | ○ | × | ○ | ○ | ○ | × | × | ○ | ○ | × |
| 104 | × | × | × | ○ | × | ○ | ○ | × | × | × | × | ○ | × | ○ | ○ | × |
| 105 | ○ | × | × | ○ | × | ○ | ○ | × | ○ | × | × | ○ | × | ○ | ○ | × |
| 106 | × | ○ | × | ○ | × | ○ | ○ | × | × | ○ | × | ○ | × | ○ | ○ | × |
| 107 | ○ | ○ | × | ○ | × | ○ | ○ | × | ○ | ○ | × | ○ | × | ○ | ○ | × |
| 108 | × | × | ○ | ○ | × | ○ | ○ | × | × | × | ○ | ○ | × | ○ | ○ | × |
| 109 | ○ | × | ○ | ○ | × | ○ | ○ | × | ○ | × | ○ | ○ | × | ○ | ○ | × |
| 110 | × | ○ | ○ | ○ | × | ○ | ○ | × | × | ○ | ○ | ○ | × | ○ | ○ | × |
| 111 | ○ | ○ | ○ | ○ | × | ○ | ○ | × | ○ | ○ | ○ | ○ | × | ○ | ○ | × |
| 112 | × | × | × | × | ○ | ○ | ○ | × | × | × | × | × | ○ | ○ | ○ | × |
| 113 | ○ | × | × | × | ○ | ○ | ○ | × | ○ | × | × | × | ○ | ○ | ○ | × |
| 114 | × | ○ | × | × | ○ | ○ | ○ | × | × | ○ | × | × | ○ | ○ | ○ | × |
| 115 | ○ | ○ | × | × | ○ | ○ | ○ | × | ○ | ○ | × | × | ○ | ○ | ○ | × |
| 116 | × | × | ○ | × | ○ | ○ | ○ | × | × | × | ○ | × | ○ | ○ | ○ | × |
| 117 | ○ | × | ○ | × | ○ | ○ | ○ | × | ○ | × | ○ | × | ○ | ○ | ○ | × |
| 118 | × | ○ | ○ | × | ○ | ○ | ○ | × | × | ○ | ○ | × | ○ | ○ | ○ | × |
| 119 | ○ | ○ | ○ | × | ○ | ○ | ○ | × | ○ | ○ | ○ | × | ○ | ○ | ○ | × |
| 120 | × | × | × | ○ | ○ | ○ | ○ | × | × | × | × | ○ | ○ | ○ | ○ | × |
| 121 | ○ | × | × | ○ | ○ | ○ | ○ | × | ○ | × | × | ○ | ○ | ○ | ○ | × |
| 122 | × | ○ | × | ○ | ○ | ○ | ○ | × | × | ○ | × | ○ | ○ | ○ | ○ | × |
| 123 | ○ | ○ | × | ○ | ○ | ○ | ○ | × | ○ | ○ | × | ○ | ○ | ○ | ○ | × |
| 124 | × | × | ○ | ○ | ○ | ○ | ○ | × | × | × | ○ | ○ | ○ | ○ | ○ | × |
| 125 | ○ | × | ○ | ○ | ○ | ○ | ○ | × | ○ | × | ○ | ○ | ○ | ○ | ○ | × |
| 126 | × | ○ | ○ | ○ | ○ | ○ | ○ | × | × | ○ | ○ | ○ | ○ | ○ | ○ | × |
| 127 | ○ | ○ | ○ | ○ | ○ | ○ | ○ | × | ○ | ○ | ○ | ○ | ○ | ○ | ○ | × |

○ : Lighted
× : Not Lighted

FIG. 19

| | SFG1 | | | | | | | | SFG2 | | | | | | | |
|---|---|---|---|---|---|---|---|---|---|---|---|---|---|---|---|---|
| | SF11 | | SF12 | | SF13 | | SF14 | | SF21 | | SF22 | | SF23 | | SF24 | |
| | 0.5 | | 2 | | 8 | | 32 | | 0.5 | | 2 | | 8 | | 32 | |
| | SP1 | SP2 | SP1 | SP2 | SP1 | SP2 | SP1 | SP2 | SP1 | SP2 | SP1 | SP2 | SP1 | SP2 | SP1 | SP2 |
| | 1 | 2 | 1 | 2 | 1 | 2 | 1 | 2 | 1 | 2 | 1 | 2 | 1 | 2 | 1 | 2 |
| | 0.5 | 1 | 2 | 4 | 8 | 16 | 32 | 64 | 0.5 | 1 | 2 | 4 | 8 | 16 | 32 | 64 |
| 128 | × | × | × | × | × | × | × | ○ | × | × | × | × | × | × | × | ○ |
| 129 | ○ | × | × | × | × | × | × | ○ | ○ | × | × | × | × | × | × | ○ |
| 130 | × | ○ | × | × | × | × | × | ○ | × | ○ | × | × | × | × | × | ○ |
| 131 | ○ | ○ | × | × | × | × | × | ○ | ○ | ○ | × | × | × | × | × | ○ |
| 132 | × | × | ○ | × | × | × | × | ○ | × | × | ○ | × | × | × | × | ○ |
| 133 | ○ | × | ○ | × | × | × | × | ○ | ○ | × | ○ | × | × | × | × | ○ |
| 134 | × | ○ | ○ | × | × | × | × | ○ | × | ○ | ○ | × | × | × | × | ○ |
| 135 | ○ | ○ | ○ | × | × | × | × | ○ | ○ | ○ | ○ | × | × | × | × | ○ |
| 136 | × | × | × | ○ | × | × | × | ○ | × | × | × | ○ | × | × | × | ○ |
| 137 | ○ | × | × | ○ | × | × | × | ○ | ○ | × | × | ○ | × | × | × | ○ |
| 138 | × | ○ | × | ○ | × | × | × | ○ | × | ○ | × | ○ | × | × | × | ○ |
| 139 | ○ | ○ | × | ○ | × | × | × | ○ | ○ | ○ | × | ○ | × | × | × | ○ |
| 140 | × | × | ○ | ○ | × | × | × | ○ | × | × | ○ | ○ | × | × | × | ○ |
| 141 | ○ | × | ○ | ○ | × | × | × | ○ | ○ | × | ○ | ○ | × | × | × | ○ |
| 142 | × | ○ | ○ | ○ | × | × | × | ○ | × | ○ | ○ | ○ | × | × | × | ○ |
| 143 | ○ | ○ | ○ | ○ | × | × | × | ○ | ○ | ○ | ○ | ○ | × | × | × | ○ |
| 144 | × | × | × | × | ○ | × | × | ○ | × | × | × | × | ○ | × | × | ○ |
| 145 | ○ | × | × | × | ○ | × | × | ○ | ○ | × | × | × | ○ | × | × | ○ |
| 146 | × | ○ | × | × | ○ | × | × | ○ | × | ○ | × | × | ○ | × | × | ○ |
| 147 | ○ | ○ | × | × | ○ | × | × | ○ | ○ | ○ | × | × | ○ | × | × | ○ |
| 148 | × | × | ○ | × | ○ | × | × | ○ | × | × | ○ | × | ○ | × | × | ○ |
| 149 | ○ | × | ○ | × | ○ | × | × | ○ | ○ | × | ○ | × | ○ | × | × | ○ |
| 150 | × | ○ | ○ | × | ○ | × | × | ○ | × | ○ | ○ | × | ○ | × | × | ○ |
| 151 | ○ | ○ | ○ | × | ○ | × | × | ○ | ○ | ○ | ○ | × | ○ | × | × | ○ |
| 152 | × | × | × | ○ | ○ | × | × | ○ | × | × | × | ○ | ○ | × | × | ○ |
| 153 | ○ | × | × | ○ | ○ | × | × | ○ | ○ | × | × | ○ | ○ | × | × | ○ |
| 154 | × | ○ | × | ○ | ○ | × | × | ○ | × | ○ | × | ○ | ○ | × | × | ○ |
| 155 | ○ | ○ | × | ○ | ○ | × | × | ○ | ○ | ○ | × | ○ | ○ | × | × | ○ |
| 156 | × | × | ○ | ○ | ○ | × | × | ○ | × | × | ○ | ○ | ○ | × | × | ○ |
| 157 | ○ | × | ○ | ○ | ○ | × | × | ○ | ○ | × | ○ | ○ | ○ | × | × | ○ |
| 158 | × | ○ | ○ | ○ | ○ | × | × | ○ | × | ○ | ○ | ○ | ○ | × | × | ○ |
| 159 | ○ | ○ | ○ | ○ | ○ | × | × | ○ | ○ | ○ | ○ | ○ | ○ | × | × | ○ |
| 160 | × | × | × | × | × | ○ | × | ○ | × | × | × | × | × | ○ | × | ○ |
| 161 | ○ | × | × | × | × | ○ | × | ○ | ○ | × | × | × | × | ○ | × | ○ |
| 162 | × | ○ | × | × | × | ○ | × | ○ | × | ○ | × | × | × | ○ | × | ○ |
| 163 | ○ | ○ | × | × | × | ○ | × | ○ | ○ | ○ | × | × | × | ○ | × | ○ |
| 164 | × | × | ○ | × | × | ○ | × | ○ | × | × | ○ | × | × | ○ | × | ○ |
| 165 | ○ | × | ○ | × | × | ○ | × | ○ | ○ | × | ○ | × | × | ○ | × | ○ |
| 166 | × | ○ | ○ | × | × | ○ | × | ○ | × | ○ | ○ | × | × | ○ | × | ○ |
| 167 | ○ | ○ | ○ | × | × | ○ | × | ○ | ○ | ○ | ○ | × | × | ○ | × | ○ |
| 168 | × | × | × | ○ | × | ○ | × | ○ | × | × | × | ○ | × | ○ | × | ○ |
| 169 | ○ | × | × | ○ | × | ○ | × | ○ | ○ | × | × | ○ | × | ○ | × | ○ |
| 170 | × | ○ | × | ○ | × | ○ | × | ○ | × | ○ | × | ○ | × | ○ | × | ○ |
| 171 | ○ | ○ | × | ○ | × | ○ | × | ○ | ○ | ○ | × | ○ | × | ○ | × | ○ |
| 172 | × | × | ○ | ○ | × | ○ | × | ○ | × | × | ○ | ○ | × | ○ | × | ○ |
| 173 | ○ | × | ○ | ○ | × | ○ | × | ○ | ○ | × | ○ | ○ | × | ○ | × | ○ |
| 174 | × | ○ | ○ | ○ | × | ○ | × | ○ | × | ○ | ○ | ○ | × | ○ | × | ○ |
| 175 | ○ | ○ | ○ | ○ | × | ○ | × | ○ | ○ | ○ | ○ | ○ | × | ○ | × | ○ |
| 176 | × | × | × | × | ○ | ○ | × | ○ | × | × | × | × | ○ | ○ | × | ○ |
| 177 | ○ | × | × | × | ○ | ○ | × | ○ | ○ | × | × | × | ○ | ○ | × | ○ |
| 178 | × | ○ | × | × | ○ | ○ | × | ○ | × | ○ | × | × | ○ | ○ | × | ○ |
| 179 | ○ | ○ | × | × | ○ | ○ | × | ○ | ○ | ○ | × | × | ○ | ○ | × | ○ |
| 180 | × | × | ○ | × | ○ | ○ | × | ○ | × | × | ○ | × | ○ | ○ | × | ○ |
| 181 | ○ | × | ○ | × | ○ | ○ | × | ○ | ○ | × | ○ | × | ○ | ○ | × | ○ |
| 182 | × | ○ | ○ | × | ○ | ○ | × | ○ | × | ○ | ○ | × | ○ | ○ | × | ○ |
| 183 | ○ | ○ | ○ | × | ○ | ○ | × | ○ | ○ | ○ | ○ | × | ○ | ○ | × | ○ |
| 184 | × | × | × | ○ | ○ | ○ | × | ○ | × | × | × | ○ | ○ | ○ | × | ○ |
| 185 | ○ | × | × | ○ | ○ | ○ | × | ○ | ○ | × | × | ○ | ○ | ○ | × | ○ |
| 186 | × | ○ | × | ○ | ○ | ○ | × | ○ | × | ○ | × | ○ | ○ | ○ | × | ○ |
| 187 | ○ | ○ | × | ○ | ○ | ○ | × | ○ | ○ | ○ | × | ○ | ○ | ○ | × | ○ |
| 188 | × | × | ○ | ○ | ○ | ○ | × | ○ | × | × | ○ | ○ | ○ | ○ | × | ○ |
| 189 | ○ | × | ○ | ○ | ○ | ○ | × | ○ | ○ | × | ○ | ○ | ○ | ○ | × | ○ |
| 190 | × | ○ | ○ | ○ | ○ | ○ | × | ○ | × | ○ | ○ | ○ | ○ | ○ | × | ○ |
| 191 | ○ | ○ | ○ | ○ | ○ | ○ | × | ○ | ○ | ○ | ○ | ○ | ○ | ○ | × | ○ |

○ : Lighted
× : Not Lighted

FIG. 20

| | SFG1 | | | | | | | | SFG2 | | | | | | | |
|---|---|---|---|---|---|---|---|---|---|---|---|---|---|---|---|---|
| | SF11 | | SF12 | | SF13 | | SF14 | | SF21 | | SF22 | | SF23 | | SF24 | |
| | 0.5 | | 2 | | 8 | | 32 | | 0.5 | | 2 | | 8 | | 32 | |
| | SP1 | SP2 | SP1 | SP2 | SP1 | SP2 | SP1 | SP2 | SP1 | SP2 | SP1 | SP2 | SP1 | SP2 | SP1 | SP2 |
| | 1 | 2 | 1 | 2 | 1 | 2 | 1 | 2 | 1 | 2 | 1 | 2 | 1 | 2 | 1 | 2 |
| | 0.5 | 1 | 2 | 4 | 8 | 16 | 32 | 64 | 0.5 | 1 | 2 | 4 | 8 | 16 | 32 | 64 |
| 192 | × | × | × | × | × | × | ○ | ○ | × | × | × | × | × | × | ○ | ○ |
| 193 | ○ | × | × | × | × | × | ○ | ○ | ○ | × | × | × | × | × | ○ | ○ |
| 194 | × | ○ | × | × | × | × | ○ | ○ | × | ○ | × | × | × | × | ○ | ○ |
| 195 | ○ | ○ | × | × | × | × | ○ | ○ | ○ | ○ | × | × | × | × | ○ | ○ |
| 196 | × | × | ○ | × | × | × | ○ | ○ | × | × | ○ | × | × | × | ○ | ○ |
| 197 | ○ | × | ○ | × | × | × | ○ | ○ | ○ | × | ○ | × | × | × | ○ | ○ |
| 198 | × | ○ | ○ | × | × | × | ○ | ○ | × | ○ | ○ | × | × | × | ○ | ○ |
| 199 | ○ | ○ | ○ | × | × | × | ○ | ○ | ○ | ○ | ○ | × | × | × | ○ | ○ |
| 200 | × | × | × | ○ | × | × | ○ | ○ | × | × | × | ○ | × | × | ○ | ○ |
| 201 | ○ | × | × | ○ | × | × | ○ | ○ | ○ | × | × | ○ | × | × | ○ | ○ |
| 202 | × | ○ | × | ○ | × | × | ○ | ○ | × | ○ | × | ○ | × | × | ○ | ○ |
| 203 | ○ | ○ | × | ○ | × | × | ○ | ○ | ○ | ○ | × | ○ | × | × | ○ | ○ |
| 204 | × | × | ○ | ○ | × | × | ○ | ○ | × | × | ○ | ○ | × | × | ○ | ○ |
| 205 | ○ | × | ○ | ○ | × | × | ○ | ○ | ○ | × | ○ | ○ | × | × | ○ | ○ |
| 206 | × | ○ | ○ | ○ | × | × | ○ | ○ | × | ○ | ○ | ○ | × | × | ○ | ○ |
| 207 | ○ | ○ | ○ | ○ | × | × | ○ | ○ | ○ | ○ | ○ | ○ | × | × | ○ | ○ |
| 208 | × | × | × | × | ○ | × | ○ | ○ | × | × | × | × | ○ | × | ○ | ○ |
| 209 | ○ | × | × | × | ○ | × | ○ | ○ | ○ | × | × | × | ○ | × | ○ | ○ |
| 210 | × | ○ | × | × | ○ | × | ○ | ○ | × | ○ | × | × | ○ | × | ○ | ○ |
| 211 | ○ | ○ | × | × | ○ | × | ○ | ○ | ○ | ○ | × | × | ○ | × | ○ | ○ |
| 212 | × | × | ○ | × | ○ | × | ○ | ○ | × | × | ○ | × | ○ | × | ○ | ○ |
| 213 | ○ | × | ○ | × | ○ | × | ○ | ○ | ○ | × | ○ | × | ○ | × | ○ | ○ |
| 214 | × | ○ | ○ | × | ○ | × | ○ | ○ | × | ○ | ○ | × | ○ | × | ○ | ○ |
| 215 | ○ | ○ | ○ | × | ○ | × | ○ | ○ | ○ | ○ | ○ | × | ○ | × | ○ | ○ |
| 216 | × | × | × | ○ | ○ | × | ○ | ○ | × | × | × | ○ | ○ | × | ○ | ○ |
| 217 | ○ | × | × | ○ | ○ | × | ○ | ○ | ○ | × | × | ○ | ○ | × | ○ | ○ |
| 218 | × | ○ | × | ○ | ○ | × | ○ | ○ | × | ○ | × | ○ | ○ | × | ○ | ○ |
| 219 | ○ | ○ | × | ○ | ○ | × | ○ | ○ | ○ | ○ | × | ○ | ○ | × | ○ | ○ |
| 220 | × | × | ○ | ○ | ○ | × | ○ | ○ | × | × | ○ | ○ | ○ | × | ○ | ○ |
| 221 | ○ | × | ○ | ○ | ○ | × | ○ | ○ | ○ | × | ○ | ○ | ○ | × | ○ | ○ |
| 222 | × | ○ | ○ | ○ | ○ | × | ○ | ○ | × | ○ | ○ | ○ | ○ | × | ○ | ○ |
| 223 | ○ | ○ | ○ | ○ | ○ | × | ○ | ○ | ○ | ○ | ○ | ○ | ○ | × | ○ | ○ |
| 224 | × | × | × | × | × | ○ | ○ | ○ | × | × | × | × | × | ○ | ○ | ○ |
| 225 | ○ | × | × | × | × | ○ | ○ | ○ | ○ | × | × | × | × | ○ | ○ | ○ |
| 226 | × | ○ | × | × | × | ○ | ○ | ○ | × | ○ | × | × | × | ○ | ○ | ○ |
| 227 | ○ | ○ | × | × | × | ○ | ○ | ○ | ○ | ○ | × | × | × | ○ | ○ | ○ |
| 228 | × | × | ○ | × | × | ○ | ○ | ○ | × | × | ○ | × | × | ○ | ○ | ○ |
| 229 | ○ | × | ○ | × | × | ○ | ○ | ○ | ○ | × | ○ | × | × | ○ | ○ | ○ |
| 230 | × | ○ | ○ | × | × | ○ | ○ | ○ | × | ○ | ○ | × | × | ○ | ○ | ○ |
| 231 | ○ | ○ | ○ | × | × | ○ | ○ | ○ | ○ | ○ | ○ | × | × | ○ | ○ | ○ |
| 232 | × | × | × | ○ | × | ○ | ○ | ○ | × | × | × | ○ | × | ○ | ○ | ○ |
| 233 | ○ | × | × | ○ | × | ○ | ○ | ○ | ○ | × | × | ○ | × | ○ | ○ | ○ |
| 234 | × | ○ | × | ○ | × | ○ | ○ | ○ | × | ○ | × | ○ | × | ○ | ○ | ○ |
| 235 | ○ | ○ | × | ○ | × | ○ | ○ | ○ | ○ | ○ | × | ○ | × | ○ | ○ | ○ |
| 236 | × | × | ○ | ○ | × | ○ | ○ | ○ | × | × | ○ | ○ | × | ○ | ○ | ○ |
| 237 | ○ | × | ○ | ○ | × | ○ | ○ | ○ | ○ | × | ○ | ○ | × | ○ | ○ | ○ |
| 238 | × | ○ | ○ | ○ | × | ○ | ○ | ○ | × | ○ | ○ | ○ | × | ○ | ○ | ○ |
| 239 | ○ | ○ | ○ | ○ | × | ○ | ○ | ○ | ○ | ○ | ○ | ○ | × | ○ | ○ | ○ |
| 240 | × | × | × | × | ○ | ○ | ○ | ○ | × | × | × | × | ○ | ○ | ○ | ○ |
| 241 | ○ | × | × | × | ○ | ○ | ○ | ○ | ○ | × | × | × | ○ | ○ | ○ | ○ |
| 242 | × | ○ | × | × | ○ | ○ | ○ | ○ | × | ○ | × | × | ○ | ○ | ○ | ○ |
| 243 | ○ | ○ | × | × | ○ | ○ | ○ | ○ | ○ | ○ | × | × | ○ | ○ | ○ | ○ |
| 244 | × | × | ○ | × | ○ | ○ | ○ | ○ | × | × | ○ | × | ○ | ○ | ○ | ○ |
| 245 | ○ | × | ○ | × | ○ | ○ | ○ | ○ | ○ | × | ○ | × | ○ | ○ | ○ | ○ |
| 246 | × | ○ | ○ | × | ○ | ○ | ○ | ○ | × | ○ | ○ | × | ○ | ○ | ○ | ○ |
| 247 | ○ | ○ | ○ | × | ○ | ○ | ○ | ○ | ○ | ○ | ○ | × | ○ | ○ | ○ | ○ |
| 248 | × | × | × | ○ | ○ | ○ | ○ | ○ | × | × | × | ○ | ○ | ○ | ○ | ○ |
| 249 | ○ | × | × | ○ | ○ | ○ | ○ | ○ | ○ | × | × | ○ | ○ | ○ | ○ | ○ |
| 250 | × | ○ | × | ○ | ○ | ○ | ○ | ○ | × | ○ | × | ○ | ○ | ○ | ○ | ○ |
| 251 | ○ | ○ | × | ○ | ○ | ○ | ○ | ○ | ○ | ○ | × | ○ | ○ | ○ | ○ | ○ |
| 252 | × | × | ○ | ○ | ○ | ○ | ○ | ○ | × | × | ○ | ○ | ○ | ○ | ○ | ○ |
| 253 | ○ | × | ○ | ○ | ○ | ○ | ○ | ○ | ○ | × | ○ | ○ | ○ | ○ | ○ | ○ |
| 254 | × | ○ | ○ | ○ | ○ | ○ | ○ | ○ | × | ○ | ○ | ○ | ○ | ○ | ○ | ○ |
| 255 | ○ | ○ | ○ | ○ | ○ | ○ | ○ | ○ | ○ | ○ | ○ | ○ | ○ | ○ | ○ | ○ |

○ : Lighted
× : Not Lighted

FIG. 21

Gamma-corrected 5-bit Disply 6-bit Display

| | | SFG1 | | | | | | SFG2 | | | | | |
|---|---|---|---|---|---|---|---|---|---|---|---|---|---|
| | | SF11 | | SF12 | | SF13 | | SF21 | | SF22 | | SF23 | |
| | | 0.5 | | 2 | | 8 | | 0.5 | | 2 | | 8 | |
| | | SP1 | SP2 | SP1 | SP2 | SP1 | SP2 | SP1 | SP2 | SP1 | SP2 | SP1 | SP2 |
| | | 1 | 2 | 1 | 2 | 1 | 2 | 1 | 2 | 1 | 2 | 1 | 2 |
| | | 0.5 | 1 | 2 | 4 | 8 | 16 | 0.5 | 1 | 2 | 4 | 8 | 16 |
| 0 | 0 | × | × | × | × | × | × | × | × | × | × | × | × |
| 1 | 0 | × | × | × | × | × | × | × | × | × | × | × | × |
| 2 | 0 | × | × | × | × | × | × | × | × | × | × | × | × |
| 3 | 0 | × | × | × | × | × | × | × | × | × | × | × | × |
| 4 | 1 | ○ | × | × | × | × | × | ○ | × | × | × | × | × |
| 5 | 1 | ○ | × | × | × | × | × | ○ | × | × | × | × | × |
| 6 | 2 | × | ○ | × | × | × | × | × | ○ | × | × | × | × |
| 7 | 2 | × | ○ | × | × | × | × | × | ○ | × | × | × | × |
| 8 | 3 | ○ | ○ | × | × | × | × | ○ | ○ | × | × | × | × |
| 9 | 4 | × | × | ○ | × | × | × | × | × | ○ | × | × | × |
| 10 | 5 | ○ | × | ○ | × | × | × | ○ | × | ○ | × | × | × |
| 11 | 6 | × | ○ | ○ | × | × | × | × | ○ | ○ | × | × | × |
| 12 | 8 | × | × | × | ○ | × | × | × | × | × | ○ | × | × |
| 13 | 9 | ○ | × | × | ○ | × | × | ○ | × | × | ○ | × | × |
| 14 | 11 | ○ | ○ | × | ○ | × | × | ○ | ○ | × | ○ | × | × |
| 15 | 13 | ○ | × | ○ | ○ | × | × | ○ | × | ○ | ○ | × | × |
| 16 | 15 | ○ | ○ | ○ | ○ | × | × | ○ | ○ | ○ | ○ | × | × |
| 17 | 17 | ○ | × | × | × | ○ | × | ○ | × | × | × | ○ | × |
| 18 | 19 | ○ | ○ | × | × | ○ | × | ○ | ○ | × | × | ○ | × |
| 19 | 21 | ○ | × | ○ | × | ○ | × | ○ | × | ○ | × | ○ | × |
| 20 | 24 | × | × | × | ○ | ○ | × | × | × | × | ○ | ○ | × |
| 21 | 27 | ○ | ○ | × | ○ | ○ | × | ○ | ○ | × | ○ | ○ | × |
| 22 | 30 | × | ○ | ○ | ○ | ○ | × | × | ○ | ○ | ○ | ○ | × |
| 23 | 33 | ○ | × | × | × | × | ○ | ○ | × | × | × | × | ○ |
| 24 | 36 | × | × | ○ | × | × | ○ | × | × | ○ | × | × | ○ |
| 25 | 39 | ○ | ○ | ○ | × | × | ○ | ○ | ○ | ○ | × | × | ○ |
| 26 | 43 | ○ | ○ | × | ○ | × | ○ | ○ | ○ | × | ○ | × | ○ |
| 27 | 46 | × | ○ | ○ | ○ | × | ○ | × | ○ | ○ | ○ | × | ○ |
| 28 | 50 | × | ○ | × | × | ○ | ○ | × | ○ | × | × | ○ | ○ |
| 29 | 54 | × | ○ | ○ | × | ○ | ○ | × | ○ | ○ | × | ○ | ○ |
| 30 | 59 | ○ | ○ | × | ○ | ○ | ○ | ○ | ○ | × | ○ | ○ | ○ |
| 31 | 63 | ○ | ○ | ○ | ○ | ○ | ○ | ○ | ○ | ○ | ○ | ○ | ○ |

○ : Lighted
× : Not Lighted

FIG. 23

Gamma-corrected 5-bit Disply 6-bit Display

| | | SFG1 | | | | | | SFG2 | | | | | |
|---|---|---|---|---|---|---|---|---|---|---|---|---|---|
| | | SF11 | | SF12 | | SF13 | | SF21 | | SF22 | | SF23 | |
| | | 0.5 | | 2 | | 8 | | 0.5 | | 2 | | 8 | |
| | | SP1 | SP2 | SP1 | SP2 | SP1 | SP2 | SP1 | SP2 | SP1 | SP2 | SP1 | SP2 |
| | | 1 | 2 | 1 | 2 | 1 | 2 | 1 | 2 | 1 | 2 | 1 | 2 |
| | | 0.5 | 1 | 2 | 4 | 8 | 16 | 0.5 | 1 | 2 | 4 | 8 | 16 |
| 0 | 0 | × | × | × | × | × | × | × | × | × | × | × | × |
| 1 | 1 | ○ | × | × | × | × | × | ○ | × | × | × | × | × |
| 2 | 2 | × | ○ | × | × | × | × | × | ○ | × | × | × | × |
| 3 | 3 | ○ | ○ | × | × | × | × | ○ | ○ | × | × | × | × |
| 4 | 4 | × | × | ○ | × | × | × | × | × | ○ | × | × | × |
| 5 | 5 | ○ | × | ○ | × | × | × | ○ | × | ○ | × | × | × |
| 6 | 6 | × | ○ | ○ | × | × | × | × | ○ | ○ | × | × | × |
| 7 | 7 | ○ | ○ | ○ | × | × | × | ○ | ○ | ○ | × | × | × |
| 8 | 8 | × | × | × | ○ | × | × | × | × | × | ○ | × | × |
| 9 | 9 | ○ | × | × | ○ | × | × | ○ | × | × | ○ | × | × |
| 10 | 10 | × | ○ | × | ○ | × | × | × | ○ | × | ○ | × | × |
| 11 | 11 | ○ | ○ | × | ○ | × | × | ○ | ○ | × | ○ | × | × |
| 12 | 12 | × | × | ○ | ○ | × | × | × | × | ○ | ○ | × | × |
| 13 | 13 | ○ | × | ○ | ○ | × | × | ○ | × | ○ | ○ | × | × |
| 14 | 14 | × | ○ | ○ | ○ | × | × | × | ○ | ○ | ○ | × | × |
| 15 | 15 | ○ | ○ | ○ | ○ | × | × | ○ | ○ | ○ | ○ | × | × |
| 16 | 16 | × | × | × | × | ○ | × | × | × | × | × | ○ | × |
| 17 | 17 | ○ | × | × | × | ○ | × | ○ | × | × | × | ○ | × |
| 18 | 19 | ○ | ○ | × | × | ○ | × | ○ | ○ | × | × | ○ | × |
| 19 | 21 | ○ | × | ○ | × | ○ | × | ○ | × | ○ | × | ○ | × |
| 20 | 24 | × | × | × | ○ | ○ | × | × | × | × | ○ | ○ | × |
| 21 | 27 | ○ | ○ | × | ○ | ○ | × | ○ | ○ | × | ○ | ○ | × |
| 22 | 30 | × | ○ | ○ | ○ | ○ | × | × | ○ | ○ | ○ | ○ | × |
| 23 | 33 | ○ | × | × | × | × | ○ | ○ | × | × | × | × | ○ |
| 24 | 36 | × | × | ○ | × | × | ○ | × | × | ○ | × | × | ○ |
| 25 | 39 | ○ | ○ | ○ | × | × | ○ | ○ | ○ | ○ | × | × | ○ |
| 26 | 43 | ○ | ○ | × | ○ | × | ○ | ○ | ○ | × | ○ | × | ○ |
| 27 | 46 | × | ○ | ○ | ○ | × | ○ | × | ○ | ○ | ○ | × | ○ |
| 28 | 50 | × | ○ | × | × | ○ | ○ | × | ○ | × | × | ○ | ○ |
| 29 | 54 | × | ○ | ○ | × | ○ | ○ | × | ○ | ○ | × | ○ | ○ |
| 30 | 59 | ○ | ○ | × | ○ | ○ | ○ | ○ | ○ | × | ○ | ○ | ○ |
| 31 | 63 | ○ | ○ | ○ | ○ | ○ | ○ | ○ | ○ | ○ | ○ | ○ | ○ |

○ : Lighted
× : Not Lighted a
b
c
d
θ
4701
4702
4703a
4703b
4721a
4721b
4704
4705
4751a
4751b
4710a
4710b 4721a
4721b
4703a
4703b
4704
4701
a
b 4721a
4703a
4704
4701
c
d 4723
a
b 4723
c
d 4705
4710a
4710b
a
b 4705
4710a
c
d θ
4701
4702
4703a
4703b
4704
4705
4710a
4710b
4724
a
b
c
d 4725b
4725a
4701b
4702
4703a
4701
a
b 4726
a
b 4704
a
b 4705
4710b
4710a
a
b 4725a
4703a
4702
4701
c
d 4726
c
d 4704
c
d 4705
4752b
4752a
4710a
c
d a
b
c
d
4701
4702
4703a
4703b
4704
4705
4710a
4710b
4727a

-- PRIOR ART --

Pixel A:
Gray Scale: 127

Pixel B:
Gray Scale: 128

Pixel A:
Gray Scale: 127

Pixel B:
Gray Scale 128

-- PRIOR ART --

-- PRIOR ART --

DISPLAY DEVICE AND DRIVING METHOD THEREOF

BACKGROUND OF THE INVENTION

1. Field of the Invention

The present invention relates to a display device and a driving method thereof. In particular, the present invention relates to a display device to which an area gray scale method is applied and a driving method thereof.

2. Description of the Related Art

In recent years, a so-called self-luminous type display device having a pixel that is formed of a light emitting element such as a light emitting diode (LED) has been attracting attention. As a light emitting element used for such a self-luminous type display device, an organic light emitting diode (OLED) (also called an organic EL element, an electro luminescence: EL element, and the like) has been drawing attention and used for an EL display. Since a light emitting element such as an OLED is a self-luminous type, it has advantages such as higher visibility of pixels than that of a liquid crystal display, and fast response without requiring a backlight. The luminance of a light emitting element is controlled by a current value flowing through the light emitting element.

As a driving method for controlling a light emitting gray scale of such a display device, there are a digital gray scale method and an analog gray scale method. In accordance with the digital gray scale method, a light emitting element is turned on/off in a digital manner to express a gray scale. Meanwhile, the analog gray scale method includes a method for controlling the light emission intensity of a light emitting element in an analog manner and a method for controlling the light emitting period of a light emitting element in an analog manner.

In the case of the digital gray scale method, there are only two states: a light emitting state and a non-light emitting state. Therefore, only two gray scales can be expressed if nothing is done. Accordingly, another method is used in combination to achieve multiple gray scales. An area gray scale method and a time gray scale method are often used as a method for multiple gray scales.

The area gray scale method is a method for expressing a gray scale by controlling an area of a lighting portion. In other words, gray scale display is performed by dividing one pixel into a plurality of sub-pixels and controlling the number or area of lighted sub-pixels (for example, see Reference 1: Japanese Patent Application Laid-Open No. H11-73158 and Reference 2: Japanese Patent Application Laid-Open No. 2001-125526). In the area gray scale method, the number of the sub-pixels cannot be increased; therefore, it is difficult to realize high-definition and multiple gray scales. This can be given as a disadvantage of the area gray scale method.

The time gray scale method is a method for expressing a gray scale by controlling the length of a light emitting period or the frequency of light emission. In other words, one frame is divided into a plurality of sub-frames, each of which is weighted with respect to the number of light emissions and a light emitting period, and then the total weight (the sum of the frequency of light emission and the sum of the light emitting period) is differentiated for each gray scale, thereby expressing a gray scale. It is known that display failure such as a pseudo contour (or a false contour) may occur when such a time gray scale method is used and measures against the failure is considered (for example, see Reference 3: Patent Publication No. 2903984, Reference 4: Patent Publication No. 3075335, Reference 5: Patent Publication No. 2639311, Reference 6: Patent Publication No. 3322809, Reference 7: Japanese Patent Application Laid-Open No. H10-307561, Reference 8: Patent Publication No. 3585369, and Reference 9: Patent Publication No. 3486884).

However, even though various methods for reducing pseudo contour have been suggested, an effect of sufficiently reducing pseudo contour has not been obtained.

For example, FIG. 1 in Reference 4 is referred to, and it is assumed that a gray scale of 127 is expressed in a pixel A and a gray scale of 128 is expressed in a pixel B adjacent to the pixel A. A light emitting state and a non-light emitting state in each sub-frame of this case are shown in FIGS. 60A and 60B. For example, FIG. 60A shows a case of seeing only the pixel A or the pixel B without turning one's eyes away. A pseudo contour is not caused in this case. This is because one's eyes sense the brightness according to the sum of the brightness of the place where one's line of sight passes. Thus, eyes sense the gray scale of the pixel A to be 127 (=1+2+4+8+16+32+32+32), and eyes sense the gray scale of the pixel B to be 128 (=32+32+32+32). In other words, eyes sense an accurate gray scale.

On the other hand, FIG. 60B shows a case where a line of sight is moved from the pixel A to the pixel B or from the pixel B to the pixel A. In this case, a gray scale is at times perceived to be 96 (=32+32+32), and at other times the gray scale is perceived to be 159 (=1+2+4+8+16+32+32+32+32) depending on a movement of the line of sight. Even though the gray scale is supposed to be perceived as 127 and 128, the gray scale is perceived to be 96 or 159, and pseudo contour occurs.

FIGS. 60A and 60B show a case of 8-bit gray scale (256 gray scales). Next, FIG. 61 shows a case of 6-bit gray scale (64 gray scales). In this case also, eyes sometimes sense the gray scale to be 16 (=16), and sometimes sense the gray scale to be 47 (=1+2+4+8+16+16) in accordance with eyes' movement. Although the eyes are supposed to sense the gray scales to be 31 and 32, they sense the gray scales to be 16 or 47. Consequently, a pseudo contour is caused.

SUMMARY OF THE INVENTION

In this manner, with only a conventional area gray scale method, realizing high-definition and multiple gray scales is difficult, and with only a conventional time gray scale method, pseudo contour occurs; therefore, degradation of image quality cannot be sufficiently suppressed.

In view of such problems, it is an object of the present invention to provide a display device structured of few sub-frames, where pseudo contour can be reduced and where multiple gray scales are possible as well, and a driving method using the display device.

One feature of the present invention is a driving method of a display device including a plurality of pixels each including m (m is an integer of $m \geqq 2$) sub-pixels which are each provided with a light emitting element, in which an area ratio of the m sub-pixels is set to be $2^0:2^1:2^2:\ldots:2^{m-3}:2^{m-2}:2^{m-1}$. Also, one frame is provided with k (k is an integer of $k \geqq 2$) sub-frame groups each including a plurality of sub-frames in a lighting period of each of the m sub-pixels, and n (n is an integer of $n \geqq 2$) sub-frames are provided in each of the k sub-frame groups so that a ratio of lengths of the lighting periods is $2^0:2^m:2^{2m}:\ldots:2^{(n-3)}m:2^{(n-2)}m:2^{(n-1)m}$. Further, sub-frames having the same lighting period length in the k sub-frame groups are set so that appearance orders thereof are approximately the same, and a gray scale of the pixel is expressed by selecting a lighting state or a non-lighting state of the m sub-pixels in the sub-frame.

One feature of the present invention is a driving method of a display device including a plurality of pixels each including m (m is an integer of m≧2) sub-pixels which are each provided with a light emitting element, in which an area ratio of the m sub-pixels is set to be $2^0:2^1:2^2:\ldots:2^{m-3}:2^{m-2}:2^{m-1}$. Also, one frame is provided with k (k is an integer of k≧2) sub-frame groups each including a plurality of sub-frames in a lighting period of each of the m sub-pixels, and the one frame is divided into n (n is an integer of n≧2) first sub-frames of which a ratio of lighting period lengths is $2^0:2^m:2^{2m}:\ldots:2^{(n-3)}m:2^{(n-2)}m:2^{(n-1)m}$. Further, each of the n first sub-frames is divided into k second sub-frames having a lighting period length of about 1/k of the first sub-frame, and each of the k second sub-frames having the same lighting period length obtained by dividing each of the n first sub-frames is placed in each of the k sub-frame groups so that appearance orders thereof are approximately the same. Furthermore, a gray scale of the pixel is expressed by selecting a lighting state or a non-lighting state of the m sub-pixels in each of the second sub-frames.

One feature of the present invention is a driving method of a display device including a plurality of pixels each including m (m is an integer of m≧2) sub-pixels which are each provided with a light emitting element, in which an area ratio of the m sub-pixels is set to be $2^0:2^1:2^2:\ldots:2^{m-3}:2^{m-2}:2^{m-1}$. Also, one frame is provided with k (k is an integer of k≧2) sub-frame groups each including a plurality of sub-frames in a lighting period of each of the m sub-pixels, and the one frame is divided into n (n is an integer of n≧2) first sub-frames of which a ratio of lighting period lengths is $2^0:2^m:2^{2m}:\ldots:2^{(n-3)}m:2^{(n-2)m}:2^{(n-1)m}$. Further, at least one first sub-frame of the n first sub-frames is divided into (a×k) second sub-frames having a lighting period length that is about 1/(a×k) (a is an integer of a≧2) of the first sub-frame, and a of the (a×k) second sub-frames obtained by dividing each of the n first sub-frames are placed in each of the k sub-frame groups. Each of the remaining first sub-frames of the n first sub-frames is divided into k second sub-frames each having a lighting period length that is about 1/k of the first sub-frame, and each of the k second sub-frames obtained by dividing each of the remaining first sub-frames is placed in each of the k sub-frame groups. Furthermore, each of the second sub-frames divided and placed having the same lighting period length is placed in each of the k sub-frame groups so that appearance orders thereof are approximately the same, and a gray scale of the pixel is expressed by selecting a lighting state or a non-lighting state of the m sub-pixels in each of the second sub-frames.

Note that in the present invention, a sub-frame of which a lighting period is divided into (a×k) may be a sub-frame having the longest lighting period in the n sub-frames.

Note that in the present invention, in each of the k sub-frame groups, lighting periods of the sub-frames included in each sub-frame group may be arranged in an ascending or descending order.

Note that, when a gray scale is a low gray scale, luminance of a pixel and the gray scale may have a linear relationship, and when the gray scale is a high gray scale, luminance of the pixel and the gray scale may have a non-linear relationship.

One feature of the present invention is a display device carrying out the driving method of the present invention, in which each of the m sub-pixels includes a light emitting element, a signal line, a scanning line, a first power supply line, a second power supply line, a selection transistor, and a driving transistor. A first electrode of the selection transistor is electrically connected to the signal line, and a second electrode thereof is electrically connected to a gate electrode of the driving transistor. A first electrode of the driving transistor is electrically connected to the first power supply line. Also, a first electrode of the light emitting element is electrically connected to a second electrode of the driving transistor, and a second electrode thereof is connected to the second power supply line.

Note that in the display device of the present invention, the signal line, the scanning line, or the first power supply line may be shared by the m sub-pixels.

Note that in the display device of the present invention, the number of the signal lines included in a pixel may be 2 or more and m or less, and the selection transistor included in any one sub-pixel of the m sub-pixels may be electrically connected to the signal line different from that connected to the selection transistor included in another sub-pixel.

Note that in the display device of the present invention, the number of the scanning lines included in a pixel may be 2 or more, and the selection transistor included in any one sub-pixel of the m sub-pixels may be electrically connected to the scanning line different from that connected to the selection transistor included in another sub-pixel.

Note that in the display device of the present invention, the number of the first power supply lines included in a pixel may be 2 or more and m or less, and the driving transistor included in any one sub-pixel of the m sub-pixels may be electrically connected to the first power supply line different from that connected to the driving transistor included in another sub-pixel.

Here, a sub-frame group refers to a group including a plurality of sub-frames. In a case of providing a plurality of sub-frame groups in one frame, there is no limit to the number of sub-frames included in each sub-frame group. However, it is desirable that the number of sub-frames included in each of the sub-frame groups be approximately equal. In addition, there is no limit to a lighting period length of each sub-frame group. However, it is desirable that the lighting period length of each of the sub-frame groups be approximately equal.

Note that dividing a sub-frame means dividing a lighting period length of a sub-frame.

Note that, in the present invention, one pixel shows one color element. Therefore, in a case of a color display device including color elements of R (red), G (green), and B (blue), a minimum unit of an image includes three pixels of R, G, and B. Note that the color element is not limited to three colors and three or more colors may be used, or a color other than RGB may also be used. For example, RGBW may be employed by adding white (W). In addition, RGB may be added with one or more of yellow, cyan, magenta, and the like, for example. Moreover, for example, as for at least one color of RGB, a similar color may be added. For example, R, G, B1, and B2 may be used. Both B1 and B2 are blue but have different wavelengths. By using such a color element, it is possible to perform display that is much more lifelike and to reduce power consumption. Note that for one color element, a plurality of regions may be used to control brightness. In this case, one color element is one pixel, and each region controlling the brightness is a sub-pixel. Therefore, when an area gray scale method is carried out for example, there is a plurality of regions for controlling brightness per one color element and all of the regions as a whole express a gray scale, and each region controlling the brightness is a sub-pixel. Therefore, in that case, one color element includes a plurality of sub-pixels. Also, in that case, depending on the sub-pixel, there is a case where a size of a region contributing to display is different. Further, in a plurality of regions controlling brightness in one color element, in other words, in a plurality of sub-pixels included in one color element, a viewing angle may be widened by slightly varying a signal supplied to each sub-pixel.

Note that the present invention includes a case where pixels are arranged (aligned) in a matrix form. Herein, "pixels are arranged (aligned) in a matrix form" includes a case where pixels are arranged over a straight line in a vertical direction or a horizontal direction, as well as a case where they are not. Therefore, when performing a full color display with for example three color elements (for example, R, G, and B), a case where dots of the three color elements have a stripe arrangement or a so-called delta arrangement is also included. Further, a case of Bayer arrangement is included as well.

Note that in the present invention, transistors of a variety of modes can be applied. Therefore, there is no restriction on a type of transistor that can be applied. Therefore, for example, a thin film transistor (TFT) or the like having a non-single crystalline semiconductor film typified by amorphous silicon or polycrystalline silicon can be applied. Accordingly, the transistor can be manufactured even if a manufacturing temperature is not high, the transistor can be manufactured at low cost, the transistor can be manufactured over a large substrate, the transistor can be manufactured over a transparent substrate, the transistor can be manufactured to allow transmission of light, and the transistor can be used to control light transmission of a display element. Also, a MOS transistor, a junction transistor, a bipolar transistor, or the like formed using a semiconductor substrate or an SOI substrate can be applied. With these, a transistor with little variation can be manufactured; a transistor with a high current supply capacity can be manufactured; a transistor with a small size can be manufactured; and a circuit with low power consumption can be configured. Further, a transistor having a compound semiconductor such as ZnO, a-InGaZnO, SiGe, and GaAs can be applied, as well as a thin film transistor obtained by thinning the transistor. With these, the transistor can be manufactured even if a manufacturing temperature is not high; the transistor can be manufactured at room temperature; and the transistor can be formed directly on, for example, a plastic substrate or a film substrate. Furthermore, a transistor or the like formed using ink-jet deposition or a printing method can be applied. With these, the transistor can be manufactured at room temperature; the transistor can be formed in a state with low vacuum; and the transistor can be manufactured with a large substrate. Also, since the transistor can be manufactured without using a mask (a reticle), a layout of the transistor can be changed easily. Further, a transistor having an organic semiconductor or a carbon nanotube, or another transistor can be applied. With these, the transistor can be formed over a substrate that can be bent. Note that hydrogen or halogen may be included in a non-single crystalline semiconductor film. Further, a substrate over which the transistor is placed can be of a variety of types, and it is not limited to a specific type. Therefore, for example, the transistor can be placed over a single crystalline substrate, an SOI substrate, a glass substrate, a quartz substrate, a plastic substrate, a paper substrate, a cellophane substrate, a stone substrate, a stainless steel substrate, a substrate having stainless steel foil, or the like. Alternatively, the transistor may be formed over a certain substrate, and then moved to another substrate, and placed over the other substrate. By using these substrates, a transistor with a good property can be formed, a transistor with low power consumption can be formed, a device can be made so as not to break easily, and a device can be formed so as have resistance to heat.

Note that, in the present invention, "connected" is synonymous to being electrically connected. Therefore, in a structure disclosed in the present invention, another element (for example, another element or a switch) capable of electrical connection may be placed in addition to a prescribed relation of connection therebetween.

Note that, as for a switch shown in the present invention, switches of various modes can be used. As an example, there is an electrical switch, a mechanical switch, or the like. In other words, the switches are not particularly limited and various switches can be used as long as current flow can be controlled. For example, the switches may be a transistor, a diode (for example, a PN diode, a PIN diode, a Schottky diode, a diode-connected transistor, or the like), a thyristor, or a logic circuit that is a combination thereof. Thus, in a case of using a transistor as the switch, the transistor operates as a mere switch; therefore, the polarity (conductivity type) of the transistor is not particularly limited. However, in a case where smaller off-current is desired, it is desirable to use a transistor having a polarity with smaller off-current. As the transistor with small off-current, a transistor provided with an LDD region, a transistor having a multi-gate structure, or the like can be used. In addition, it is desirable to use an N-channel transistor when a transistor to be operated as a switch operates in a state where the potential of a source terminal thereof is close to a lower potential side power supply (such as VSS, GND, or 0 V), whereas it is desirable to use a P-channel transistor when a transistor operates in a state where the potential of a source terminal thereof is close to a higher potential side power supply (such as VDD). This is because the absolute value of a gate-source voltage can be increased, and the transistor easily operates as a switch. Note that the switch may be of a CMOS type using both the N-channel transistor and the P-channel transistor. When the CMOS-type switch is employed, current can flow when either the p-channel switch or the N-channel switch is brought into a conductive state, and this makes it easier to function as the switch. For example, voltage can be outputted appropriately even when a voltage of an input signal to the switch is high, or low. Further, since a voltage amplitude value of a signal for turning on/off the switch can be reduced, power consumption can also be reduced.

Note that, in the present invention, the description of something formed "over" a certain object, as in "formed over . . . " does not necessarily mean that it has direct contact with the certain object. This includes a case where there is no direct contact, that is, a case where another object is sandwiched therebetween. Therefore, for example, a case where a layer B is formed over a layer A includes a case where the layer B is formed over the layer A so as to be in direct contact with the layer A, as well as a case where another layer (for example, a layer C, a layer D, or the like) is formed over the layer A so as to be in direct contact with the layer A and the layer B is formed thereover to be in direct contact the other layer. Note that the same applies to the description "under," which includes a case where there is direct contact and a case where there is no direct contact.

Note that, in the present invention, a semiconductor device refers to a device having a circuit including a semiconductor element (a transistor, a diode, or the like). In addition, a semiconductor device may also refer to devices in general that can function by utilizing semiconductor characteristics. Moreover, a display device refers to a device having a display element (a liquid crystal element, a light emitting element, or the like). Note that a display device may also refer to a display panel body where a plurality of pixels, each including a display element such as a liquid crystal element or an EL element, or a peripheral driver circuit for driving these pixels is formed over a substrate. Further, a display device may also include one with a flexible printed circuit (FPC) or a printed wiring board (PWB) (such as an IC, a resistance element, a capacitor element, an inductor, or a transistor). Furthermore, a display device may also include an optical sheet such as a polarizing plate or a phase plate. A display device may also include a back light (may include a light guide plate, a prism sheet, a diffusion sheet, a reflecting sheet, or a light source (such as an LED or a cold-cathode tube)).

Note that a display device of the present invention may be of various modes or may include various display elements. For example, a display medium in which contrast varies by an electromagnetic action, such as an EL element (such as an organic EL element, an inorganic EL element, or an EL element containing an organic material and an inorganic material), an electron-emitting element, a liquid crystal element, electronic ink, a grating light valve (GLV), a plasma display (PDP), a digital micromirror device (DMD), a piezoelectric ceramic display, or a carbon nanotube can be applied. Note that an EL display is used as a display device using the EL element; a field emission display (FED), an SED (Surface-conduction Electron-emitter Display) type flat display, or the like is used as a display device using the electron-emitting element; a liquid crystal display, a transmissive liquid crystal display, a semi-transmissive liquid crystal display, or a reflective liquid crystal display is used as a display device using the liquid crystal element; and electronic paper is used as a display device using electronic ink.

Note that a light emitting element in this specification refers to an element of display elements, which is capable of controlling luminance depending on a current value flowing in the element. Typically, the light emitting element refers to an EL element. Other than an EL element, an electron-emitting element is also included as the light emitting element.

Note that in this specification, a case of having a light emitting element as a display element is mainly described as an example; however the display element is not limited to the light emitting element in the content of the present invention. A variety of display elements as shown above can be applied.

According to the present invention, it is possible to reduce a pseudo contour and to perform multiple gray scales as well by combining an area gray scale method and a time gray scale method. Therefore, it becomes possible to improve display quality and to view a clear image. In addition, it is possible to improve a duty ratio (a ratio of a lighting period per one frame) than a conventional time gray scale method, and voltage applied to a light emitting element is reduced. Thus, power consumption can be reduced, and deterioration of the light emitting element can be suppressed.

BRIEF DESCRIPTION OF DRAWINGS

In the accompanying drawings:

FIG. 1 shows an example of a selection method of a sub-frame and a sub-pixel according to a driving method of the present invention;

FIG. 3 shows an example of a selection method of a sub-frame and a sub-pixel according to a driving method of the present invention;

FIG. 5 shows an example of a selection method of a sub-frame and a sub-pixel according to a driving method of the present invention;

FIG. 7 shows an example of a selection method of a sub-frame and a sub-pixel according to a driving method of the present invention;

FIG. 9 shows an example of a selection method of a sub-frame and a sub-pixel according to a driving method of the present invention;

FIG. 11 shows an example of a selection method of a sub-frame and a sub-pixel according to a driving method of the present invention;

FIG. 13 shows an example of a selection method of a sub-frame and a sub-pixel according to a driving method of the present invention;

FIG. 15 shows an example of a selection method of a sub-frame and a sub-pixel according to a driving method of the present invention;

FIG. 17 shows an example of a selection method of a sub-frame and a sub-pixel according to a driving method of the present invention;

FIG. 18 shows an example of a selection method of a sub-frame and a sub-pixel according to a driving method of the present invention;

FIG. 19 shows an example of a selection method of a sub-frame and a sub-pixel according to a driving method of the present invention;

FIG. 20 shows an example of a selection method of a sub-frame and a sub-pixel according to a driving method of the present invention;

FIG. 21 shows an example of a selection method of a sub-frame and a sub-pixel in a case of performing gamma correction according to a driving method of the present invention;

FIG. 23 shows an example of a selection method of a sub-frame and a sub-pixel in a case of performing gamma correction according to a driving method of the present invention;

FIGS. 48A-1 to 48D-2 each describe a manufacturing method of a transistor used in a display device of the present invention;

FIGS. 49A-1 to 49C-2 each describe a manufacturing method of a transistor used in a display device of the present invention;

FIGS. 50A-1 to 50D-2 each describe a manufacturing method of a transistor used in a display device of the present invention;

FIGS. 51A-1 to 51D-2 each describes a manufacturing method of a transistor used in a display device of the present invention;

FIGS. 52A-1 to 52D-2 each describe a manufacturing method of a transistor used in a display device of the present invention;

FIGS. 53A-1 to 53B-2 each describe a manufacturing method of a transistor used in a display device of the present invention;

DETAILED DESCRIPTION OF THE INVENTION

Embodiment Mode

Figure 2:
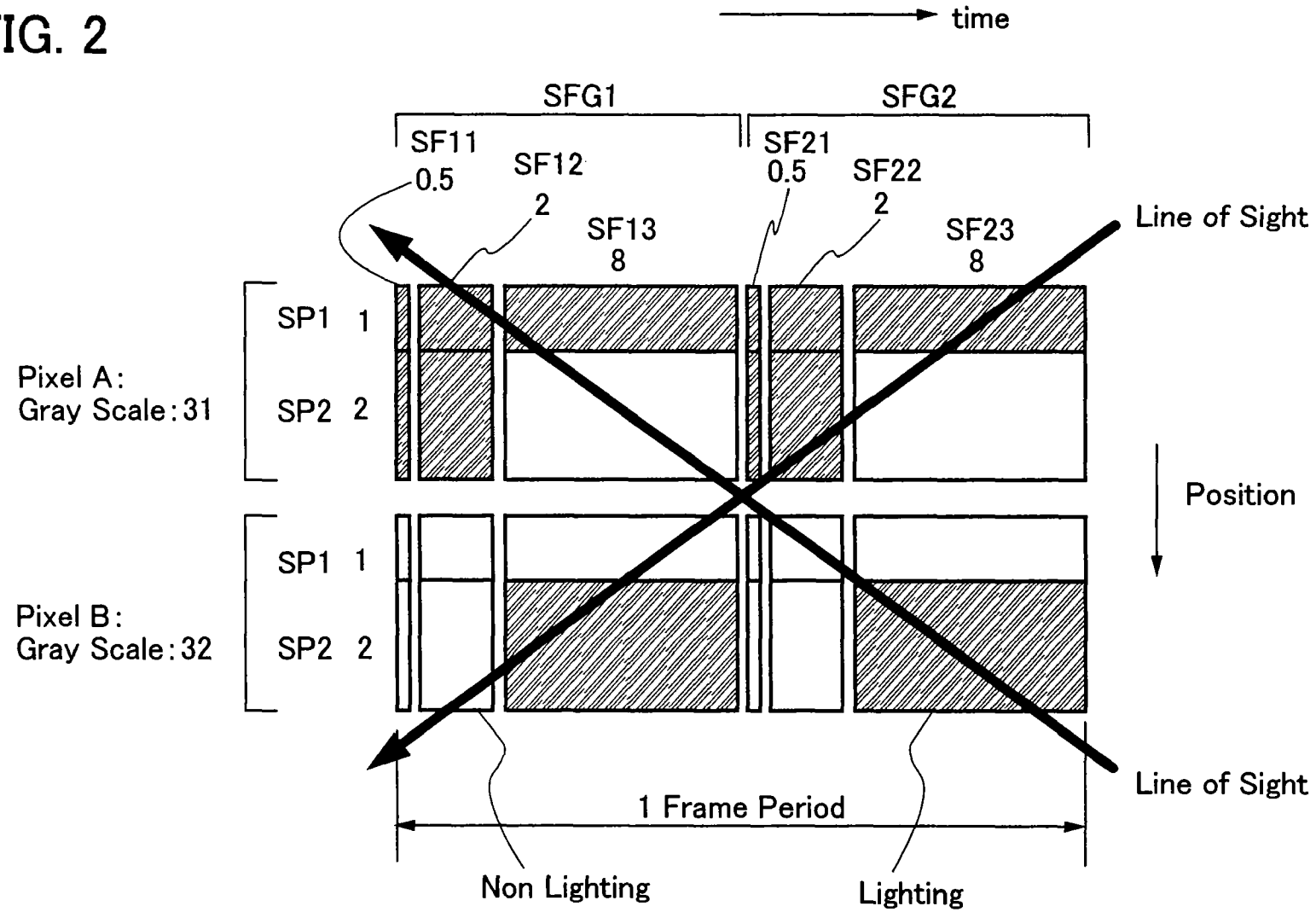
FIG. 2 shows an effect of pseudo contour reduction according to a driving method of the present invention.

Embodiment modes of the present invention will be explained below with reference to the drawings. However, it is to be easily understood that various changes and modifications will be apparent to those skilled in the art. Therefore, unless such changes and modifications depart from the scope of the present invention, they should be construed as being included therein.

Embodiment Mode 1

In this embodiment mode, an example of applying a driving method of the present invention to a case of a 6-bit display (64 gray scales) is described.

The driving method of this embodiment mode is a combination of an area gray scale method by which a gray scale is expressed by dividing one pixel into a plurality of sub-pixels and controlling the number or area of lighted sub-pixels, and a time gray scale method by which a gray scale is expressed by dividing one frame into a plurality of sub-frames, each of which is weighted with respect to the number of light emissions and a light emitting period, and then the total weight is differentiated for each gray scale. In other words, one pixel is divided into m sub-pixels so that the m sub-pixels have an area ratio of $2^0:2^1:2^2:\ldots:2^{m-3}:2^{m-2}:2^{m-1}$. In addition, k sub-frame groups (k is an integer of $k \geqq 2$) including a plurality of sub-frames are provided in one frame, along with dividing one frame into n sub-frames so that a ratio of a length of a lighting period of the n sub-frames is $2^0:2^m:2^{2m}:\ldots:2^{(n-3)m}:2^{(n-2)m}:2^{(n-1)m}$. Further, each of the n sub-frames is divided into k sub-frames each having a lighting period length that is about 1/k of a lighting period length of each of the n sub-frames, and one of these sub-frames is placed in each of the k sub-frame groups. At this time, the sub-frame is arranged in each of the k sub-frame groups so that an appearance order is about the same. Then, a gray scale is expressed by controlling lighting or non-lighting in each of the m sub-pixels in each of the n sub-frames.

First, an expression method of each gray scale, that is, how each sub-pixel is to be lighted in each sub-frame for each gray scale, will be explained. In this embodiment mode, an example of a case is explained, where one pixel is divided into two sub-pixels (SP1 and SP2) so that an area ratio of the sub-pixels is 1:2, along with providing two sub-frame groups (SFG1 and SFG2) in one frame, as well as dividing one frame into three sub-frames (SF1, SF2, and SF3) so that a lighting period ratio of the sub-frames is 1:4:16. Note that in this example, m=2, n=3, and k=2 are satisfied.

Here, the sub-pixels have the following areas: SP1=1 and SP2=2, and the sub-frames have the following lighting periods: SF1=1, SF2=4, and SF3=16.

In this embodiment mode, each of the sub-frames (SF1 to SF3) obtained by dividing one frame into three so that a lighting period ratio is 1:4:16 is further divided into two sub-frames each having a lighting period length that is ½ of the lighting period of each of the sub-frames (SF1 to SF3). In other words, SF1 having a lighting period of 1 is divided into two sub-frames SF11 and SF21 each having a lighting period of 0.5. Similarly, SF2 having a lighting period of 4 is divided into two sub-frames SF12 and SF22 each having a lighting period of 2, and SF3 having a lighting period of 16 is divided into two sub-frames SF13 and SF23 each having a lighting period of 8. Then, SF11, SF12, and SF13 are arranged in the sub-frame group 1 (SFG1), and SF21, SF22, and SF23 are arranged in the sub-frame 2 (SFG2). At this time, appearance order of SF11, SF12, and SF13 in the sub-frame group 1, and appearance order of SF21, SF22, and SF23 in the sub-frame group 2 are to be the same.

Accordingly, each of the two sub-frame groups includes three sub-frames, and lighting periods of the sub-frames are such that SF11=0.5, SF12=2, SF13=8, SF21=0.5, SF22=2, and SF23=8.

Figures 1, 2, 48A, 48B, 48C, 48D:
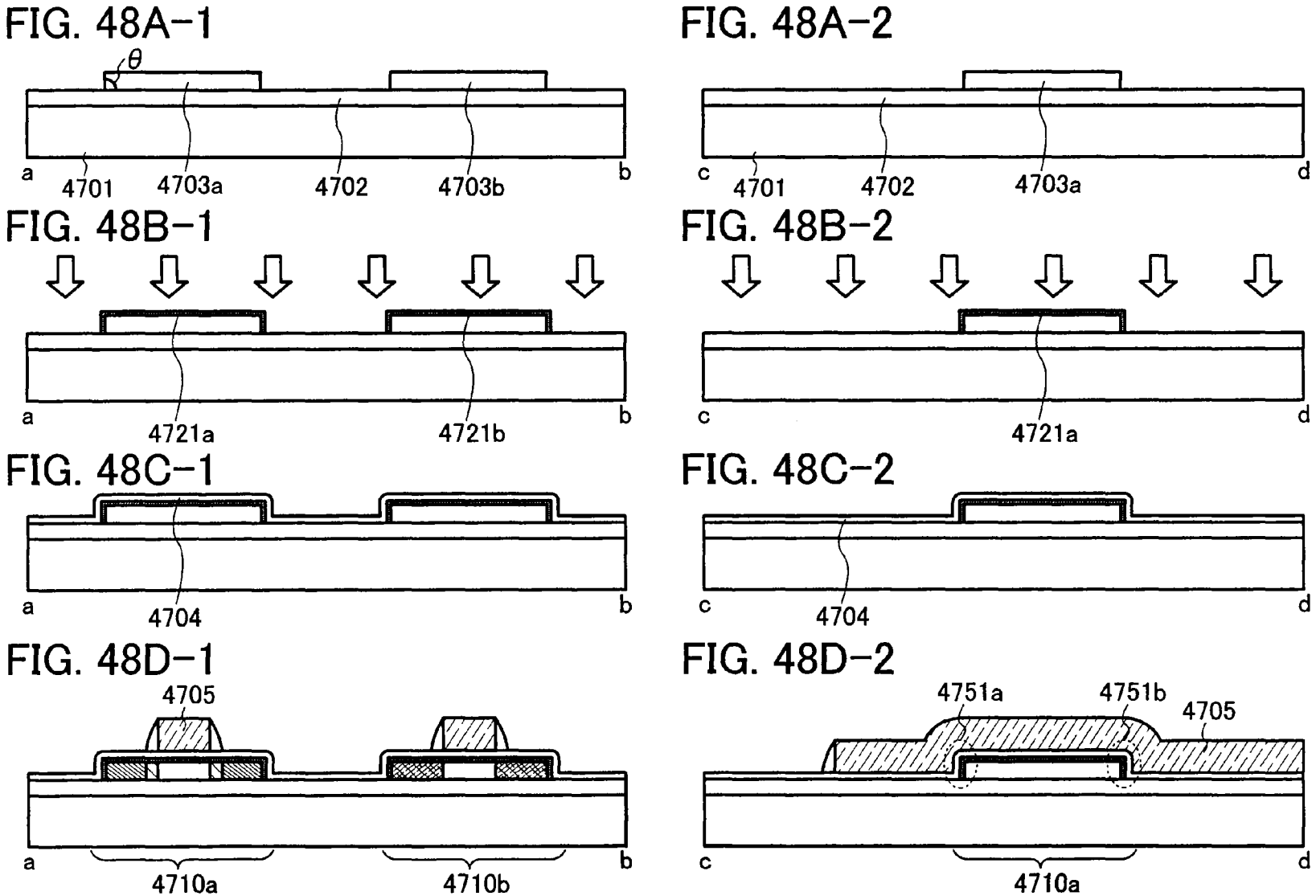

FIG. 1 shows an expression method of each gray scale in this case. Note that, in FIG. 1, in each sub-frame, a sub-pixel marked by "○" indicates that it is lighted, and a sub-pixel marked by "x" indicates that it is not lighted.

In the present invention, it is considered that a product of an area of each sub-pixel and a lighting period of each sub-frame is substantial light emission intensity. For example, in the sub-frame group 1, a light emission intensity of SF11 having a lighting period of 0.5 in a case where only the sub-pixel 1 with an area of 1 is lighted is 1×0.5=0.5, and the light emission intensity in a case where only the sub-pixel 2 with an area of 2 is lighted is 2×0.5=1. Similarly, a light emission intensity of SF12 having a lighting period of 2 in a case where only the sub-pixel 1 is lighted is 2, and the light emission intensity in a case where only the sub-pixel 2 is lighted is 4. Similarly, a light emission intensity of SF13 having a lighting period of 8 in a case where only the sub-pixel 1 is light is 8, and the light emission intensity in a case where only the sub-pixel 2 is lighted is 16. Note that, in the sub-frames included in the sub-frame group 2, the light emission intensity is set in a similar manner. In this manner, depending on a combination of an area of a sub-pixel and a lighting period of a sub-frame, a different light emission intensity can be created, and a gray scale is expressed by this light emission intensity.

Subsequently, an expression method of a gray scale, in other words, an example of a selection method of each sub-frame, is described. In particular, regarding sub-frames of which lighting period lengths are equal, it is desirable that there is the following regularity in selecting the sub-frames.

For example, for the sub-frames SF11 and SF21 each having a lighting period of 0.5, their selection/non-selection states, as well as their lighting/non-lighting states of sub-pixels, are matched. In other words, if SF11 is selected, SF21 is also selected; and if SF11 is not selected, SF21 is also not selected. Also, for example, if the sub-pixel 1 is lighted in SF11, the sub-pixel 1 is also lighted in SF21; and if the sub-pixel 2 is lighted in SF11, the sub-pixel 2 is also lighted in SF21. This is because they are originally the sub-frame having a lighting period of 1, which is divided into SF11 and SF21. Similarly, for the sub-frames SF12 and SF22 each having a lighting period of 2, their selection/non-selection states, as well as their lighting/non-lighting states of sub-pixels, are matched. This is because SF12 and SF22 are originally the sub-frame having a lighting period of 4, which is divided. In a similar manner, for the sub-frames SF13 and SF23 each having a lighting period of 8, their selection/non-selection states, as well as their lighting/non-lighting states of sub-pixels, are matched. This is because SF13 and SF23 are originally the sub-frame having a lighting period of 16, which is divided.

Therefore, for example, in a case of expressing a gray scale of 1, the sub-pixel 1 is lighted in SF11 and SF21. Also, in a case of expressing a gray scale of 2, the sub-pixel 2 is lighted in SF11 and SF21. Further, in a case of expressing a gray scale of 3, the sub-pixel 1 and the sub-pixel 2 are lighted in SF11 and SF21. Furthermore, in a case of expressing a gray scale of 6, the sub-pixel is lighted in SF11 and SF21, and the sub-pixel 1 is lighted in SF12 and SF22. For other gray scales, respective sub-pixels to be lighted are selected for each sub-frame in a similar manner.

As described above, it is possible to express a 6-bit gray scale (64 gray scales) by selection of a sub-pixel to be lighted for each sub-frame.

With the driving method of the present invention, pseudo contour can be reduced. For example, it is assumed that a gray scale of 31 is expressed in a pixel A while a gray scale of 32 is expressed in a pixel B in FIG. 1. FIG. 2 shows a lighting/non-lighting state of each sub-pixel in each sub-frame in that case.

Here, how to interpret FIG. 2 is described. FIG. 2 is a diagram showing the lighting/non-lighting state of a pixel in one frame. A horizontal direction of FIG. 2 indicates time, and a vertical direction indicates a position of the pixel. Further, lengths in a vertical direction of squares shown in FIG. 2 indicate an area ratio of sub-pixels, and lengths in a horizontal direction indicate a length ratio of a lighting period of each sub-frame. Further, an area of each square drawn in FIG. 2 shows a light emission intensity.

For example, when a line of sight is moved, a gray scale is at times perceived to be 26 (=2+8+16), and at other times the gray scale is perceived to be 29 (=16+1+4+8), depending on a movement of the line of sight. Even though the gray scale is supposed to be perceived as 31 and 32, the gray scale is perceived to be 26 or 29, and pseudo contour occurs. However, since gray scale gap is smaller than when a conventional driving method is used, pseudo contour is reduced compared to when the conventional driving method is used.

Note that in this embodiment mode, the lighting period lengths of the sub-frames (SF1, SF2, and SF3) before being divided into the same number of frames as the number of sub-frame groups is 1, 4, and 16, respectively, they are not limited thereto.

Further, in this embodiment mode, each of the three sub-frames (SF1, SF2, and SF3) of which the lighting period ratio is 1:4:16 is further divided into two sub-frames (SF11 to SF23), which is the same number as the number of the sub-frame groups; however, a division number of each sub-frame may be different from the number of the sub-frame groups.

For example, at least one of n sub-frames of which a lighting period ratio is $2^0:2^m:2^{2m}:\ldots:2^{(n-3)m}:2^{(n-2)m}:2^{(n-1)m}$ is divided into (a×k) sub-frames each having a lighting period length that is about 1/(a×k) (a is an integer of a≧2) of the sub-frame, and then a sub-frames are placed in each of the k sub-frame groups. Subsequently, a remaining sub-frame is divided into k sub-frames each having a lighting period length of about 1/k of the sub-frame, and one of these may be provided for each of the k sub-frame groups. In particular, as a sub-frame to be divided into sub-frames each having a lighting period of (a×k), a sub-frame having the longest lighting period among the n sub-frames may be selected.

For example, FIG. 3 shows an example of a case where one pixel is divided into two sub-pixels (SP1 and SP2) so that an area ratio of the sub-pixels is 1:2, along with providing two sub-frame groups (SFG1 and SFG2) in one frame; dividing one frame into three sub-frames (SF1, SF2, and SF3) so that a lighting period ratio is 1:4:16; dividing a sub-frame among them having the longest lighting period of 16 into four sub-frames each having a lighting period length that is ¼ of the sub-frame, and dividing each of the remaining two sub-frames into two sub-frames each having a lighting period length that is ½ of the sub-frame. Note that in this example, m=2, n=3, k=2, and a=2 are satisfied.

Here, the sub-pixels have the following areas: SP1=1 and SP2=2, and the sub-frames have the following lighting periods: SF1=1, SF2=4, and SF3=16.

In FIG. 3, among the three sub-frames obtained by dividing one frame so that a lighting period ratio is 1:4:16, SF3 having the longest lighting period of 16 is divided into four sub-frames SF13, SF14, SF23, and SF24 each having a lighting period length of 4 that is ¼ of the sub-frame. Also, as for the remaining SF1 and SF2, each is further divided into two sub-frames each having a lighting period length that is ½ of the sub-frame. In other words, SF1 having a lighting period of 1 is divided into two sub-frames SF11 and SF21 each having a lighting period of 0.5, and SF2 having a lighting period of 4 is divided into two sub-frames SF12 and SF22 each having a lighting period of 2. Then, SF11, SF12, SF13, and SF14 are arranged in the sub-frame group 1 (SFG1), and SF21, SF22, SF23, and SF24 are arranged in the sub-frame group (SFG2). At this time, appearance order of SF11, SF12, SF13, and SF14 in the sub-frame group 1, and appearance order of SF21, SF22, SF23, and SF24 in the sub-frame group 2 are to be the same.

Accordingly, each of the two sub-frame groups includes four sub-frames, and lighting periods of the sub-frames are such that SF11=0.5, SF12=2, SF13=4, SF14=4, SF21=0.5, SF22=2, SF23=4, and SF24=4.

In FIG. 3, it is considered that a product of an area of each sub-pixel and a lighting period of each sub-frame is substantial light emission intensity. For example, in the sub-frame group 1, a light emission intensity of SF11 having a lighting period of 0.5 in a case where only the sub-pixel 1 with an area of 1 is lighted is 0.5, and the light emission intensity in a case where only the sub-pixel 2 with an area of 2 is lighted is 1. Similarly, a light emission intensity of SF12 having a lighting period of 2 in a case where only the sub-pixel 1 is lighted is 2, and the light emission intensity in a case where only the sub-pixel 2 is lighted is 4. Similarly, a light emission intensity of SF13 and SF14 each having a lighting period of 4 in a case where only the sub-pixel 1 is lighted is 4, and the light emission intensity in a case where only the sub-pixel 2 is lighted is 8. Note that, in the sub-frames included in the sub-frame group 2, the light emission intensity is set in a similar manner. In this manner, depending on a combination of an area of a sub-pixel and a lighting period of a sub-frame, a different light emission intensity can be created, and a 6-bit gray scale (64 gray scales) is expressed by this light emission intensity.

Figure 4:
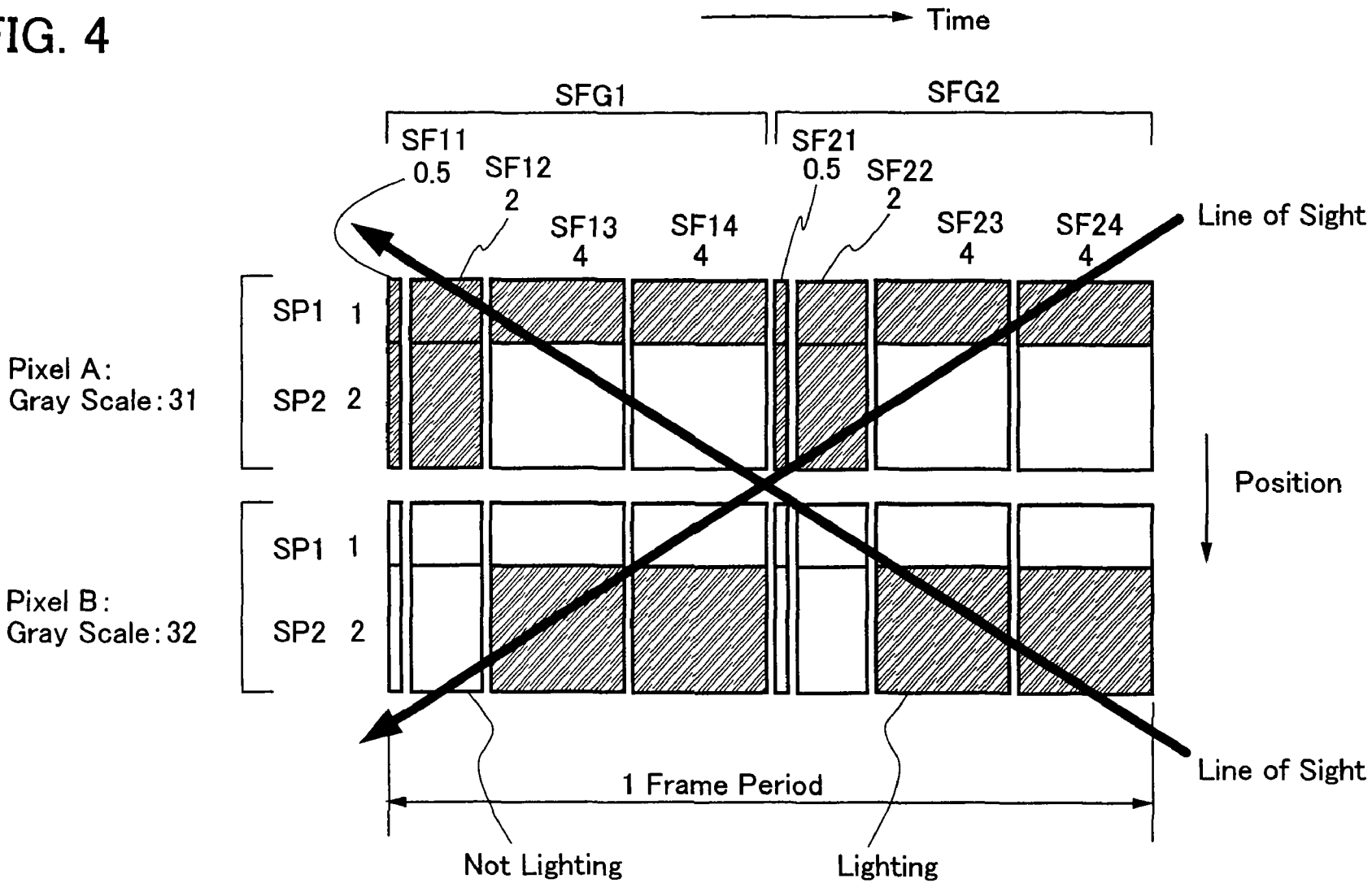
FIG. 4 shows an effect of pseudo contour reduction according to a driving method of the present invention.

With such a driving method shown in FIG. 3, pseudo contour can be reduced. For example, it is assumed that a gray scale of 31 is displayed in a pixel A while a gray scale of 32 is displayed in a pixel B in FIG. 3. FIG. 4 shows a lighting/non-lighting state of each sub-pixel in each sub-frame, in that case. For example, when a line of sight is moved, the gray scale is at times perceived to be 22 (=2+4+8+8), and at other times the gray scale is perceived to be 29 (=8+8+1+4+4+4), depending on a movement of the line of sight. Even though the gray scale is supposed to be perceived as 31 and 32, the gray scale is perceived to be 22 or 29, and pseudo contour occurs. However, since gray scale gap is smaller than when a conventional driving method is used, pseudo contour is reduced compared to when the conventional driving method is used.

In this manner, by reducing a length of a lighting period of each sub-frame or increasing the division number of each sub-frame, eyes are tricked so as to perceive less gray scale gap when the line of sight is moved, compared to the conventional driving method. Therefore, this has a profound effect on reducing pseudo contour. Note that the sub-frame of which a lighting period is further divided into four is not limited to a sub-frame having the longest lighting period.

Note that, by reducing a length of a lighting period of each sub-frame or increasing the division number of each sub-frame, a selection method of a sub-pixel in each sub-frame for expressing the same gray scale is increased. Therefore, the selection method of each sub-pixel in each sub-frame is not limited thereto. For example, in a case of expressing a gray scale of 31, in FIG. 3, the sub-pixel 1 is lighted in SF13, SF14, SF23, and SF24; however, the sub-pixel 2 may be lighted in SF13 and SF23. An example of this case is shown in FIG. 5.

Figure 6:
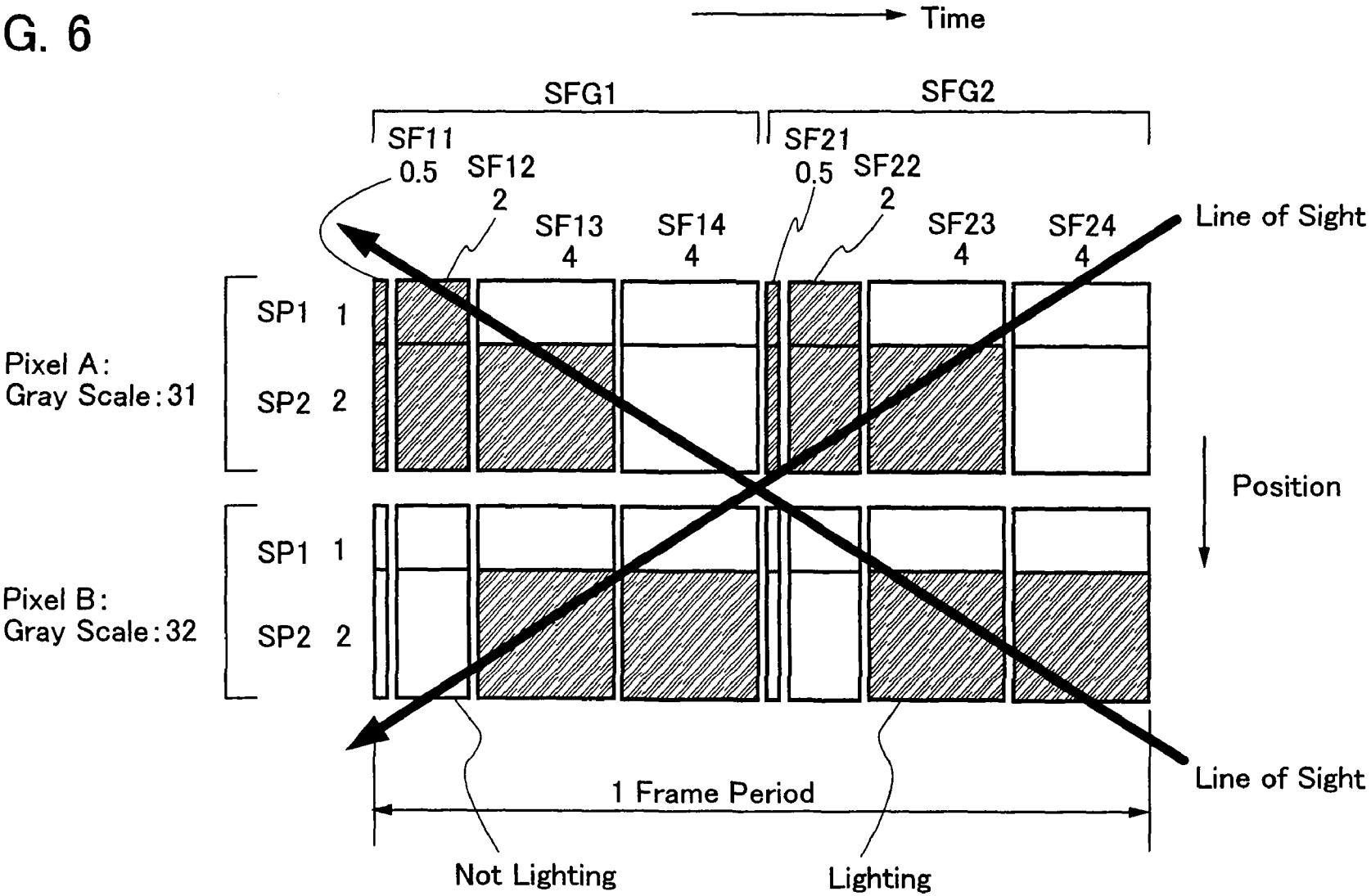
FIG. 6 shows an effect of pseudo contour reduction according to a driving method of the present invention.

Note that by using such a driving method as show in FIG. 5, pseudo contour can be reduced. For example, it is assumed that a gray scale of 31 is displayed in a pixel A, and a gray scale of 32 is displayed in a pixel B in FIG. 5. FIG. 6 shows a lighting/non-lighting state of each sub-pixel in each sub-frame, in that case. For example, when a line of sight is moved, the gray scale is at times perceived to be 26 (=2+8+8+8), and at other times the gray scale is perceived to be 29 (=8+8+1+4+8), depending on a movement of the line of sight. Even though the gray scale is supposed to be perceived as 31 and 32, the gray scale is perceived to be 26 or 29, and pseudo contour occurs. However, since gray scale gap is smaller than when a conventional driving method is used, pseudo contour is reduced compared to when the conventional driving method is used.

Accordingly, it is possible to have a profound effect on reducing pseudo contour by selectively changing a selection method of a sub-pixel in each sub-frame for a gray scale which is especially likely to cause pseudo contour.

Note that a sequence of lighting periods of sub-frames is not limited thereto. For example, the sequence of the lighting periods of the sub-frames in each sub-frame group may be in an ascending order or in a descending order. This is because by having the sequence of the lighting periods of the sub-frames in an ascending order or in a descending order, a gray scale gap when a line of sight is moved can be made to be smaller than when a conventional driving method is used; therefore, pseudo contour can be reduced compared to when the conventional driving method is used.

Alternatively, after the lighting periods of the sub-frames in each sub-frame group are arranged in an ascending order on in a descending order, a sequence of a sub-frame having the longest lighting period and a sub-frame having the second longest lighting period may be switched.

For example, FIG. 7 shows an example where a sequence of a sub-frame having the longest lighting period and a sub-frame having the second longest lighting period in FIG. 5 is switched in each sub-frame group.

In FIG. 7, a sequence of a sub-frame having the longest lighting period of 4 and a sub-frame having the second longest lighting period of 2 in FIG. 5 is switched in each sub-frame group. In other words, in the sub-frame group 1, SF13 having a lighting period of 4 and SF12 having a lighting period of 2 are switched, and in the sub-frame group 2, SF23 having a lighting period of 4 and SF22 having a lighting period of 2 are switched.

Figure 8:
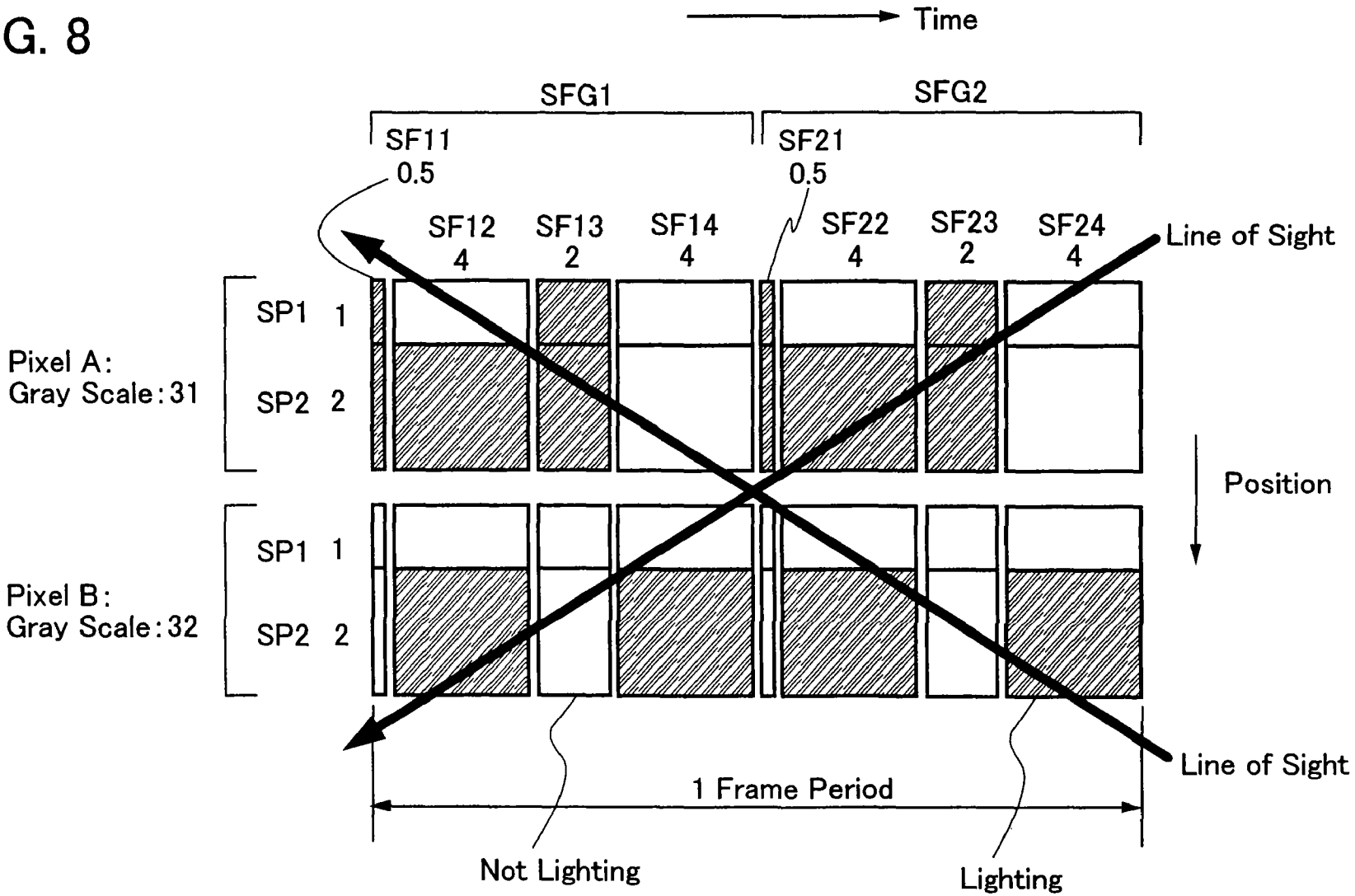
FIG. 8 shows an effect of pseudo contour reduction according to a driving method of the present invention.

Note that by using such a driving method as shown in FIG. 7, pseudo contour can be reduced. For example, it is assumed that a gray scale of 31 is displayed in a pixel A, and a gray scale of 32 is displayed in a pixel B in FIG. 7. FIG. 8 shows a lighting/non-lighting state of each sub-pixel in each sub-frame, in that case. For example, when a line of sight is moved, the gray scale is at times perceived to be 28 (=8+4+8+8), and at other times the gray scale is perceived to be 30 (=8+8+8+4+2), depending on a movement of the line of sight. Even though the gray scale is supposed to be perceived as 31 and 32, the gray scale is perceived to be 28 or 30, and pseudo contour occurs. However, since gray scale gap is smaller than when a conventional driving method is used, pseudo contour is reduced compared to when the conventional driving method is used.

In this manner, by changing the sequence of the lighting periods of the sub-frames, eyes are tricked so as to perceive less gray scale gap when the line of sight is moved. Consequently, pseudo contour can be reduced.

Note that, sub-frames of which their sequence is switched after the lighting periods of the sub-frames in each sub-frame group are arranged in an ascending order or in a descending order, are not limited to the sub-frame having the longest lighting period and the sub-frame having the second longest lighting period. For example, the sub-frame having the longest lighting period and a sub-frame having the third longest lighting period may be switched, or the sub-frame having the second longest lighting period and the sub-frame having the third longest lighting period may be switched.

Note that a length of a lighting period is to be appropriately changed depending on the total of gray scale levels (number of bits), the total number of sub-frames, or the like. Thus, even if the length of the lighting period is the same, if the total of gray scale levels (number of bits) or the total number of sub-frames is changed, there is a possibility that actual length of the lighting period (for example, what μs it is) is changed.

Note that a lighting period is used when a light emitting element is lighted continuously, and a lighting frequency is used when a light emitting element is turned on and off repeatedly in a certain period. A typical display using a lighting frequency is a plasma display, and a typical display using a lighting period is an organic EL display.

Note that in this embodiment mode, although an area ratio of the sub-pixels is 1:2, it is not limited thereto. For example, the sub-pixels may be divided to as to have an area ratio of 1:4, or 1:8.

For example, when the area ratio of the sub-pixels is 1:1, the same light emission intensity is obtained by causing light emission in either sub-pixel in the same sub-frame. Therefore, when the same gray scale is to be expressed, the sub-pixel to emit light may be switched. Accordingly, concentration of light emission in only a specific sub-pixel can be prevented, and burn-in of the pixel can be prevented.

Note that it is possible to express more gray scales with few sub-pixels and few sub-frames by having an area ratio of m sub-pixels be $2^0:2^1:2^2: \ldots :2^{m-3}:2^{m-2}:2^{m-1}$ and having a lighting period of n sub-frames be $2^0:2^m:2^{2m}: \ldots :2^{(n-3)m}:2^{(n-2)m}:2^{(n-1)m}$. In addition, since a gray scale that can be expressed by this method has a constant rate of change, it is possible to display a more smooth gray scale and to improve an image quality.

Note that in this embodiment mode, the number of sub-pixels is two; however, it is not limited thereto.

For example, FIG. 9 shows an example of a case where one pixel is divided into three sub-pixels (SP1, SP2, and SF3) so that an area ratio of the sub-pixels is 1:2:4, along with providing two sub-frame groups in one frame (SFG1 and SFG2), as well as dividing one frame into two sub-frames (SF1 and SF2) so that a ratio of lighting periods of the sub-frames is 1:8. Note that in this example, m=3, n=2, and k=2 are satisfied.

Here, the sub-pixels have the following areas: SP1=1, SP2=2, and SP3=4, and the sub-frames have the following lighting periods: SF1=1 and SF2=8.

In FIG. 9, each of the sub-frames (SF1 and SF2) obtained by dividing one frame into two so that the lighting period ratio is 1:8 is further divided into two sub-frames each having a lighting period length that is ½ of the lighting period of each of the sub-frames (SF1 and SF2). In other words, SF1 having a lighting period of 1 is divided into two sub-frames SF11 and SF21 each having a lighting period of 0.5. Similarly, SF2 having a lighting period of 8 is divided into two sub-frames SF12 and SF22 each having a lighting period of 4. Then, SF11 and SF12 are placed in the sub-frame group 1 (SFG1), and SF21 and SF22 are placed in the sub-frame group 2 (SFG2). At this time, appearance order of SF11 and SF12 in the sub-frame group 1, and appearance order of SF21 and SF22 in the sub-frame group 2 are to be the same.

Accordingly, each of the two sub-frame groups includes two sub-frames, and lighting periods of the sub-frames are such that SF11=0.5, SF12=4, SF21=0.5, and SF22=4.

In FIG. 9, it is considered that a product of an area of each sub-pixel and a lighting period of each sub-frame is substantial light emission intensity. For example, in the sub-frame group 1, a light emission intensity of SF11 having a lighting period of 0.5 in a case where only the sub-pixel 1 with an area of 1 is lighted is 0.5, the light emission intensity in a case where only the sub-pixel 2 with an area of 2 is lighted is 1, and the light emission intensity in a case where only the sub-pixel 3 with an area of 4 is lighted is 2. Similarly, a light emission intensity of SF12 having a lighting period of 4 in a case where only the sub-pixel 1 is lighted is 4, the light emission intensity in a case where only the sub-pixel 2 is lighted is 8, and the light emission intensity in a case where only the sub-pixel 3 is lighted is 16. Note that, in the sub-frames included in the sub-frame group 2, the light emission intensity is set in a similar manner. In this manner, depending on a combination of an area of a sub-pixel and a lighting period of a sub-frame, a different light emission intensity can be created, and a 6-bit gray scale (64 gray scales) is expressed by this light emission intensity.

Figure 10:
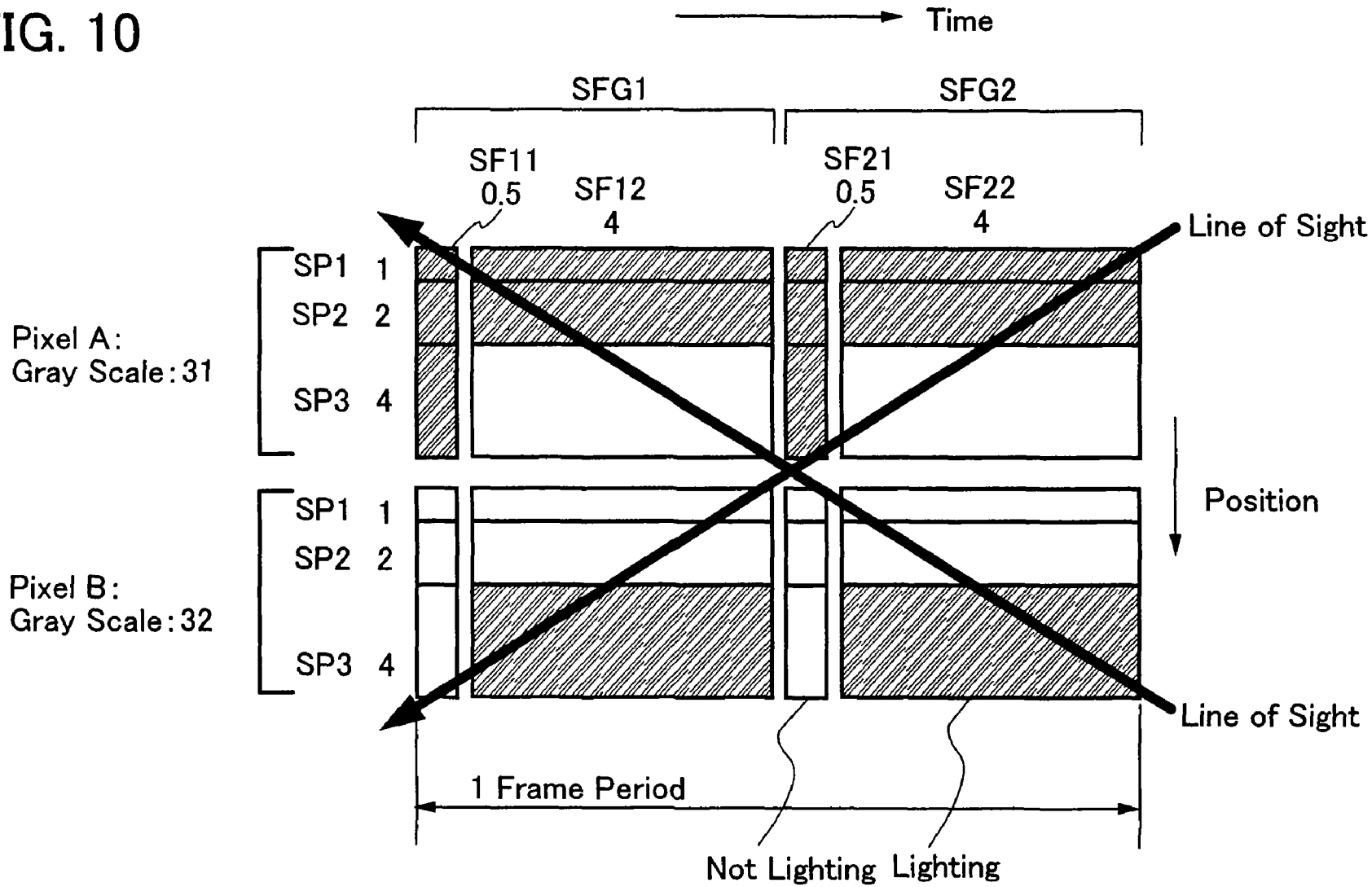
FIG. 10 shows an effect of pseudo contour reduction according to a driving method of the present invention.

With such a driving method as shown in FIG. 9, pseudo contour can be reduced. For example, it is assumed that a gray scale of 31 is displayed in a pixel A while a gray scale of 32 is displayed in a pixel B in FIG. 9. FIG. 10 shows a lighting/non-lighting state of each sub-pixel in each sub-frame, in that case. For example, when a line of sight is moved, the gray scale is at times perceived to be 28.5 (=0.5+4+8+16), and at other times the gray scale is perceived to be 30 (=16+2+8+4), depending on a movement of the line of sight. Even though the gray scale is supposed to be perceived as 31 and 32, the gray scale is perceived to be 28.5 or 30, and pseudo contour occurs. However, since gray scale gap is smaller than when a conventional driving method is used, pseudo contour is reduced compared to when the conventional driving method is used.

Further, in FIG. 9, one frame may be divided into two sub-frames (SF1 and SF2) so that a lighting period ratio is 1:8, a sub-frame between them having the longer lighting period of 8 may be divided into four sub-frames each having a lighting period length that is ¼ of the sub-frame, and the remaining sub-frame may be divided into two sub-frames each having a lighting period length that is ½ of the sub-frame. An example of this case is shown in FIG. 11. Note that in this example, m=3, n=2, k=2, and a=2 are satisfied.

Here, the sub-pixels have the following areas: SP1=1, SP2=2, and SP3=4, and the sub-frames have the following lighting periods: SF1=1 and SF2=8.

In FIG. 11, between the two sub-frames obtained by dividing one frame so that a lighting period ratio is 1:8, SF2 having the longer lighting period of 8 is divided into four sub-frames SF12, SF13, SF22, and SF23 each having a lighting period length of 2 that is ¼ of the sub-frame. Also, as for the remaining SF1, it is further divided into two frames SF11 and SF21 each having a lighting period of 0.5 that is ½ of the sub-frame. Then, SF11, SF12, and SF13 are arranged in the sub-frame group 1 (SFG1), and SF21, SF22, and SF23 are arranged in the sub-frame group 2 (SFG2). At this time, appearance order of SF11, SF12, and SF13 in the sub-frame group 1, and appearance order of SF21, SF22, and SF23 in the sub-frame group 2 are to be the same.

Accordingly, each of the two sub-frame groups includes three sub-frames, and lighting periods of the sub-frames are such that SF11=0.5, SF12=2, SF13=2, SF21=0.5, SF22=2, and SF23=2.

In FIG. 11, it is considered that a product of an area of each sub-pixel and a lighting period of each sub-frame is substantial light emission intensity. For example, in the sub-frame group 1, a light emission intensity of SF11 having a lighting period of 0.5 in a case where only the sub-pixel 1 with an area of 1 is lighted is 0.5, the light emission intensity in a case where only the sub-pixel 2 with an area of 2 is lighted is 1, and the light emission intensity in a case where only the sub-pixel 3 with an area of 4 is lighted is 2. Similarly, a light emission intensity of each of SF12 and SF13 each having a lighting period of 2 in a case where only the sub-pixels 1 is lighted is 2, the light emission intensity in a case where only the sub-pixels 2 is lighted is 4, and the light emission intensity in a case where only the sub-pixels 3 is lighted is 8. Note that, in the sub-frames included in the sub-frame group 2, the light emission intensity is set in a similar manner. In this manner, depending on a combination of an area of a sub-pixel and a lighting period of a sub-frame, a different light emission intensity can be created, and a 6-bit gray scale (64 gray scales) is expressed by this light emission intensity.

Figure 12:
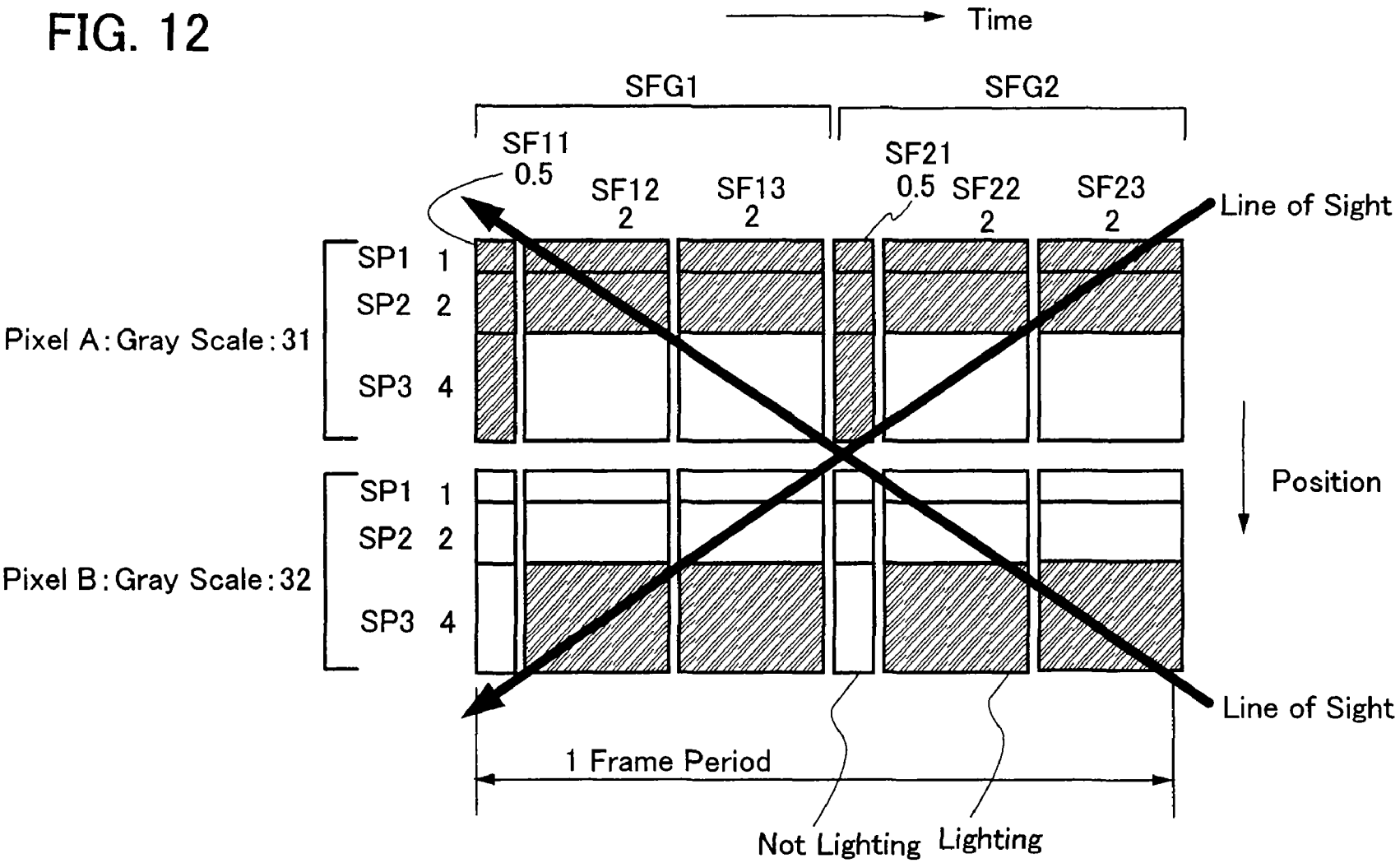
FIG. 12 shows an effect of pseudo contour reduction according to a driving method of the present invention.

With such a driving method as shown in FIG. 11, pseudo contour can be reduced. For example, it is assumed that a gray scale of 31 is displayed in a pixel A while a gray scale of 32 is displayed in a pixel B in FIG. 11. FIG. 12 shows a lighting/non-lighting state of each sub-pixel in each sub-frame, in that case. For example, when a line of sight is moved, the gray scale is at times perceived to be 22 (=2+4+8+8), and at other times the gray scale is perceived to be 28 (=8+8+2+4+4+2), depending on a movement of the line of sight. Even though the gray scale is supposed to be perceived as 31 and 32, the gray scale is perceived to be 22 or 28, and pseudo contour occurs. However, since gray scale gap is smaller than when a conventional driving method is used, pseudo contour is reduced compared to when the conventional driving method is used.

In this manner, by reducing a length of a lighting period of each sub-frame or increasing the division number of each sub-frame, eyes are tricked so as to perceive less gray scale gap when the line of sight is moved, compared to the conventional driving method. Therefore, this has a profound effect on reducing pseudo contour. Note that the sub-frame where a lighting period is further divided into four is not limited to a sub-frame having the longest lighting period.

Note that, by reducing a length of a lighting period of each sub-frame or increasing the division number of each sub-frame, a selection method of a sub-pixel in each sub-frame for displaying the same gray scale is increased. Therefore, the selection method of each sub-pixel in each sub-frame is not limited thereto. For example, in a case of displaying a gray scale of 31, in FIG. 11, the sub-pixel 1 and sub-pixel 2 are lighted in SF12, SF13, SF22, and SF23; however, the sub-pixel 2 and sub-pixel 3 may be lighted in SF12 and SF22. An example of this case is shown in FIG. 13.

Figure 14:
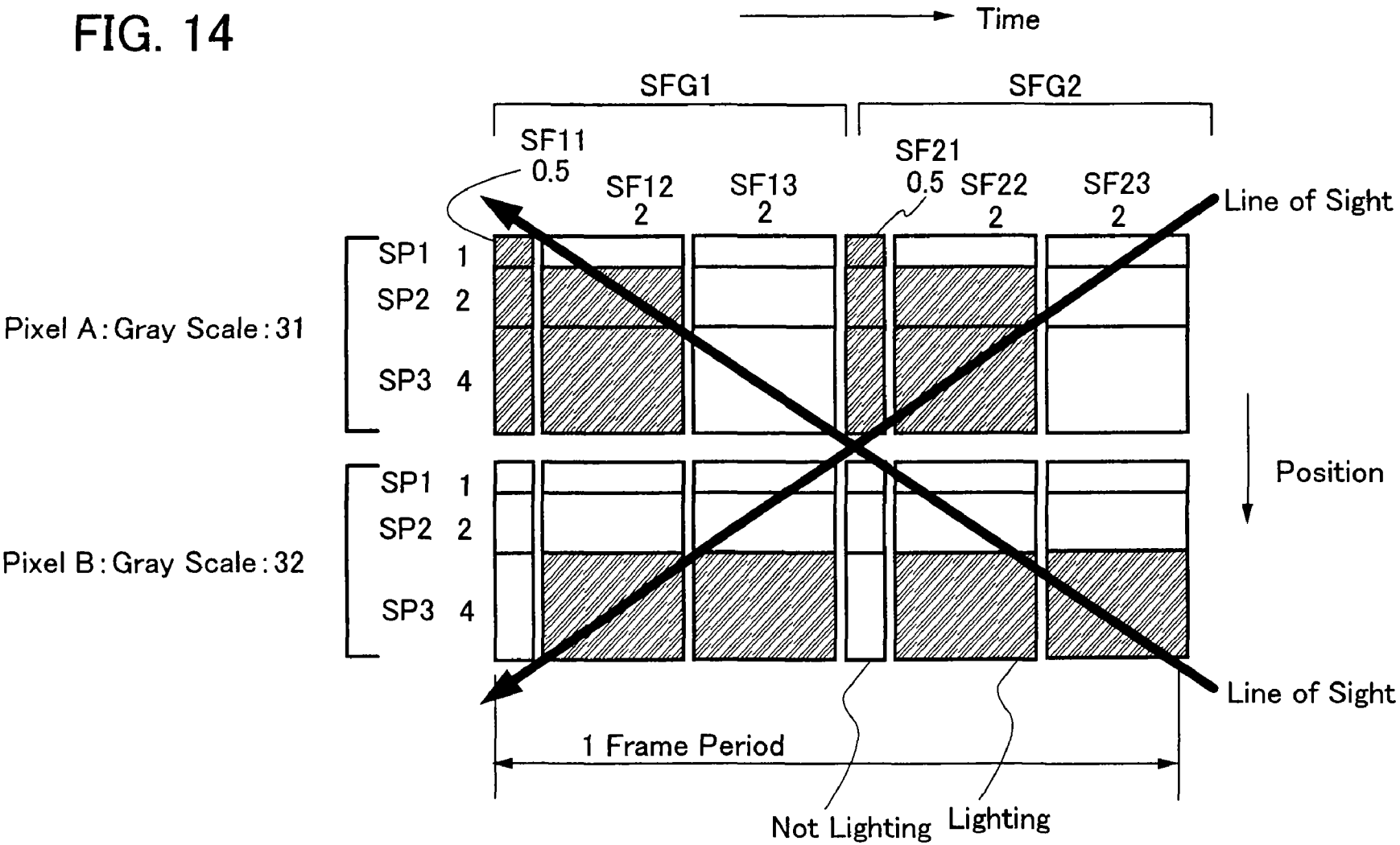
FIG. 14 shows an effect of pseudo contour reduction according to a driving method of the present invention.

With such a driving method as shown in FIG. 13, pseudo contour can be reduced. For example, it is assumed that a gray scale of 31 is displayed in a pixel A while a gray scale of 32 is displayed in a pixel B in FIG. 13. FIG. 14 shows a lighting/non-lighting state of each sub-pixel in each sub-frame, in that case. For example, when a line of sight is moved, the gray scale is at times perceived to be 28 (=4+8+8+8), and at other times the gray scale is perceived to be 30 (=8+8+2+8+4), depending on a movement of the line of sight. Even though the gray scale is supposed to be perceived as 31 and 32, the gray scale is perceived to be 28 or 30, and pseudo contour occurs. However, since gray scale gap is smaller than when a conventional driving method is used, pseudo contour is reduced compared to when the conventional driving method is used.

Accordingly, it is possible to have a profound effect on reducing pseudo contour by selectively changing a selection method of a sub-pixel in each sub-frame for a gray scale which are especially likely to cause pseudo contour.

Note that correspondence between areas and numbers of the sub-pixels are not limited thereto. For example, in FIG. 11, the sub-pixels have the following areas: SP1=1, SP2=2, and SP3=4; however, the following areas may also be employed: SP1=1, SP2=4, and SP3=2; SP1=2, SP2=1, and SP3=4; or SP1=4, SP2=2, and SP3=1.

Accordingly, by using a driving method of the present invention, it is possible to reduce pseudo contour without increasing the number of sub-frames and to display with a higher gray scale level. In addition, since it is possible to reduce the number of sub-frames compared with a conventional time gray scale method, a lighting period of each sub-frame can be provided to be long. Accordingly, it is possible to improve a duty ratio, and voltage applied to a light emitting element is reduced. Thus, power consumption can be reduced, and there will be little deterioration of a light emitting element.

Note that a selection method of a sub-pixel in each sub-frame may be changed in terms of time or a location in a certain gray scale. In other words, a selection method of a sub-pixel in each sub-frame may be changed depending on the time or a selection method of a sub-pixel in each sub-frame may be changed depending on pixels. Further, the selection method of a sub-pixel in each sub-frame may also be changed depending on the time and pixels.

For example, in expressing a certain gray scale, different selection methods of sub-pixels may be used in odd-numbered frames and even-numbered frames. For example, the gray scale may be expressed by a selection method of sub-pixels shown in FIG. 11 in odd-numbered frames whereas the gray scale may be expressed by a selection method of sub-pixels shown in FIG. 13 in even-numbered frames. Accordingly, pseudo contour can be reduced by changing the selection method of sub-pixels between the odd-numbered frames and even-numbered frames in expressing a gray scale which is especially likely to cause pseudo contour.

Although the selection method of sub-frames is changed herein for the gray scale which is especially likely to cause pseudo contour, the selection method of sub-pixels may be changed for an arbitrary gray scale.

Alternatively, the selection method of a sub-pixel in each sub-frame may be changed between the case of displaying pixels in odd-numbered rows and pixels in even-numbered rows in order to express a certain gray scale. Further alternatively, the selection method of a sub-pixel in each sub-frame may be changed between the case of displaying pixels in odd-numbered columns and pixels in even-numbered columns in order to express a certain gray scale.

In addition, the division number or a ratio of the lighting periods of the sub-frames may be changed in odd-numbered frames and even-numbered frames in order to express a certain gray scale. For example, in odd-numbered frames, the gray scale may be expressed by the selection method of sub-pixels shown in FIG. 9, and in even-numbered frames, the gray scale may be expressed by the selection method of sub-pixels shown in FIG. 11.

Note that a sequence of lighting periods of sub-frames may be changed depending on the time. For example, the sequence of the lighting periods of the sub-frames may be changed in the first frame and the second frame. Also, the sequence of the lighting periods of the sub-frames may be changed depending on location. For example, the sequence of the lighting periods of sub-frames of pixels A and B may be changed. In addition, by combining these, the sequence of the lighting periods of the sub-frames may be changed depending on the time and location. For example, in FIG. 11, in odd-numbered frames, lighting periods of sub-frames may be such that SF11=0.5, SF12=2, SF13=2, SF21=0.5, SF22=2, and SF23=2; and in even-numbered frames, lighting periods of the sub-frames may be such that SF11=2, SF12=0.5, SF13=2, SF21=2, SF22=0.5, and SF23=2.

Note that so far, an example of the case where the number of sub-frame groups is two (k=2) is shown; however, the number of sub-frame groups is not limited thereto. For example, FIG. 15 shows an example of a case where four sub-frame groups are provided in one frame.

In FIG. 15, one pixel is divided into two sub-pixels (SP1 and SP2) so that an area ratio of the sub-pixels is 1:2, along with providing four sub-frame groups (SFG1, SFG2, SFG3, and SFG4) in one frame, as well as dividing one frame into three sub-frames (SF1, SF2, and SF3) so that a lighting period ratio of the sub-frames is 1:4:16. Note that in this example, m=2, n=3, and k=4 are satisfied.

Here, the sub-pixels have the following areas: SP1=1 and SP2=2, and the sub-frames have the following lighting periods: SF1=1, SF2=4, and SF3=16.

In FIG. 15, each of the sub-frames (SF1 to SF3) obtained by dividing one frame into three so that a lighting period ratio is 1:4:16 is further divided into four sub-frames each having a lighting period length that is ¼ of the lighting period of each of the sub-frames (SF1 to SF3). In other words, SF1 having a lighting period of 1 is divided into four sub-frames SF11, SF21, SF31, and SF41 each having a lighting period of 0.25. Similarly, SF2 having a lighting period of 4 is divided into four sub-frames SF12, SF22, SF32, and SF42 each having a lighting period of 1, and SF3 having a lighting period of 16 is divided into four sub-frames SF13, SF23, SF33, and SF43 each having a lighting period of 4. Then, SF11, SF12, and SF13 are arranged in the sub-frame group 1 (SFG1); SF21, SF22, and SF23 are arranged in the sub-frame group 2 (SFG2); SF31, SF32, and SF33 are arranged in the sub-frame group 3 (SFG3); and SF41, SF42, and SF43 are arranged in the sub-frame group 4 (SFG4). At this time, appearance orders of SF11, SF12, and SF13; SF21, SF22, and SF23; SF31, SF32, and SF33; and SF41, SF42, and SF43 in the sub-frame group 1 to 4, respectively, are to be the same.

Accordingly, each of the four sub-frame groups includes three sub-frames, and lighting periods of the sub-frames are such that SF11=0.25, SF12=1, SF13=4, SF21=0.25, SF22=1, SF23=4, SF31=0.25, SF32=1, SF33=4, SF41=0.25, SF42=1, and SF43=4.

In FIG. 15, it is considered that a product of an area of each sub-pixel and a lighting period of each sub-frame is substantial light emission intensity. For example, in the sub-frame group 1, a light emission intensity of SF11 having a lighting period of 0.25 in a case where only the sub-pixel 1 with an area of 1 is lighted is 0.25, and the light emission intensity in a case where only the sub-pixel 2 with an area of 2 is lighted is 0.5. Similarly, a light emission intensity of SF12 having a lighting period of 1 in a case where only the sub-pixel 1 is lighted is 1, and the light emission intensity in a case where only the sub-pixel 2 is lighted is 2. Similarly, a light emission intensity of SF13 having a lighting period of 4 in a case where only the sub-pixel 1 is light is 4, and the light emission intensity in a case where only the sub-pixel 2 is lighted is 8. Note that, in other sub-frame groups, the light emission intensity is set in a similar manner. In this manner, depending on a combination of an area of a sub-pixel and a lighting period of a sub-frame, a different light emission intensity can be created, and a 6-bit gray scale (64 gray scales) is expressed by this light emission intensity.

Figure 16:
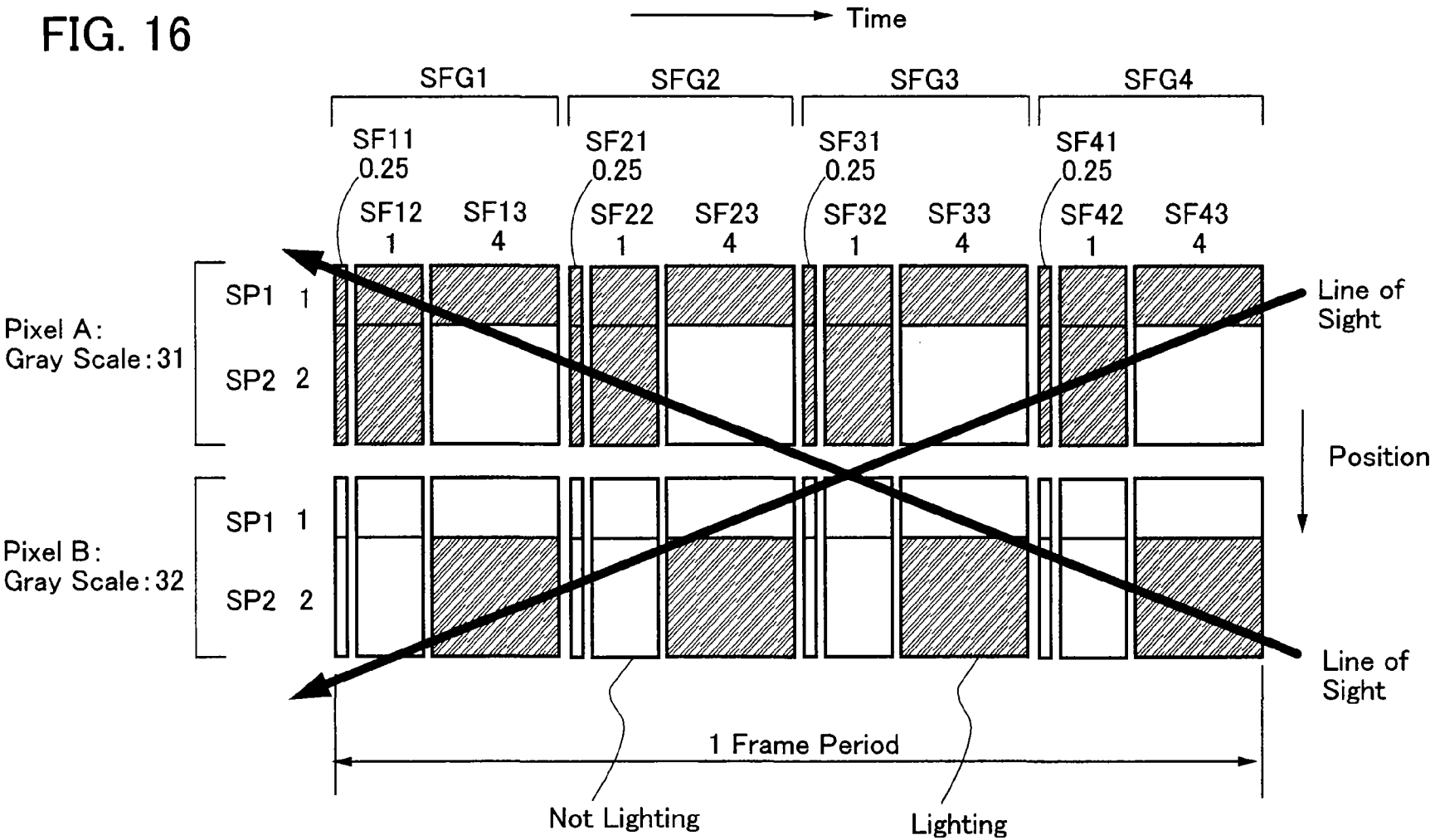
FIG. 16 shows an effect of pseudo contour reduction according to a driving method of the present invention.

Note that with such a driving method as shown in FIG. 15, pseudo contour can be reduced. For example, it is assumed that a gray scale of 31 is displayed in a pixel A while a gray scale of 32 is displayed in a pixel B in FIG. 15. FIG. 16 shows a lighting/non-lighting state of each sub-pixel in each sub-frame, in that case. For example, when a line of sight is moved, the gray scale is at times perceived to be 22.5 (=8+8+0.5+2+4), and at other times the gray scale is perceived to be 23.75 (=0.25+1+4+0.5+2+8+8), depending on a movement of the line of sight. Even though the gray scale is supposed to be perceived as 31 and 32, the gray scale is perceived to be 22.5 or 23.75, and pseudo contour occurs. However, since gray scale gap is smaller than when a conventional driving method is used, pseudo contour is reduced compared to when the conventional driving method is used.

Note that in this embodiment mode, an example of a case of a 6-bit gray scale (64 gray scales) is given; however, a gray scale level to be displayed is not limited thereto. For example, an 8-bit gray scale (256 gray scales) can be expressed. An example of this case is shown in FIGS. 17 to 20. Note that selection methods of sub-pixels for gray scales of 0 to 63; 64 to 127; 128 to 191; and 192 to 255 are shown in FIGS. 17, 18, 19, and 20, respectively.

In each of FIGS. 17 to 20, one pixel is divided into two sub-pixels (SP1 and SP2) so that an area ratio of the sub-pixels is 1:2, along with providing two sub-frame groups (SFG1, and SFG2) in one frame, as well as dividing one frame into four sub-frames (SF1, SF2, SF3, and SF4) so that a lighting period ratio of the sub-frames is 1:4:16:64. Note that in this example, m=2, n=4, and k=2 are satisfied.

Here, the sub-pixels have the following areas: SP1=1 and SP2=2, and the sub-frames have the following lighting periods: SF1=1, SF2=4, SF3=16, and SF4=64.

In each of FIGS. 17 to 20, the four sub-frames (SF1 to SF4) obtained by dividing one frame so that a lighting period ratio is 1:4:16:64 are each further divided into two sub-frames each having a lighting period length that is ½ of the sub-frame. In other words, SF1 having a lighting period of 1 is divided into two sub-frames SF11 and SF21 each having a lighting period of 0.5. Similarly, SF2 having a lighting period of 4 is divided into two sub-frames SF12 and SF22 each having a lighting period of 2; SF3 having a lighting period of 16 is divided into two sub-frames SF13 and SF23 each having a lighting period of 8; and SF4 having a lighting period of 64 is divided into two sub-frames SF14 and SF24 each having a lighting period of 32. Then, SF11, SF12, SF13, and SF14 are arranged in the sub-frame group 1 (SFG1), and SF21, SF22, SF23, and SF24 are arranged in the sub-frame group 2 (SFG2). At this time, appearance order of SF11, SF12, SF13, and SF14 in the sub-frame group 1 and appearance order of SF21, SF22, SF23, and SF24 in the sub-frame group 2 are to be the same.

Accordingly, each of the two sub-frame groups includes four sub-frames, and lighting period of the sub-frames are such that SF11=0.5, SF12=2, SF13=8, SF14=32, SF21=0.5, SF22=2, SF23=8, and SF24=32.

In each of FIGS. 17 to 20, it is considered that a product of an area of each sub-pixel and a lighting period of each sub-frame is substantial light emission intensity. For example, in the sub-frame group 1, a light emission intensity of SF11 having a lighting period of 0.5 in a case where only the sub-pixel 1 with an area of 1 is lighted is 0.5, and the light emission intensity in a case where only the sub-pixel 2 with an area of 2 is lighted is 1. Similarly, a light emission intensity of SF12 having a lighting period of 2 in a case where only the sub-pixel 1 is lighted is 2, and the light emission intensity in a case where only the sub-pixel 2 is lighted is 4. Similarly, a light emission intensity of SF13 having a lighting period of 8 in a case where only the sub-pixel 1 is lighted is 8, and the light emission intensity in a case where only the sub-pixel 2 is lighted is 16. Similarly, a light emission intensity of SF14 having a lighting period of 32 in a case where only the sub-pixel 1 is lighted is 32, and the light emission intensity in a case where only the sub-pixel 2 is lighted is 64. Note that, in the sub-frames included in the sub-frame group 2, the light emission intensity is set in a similar manner. In this manner, depending on a combination of an area of a sub-pixel and a lighting period of a sub-frame, a different light emission intensity can be created, and a 8-bit gray scale (256 gray scales) is expressed by this light emission intensity.

Note that, the contents described so far such as gray scale level to be displayed; area ratio and number of sub-pixels; lighting period ratio and division number of sub-frames; number of sub-frame groups; and change of selection methods of sub-frames and sub-pixels depending on a gray scale, may be used in combination with each other.

Embodiment Mode 2

Embodiment Mode 1 describes a case where a lighting period increases in linear proportion to an increase in gray scales. In this embodiment mode, a case of applying gamma correction is described.

Gamma correction refers to a method where the lighting period increases in non-linear proportion to an increased gray scale. Even when luminance increases linearly, it is difficult for human eyes to perceive that the luminance has become higher proportionally. It is even more difficult for human eyes to perceive the difference in luminance as the luminance becomes higher. Therefore, in order for human eyes to perceive the difference in luminance, a lighting period is required to be lengthened in accordance with the increased gray scales, that is, gamma correction is required to be performed. Note that when a gray scale is x and luminance is y, the relation between the luminance and the gray scale in performing the gamma correction can be expressed by the following Formula (1):

$$y = A \times x^{\gamma} \tag{1}$$

Note that, in Formula (1), A is a constant for normalizing the luminance y to be within the range of $0 \leqq y \leqq 1$, while y which is an exponent of the gray scale x is a parameter indicating the degree of the gamma correction.

As the simplest method, there is a method where display is performed with a larger number of bits (gray scale levels) than the number of bits (gray scale levels) which are actually displayed. For example, in a case of displaying a 6-bit gray scale (64 gray scales), display is performed with an 8-bit gray scale (256 gray scales). When actually displaying an image, display is performed with a 6-bit gray scale (64 gray scales) so that the luminance increases in non-linear proportion to the gray scale. Accordingly, the gamma correction can be performed.

Figure 22A:
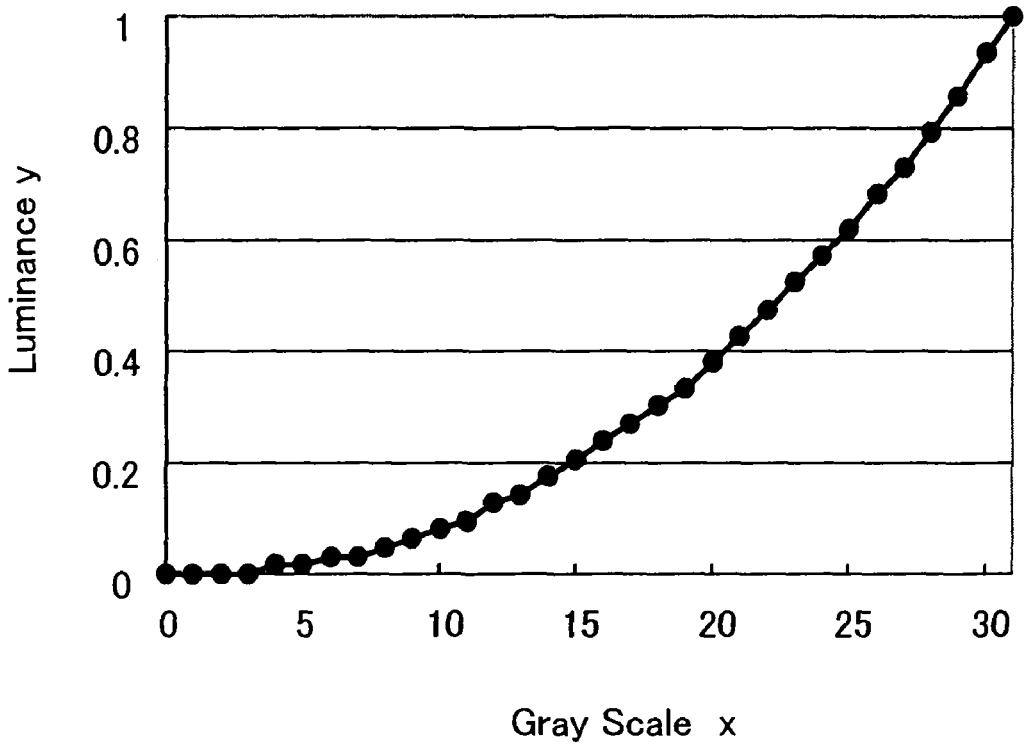
FIGS. 22A and 22B each show a gray scale-luminance relationship in a case of performing gamma correction according to a driving method of the present invention.
Figure 22B:
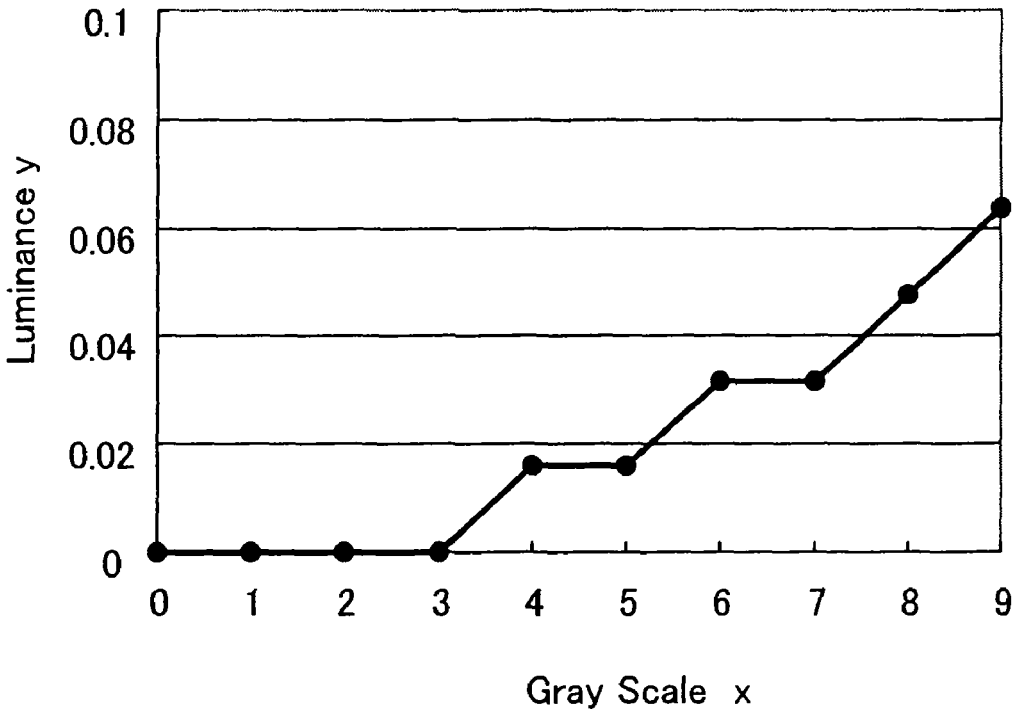

As an example, FIG. 21 shows a selection method of sub-pixels in each sub-frame in a case of displaying an image with a 6-bit gray scale (64 gray scales) in order to display a 5-bit gray scale (32 gray scales) by performing the gamma correction. FIG. 21 shows a selection method of sub-pixels in each sub-frame in the case of displaying an image with a 5-bit gray scale (32 gray scales) by performing the gamma correction so that $\gamma=2.2$ is satisfied at all the gray scales. Note that $\gamma=2.2$ is the value which can best correct the characteristics of the human visual perception, with which human eyes can perceive the most appropriate difference in luminance even when the luminance becomes higher. In FIG. 21, up to a gray scale of 3 in a 5-bit gray scale with the gamma correction, display is actually performed by the selection method of sub-frames for displaying a gray scale of 0 in the case of a 6-bit gray scale. Similarly, at a gray scale of 4 in a 5-bit gray scale with the gamma correction, display is actually performed by a selection method of sub-frames for displaying a gray scale of 1 in the case of a 6-bit gray scale, and at a gray scale of 6 in a 5 bit-gray scale with the gamma correction, display is actually performed by a selection method of sub-frames for displaying a gray scale of 2 in the case of 6 bit-gray scale. FIGS. 22A and 22B are graphs showing the relation between the gray scale x and the luminance y. FIG. 22A is a graph showing the relation between the gray scale x and the luminance y at all the gray scales, while FIG. 22B is a graph showing the relation between the gray scale x and the luminance y at low gray scales. In this manner, display may be performed in accordance with a correspondence table between a 5-bit gray scale with the gamma correction and a 6-bit gray scale. Accordingly, the gamma correction which can satisfy $\gamma=2.2$ can be performed.

However, as is apparent from FIG. 22B, the gray scales of 0 to 3, 4 and 5, and 6 and 7 are each displayed with the same luminance in the case of FIG. 21. This is because, since the gray scale levels are not enough in the case of displaying a 6-bit gray scale, difference in luminance cannot be expressed fully. As a countermeasure against this, the following two methods can be considered.

The first method is a method of further increasing the number of bits which can be displayed. In other words, display is performed with not a 6-bit gray scale but 7-bit gray scales or more, and preferably an 8-bit gray scale or more. Consequently, a smooth image can be displayed even in the low gray scale regions.

Figure 24A:
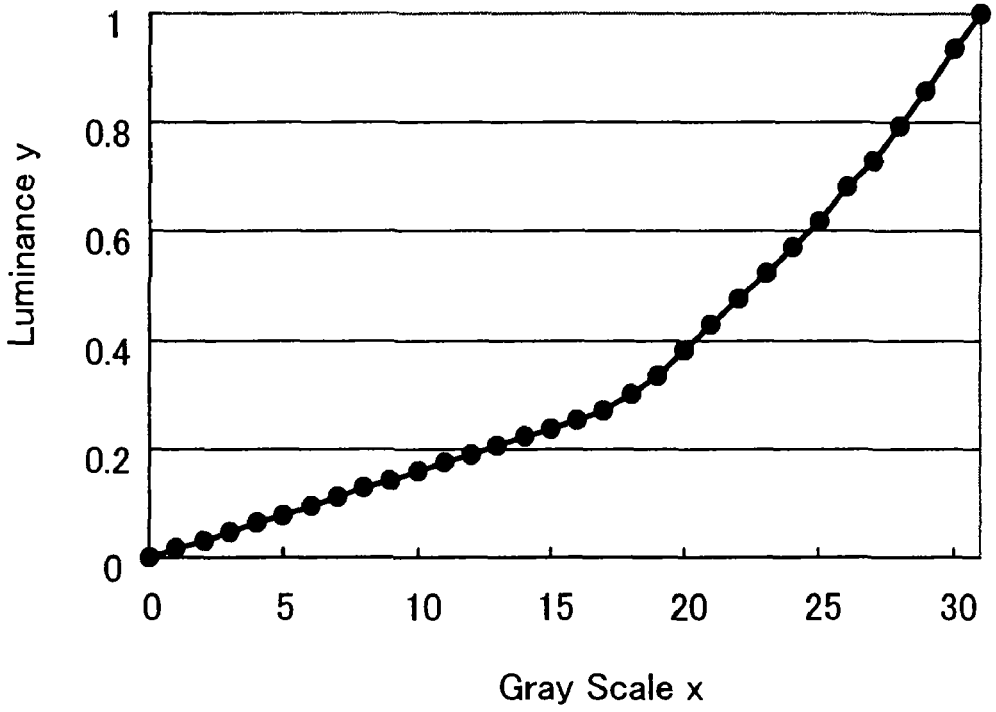
FIGS. 24A and 24B each show a gray scale-luminance relationship in a case of performing gamma correction according to a driving method of the present invention.
Figure 24B:
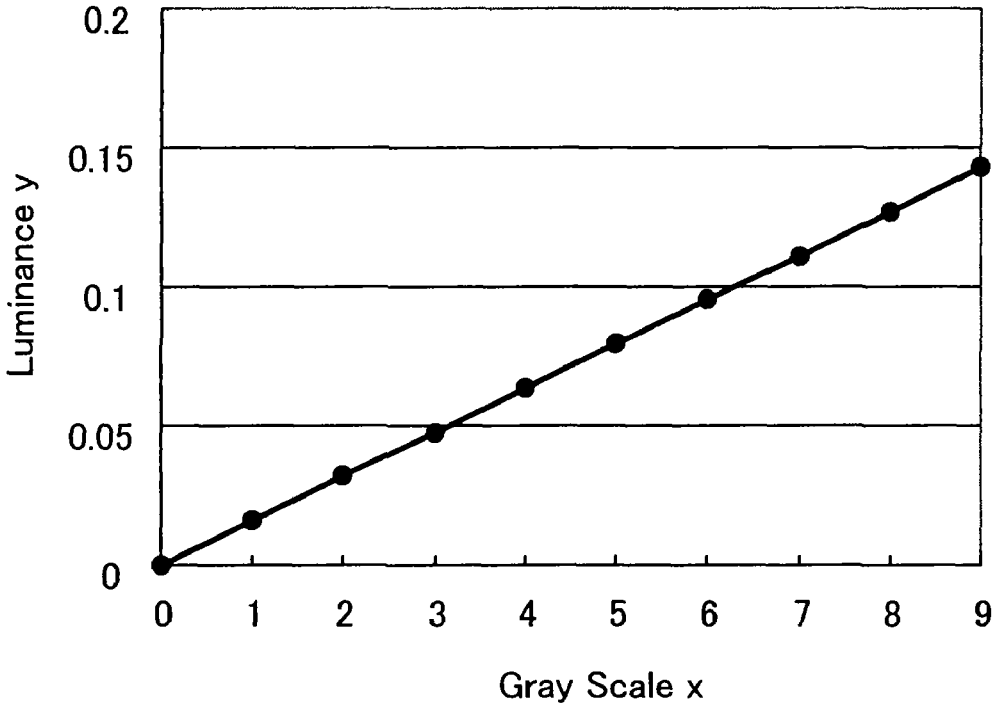

The second method is a method of displaying a smooth image by not satisfying $\gamma=2.2$ in the low gray scale regions but by linearly changing the luminance. FIG. 23 shows a selection method of sub-frames of this case. In FIG. 23, in order to display a gray scale of up to 17, the same selection method of sub-frames is used in both a 5-bit gray scale and a 6-bit gray scale. However, at a gray scale of 18 in displaying a 5-bit gray scale with the gamma correction, pixels are actually lighted by a selection method of sub-frames for displaying a gray scale of 19 in a 6-bit gray scale. Similarly, at a gray scale of 19 in displaying a 5-bit gray scale with the gamma correction, display is actually performed by a selection method of sub-frames for displaying a gray scale of 21 in a 6-bit gray scale, and at a gray scale of 20 in displaying a 5-bit gray scale with the gamma correction, display is actually performed by a selection method of sub-frames for displaying a gray scale of 24 in of a 6-bit gray scale. FIGS. 24A and 24B show the relation between the gray scale x and the luminance y. FIG. 24A is a graph showing the relation between the gray scale x and the luminance y at all the gray scales, while FIG. 24B is a graph showing the relation between the gray scale x and the luminance y at low gray scales. In the low gray scale regions, the luminance changes linearly. By performing such gamma correction, a smoother image can be displayed in the low gray scale regions.

In other words, by changing the luminance in linear proportion to the gray scales in the low gray scale regions while changing the luminance in nonlinear proportion to the gray scales in other gray scale regions, a smoother image can be displayed in the low gray scale regions.

Note also that the correspondence table between the 5-bit gray scale with gamma correction and the 6-bit gray scale may be appropriately modified. Thus, by modifying the correspondence table, the degree of gamma correction (that is, the value of $\gamma$) can be easily changed. Accordingly, the present invention is not limited to $\gamma=2.2$.

Moreover, the present invention is not particularly limited to the number of bits (for example, p bits, where p is an integer) to be actually displayed, and the number of bits to be applied with gamma correction (for example, q bits, where q is an integer). In the case of displaying bits by performing gamma correction, the number of bits p is desirably set as large as possible in order to express gray scales smoothly. However, if the number p is set too large, a problem may arise such that the number of sub-frames is increased accordingly. Thus, the relation between the number of bits q and p desirably satisfies $q+2 \leqq p \leqq q+5$. Accordingly, gray scales can be smoothly expressed while suppressing the number of sub-frames.

Note that the content described in this embodiment mode can be applied by being freely combined with the content described in Embodiment Mode 1.

Embodiment Mode 3

In this embodiment mode, an operation of a display device is described with reference to a timing chart in the case (FIG. 1) where one pixel is divided into two sub-pixels (SP1 and SP2) so that an area ratio of the sub-pixels is 1:2, along with providing two sub-frame groups (SFG1 and SFG2) in one frame, as well as dividing one frame into three sub-frames (SF1, SF2, and SF3) so that a lighting period ratio of the sub-frames is 1:4:16.

Here, the sub-pixels have the following areas: SP1=1 and SP2=2, and the sub-frames have the following lighting periods: SF1=1, SF2=4, and SF3=16.

Figure 25:
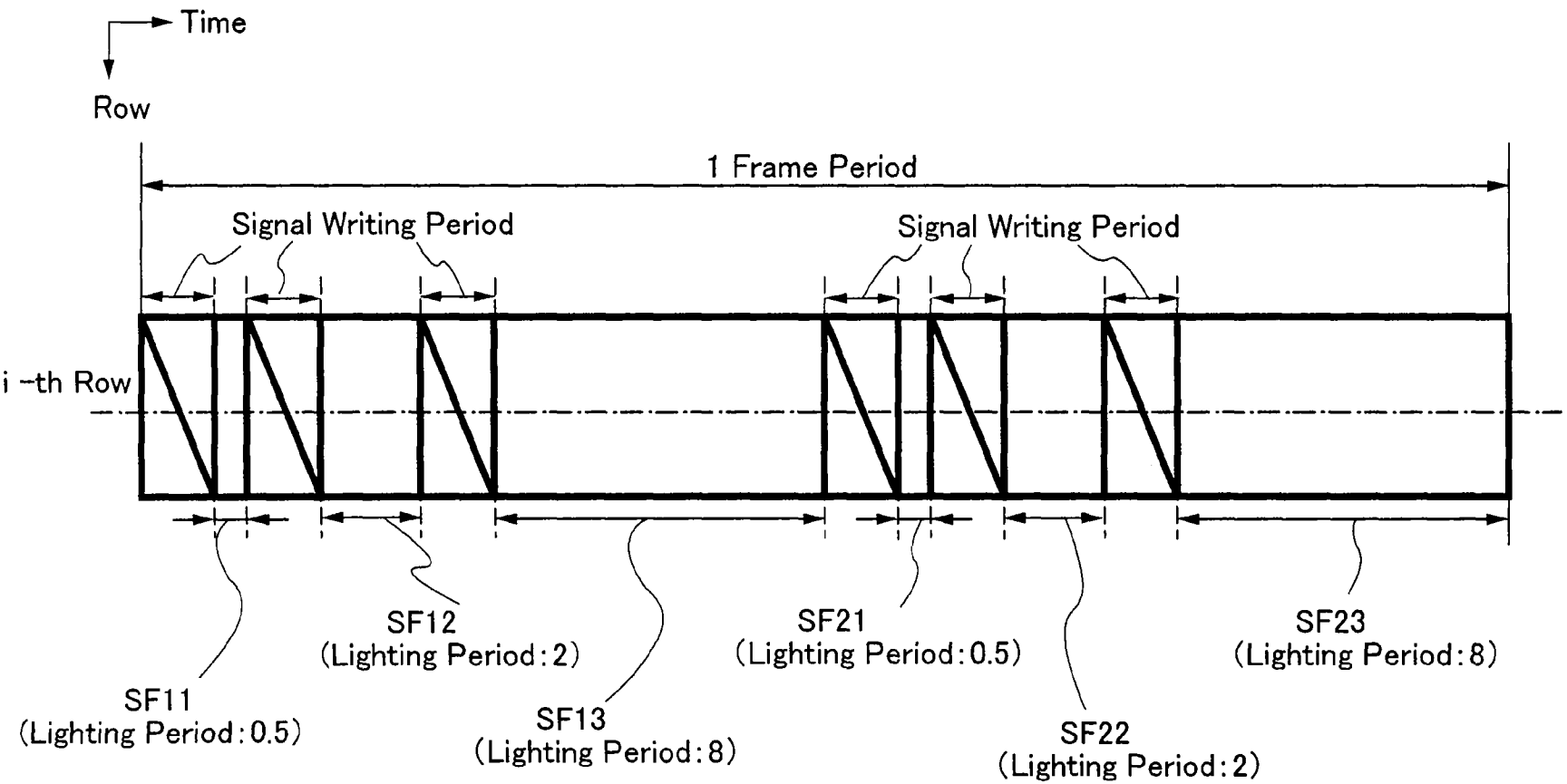
FIG. 25 shows an example of a timing chart in a case where a period in which a signal is written to a pixel and a lighting period are separated.

First, FIG. 25 shows a timing chart in the case where a period where a signal is written to a pixel and a lighting period are separated. Note that a timing chart is a diagram showing a timing of light emission of a pixel in one frame. A horizontal direction indicates time, and a vertical direction indicates a row where pixels are arranged.

First, signals for one screen are inputted to all pixels in a signal writing period. During this period, pixels are not lighted. After the signal writing period, a lighting period starts and pixels are lighted. The length of the lighting period at this time is 0.5. Next, a subsequent sub-frame starts and signals for one screen are inputted to all pixels in a signal writing period. During this period, pixels are not lighted. After the signal writing period, a lighting period starts and pixels are lighted. A length of the lighting period at this time is 2.

By repeating similar operations, the lengths of the lighting periods are arranged in an order of 0.5, 2, 8, 0.5, 2, 8.

Such a driving method where a period in which a signal is written to a pixel and a lighting period are separated is preferably applied to a plasma display. Note that, in a case where the driving method is used for a plasma display, an initialization operation and the like are required, which are omitted in FIG. 25 for simplicity.

In addition, this driving method is also suitable to be applied to an EL display (an organic EL display, an inorganic EL display, a display formed of elements including an inorganic substance and an organic substance, or the like), a field emission display, a display using a Digital Micromirror Device (DMD), or the like.

Figure 26:
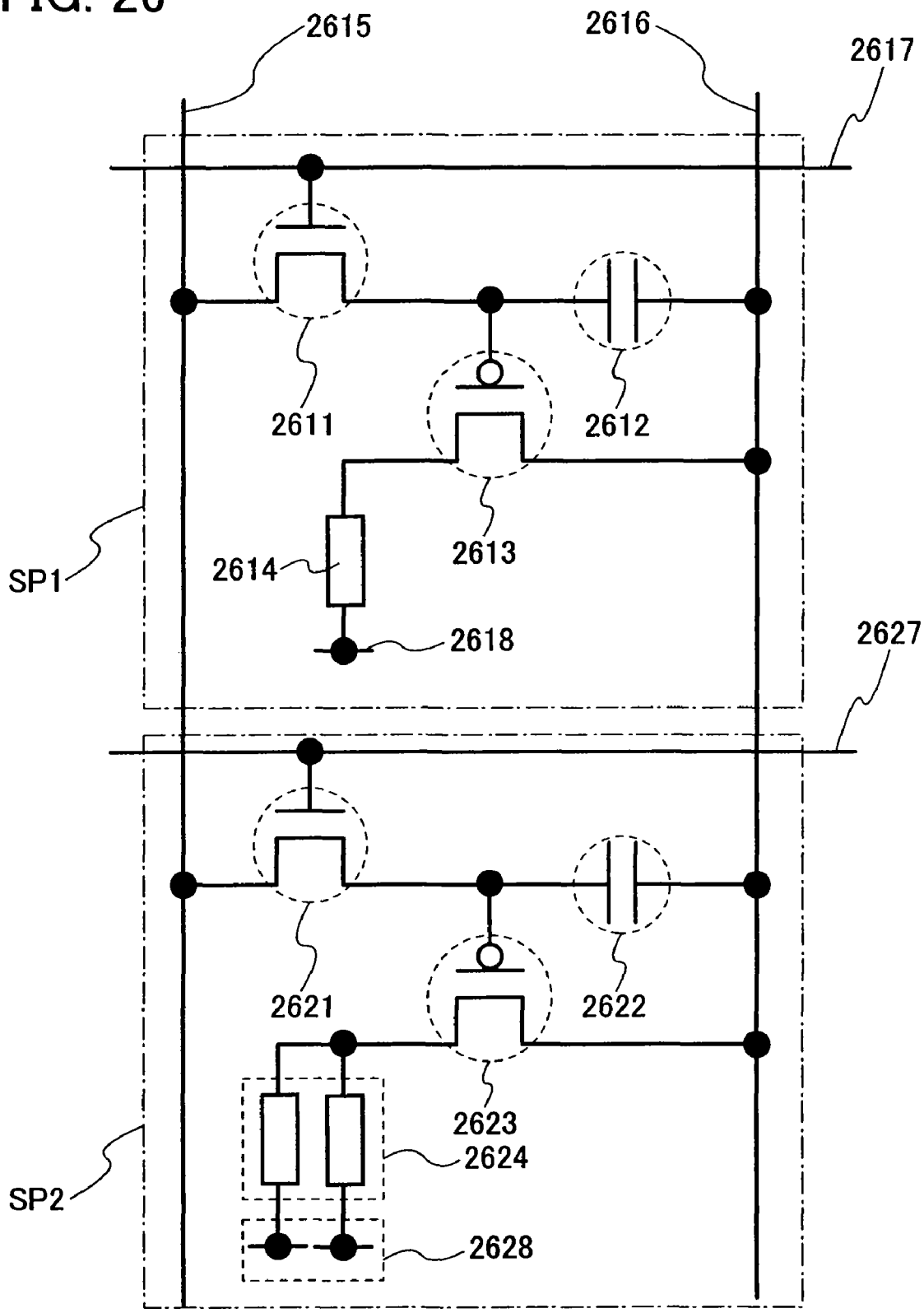
FIG. 26 shows an example of a pixel configuration in a case where a period in which a signal is written to a pixel and a lighting period are separated.

Here, a pixel configuration for realizing the driving method, where a period in which a signal is written to a pixel and a lighting period are separated, is shown in FIG. 26. FIG. 26 is a configuration example of a case where a plurality of scanning lines are provided, and a gray scale is expressed by changing the number of light emitting elements to emit light by controlling which scanning lines are to be selected. Note that in FIG. 26, an area of each sub-pixel is expressed by the number of the light emitting elements. Therefore, there is one light emitting element in the sub-pixel 1 and two light emitting elements in the sub-pixel 2.

First, a pixel configuration shown in FIG. 26 will be explained. The sub-pixel 1 includes a first selection transistor 2611, a first driving transistor 2613, a first holding capacitor 2612, a signal line 2615, a first power supply line 2616, a first scanning line 2617, a first light emitting element 2614, and a second power supply line 2618.

In the first selection transistor 2611, a gate electrode is connected to the first scanning line 2617, a first electrode is connected to the signal line 2615, and a second electrode is connected to a second electrode of the first holding capacitor 2612 and a gate electrode of the first driving transistor 2613. A first electrode of the first holding capacitor 2612 is connected to the first power supply line 2616. In the first driving transistor 2613, a first electrode is connected to the first power supply line 2616, and a second electrode is connected to a first electrode of the first light emitting element 2614. A second electrode of the first light emitting element 2614 is connected to the second power supply line 2618.

The sub-pixel 2 includes a second selection transistor 2621, a second driving transistor 2623, a second holding capacitor 2622, the signal line 2615, the first power supply line 2616, a second scanning line 2627, second light emitting elements 2624, and a third power supply line 2628. Note that connections of each element and wiring of the sub-pixel 2 is similar to those of the sub-pixel 1; thus, the explanation is omitted.

Next, an operation of the pixel shown in FIG. 26 will be explained. Here, an operation of the sub-pixel 1 will be explained. The first scanning line 2617 is selected by increasing a potential of the first scanning line 2617, the first selection transistor 2611 is turned on, and a signal is inputted to the first holding capacitor 2612 from the signal line 2615. Thus, in accordance with the signal, the current of the first driving transistor 2613 is controlled, and a current flows from the first power supply line 2616 to the first light emitting element 2614. Note that an operation of the sub-pixel 2 is similar to that of the sub-pixel 1; thus, the explanation is omitted.

At this time, depending on the scanning line selected between the first and the second scanning lines, the number of light emitting elements lighted is changed. For example, when only the first scanning line 2617 is selected, only the first selection transistor 2611 is turned on and only the current of the first driving transistor 2613 is controlled; therefore, only the first light emitting element 2614 emits light. In other words, only the sub-pixel 1 emits light. On the other hand, when only the second scanning line 2627 is selected, only the second selection transistor 2621 is turned on and only the current of the second driving transistor 2623 is controlled; therefore, only the second light emitting elements 2624 emit light. In other words, only the sub-pixel 2 emits light. In addition, when both the first and second scanning lines 2617 and 2627 are selected, the first and second selection transistors 2611 and 2621 are turned on and the respective currents of the first and second driving transistors 2613 and 2623 are controlled; therefore, both the first and second light emitting elements 2614 and 2624 emit light. In other words, both the sub-pixels 1 and 2 emit light.

Note that, in the signal writing period, the respective potentials of the first power supply line 2616, and the second and third power supply lines 2618 and 2628 are controlled so as not to apply voltage to the light emitting elements 2614 and 2624. For example, the second and third power supply lines 2618 and 2628 may be set in a floating state. Alternatively, the potential of the second and third power supply lines 2618 and 2628 may be made lower than the potential of the signal line 2615 by a threshold voltage of the first and second driving transistors 2613 and 2623. Further alternatively, the potential of the second and third power supply lines 2618 and 2628 may be made equal to or higher than that of the signal line 2615. As a result, the light emitting elements 2614 and 2624 can be prevented from lighting in the signal writing period.

Note that the second power supply line 2618 and the third power supply line 2628 may be different wires, or share a common wire.

Note that in order to realize the pixel configuration shown in FIG. 26, in a case of dividing one pixel into m (m is an integer of $m \geqq 2$) sub-pixels, the number of scanning lines in one pixel may be 2 or more and m or less, and a selection transistor included in at least one sub-pixel among the m sub-pixels may be connected to a scanning line different from that connected to selection transistors included in other sub-pixels.

Figure 27:
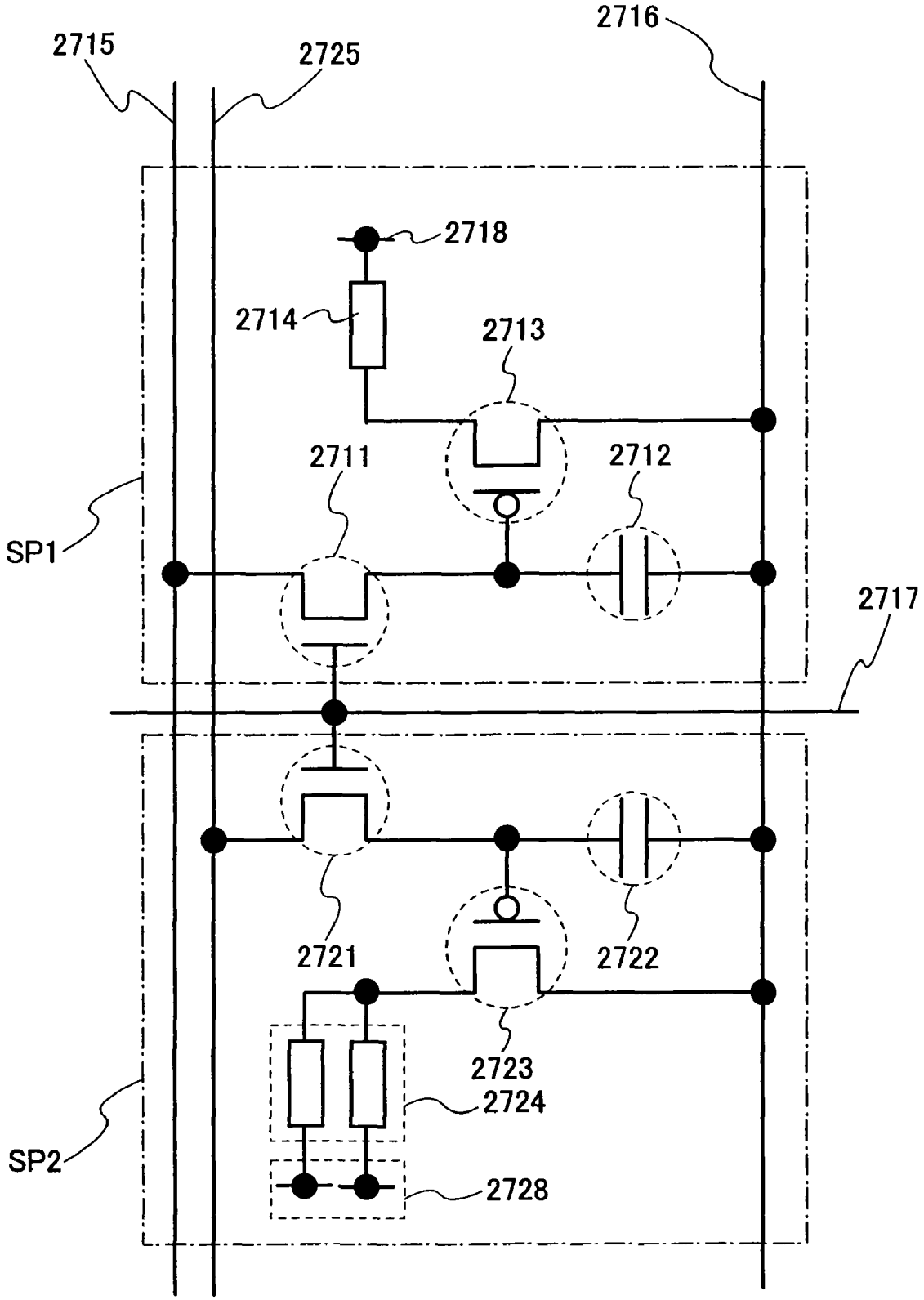
FIG. 27 shows an example of a pixel configuration in a case where a period in which a signal is written to a pixel and a lighting period are separated.

Note that FIG. 26 is the configuration example of a case where a plurality of scanning lines are provided, and a gray scale is expressed by changing the number of light emitting elements to emit light by controlling which scanning lines are to be selected. However, it is also possible to express a gray scale by providing a plurality of signal lines, and changing the number of light emitting elements to emit light by controlling what kind of signal is to be inputted to which signal line. A configuration example of this case is shown in FIG. 27.

First, a pixel configuration shown in FIG. 27 will be explained. The sub-pixel 1 includes a first selection transistor 2711, a first driving transistor 2713, a first holding capacitor 2712, a first signal line 2715, a first power supply line 2716, a scanning line 2717, a first light emitting element 2714, and a second power supply line 2718.

In the first selection transistor 2711, a gate electrode is connected to the scanning line 2717, a first electrode is connected to the first signal line 2715, and a second electrode is connected to a second electrode of the first holding capacitor 2712 and a gate electrode of the first driving transistor 2713. A first electrode of the first holding capacitor 2712 is connected to the first power supply line 2716. In the first driving transistor 2713, a first electrode is connected to the first power supply line 2716, and a second electrode is connected to a first electrode of the first light emitting element 2714. A second electrode of the first light emitting element 2714 is connected to the second power supply line 2718.

The sub-pixel 2 includes a second selection transistor 2721, a second driving transistor 2723, a second holding capacitor 2722, a second signal line 2725, the first power supply line 2716, the scanning line 2717, second light emitting elements 2724, and a third power supply line 2728. Note that connections of each element and wiring of the sub-pixel 2 are similar to those of the sub-pixel 1; thus, the explanation is omitted.

Next, an operation of the pixel shown in FIG. 27 will be explained. Here, an operation of the sub-pixel 1 will be explained. The scanning line 2717 is selected by increasing the potential of the scanning line 2717, the first selection transistor 2711 is turned on, and a video signal is inputted to the first holding capacitor 2712 from the first signal line 2715. Thus, in accordance with the video signal, the current of the first driving transistor 2713 is controlled, and a current flows from the first power supply line 2716 to the first light emitting element 2714. Note that an operation of the sub-pixel 2 is similar to that of the sub-pixel 1; thus, the explanation is omitted.

At this time, depending on signals inputted to the first and second signal lines 2715 and 2725, the number of lighted light emitting elements is changed. For example, when a Lo signal is inputted to the first signal line 2715 and a Hi signal is inputted to the second signal line 2725, only the first driving transistor 2713 is turned on; therefore, only the first light emitting element 2714 emits light. In other words, only the sub-pixel 1 emits light. On the other hand, when a Hi signal is inputted to the first signal line 2715 and a Lo signal is inputted to the second signal line 2725, only the second driving transistor 2723 is turned on; therefore, only the second light emitting elements 2724 emits light. In other words, only the sub-pixel 2 emits light. In addition, when a Lo signal is inputted to both the first and second signal lines 2715 and 2725, both the first and second driving transistors 2713 and 2723 are turned on; therefore, the first and second light emitting elements 2714 and 2724 emit light. In other words, both the sub-pixels 1 and 2 emit light.

Here, currents flowing to the first and second light emitting elements 2714 and 2724 can be controlled by controlling voltages of video signals inputted to the first and second signal lines 2715 and 2725. As a result, luminance of each sub-pixel can be changed, and a gray scale can be expressed. For example, in a case where the sub-pixel 1 with an area of 1 is lighted in SF11 having a lighting period of 0.5, the light emission intensity is 0.5; however, by changing a level of voltage of a video signal inputted to the first signal line 2715, the luminance of the first light emitting element 2714 can be changed. Accordingly, even more gray scales can be expressed than gray scales expressed using areas of sub-pixels and lengths of lighting periods of sub-frames. Also, by expressing a gray scale with voltage applied to a light emitting element included in each sub-pixel in addition to using the area of a sub-pixel and the length of a lighting period of a sub-frame, the same gray scale level can be expressed with less number of sub-pixels and less number of sub-frames. Accordingly, aperture ratio of a pixel portion can be increased. Also, duty ratio can be improved, and luminance can be increased. Further, by the improvement in duty ratio, voltage applied to the light emitting element can be made to be small. Consequently, power consumption can be reduced, and degradation of the light emitting element can be reduced.

Note that in order to realize the pixel configuration shown in FIG. 27, in a case of dividing one pixel into m (m is an integer of m≧2) sub-pixels, the number of signal lines in one pixel may be 2 or more and m or less, and a selection transistor included in at least one sub-pixel among the m sub-pixels may be connected to a signal line different from that connected to selection transistors included in other sub-pixels.

Figure 28:
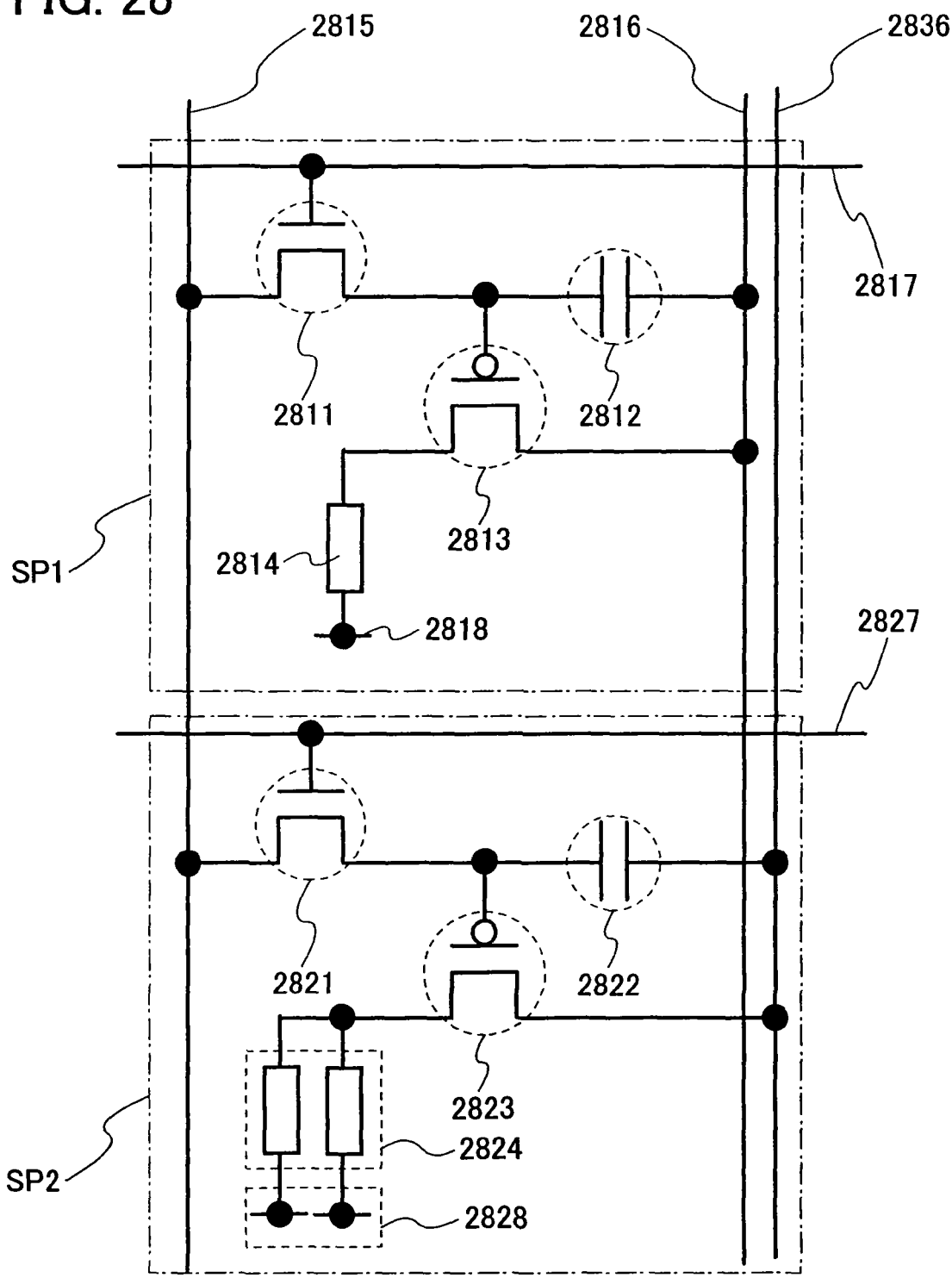
FIG. 28 shows an example of a pixel configuration in a case where a period in which a signal is written to a pixel and a lighting period are separated.

Although a common power supply line (the first power supply lines 2616 and 2716) is connected to each sub-pixel in FIG. 26 and FIG. 27, a plurality of power supply lines may be provided to change a power supply voltage that is applied to each sub-pixel. For example, FIG. 28 shows a configuration example of a case in FIG. 26 where two power supply lines are provided.

First, a pixel configuration shown in FIG. 28 will be explained. The sub-pixel 1 includes a first selection transistor 2811, a first driving transistor 2813, a first holding capacitor 2812, a signal line 2815, a first power supply line 2816, a first scanning line 2817, a first light emitting element 2814, and a second power supply line 2818.

In the first selection transistor 2811, a gate electrode is connected to the first scanning line 2817, a first electrode is connected to the signal line 2815, and a second electrode is connected to a second electrode of the first holding capacitor 2812 and a gate electrode of the first driving transistor 2813. A first electrode of the first holding capacitor 2812 is connected to the first power supply line 2816. In the first driving transistor 2813, a first electrode is connected to the first power supply line 2816, and a second electrode is connected to a first electrode of the first light emitting element 2814. A second electrode of the first light emitting element 2814 is connected to the second power supply line 2818.

The sub-pixel 2 includes a second selection transistor 2821, a second driving transistor 2823, a second holding capacitor 2822, the signal line 2815, a second scanning line 2827, second light emitting elements 2824, a third power supply line 2828, and a fourth power supply line 2836. Note that connections of each element and wiring of the sub-pixel 2 is similar to those of the sub-pixel 1; thus, the explanation is omitted.

Here, currents flowing to the first and second light emitting elements 2814 and 2824 can be controlled by controlling voltages applied to the first and fourth power supply lines 2816 and 2836. As a result, luminance of each sub-pixel can be changed, and a gray scale can be expressed. For example, in a case where the sub-pixel 1 with an area of 1 is lighted in SF11 having a lighting period of 0.5, light emission intensity is 0.5; however, by changing a level of voltage applied to the first power supply line 2816, the luminance of the first light emitting element 2814 can be changed. Accordingly, even more gray scales can be expressed than gray scales expressed using areas of sub-pixels and lengths of lighting periods of sub-frames. Also, by expressing a gray scale with voltage applied to a light emitting element included in each sub-pixel in addition to using the area of a sub-pixel and the length of a lighting period of a sub-frame, the same gray scale level can be expressed with less number of sub-pixels and less number of sub-frames. Accordingly, aperture ratio of a pixel portion can be increased. Also, duty ratio can be improved, and luminance can be increased. Further, by the improvement in duty ratio, voltage applied to the light emitting element can be made to be small. Consequently, power consumption can be reduced, and degradation of the light emitting element can be reduced.

Note that in order to realize the pixel configuration shown in FIG. 28, in a case of dividing one pixel into m (m is an integer of m≧2) sub-pixels, the number of power supply lines that are equivalent to the first power supply lines in FIG. 26 and FIG. 27 in one pixel may be 2 or more and m or less, and a driving transistor included in at least one sub-pixel among the m sub-pixels may be connected to the foregoing power supply line different from that connected to driving transistors included in other sub-pixels.

Figure 29:
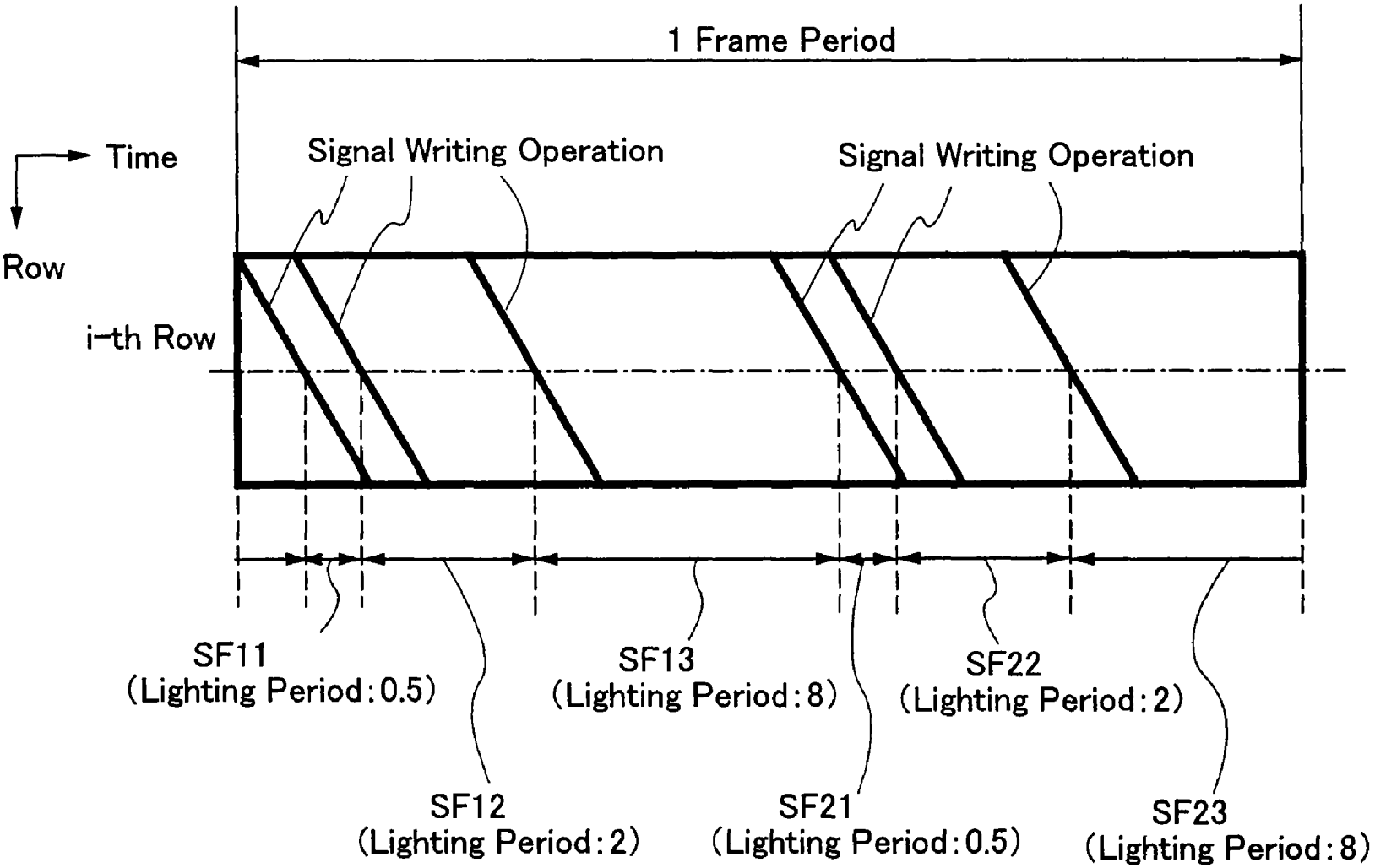
FIG. 29 shows an example of a timing chart in a case where a period in which a signal is written to a pixel and a lighting period are not separated.

Then, FIG. 29 shows a timing chart in a case where a period where signals are written to a pixel and a lighting period are not separated. A lighting period starts immediately after signals are written to each row.

In a certain row, after writing of signals and a prescribed lighting period are completed, a signal writing operation starts in a subsequent sub-frame. By repeating signal writing, the lengths of the lighting periods are arranged in an order of 0.5, 2, 8, 0.5, 2, and 8.

In this manner, many sub-frames can be arranged in one frame even if an operation of signal writing is slow.

Such a driving method is preferably applied to a plasma display. Note that, in a case where the driving method is used for a plasma display, an initialization operation and the like are required, which are omitted in FIG. 29 for simplicity.

Moreover, this driving method is also preferably applied to an EL display, a field emission display, a display using a Digital Micromirror Device (DMD), or the like.

Figure 30:
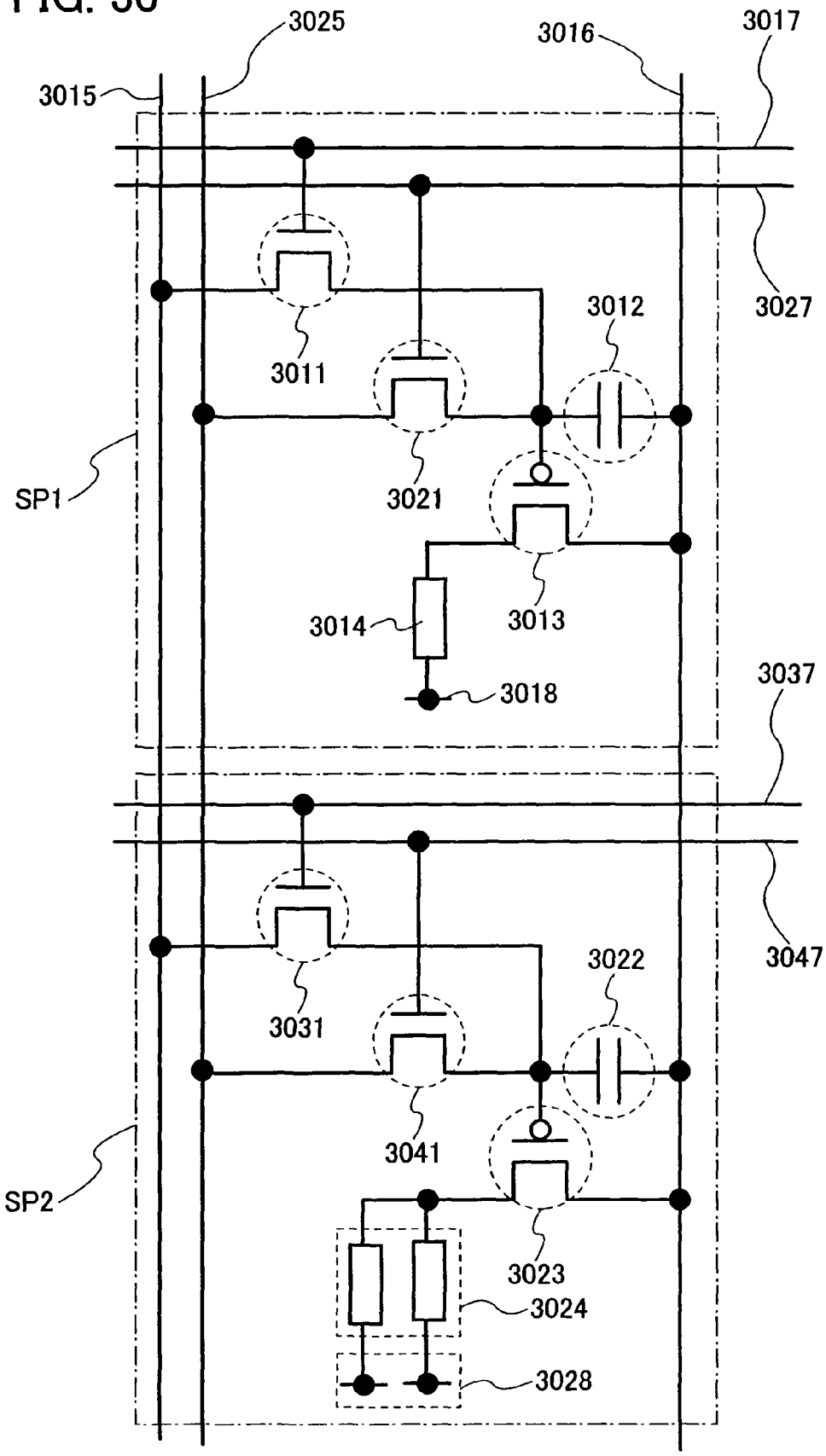
FIG. 30 shows an example of a pixel configuration in a case where a period in which a signal is written to a pixel and a lighting period are not separated.

Here, FIG. 30 shows a pixel configuration for realizing a driving method where a period where a signal is written to a pixel and a lighting period are not separated. Note that, in order to realize such a driving method, it is necessary that a plurality of rows can be simultaneously selected.

First, a pixel configuration shown in FIG. 30 will be explained. The sub-pixel 1 includes first and second selection transistors 3011 and 3021, a first driving transistor 3013, a first holding capacitor 3012, first and second signal lines 3015 and 3025, a first power supply line 3016, first and second scanning lines 3017 and 3027, a first light emitting element 3014, and a second power supply line 3018.

In the first selection transistor 3011, a gate electrode is connected to the first scanning line 3017, a first electrode is connected to the first signal line 3015, and a second electrode is connected to a second electrode of the second selection transistor 3021, a second electrode of the first holding capacitor 3012, and a gate electrode of the first driving transistor 3013. In the second selection transistor 3021, a gate electrode is connected to the second scanning line 3027, and a first electrode is connected to the second signal line 3025. A first electrode of the first holding capacitor 3012 is connected to the first power supply line 3016. In the first driving transistor 3013, a first electrode is connected to the first power supply line 3016, and a second electrode is connected to a first electrode of the first light emitting element 3014. A second electrode of the first light emitting element 3014 is connected to the second power supply line 3018.

The sub-pixel 2 includes third and fourth selection transistors 3031 and 3041, a second driving transistor 3023, a second holding capacitor 3022, the first and second signal lines 3015 and 3025, the first power supply line 3016, third and fourth scanning lines 3037 and 3047, second light emitting elements 3024, and a third power supply line 3028. Note that connections of each element and wiring of the sub-pixel 2 is similar to those of the sub-pixel 1; thus, the explanation is omitted.

Next, an operation of the pixel shown in FIG. 30 will be explained. Here, an operation of the sub-pixel 1 will be explained. The first scanning line 3017 is selected by increasing the potential of the first scanning line 3017, the first selection transistor 3011 is turned on, and a signal is inputted to the first holding capacitor 3012 from the first signal line 3015. Thus, in accordance with the signal, the current of the first driving transistor 3013 is controlled, and a current flows from the first power supply line 3016 to the first light emitting element 3014. Similarly, the second scanning line 3027 is selected by increasing the potential of the second scanning line 3027, the second selection transistor 3021 is turned on, and a signal is inputted to the first holding capacitor 3012 from the second signal line 3025. Thus, in accordance with the signal, the current of the first driving transistor 3013 is controlled, and a current flows from the first power supply line 3016 to the first light emitting element 3014. Note that an operation of the sub-pixel 2 is similar to that of the sub-pixel 1; thus, the explanation is omitted.

The first and second scanning lines 3017 and 3027 can be controlled separately. Similarly, the third and fourth scanning lines 3037 and 3047 can be controlled separately. In addition, the first and the second signal lines 3015 and 3025 can be controlled separately. Accordingly, signals can be imputed to two rows of pixels at the same time, thus, the driving method as shown in FIG. 29 can be achieved.

Figure 31:
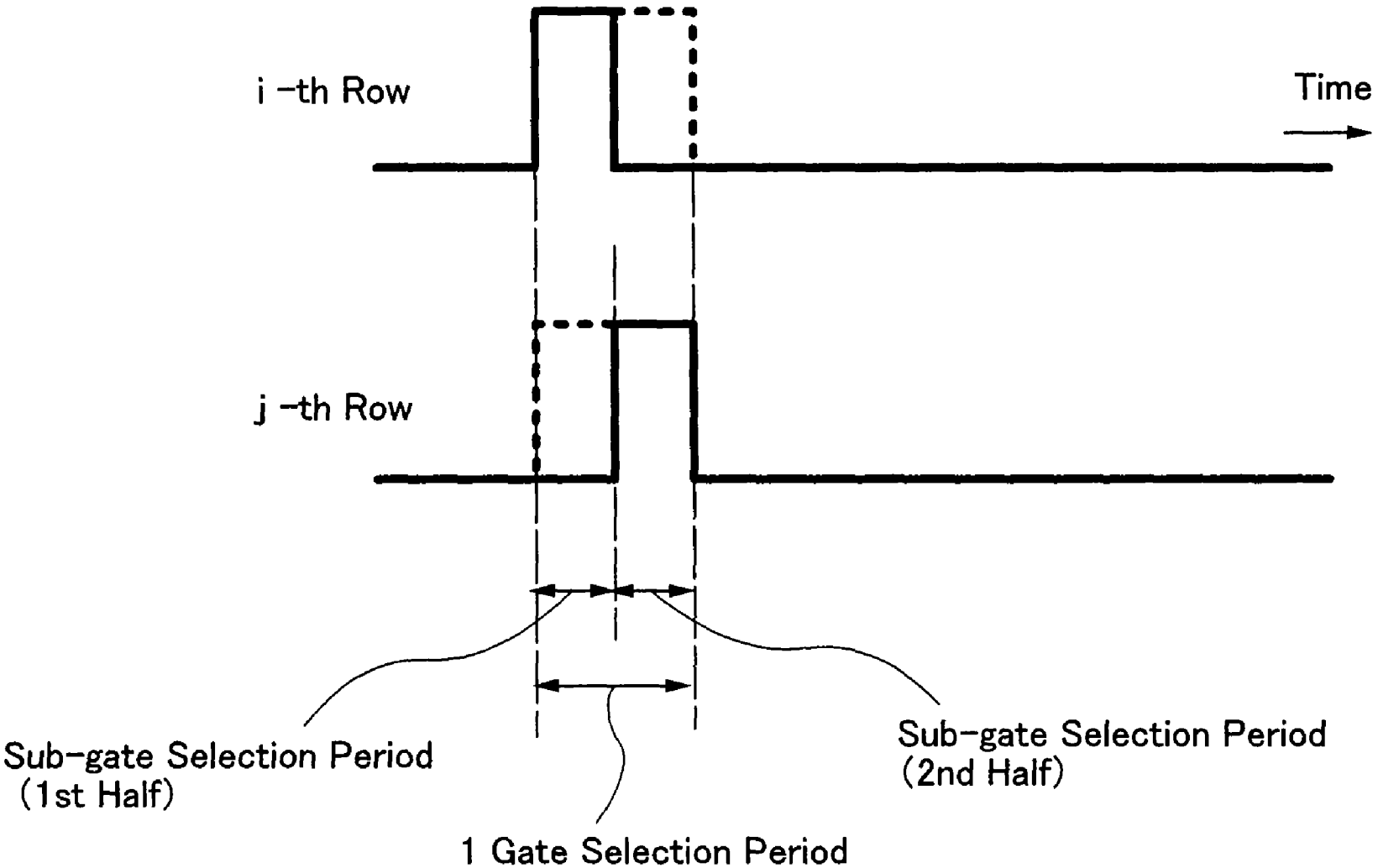
FIG. 31 shows an example of a timing chart for selecting two rows in one gate selection period.

Note that the driving method as shown in FIG. 29 can also be achieved using the circuit in HG 26. At this time, a method of dividing one gate selection period into a plurality of sub-gate selection periods is used. First, as shown in FIG. 31, one gate selection period is divided into a plurality of sub-gate selection periods (two in FIG. 31). Each scanning line is selected in each of the sub-gate selection periods by increasing the potential of each scanning line, and a corresponding signal at that time is inputted to the signal line 2615. For example, in one gate selection period, the i-th row is selected in the first half of the period and the j-th row is selected in the latter half of the period. Accordingly, an operation can be performed as if the two rows are selected at the same time in one gate selection period.

Note that details of such a driving method are mentioned in, for example, Japanese Patent Laid-Open No. 2001-324958 and the like, which can be applied in combination with the present application.

Although FIG. 30 shows an example of providing a plurality of scanning lines, one signal line may be provided and the first electrodes of the first to fourth selection transistors may be connected to the signal line. In addition, a plurality of power supply lines that are equivalent to the first power supply line in FIG. 30 may be provided.

Figure 32:
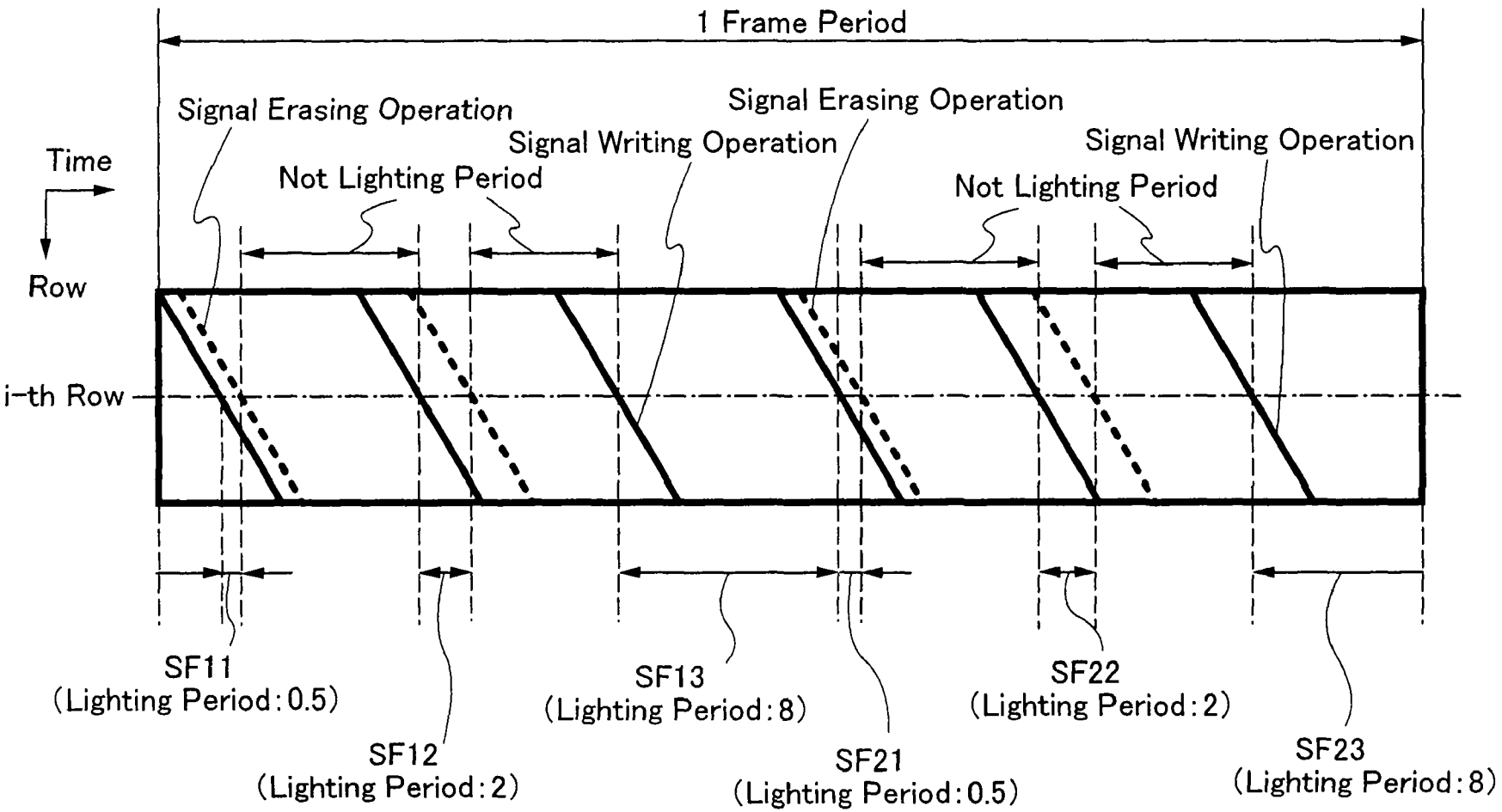
FIG. 32 shows an example of a timing chart in a case of erasing a signal of a pixel.

Next, FIG. 32 shows a timing chart in a case where signals of pixels are erased. In each row, a signal writing operation is performed and the signals of the pixels are erased before a subsequent signal writing operation. Consequently, the length of a lighting period can be easily controlled.

In a certain row, after writing of signals and a prescribed lighting period are completed, a signal writing operation starts in a subsequent sub-frame. In a case where a lighting period is short, a signal erasing operation is performed on forcibly provide a non-lighting state. By repeating such operations, the lengths of the lighting periods are arranged in an order of 0.5, 2, 8, 0.5, 2, and 8.

Note that, although the signal erasing operation is performed in the case where the lighting periods are 0.5 and 2 in FIG. 32, it is not limited thereto. The erasing operation may be performed in other lighting periods.

Accordingly, many sub-frames can be arranged in one frame even if an operation of signal writing is slow. Moreover, in the case of performing the signal erasing operation, data for erasing is not required to be obtained as well as a video signal; therefore, the driving frequency of a source driver can also be reduced.

Such a driving method is preferably applied to a plasma display. Note that, in a case where the driving method is used for a plasma display, an initialization operation and the like are required, which are omitted in FIG. 32 for simplicity.

Moreover, this driving method is also preferably applied to an EL display, a field emission display, a display using a Digital Micromirror Device (DMD), or the like.

Figure 33:
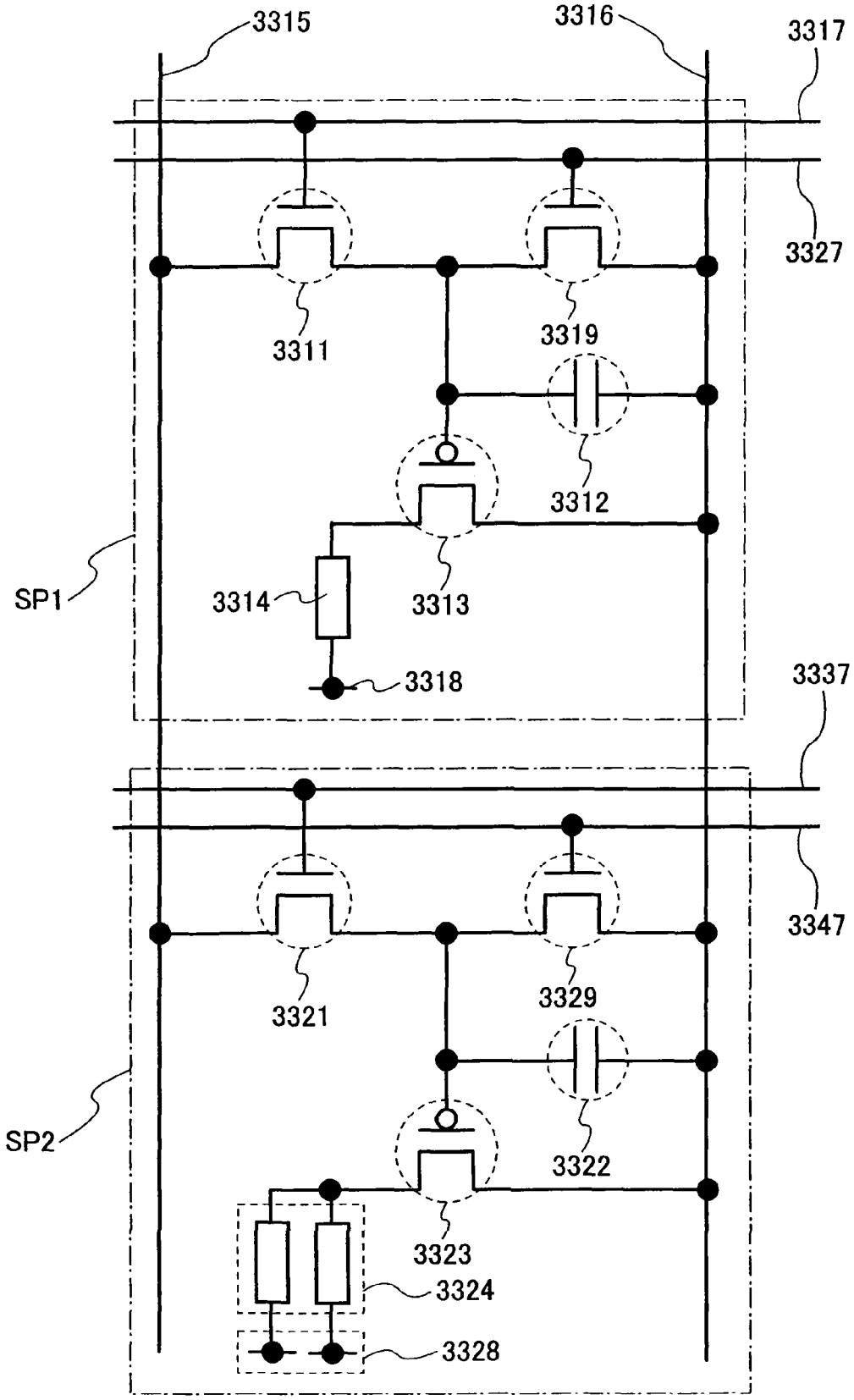
FIG. 33 shows an example of a pixel configuration in a case of erasing a signal of a pixel.

Here, FIG. 33 shows a pixel configuration in a case of performing an erasing operation. A pixel shown in FIG. 33 is a configuration example in a case of performing an erasing operation by using an erasing transistor.

First, a pixel configuration shown in FIG. 33 will be explained. The sub-pixel 1 includes a first selection transistor 3311, a first driving transistor 3313, a first erasing transistor 3319, a first holding capacitor 3312, a signal line 3315, a first power supply line 3316, first and second scanning lines 3317 and 3327, a first light emitting element 3314, and a second power supply line 3318.

In the first selection transistor 3311, a gate electrode is connected to the first scanning line 3317, a first electrode is connected to the signal line 3315, and a second electrode is connected to a second electrode of the first erasing transistor 3319, a second electrode of the first holding capacitor 3312, and a gate electrode of the first driving transistor 3313. In the first erasing transistor 3319, a gate electrode is connected to the second scanning line 3327, and a first electrode is connected to the first power supply line 3316. A first electrode of the first holding capacitor 3312 is connected to the first power supply line 3316. In the first driving transistor 3313, a first electrode is connected to the first power supply line 3316, and a second electrode is connected to a first electrode of the first light emitting element 3314. A second electrode of the first light emitting element 3314 is connected to the second power supply line 3318.

The sub-pixel 2 includes a second selection transistor 3321, a second driving transistor 3323, a second erasing transistor 3329, a second holding capacitor 3322, the signal line 3315, the first power supply line 3316, third and fourth scanning lines 3337 and 3347, second light emitting elements 3324, and a third power supply line 3328. Note that connections of each element and wiring of the sub-pixel 2 is similar to those of the sub-pixel 1; thus, the explanation is omitted.

Next, an operation of the pixel shown in FIG. 33 will be explained. Here, an operation of the sub-pixel 1 will be explained. The first scanning line 3317 is selected by increasing the potential of the first scanning line 3317, the first selection transistor 3311 is turned on, and a signal is inputted to the first holding capacitor 3312 from the signal line 3315. Thus, in accordance with the signal, the current of the first driving transistor 3313 is controlled, and a current flows from the first power supply line 3316 to the first light emitting element 3314.

In order to erase a signal, the second scanning line 3327 is selected by increasing the potential of the second scanning line 3327, the first erasing transistor 3319 is turned on, and the first driving transistor 3313 is turned off. Thus, no current flows through the first light emitting element 3314. Consequently, a non-lighting period can be provided, and the length of a lighting period can be freely controlled.

Note that an operation of the sub-pixel 2 is similar to that of the sub-pixel 1; thus, the explanation is omitted.

Although the erasing transistors 3319 and 3329 are used in FIG. 33, another method may be used. This is because a non-lighting period may forcibly be provided so that no current is supplied to the light emitting elements 3314 and 3324. Therefore, a non-lighting period may be provided by placing a switch somewhere in a path where a current flows from the first power supply line 3316 to the second and third power supply lines 3318 and 3328 through the light emitting elements 3314 and 3324, and controlling on/off of the switch. Alternatively, a gate-source voltage of the driving transistors 3313 and 3323 may be controlled to forcibly turn the driving transistors off.

Figure 34:
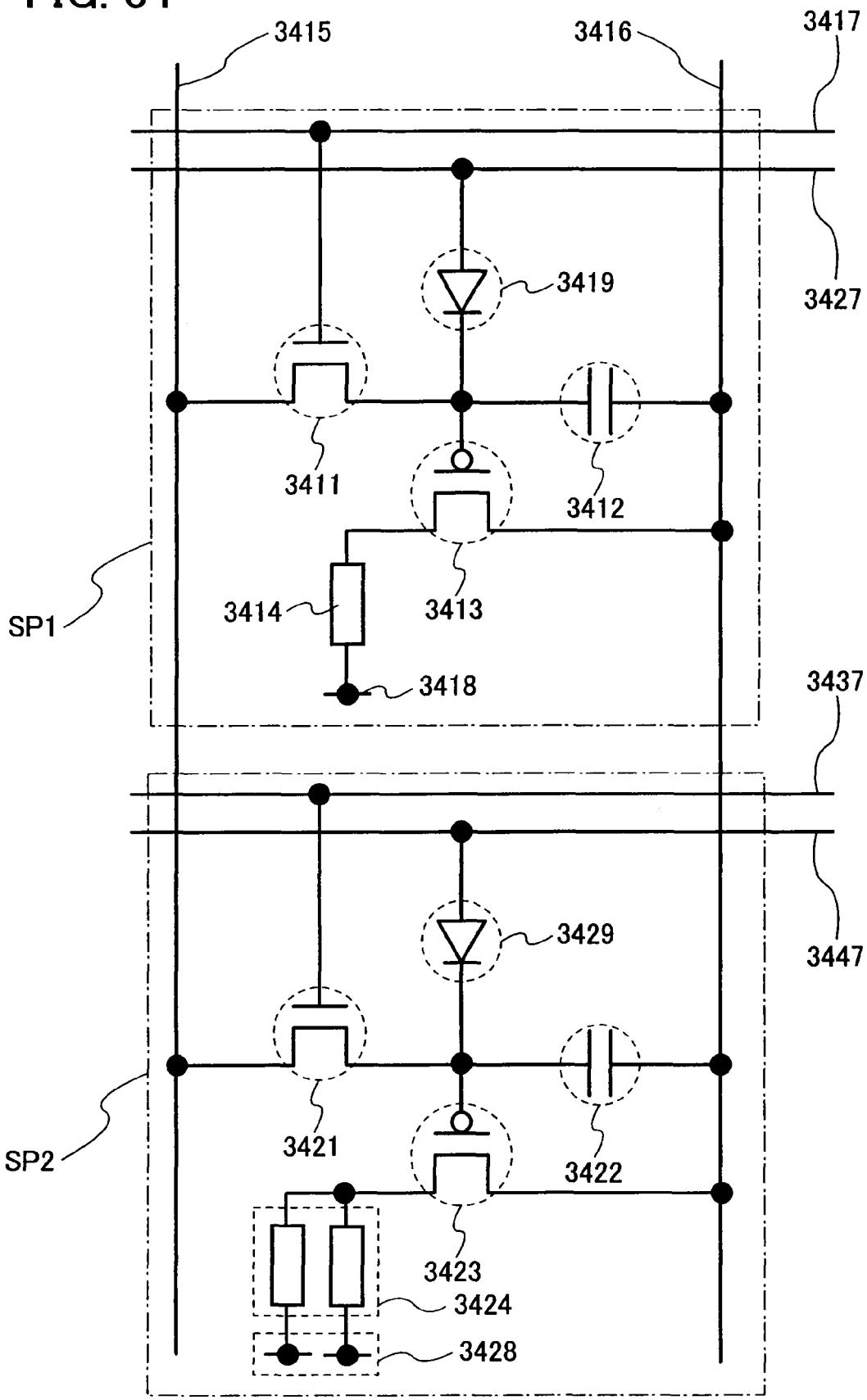
FIG. 34 shows an example of a pixel configuration in a case of erasing a signal of a pixel.

Here, FIG. 34 shows an example of a pixel configuration in a case where a driving transistor is forcibly turned off. The pixel shown in FIG. 34 is a configuration example in a case where a driving transistor is forcibly turned off by using an erasing diode.

First, the pixel configuration shown in FIG. 34 will be explained. The sub-pixel 1 includes a first selection transistor 3411, a first driving transistor 3413, a first holding capacitor 3412, a signal line 3415, a first power supply line 3416, a first scanning line 3417, a second scanning line 3427, a first light emitting element 3414, a second power supply line 3418, and a first erasing diode 3419.

In the first selection transistor 3411, a gate electrode is connected to the first scanning line 3417, a first electrode is connected to the signal line 3415, a second electrode is connected to a second electrode of the first erasing diode 3419, a second electrode of the first holding capacitor 3412, and a gate electrode of the first driving transistor 3413. A first electrode of the first erasing diode 3419 is connected to the second scanning line 3427. A first electrode of the first holding capacitor 3412 is connected to the first power supply line 3416. In the first driving transistor 3413, a first electrode is connected to the first power supply line 3416, and a second electrode is connected to a first electrode of the first light emitting element 3414. A second electrode of the first light emitting element 3414 is connected to the second power supply line 3418.

The sub-pixel 2 includes a second selection transistor 3421, a second driving transistor 3423, a second holding capacitor 3422, the signal line 3415, the first power supply line 3416, third and fourth scanning lines 3437 and 3447, second light emitting elements 3424, a third power supply line 3428, and a second erasing diode 3429. Note that connections of each element and wiring of the sub-pixel 2 is similar to those of the sub-pixel 1; thus, the explanation is omitted.

Next, an operation of the pixel shown in FIG. 34 will be explained. Here, an operation of the sub-pixel 1 will be explained. The first scanning line 3417 is selected by increasing the potential of the first scanning line 3417, the first selection transistor 3411 is turned on, and a signal is inputted to the first holding capacitor 3412 from the signal line 3415. Thus, in accordance with the signal, the current of the first driving transistor 3413 is controlled, and a current flows from the first power supply line 3416 to the first light emitting element 3414.

In order to erase a signal, the second scanning line 3427 is selected by increasing the potential of the second scanning line 3427, the first erasing diode 3419 is turned on, and a current flows from the second scanning line 3427 to the gate electrode of the first driving transistor 3413. Consequently, the first driving transistor 3413 is turned off. Thus, no current flows through the first light emitting element 3214 from the first power supply line 3416. Consequently, a non-lighting period can be provided, and the length of a lighting period can be freely controlled.

In order to hold a signal, the second scanning line 3427 is not selected by reducing the potential of the second scanning line 3427. Thus, the first erasing diode 3419 is turned off and the gate potential of the first driving transistor 3413 is thus held.

Note that an operation of the sub-pixel 2 is similar to that of the sub-pixel 1; thus, the explanation is omitted.

Note that the erasing diodes 3419 and 3429 may be any element as far as the erasing diodes have rectifying properties. The erasing diodes may be a PN diode, a PIN diode, a Schottky diode, or a Zener diode.

Figure 35:
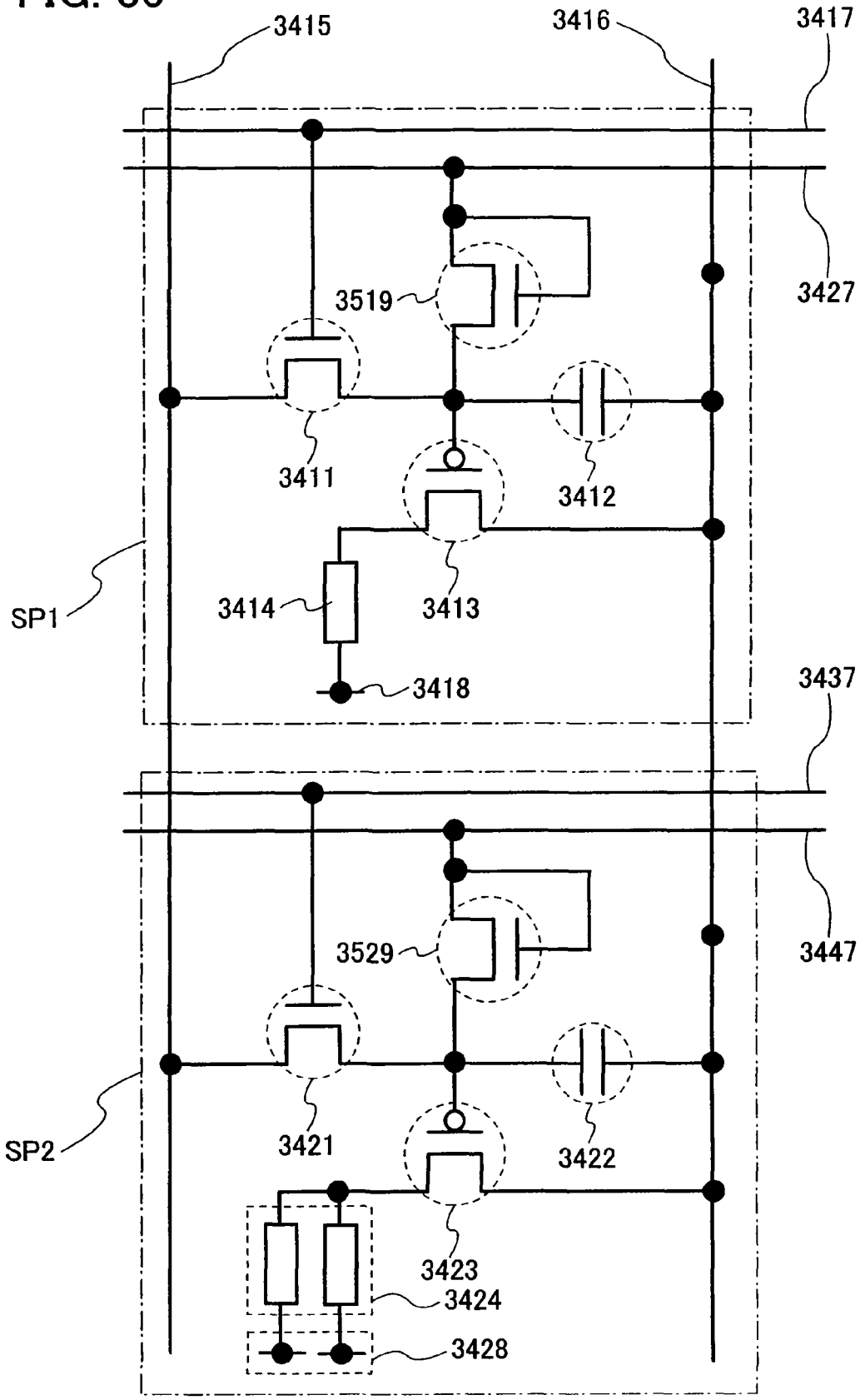
FIG. 35 shows an example of a pixel configuration in a case of erasing a signal of a pixel.

In addition, a diode-connected transistor (a gate and a drain thereof are connected) may also be used. FIG. 35 shows a circuit diagram of this case. As the first and second erasing diodes 3419 and 3429, diode-connected transistors 3519 and 3529 are used. Although an N-channel transistor is used as the diode-connected transistor herein, the present invention is not limited thereto and a P-channel transistor may also be used.

Note that the driving method as shown in FIG. 32 can also be realized using the circuit in FIG. 26 as another circuit. In this case, a method of dividing one gate selection period into a plurality of sub-gate selection periods is used. First, as shown in FIG. 31, one gate selection period is divided into a plurality of sub-gate selection periods (two in FIG. 31). Each scanning line is selected in each of the sub-gate selection periods by increasing the potential of each scanning line and a corresponding signal (a video signal and an erasing signal) at that time is inputted to the signal line 2615. For example, in one gate selection period, an i-th row is selected in the first half, and a j-th row is selected in the latter half. Then, when the i-th row is selected, a video signal to be inputted to a pixel in the i-th row is inputted to the signal line 2615. On the other hand, when the j-th row is selected, a signal, which turns off the driving transistor of a pixel in the j-th row, is inputted to the signal line 2615. Accordingly, an operation can be performed as if the two rows are selected at the same time in one gate selection period.

Note that details of such a driving method are mentioned in, for example, Japanese Patent Laid-Open No. 2001-324958 and the like, which can be applied in combination with the present application.

Although FIG. 33, FIG. 34, and FIG. 35 each show an example of providing a plurality of scanning lines, a plurality of signal lines may also be provided, or a plurality of power supply lines that are equivalent to the first power supply lines in FIGS. 33 to 35 may also be provided.

Note that the timing charts, pixel configurations, and driving methods that are shown in this embodiment mode are each one example, and the present invention is not limited thereto. The present invention can be applied to various timing charts, pixel configurations, and driving methods.

Note that a lighting period, a signal writing period, and a non-lighting period are arranged in one frame in this embodiment mode; however, the present invention is not limited thereto and other operation periods may also be arranged. For example, a so-called reverse bias period may be provided, which is a period where voltage that is to be applied to a light emitting element is made to have an opposite polarity than usual. By providing the reverse bias period, reliability of the light emitting element is improved in some cases.

Note that in the pixel configuration described in this embodiment mode, the polarity of a transistor is not limited thereto.

Note that in the pixel configuration described in this embodiment mode, a holding capacitor can be omitted by substituting it with parasitic capacitance of a transistor.

Note that the content described in this embodiment mode can be implemented by being freely combined with the contents described in Embodiment Modes 1 and 2.

Embodiment Mode 4

Figure 36:
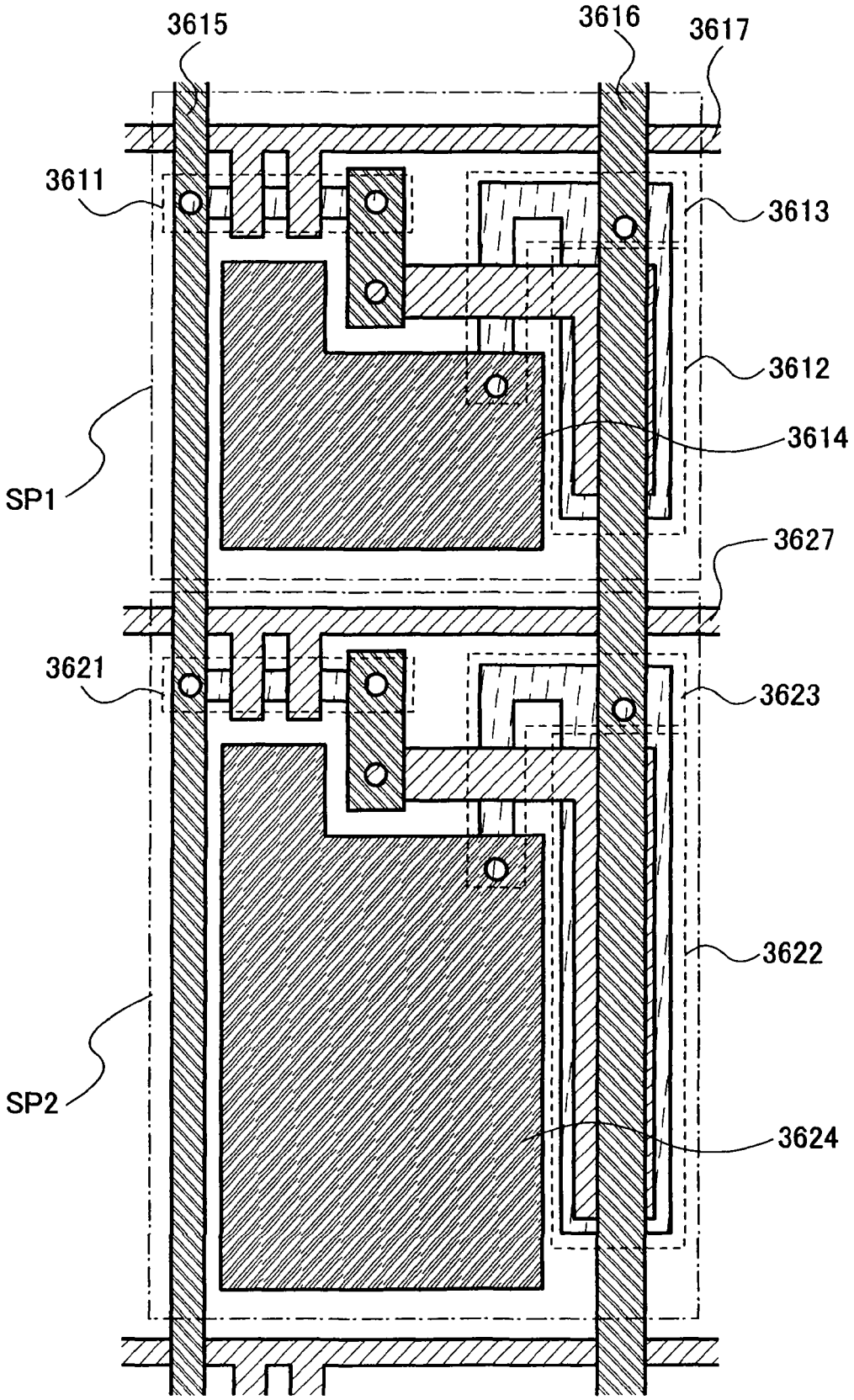
FIG. 36 shows an example of a pixel portion layout of a display device using a driving method of the present invention.

This embodiment mode will describe a layout of a pixel in a display device of the present invention. As an example, FIG. 36 shows a layout diagram of the circuit diagram shown in FIG. 26. Note that the circuit diagram and the layout diagram are not limited to FIG. 26 and FIG. 36.

First and second selection transistors 3611 and 3621, first and second driving transistors 3613 and 3623, first and second holding capacitors 3612 and 3622, electrodes 3614 and 3624 of first and second light emitting elements, a signal line 3615, a power supply line 3616, and first and second scanning lines 3617 and 3627 are arranged in FIG. 36. As for a sub-pixel 1 (SP1), a source electrode and a drain electrode of the first selection transistor 3611 are each connected to the signal line 3615 and a gate electrode of the first driving transistor 3613. A gate electrode of the first selection transistor 3611 is connected to the first scanning line 3617. A source electrode and a drain electrode of the first driving transistor 3613 are respectively connected to the power supply line 3616 and the electrode 3614 of the first light emitting element. The first holding capacitor 3612 is connected between the gate electrode of the first driving transistor 3613 and the power supply line 3616. There are the same connection relations also as for a sub-pixel 2 (SP2). Then, the electrodes 3614 and 3624 of the first and second light emitting elements have an area ratio of 1:2.

The signal line 3615 and the power supply line 3616 are each formed of a second wiring, whereas the first and second scanning lines 3607 and 3617 are each formed of a first wiring.

Figure 37:
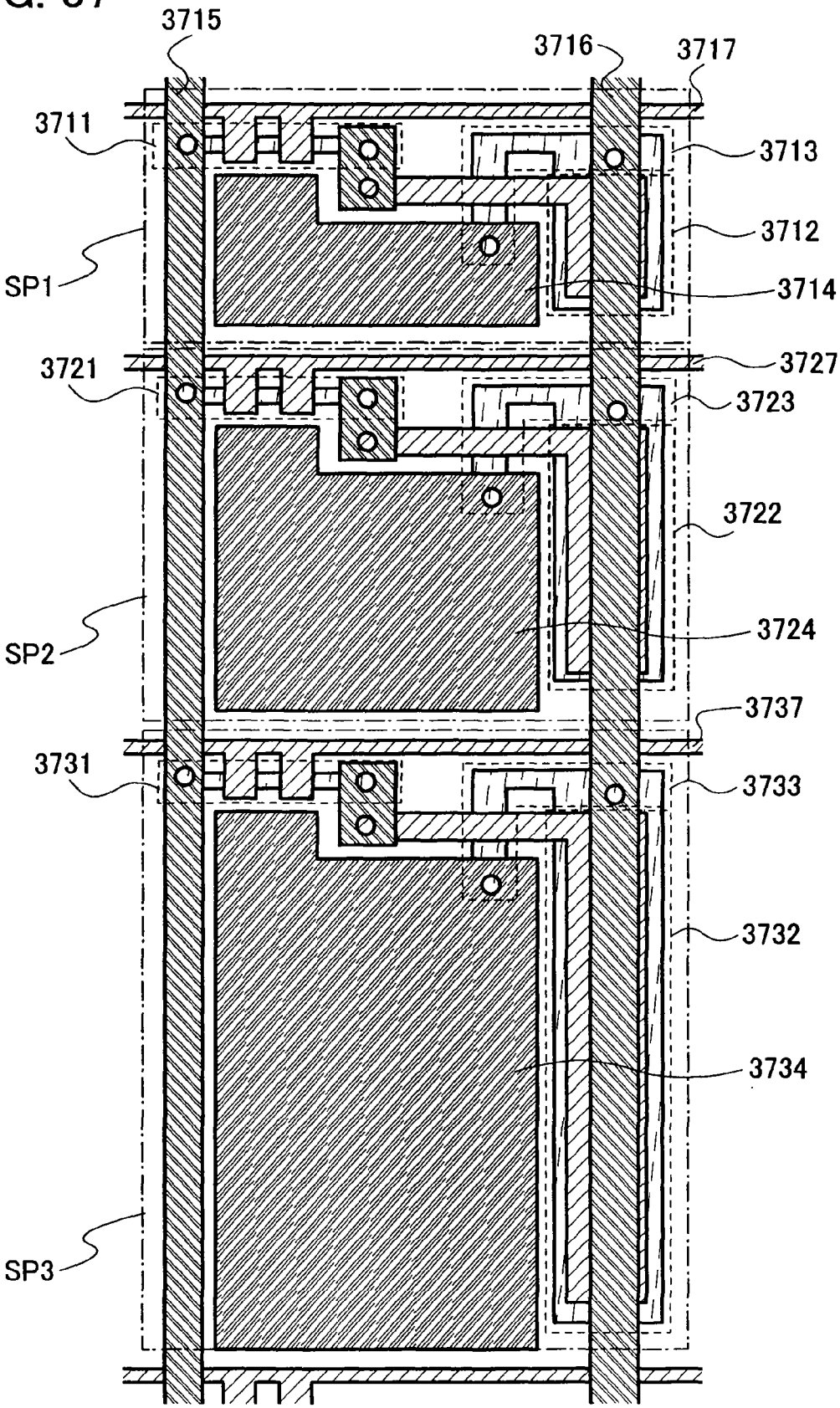
FIG. 37 shows an example of a pixel portion layout of a display device using a driving method of the present invention.

FIG. 37 shows an example of a layout of a pixel in a case where the sub-pixels have an area ratio of 1:2:4. FIG. 37 includes first, second, and third selection transistors 3711, 3721, and 3731, first, second, and third driving transistors 3713, 3723, and 3733, first, second, and third holding capacitors 3712, 3722, and 3732, electrodes 3714, 3724, and 3734 of first, second, and third light emitting elements, a signal line 3715, a power supply line 3716, and first, second, and third scanning lines 3717, 3727, and 3737. Then, the electrodes 3714, 3724, and 3734 of the first, second, and third light emitting elements have an area ratio of 1:2:4.

In a case where a transistor has a top gate structure, films are formed in the order of a substrate, a semiconductor layer, a gate insulating film, a first wiring, an interlayer insulating film, and a second wiring. In a case where the transistor has a bottom gate structure, films are formed in the order of a substrate, a first wiring, a gate insulating film, a semiconductor layer, an interlayer insulating film, and a second wiring.

Figure 38:
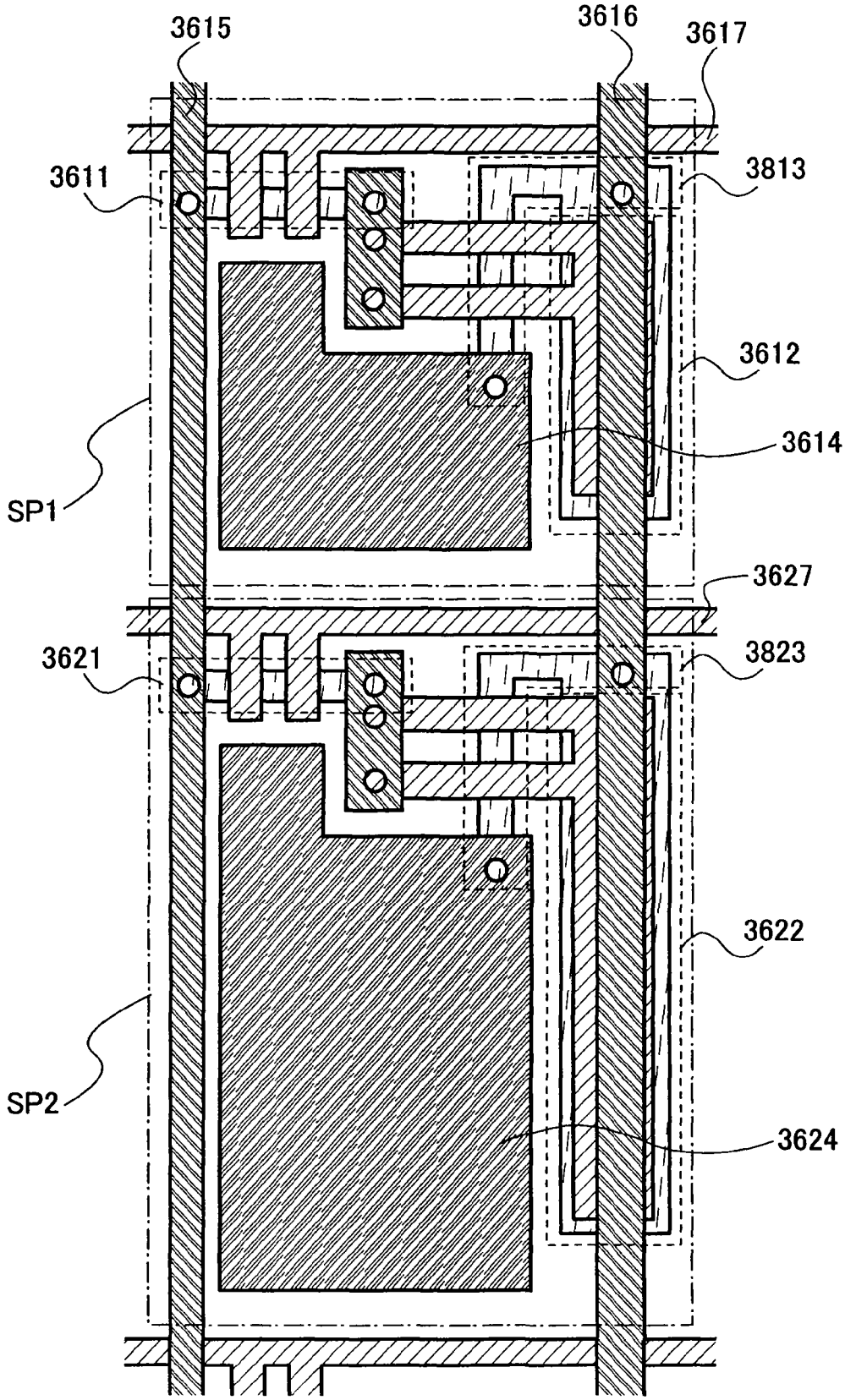
FIG. 38 shows an example of a pixel portion layout of a display device using a driving method of the present invention.

Note that in this embodiment mode, the selection transistors and the driving transistors have single gate structures; however, structures of these transistors can take a variety of modes. For example, a structure may be a multi-gate structure in which there are two or more gate electrodes. In a multi-gate structure, a structure is such that channel regions are serially connected; therefore, a structure is such that a plurality of transistors are serially connected. FIG. 38 shows a layout diagram of the driving transistors 3613 and 3623 in FIG. 36 having multi-gate structures. In FIG. 38, driving transistors 3813 and 3823 have multi-gate structures. By having a multi-gate structure, an off current can be reduced, reliability can be improved by improving pressure resistance of the transistors, and the transistors can have flat characteristics even if a drain-source voltage changes when operating in a saturation region, since a drain-source current does not change much. Also, the transistors may have a structure in which a gate electrode is placed over and under a channel. By having a structure in which a gate electrode is placed over and under a channel, current value is increased since the number of channel regions increases, and an S-value can be improved since it is easier to form a depletion layer. When a gate electrode is placed over and under a channel, a structure is such that a plurality of transistors are connected in parallel. Further, the transistors may have a structure in which a gate electrode is placed over a channel; one in which a gate electrode is placed under a channel; a forward staggered structure; a reverse staggered structure; or one in which a channel region is separated into a plurality of regions, of which the plurality of regions may be connected in parallel or serially connected. Further, a source electrode or a drain electrode may overlap with the channel (or a portion thereof). By having a structure in which a source electrode or a drain electrode overlaps with the channel (or a portion thereof), unstable operation due to accumulation of electrical charge in one portion of the channel can be prevented. Further, there may be an LDD region. By providing an LDD region, an off current can be reduced, reliability can be improved by improving pressure resistance of the transistors, and the transistors can have flat characteristics even if a drain-source voltage changes when operating in a saturation region, since a drain-source current does not change much.

Note that wirings and electrodes are formed to include: one element or a plurality of elements selected from a group consisting of aluminum (Al), tantalum (Ta), titanium (Ti), molybdenum (Mo), tungsten (W), neodymium (Nd), chromium (Cr), nickel (Ni), platinum (Pt), gold (Au), silver (Ag), copper (Cu), magnesium (Mg), scandium (Sc), cobalt (Co), zinc (Zn), niobium (Nb), silicon (Si), phosphorus (P), boron (B), arsenic (As), gallium (Ga), indium (In), tin (Sn), and oxygen (O); a compound or an alloy material having one element or a plurality of elements selected from the foregoing group (for example, indium tin oxide (ITO), indium zinc oxide (IZO), indium tin oxide added with silicon oxide (ITSO), zinc oxide (ZnO), aluminum-neodymium (Al—Nd), magnesium-silver (Mg—Ag), or the like); or a substance in which these compounds are combined. Alternatively, the wirings and electrodes are formed to include a compound of those and silicon (silicide) (for example, aluminum-silicon, molybdenum-silicon, nickel-silicide, or the like), or a compound of those and nitrogen (for example, titanium nitride, tantalum nitride, molybdenum nitride, or the like). Note that silicon (Si) may include a lot of N-type impurities (such as phosphorous) or P-type impurities (such as boron). By containing such impurities, conductivity improves and silicon acts in a similar manner to a regular conductor; therefore, it becomes easier to be used as a wiring or an electrode. Note that silicon may be single crystalline, polycrystalline (polysilicon), or amorphous (amorphous silicon). By using single crystalline silicon or polysilicon, resistance can be made small. By using amorphous silicon, manufacturing steps can be simplified. Note that since aluminum and silver have high conductivities, etching is carried out easily because signal delay can be reduced; therefore, it is easy to pattern, and microfabrication can be carried out. Note that since copper has high conductivity, signal delay can be reduced. Also, even if molybdenum comes into contact with an oxide semiconductor such as ITO or IZO, or silicon, a problem of defective materials or the like does not occur. Consequently, it is easy to carry out patterning or etching, and molybdenum has high heat resistance; therefore, it is desirable to use molybdenum to manufacture wirings and electrodes. Further, even if titanium comes into contact with an oxide semiconductor such as ITO or IZO, or silicon, a problem of defective materials or the like does not occur, and titanium has high heat resistance; therefore, it is desirable. Furthermore, tungsten and neodymium are desirable since they have high heat resistance. In particular, an alloy of neodymium and aluminum is desirable because heat resistance is improved, and a hillock is not easily caused. Silicon is desirable because it can be formed at the same time as a semiconductor layer included in a transistor, and has high heat resistance. Note that indium tin oxide (ITO), indium zinc oxide (IZO), indium tin oxide added with silicon oxide (ITSO), zinc oxide (ZnO), and silicon (Si), have light transmitting properties; therefore, they are desirable to be used in a portion where light is to permeate. For example, they can be used for a pixel electrode or a common electrode.

Note that these may have a single layer or a stacked-layer structure to form the wirings and electrodes. By forming the wirings and electrodes in a single layer structure, a manufacturing process can be simplified, the number of days required for the process can be reduced, and cost can be reduced. Also, by having a stacked-layer structure, wirings and electrodes with good performance can be formed by using the advantage and reducing the disadvantage of each material. For example, by including a material with low resistance (such as aluminum) in a stacked-layer structure, low resistance of a wiring can be realized. Also, if including a material having high heat resistance, for example a stacked-layer structure in which a material having low heat resistance but having another advantage is interposed between the materials having high heat resistance, can increase the overall heat resistance of a wiring or an electrode. For example, a stacked-layer structure in which a layer including aluminum is interposed between layers including molybdenum or titanium is desirable. Note that in a case where there is a portion of the wiring or the electrode coming into direct contact with a wiring or an electrode of a different material, the wirings or electrodes may adversely effect each other. For example, one material may go into the other material and change a property of the other material, and this may prevent an intended purpose from being achieved, or cause a problem which may inhibit normal manufacturing. In such a case, the problem can be solved by interposing a certain layer between other layers, or by covering the certain layer with another layer. For example, if indium tin oxide (ITO) and aluminum are to come into contact, it is desirable to interpose titanium or molybdenum therebetween. Also, if silicon and aluminum are to come into contact, it is desirable to interpose titanium or molybdenum therebetween.

Figure 39:
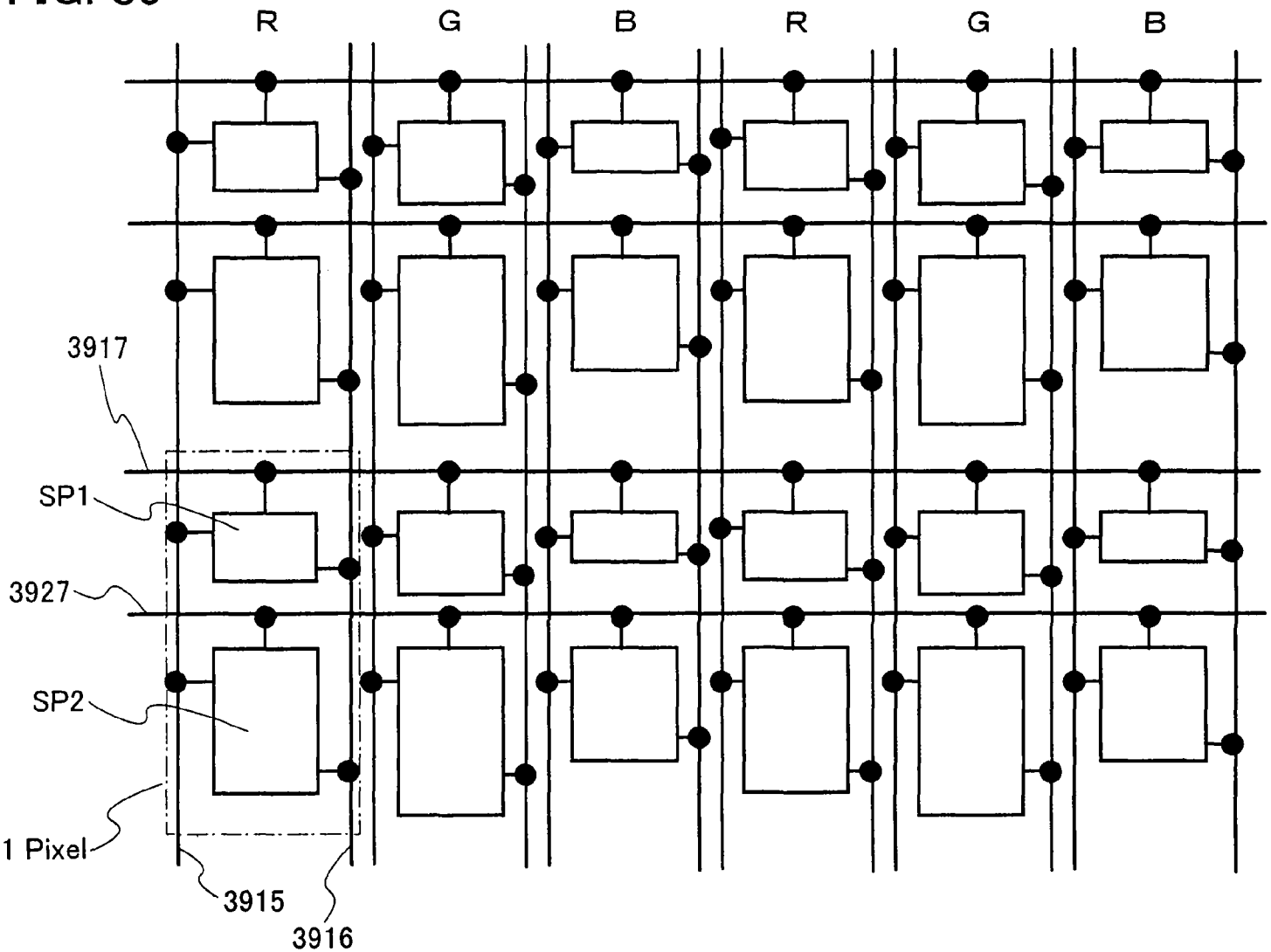
FIG. 39 shows an example of a pixel portion layout of a display device using a driving method of the present invention.

Note that the total light emission area of a pixel may be changed in each pixel of R (red), G (green), and B (blue). FIG. 39 shows an embodiment of this case.

In an example shown in FIG. 39, each pixel includes two sub-pixels. Also, a signal line 3915, a first power supply line 3916, and, first and second scanning lines 3917 and 3927 are arranged. Further, in FIG. 39, the size of an area of each sub-pixel corresponds to a light emission area of each sub-pixel.

In FIG. 39, the order of the total light-emission area of a pixel, from largest to smallest, is G, R, and B. Accordingly, appropriate color balance of R, G, and B can be realized; thus, it is possible to perform color display with higher resolution. Further, power consumption can be reduced, and the life of a light emitting element can be extended.

Figure 40:
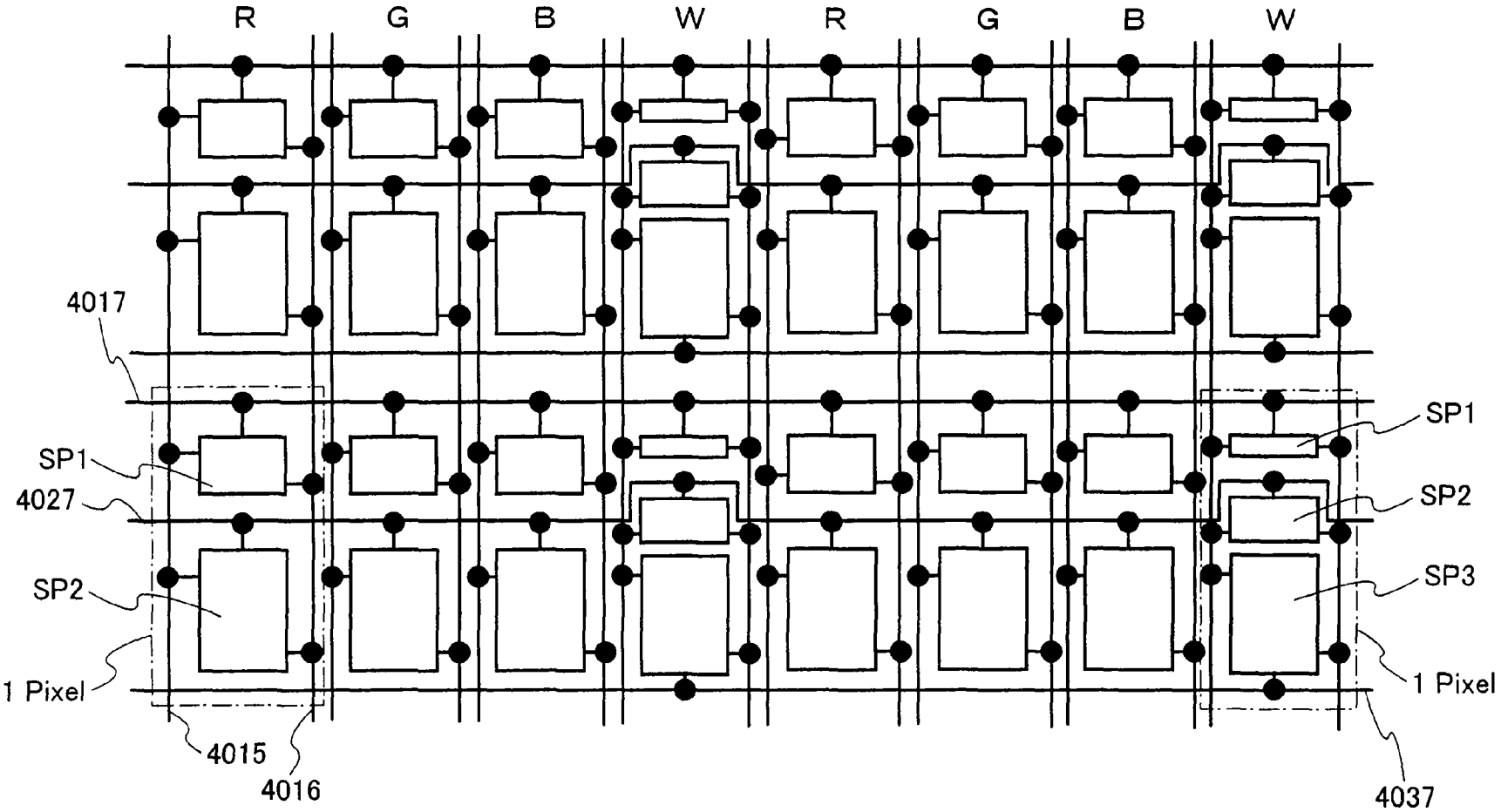
FIG. 40 shows an example of a pixel portion layout of a display device using a driving method of the present invention.

In addition, in a structure of R, G, B, and W (white), the number of sub-pixels in the RGB portion and the number of sub-pixels in the W portion may be different. FIG. 40 shows an embodiment of this case.

In FIG. 40, the RGB portion is divided into two sub-pixels, and the W portion is divided into three sub-pixels. Also, a signal line 4015, a first power supply line 4016, a first scanning line 4017, a second scanning line 4027, and a third scanning line 4037 are arranged.

In FIG. 40, the RGB portion is divided into two sub-pixels, and the W portion is divided into three sub-pixels. Accordingly, it is possible to perform white color display with higher resolution.

Note that the content described in this embodiment mode can be implemented by being freely combined with the contents described in Embodiment Modes 1 to 3.

Embodiment Mode 5

This embodiment mode will explain a structure and an operation of a signal line driver circuit, a scanning line driver circuit, and the like in a display device. This embodiment mode will explain an example in a case where one pixel is divided into two sub-pixels (SP1 and SP2).

Figure 41A:
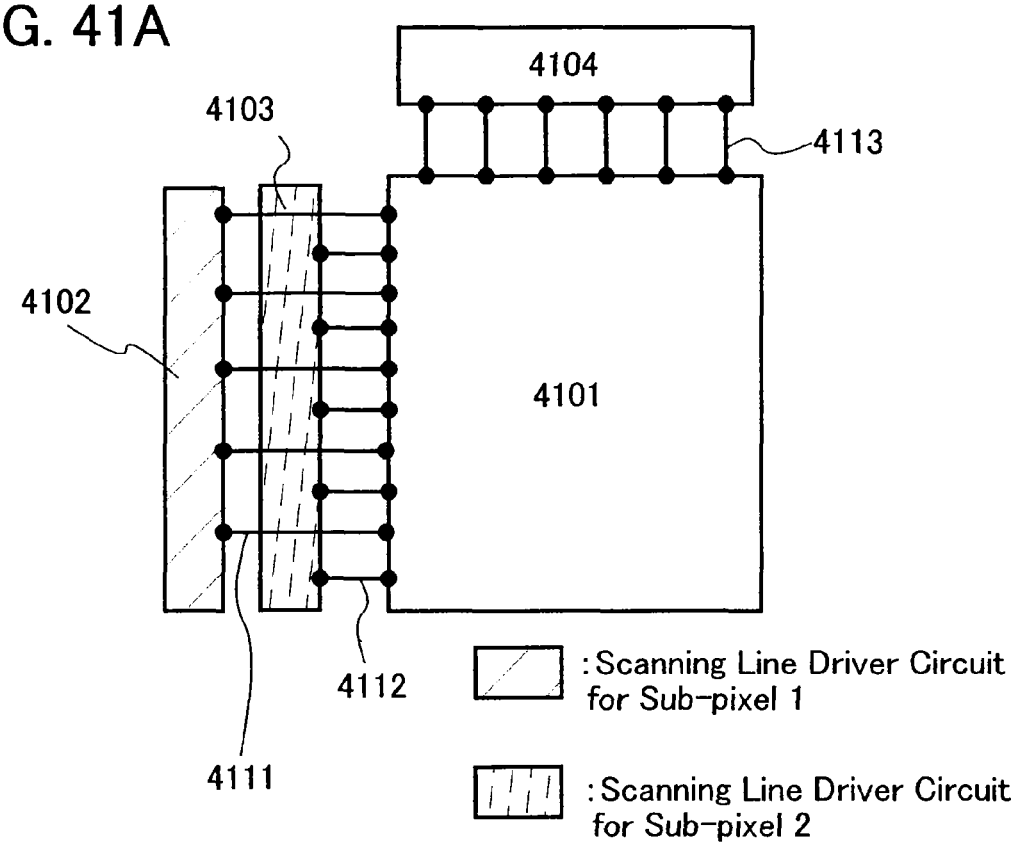
FIGS. 41A to 41C show an example of a display device using a driving method of the present invention.

For example, a case of employing a type of pixel configuration in which a plurality of scanning lines is provided is considered. First, in a case where a period in which a signal is written to a pixel and a lighting period are separated, a display device has a pixel portion 4101, first and second scanning line driver circuits 4102 and 4103, and a signal line driver circuit 4104, as shown in FIG. 41A. As one example, the pixel configuration of this case is as shown in FIG. 26.

Figure 41B:
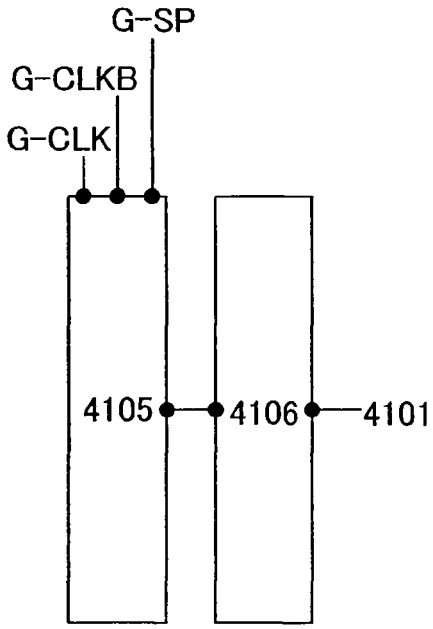

First, the scanning line driver circuits will be explained. The first and second scanning line driver circuits 4102 and 4103 sequentially output selection signals to the pixel portion 4101. FIG. 41B shows one example of a configuration of the first and second scanning line driver circuits 4102 and 4103. The scanning line driver circuits each include a shift register 4105, an amplifier circuit 4106, and the like.

Then, operations of the first and second scanning line driver circuits 4102 and 4103 shown in FIG. 41B will be briefly explained. A clock signal (G-CLK), a start pulse (G-SP), and a clock inverted signal (G-CLKB) are inputted to the shift register 4105, and sampling pulses are sequentially outputted in accordance with the timing of these signals. The outputted sampling pulses are amplified in the amplifier circuit 4106 and inputted to the pixel portion 4101 from each scanning line.

Note that a buffer circuit or a level shifter circuit may be included in a configuration of the amplifier circuit 4106. Further, a pulse width control circuit and the like may be arranged in the scanning line driver circuits in addition to the shift register 4105 and the amplifier circuit 4106.

Here, the first scanning line driver circuit 4102 is a driver circuit for sequentially outputting the selection signals to a first scanning line 4111 connected to the sub-pixel 1 (SP1), and the second scanning line driver circuit 4103 is a driver circuit for sequentially outputting the selection signals to a second scanning line 4112 connected to the sub-pixel 2 (SP2). Note that, generally, in a case of dividing one pixel into m (m is an integer of $m \geqq 2$) sub-pixels, m scanning line driver circuits may be provided.

Next, the signal line driver circuit will be explained. The signal line driver circuit 4104 sequentially outputs video signals to the pixel portion 4101 via a signal line 4113. An image is displayed in the pixel portion 4101 by controlling a state of light in accordance with the video signals. A video signal that is inputted to the pixel portion 4101 from the signal line driver circuit 4104 is a voltage in many cases. In other words, states of a light emitting element arranged in each pixel and an element that controls the light emitting element are changed by the video signal (voltage) inputted from the signal line driver circuit 4104. As an example of the light emitting element arranged in a pixel, an EL element, an element used for an FED (Field Emission Display), a liquid crystal, a DMD (Digital Micromirror Device), and the like can be given.

Figure 41C:
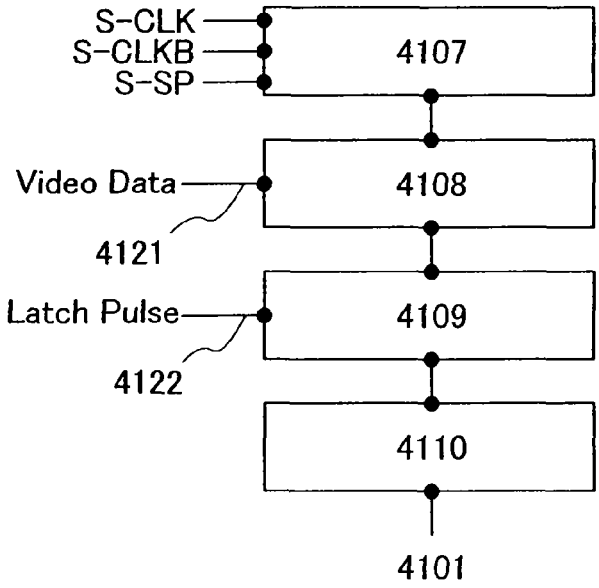

FIG. 41C shows one example of a configuration of the signal line driver circuit 4104. The signal line driver circuit 4104 includes a shift register 4107, a first latch circuit (LAT1) 4108, a second latch circuit (LAT2) 4109, an amplifier circuit 4110, and the like. Note that, as a configuration of the amplifier circuit 4110, a buffer circuit may be provided, a level shifter circuit may be provided, a circuit having a function of converting a digital signal into an analog signal may be provided, or a circuit having a function of performing gamma correction may be provided.

In addition, the pixel includes a light emitting element such as an EL element. The light emitting element may be provided with a circuit for outputting a current (a video signal), that is, a current source circuit.

Subsequently, an operation of the signal line driver circuit 4104 will be briefly explained. A clock signal (S-CLK), a start pulse (S-SP), and a clock inverted signal (S-CLKB) are inputted to the shift register 4107, and sampling pulses are sequentially outputted in accordance with the timing of these signals.

The sampling pulses outputted from the shift register 4107 are inputted to the first latch circuit (LAT1) 4108. Since a video signal is inputted to the first latch circuit (LAT1) 4108 from a video signal line 4121, the video signal is held in each column in accordance with the timing when the sampling pulses are inputted.

After holding of the video signal is completed to the last column in the first latch circuit (LAT1) 4108, a latch pulse (Latch Pulse) is inputted from a latch control line 4122, and the video signal which has been held in the first latch circuit (LAT1) 4108 is transferred to the second latch circuit (LAT2) 4109 all at once in a horizontal retrace period. Thereafter, the video signals of one row, which have been held in the second latch circuit (LAT2) 4109, are inputted to the amplifier circuit 4110 all at once. A signal which is outputted from the amplifier circuit 4110 is inputted to the pixel portion 4101 from each signal line.

The video signal which has been held in the second latch circuit (LAT2) 4109 is inputted to the amplifier circuit 4110, and while the video signal is inputted to the pixel portion 4101, the shift register 4107 outputs a sampling pulse again. In other words, two operations are performed at the same time. Accordingly, a line sequential driving can be realized. Hereafter, the above operation is repeated.

Note that the signal line driver circuit or part thereof (such as the current source circuit or the amplifier circuit) may be formed using, for example, an external IC chip instead of being provided over the same substrate as the pixel portion 4101.

By using the scanning line driver circuits and the signal line driver circuit as described above, it is possible to realize the driving in the case where a period in which a signal is written to a pixel and a lighting period are separated.

Figure 42:
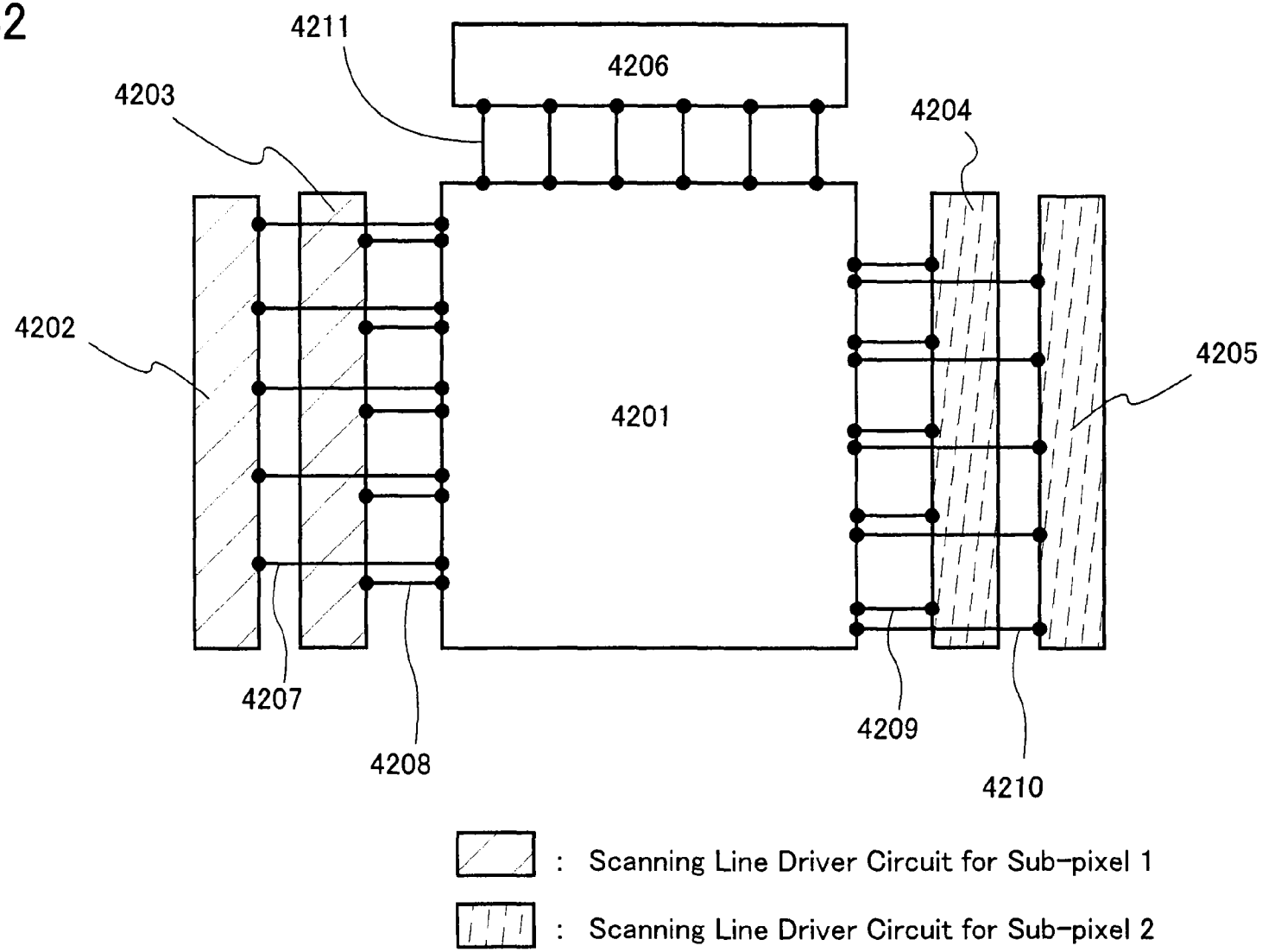
FIG. 42 shows an example of a display device using a driving method of the present invention.

Then, in a case of performing an operation of erasing a signal of a pixel, a display device includes a pixel portion 4201, first, second, third, and fourth scanning line driver circuits 4202, 4203, 4204, and 4205, and a signal line driver circuit 4206, as shown in FIG. 42. One example of a pixel configuration of this case is as shown in FIG. 33. Note that the configuration of the scanning line driver circuits and the signal line driver circuit is similar to that explained in FIG. 41; thus, the explanation is omitted.

Here, the first and second scanning line driver circuits 4202 and 4203 are each a circuit for driving a scanning line connected to the sub-pixel 1. Here, the first scanning line driver circuit 4202 sequentially outputs selection signals to a first scanning line 4207 (a scanning line to which a selection transistor is connected) connected to the sub-pixel 1. On the other hand, the second scanning line driver circuit 4203 sequentially outputs erasing signals to a second scanning line 4208 (a scanning line to which an erasing transistor is connected) connected to the sub-pixel 1. Accordingly, the selection signals and the erasing signals are written to the sub-pixel 1.

Similarly, the third and fourth scanning line driver circuits 4204 and 4205 are each a circuit for driving a scanning line connected to the sub-pixel 2. Here, the third scanning line driver circuit 4204 sequentially outputs selection signals to a third scanning line 4209 connected to the sub-pixel 2. On the other hand, the fourth scanning line driver circuit 4205 sequentially outputs erasing signals to a fourth scanning line 4210 connected to the sub-pixel 2. Accordingly, the selection signals and the erasing signals are written to the sub-pixel 2.

Also, the signal line driving circuit 4206 is a circuit for sequentially outputting video signals to the pixel portion 4201 via a signal line 4211.

By using the scanning line driver circuits and the signal line driver circuit as described above, it is possible to realize the driving in the case of performing an operation of erasing a signal of a pixel.

Although this embodiment mode explains the case of employing a type of pixel configuration in which a plurality of scanning lines are provided, a signal line driver circuit corresponding to each sub-pixel may be provided in a case of employing a type of pixel configuration in which a plurality of signal lines are provided.

Figure 43:
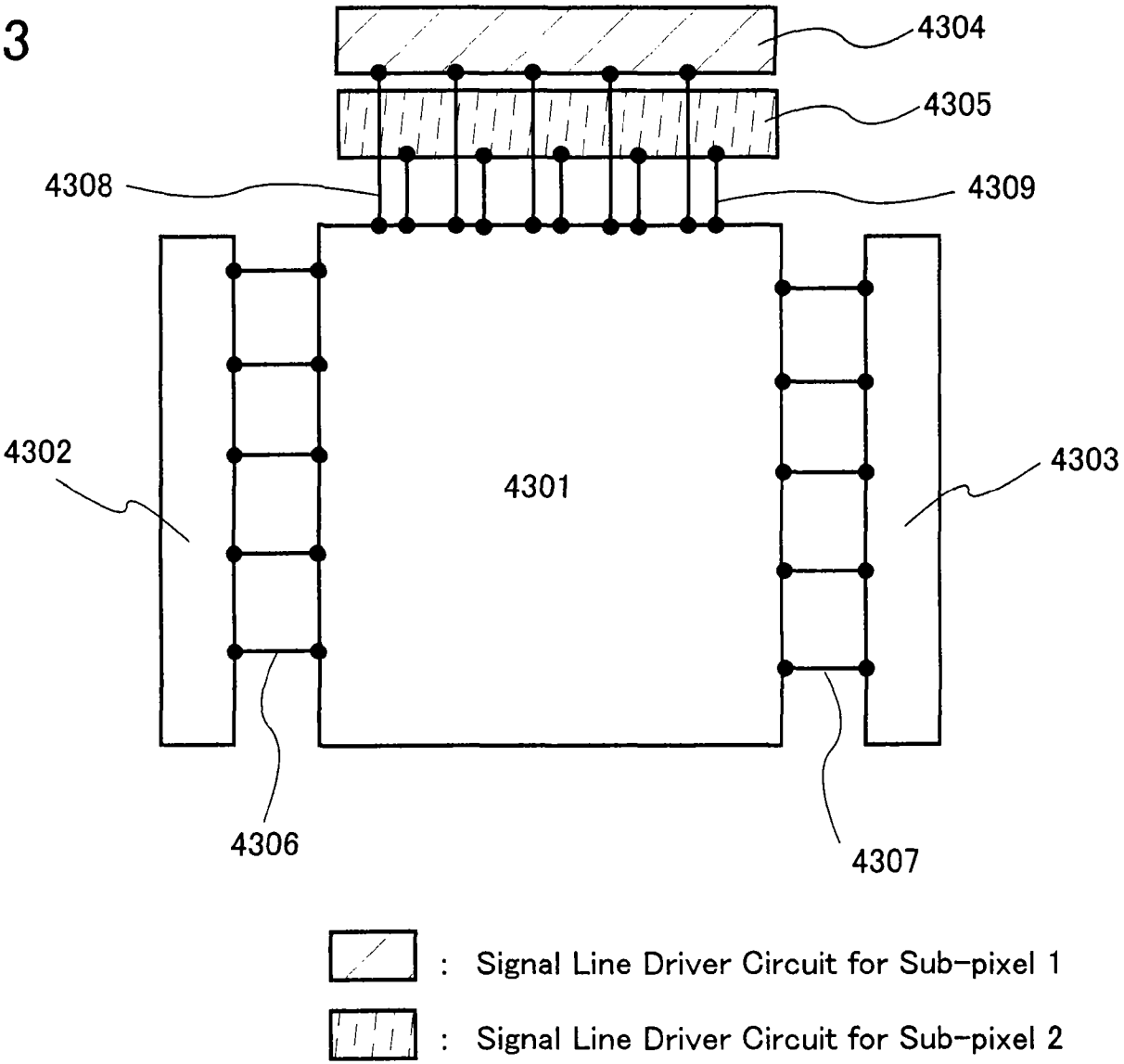
FIG. 43 shows an example of a display device using a driving method of the present invention.

For example, in a case of performing an operation of erasing a signal of a pixel, a display device has a pixel portion 4301, first and second scanning line driver circuits 4302 and 4303, and first and second signal line driver circuits 4304 and 4305, as shown in FIG. 43. Note that the configuration of the scanning line driver circuits and the signal line driver circuits is similar to that explained in FIG. 41; thus, the explanation is omitted.

Here, the first scanning line driver circuit 4302 is a driver circuit for sequentially outputting selection signals to a first scanning line 4306 (a scanning line to which a selection transistor is connected), and the second scanning line driver circuit 4303 is a driver circuit for sequentially outputting erasing signals to a second scanning line 4307 (a scanning line to which an erasing transistor is connected).

In addition, the first signal line driver circuit 4304 is a driver circuit for sequentially outputting video signals to a first signal line 4308 connected to the sub-pixel 1 (SP1), and the second signal line driver circuit 4305 is a driver circuit for sequentially outputting video signals to a second signal line 4309 connected to the sub-pixel 2 (SP2). Note that, generally, in a case of dividing one pixel into m (m is an integer of $m \geqq 2$) sub-pixels, m signal line driver circuits may be provided.

By using the scanning line driver circuits and the signal line driver circuit as described above, it is possible to realize the driving in the case of performing an operation of erasing a signal of a pixel.

Note that the configuration of the signal line driver circuits, the scanning line driver circuits, and the like is not limited to those in FIGS. 41 to 43.

Note that a transistor of the present invention may be any type of transistor, and formed over any substrate. Therefore, all the circuits as shown in FIGS. 41 to 43 may be formed over any substrate including a glass substrate, a plastic substrate, a single crystalline substrate, and an SOI substrate. Alternatively, part of the circuits in FIGS. 41 to 43 may be formed over a certain substrate, and another part of the circuits in FIGS. 41 to 43 may be formed over another substrate. In other words, not all the circuits in FIGS. 41 to 43 are required to be formed over the same substrate. For example, in FIGS. 41 to 43, the pixel portion and the scanning line driver circuits may be formed over a glass substrate using transistors, and the signal line driver circuit (or part thereof) may be formed over a single crystalline substrate as an IC chip, and then the IC chip may be placed and connected to the glass substrate by COG (Chip On Glass). Alternatively, the IC chip may be connected to the glass substrate by TAB (Tape Automated Bonding) or using a printed substrate.

Note that the content described in this embodiment mode can be implemented by being freely combined with the contents described in Embodiment Modes 1 to 4.

Embodiment Mode 6

Figure 62A:
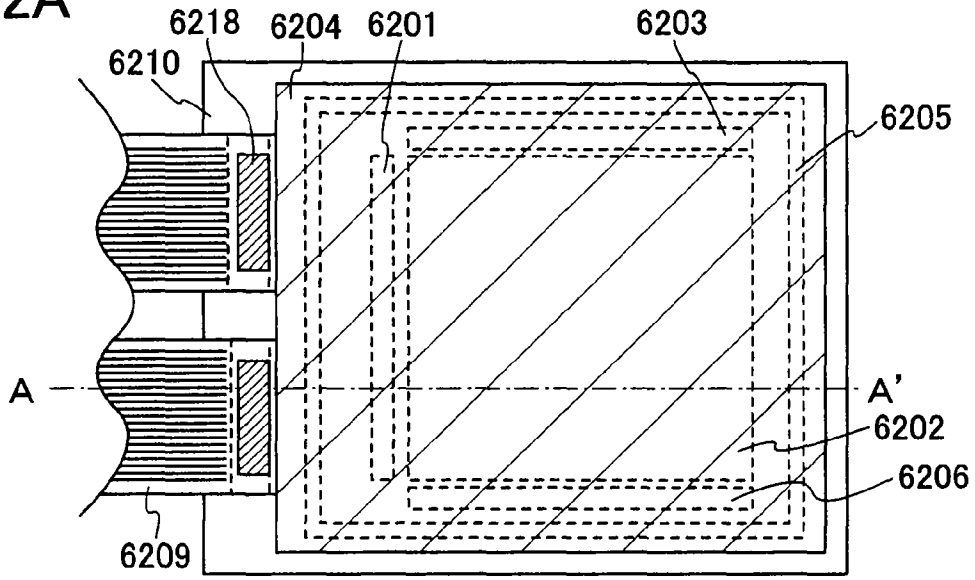
FIGS. 62A and 62B each show an example of a structure of a display panel used in a display device of the present invention.
Figure 62B:
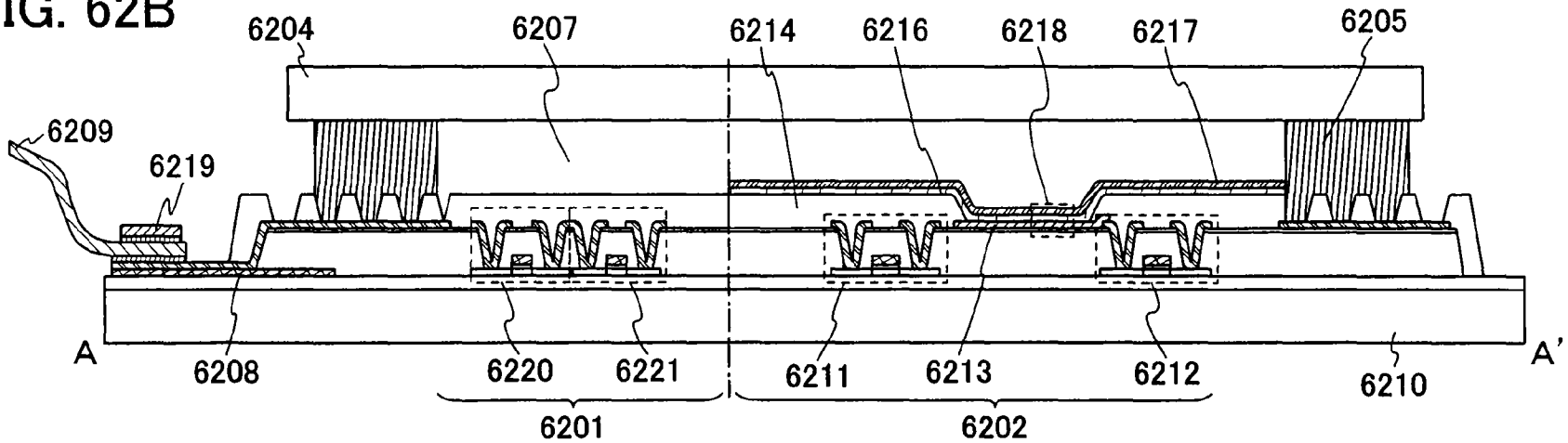

In this embodiment mode, a display panel used in a display device of the present invention is described with reference to FIGS. 62A and 62B and the like. Note that FIG. 62A is a top view showing a display panel, and FIG. 62B is a cross-sectional view of the figure in FIG. 62A along a line A-A'. A signal line driving circuit 6201, a pixel portion 6202, a first scanning line driver circuit 6203, and a second scanning line driver circuit 6206 are included, which are shown by dotted lines. Also, a sealing substrate 6204 and a sealing material 6205 are included, and a space surrounded by the sealing material 6205 is a space 6207.

Note that a wiring 6208 is a wiring for transmitting signals inputted to the first scanning line driver circuit 6203, the second scanning line driver circuit 6206, and the signal line driver circuit 6201, and receives video signals, clock signals, start signals, and the like from an FPC 6209 that is an external input terminal. Over a junction of the FPC 6209 and the display panel, IC chips (semiconductor chips in which a memory circuit, a buffer circuit, and the like are formed) 6218 and 6219 are mounted by COG (Chip On Glass) or the like. Note that only the FPC 6209 is shown in the figure; however, a printed wiring board (PWB) may be attached to this FPC.

Next, a cross-sectional structure is described using FIG. 62B. Over a substrate 6210, the pixel portion 6202 and peripheral driver circuits (the first scanning line driver circuit 6203, the second scanning line driver circuit 6206, and the signal line driver circuit 6201) are formed. Here, the signal line driver circuit 6201 and the pixel portion 6202 are shown.

Note that the signal line driver circuit 6201 is formed of many transistors such as a transistor 6220 and a transistor 6221. Also, in this embodiment mode, a display panel in which the peripheral driver circuits are integrally formed over the same substrate is described; however, this is not always necessary, and all or a part of the peripheral driver circuits may be formed as an IC chip, and mounted by COG Moreover, the pixel portion 6202 includes a plurality of circuits forming a pixel including a switching transistor 6211 and a driver transistor 6212. Note that a source electrode of the driver transistor 6212 is connected to a first electrode 6213. An insulator 6214 is formed covering an end portion of the first electrode 6213. Here, a positive type photosensitive acrylic resin film is used.

In addition, for good coverage, a curved surface having curvature is formed in an upper end portion or a lower end portion of the insulator 6214. For example, in the case of using a positive photosensitive acrylic as a material for the insulator 6214, a curved surface having a curvature radius (0.2 to 3 μm) is preferably provided only in the upper end portion of the insulator 6214. In addition, as the insulator 6214, either a negative type photosensitive acrylic to be insoluble in etchant by light irradiation or a positive type photosensitive acrylic to be soluble in etchant by light can be used.

Over the first electrode 6213, a layer containing an organic compound 6216 and a second electrode 6217 are formed. Here, as a material used for the first electrode 6213 which functions as an anode, a material with high work function is desirably used. For example, a single layer film such as an ITO (indium tin oxide) film, an indium zinc oxide (IZO) film, a titanium nitride film, a chromium film, a tungsten film, a Zn film, and a Pt film; a stacked layer of a titanium nitride film and a film mainly containing aluminum; a three-layer structure of a titanium nitride film, a film mainly containing aluminum, and a titanium nitride film, and the like can be used. Note that in the case of a stacked-layer structure, resistance as a wiring is low and good ohmic contact is obtained. In addition, the stacked-layer structure can function as an anode.

Moreover, the layer containing an organic compound 6216 is formed by a vapor deposition method using a vapor deposition mask, or an ink-jet method. For the layer containing an organic compound 6216, a metal complex using a metal of group 4 of the periodic table is used for a part thereof, and may be combined with a low molecular weight material or a high molecular weight material. In addition, for a material used for the layer containing an organic compound, there are usually many cases where an organic compound is used as a single layer or a stacked layer. However, this embodiment mode includes a structure in which a film including an organic compound partially includes an inorganic compound. In addition, a known triplet material can also be used.

Further, as a material used for the second electrode 6217 which is a cathode formed over the layer containing an organic compound 6216, a material with a low work function (Al, Ag, Li, Ca, or an alloy of these such as MgAg, MgIn, AlLi, $CaF_2$, or calcium nitride) may be used. Note that in the case where light generated in the layer containing an organic compound 6216 is transmitted through the second electrode 6217, as the second electrode 6217, a stacked layer of a metal thin film and, a transparent conductive film (ITO (indium tin oxide), an indium oxide-zinc oxide alloy ($In_2O_3$—ZnO), zinc oxide (ZnO), or the like) may be used.

In addition, the sealing substrate 6204 is stuck to the substrate 6210 by the sealing material 6205 to be a structure provided with a light emitting element 6218 in the space 6207 surrounded by the substrate 6210, the sealing substrate 6204, and the sealing material 6205. Note that there is also a structure in which the space 6207 is filled with an inert gas (nitrogen, argon, or the like), as well as with the sealing material 6205.

Note that an epoxy-based resin is preferably used for the sealing material 6205. Further, these materials are desirably a material which does not transmit moisture or oxygen as much as possible. In addition, as a material used for the sealing substrate 6204, a glass substrate, a quartz substrate, as well as a plastic substrate including FRP (Fiberglass-Reinforced Plastics), PVF (polyvinyl fluoride), Mylar, polyester, acrylic, or the like can be used.

In this manner, a display panel having a pixel configuration of the present invention can be obtained.

As shown in FIGS. 62A and 62B, the signal line driver circuit 6201, the pixel portion 6202, the first scanning line driver circuit 6203, and the second scanning line driver circuit 6206 are integrally formed to lower cost of the display device. Further, by using a unipolar transistor for the signal line driver circuit 6201, the pixel portion 6202, the first scanning line driver circuit 6203, and the second scanning line driver circuit 6206, a manufacturing step can be simplified to lower cost further. Furthermore, by applying amorphous silicon to a semiconductor layer of a transistor used for the signal line driver circuit 6201, the pixel portion 6202, the first scanning line driver circuit 6203, and the second scanning line driver circuit 6206, cost can be lowered even more.

Note that a configuration of the display panel is not limited to such a configuration as shown in FIG. 62A, in which the signal line driver circuit 6201, the pixel portion 6202, the first scanning line driver circuit 6203, and the second scanning line driver circuit 6206 are integrally formed, and the configuration may be that of forming a signal line driver circuit that is equivalent to the signal line driver circuit 6201 over an IC chip, and then mounting the IC chip on a display panel by COG or the like.

That is, only the signal line driver circuit for which a high speed operation is required is formed over an IC chip using a CMOS or the like to lower power consumption. In addition, the IC chip is a semiconductor chip using a silicon wafer or the like to perform a higher speed operation and lower power consumption.

Then, by integrally forming the scanning line driver circuits and the pixel portion, power consumption can be lowered. Note that by forming these scanning line driver circuits and pixel portion by unipolar transistors, cost can be lowered further. As a pixel configuration included in the pixel portion, the configuration shown in Embodiment Mode 3 can be applied. Also, by using amorphous silicon for a semiconductor layer of the transistor, a manufacturing step can be simplified to lower cost even further.

In this manner, cost of a display device with high-definition can be lowered. In addition, at a connecting portion between the FPC 6209 and the substrate 6210, by mounting an IC chip in which a function circuit (a memory or a buffer) is formed, area of the substrate can be effectively used.

Moreover, a structure may be that of forming over an IC chip a signal line driver circuit, a first scanning line driver circuit, and a second scanning line driver circuit that are equivalent to the signal line driver circuit 6201, the first scanning line driver circuit 6203, and the second scanning line driver circuit 6206 in FIG. 62A, and then mounting the IC chip on a display panel by COG or the like. In this case, a high-definition display device can have even lower power consumption. Consequently, in order for a display device to have even less power consumption, it is desirable to use polysilicon in a semiconductor layer of a transistor used in a pixel portion.

Further, when amorphous silicon is used for a semiconductor layer of a transistor of the pixel portion 6202, cost can be lowered. In addition, a large display panel can be manufactured Note that the scanning line driver circuits and the signal line driver circuit are not limited to being provided in a row direction and a column direction of a pixel.

Figure 63:
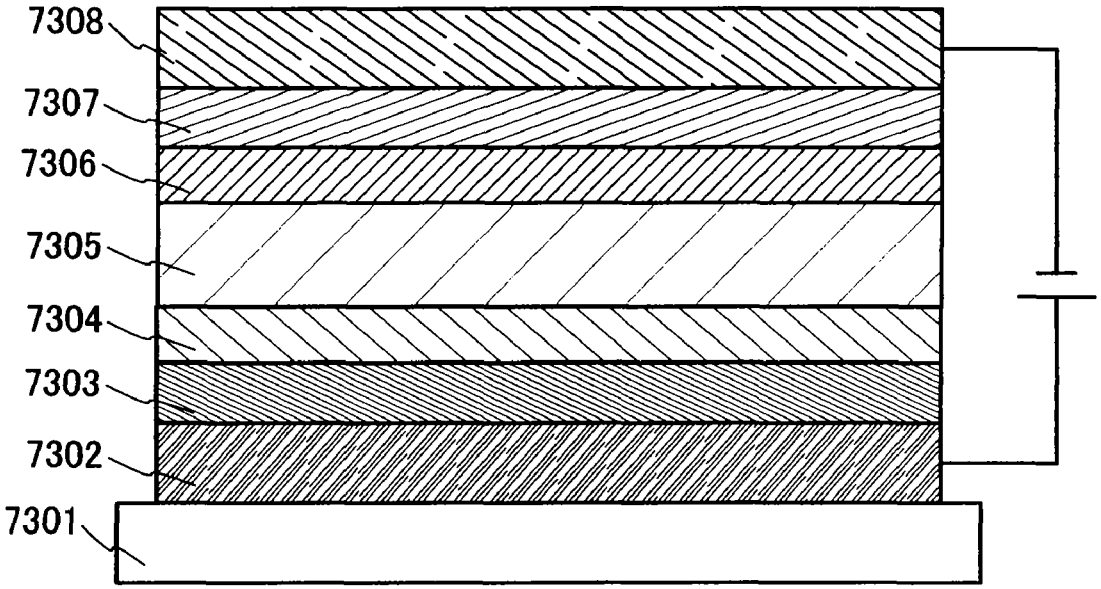
FIG. 63 shows an example of a structure of a light emitting element used in a display device of the present invention.

Subsequently, an example of a light emitting element that can be applied to the light emitting element 6218 is shown in FIG. 63.

The light emitting element has an element structure of stacking over a substrate 7301 an anode 7302, a hole injecting layer 7303 including a hole injecting material, a hole transporting layer 7304 including a hole transporting material, a light emitting layer 7305, an electron transporting layer 7306 including an electron transporting material, an electron injecting layer 7307 including an electron injecting material, and a cathode 7308. Here, the light emitting layer 7305 is sometimes formed using only one kind of light emitting material; however, it may also be formed using two or more kinds of materials. Further, an element structure of the present invention is not limited to this structure.

Further, in addition to a stacked-layer structure shown in FIG. 63 in which each functional layer is stacked, there is a wide array of structure such as an element using a high molecular compound, a high-efficiency element utilizing in a light emitting layer a triplet light emitting material which emits light from a triplet excited state. The present invention can also be applied to a white light emitting element obtained by controlling a recombination region of carriers with a hole blocking layer, and separating a light emitting region into two regions.

Next, a manufacturing method of an element of the present invention shown in FIG. 63 is described. First, a hole injecting material, a hole transporting material, and a light emitting material are deposited in this order over the substrate 7301 having the anode 7302 (ITO (indium tin oxide)). Subsequently, an electron transporting material and an electron injecting material are deposited, and the cathode 6308 is formed lastly by vapor deposition.

Next, preferable materials for the hole injecting material, the hole transporting material, the electron transporting material, the electron injecting material, and the light emitting material are described below.

As the hole injecting material, among organic compounds, a porphyrin-based compound, phthalocyanine (hereinafter referred to as "$H_2Pc$"), copper phthalocyanine (hereinafter referred to as "CuPc") and the like are effective. In addition, a material which has smaller ionization potential than the used hole transporting material and has a hole transporting function can be used as the hole injecting material as well. There is a material in which chemical doping is performed on a conductive high molecular compound, such as polyethylene dioxy thiophene (hereinafter referred to as "PEDOT") doped with polystyrene sulfonate (hereinafter referred to as "PSS"), polyaniline, or the like. Further, an insulating high molecular compound is effective in planarizing an anode, and polyimide (hereinafter referred to as "PI") is often used. Furthermore, an inorganic compound is used, such as a metal thin film of gold or platinum, as well as an ultra thin film of aluminum oxide (hereinafter referred to as "alumina").

As a hole transporting material, an aromatic amine-based compound (that is, a compound having a bond of benzene ring-nitrogen) is most widely used. The materials that are widely used include 4,4'-bis(diphenylamino)-biphenyl (hereinafter referred to as "TAD"), derivatives thereof such as 4,4'-bis[N-(3-methylphenyl)-N-phenyl-amino]-biphenyl (hereinafter referred to as "TPD") or 4,4'-bis[N-(1-naphthyl)-N-phenyl-amino]-biphenyl (hereinafter referred to as "α-NPD"). Further, star burst aromatic amine compounds such as 4,4',4"-tris(N,N-diphenyl-amino)-triphenylamine (hereinafter referred to as "TDATA") or 4,4',4"-tris[N-(3-methylphenyl)-N-phenyl-amino]-triphenylamine (hereinafter referred to as "MTDATA") are given.

As an electron transporting material, a metal complex is often used, which includes a metal complex having a quinoline skeleton or a benzoquinoline skeleton such as tris(8-quinolinolato)aluminum (hereinafter referred to as "$Alq_3$"), BAlq, tris(4-methyl-8-quinolinolato)aluminum (hereinafter referred to as "Almq"), or bis(10-hydroxybenzo[h]-quinolinato)beryllium (hereinafter referred to as "BeBq"). Also, a metal complex having an oxazole-based or a thiazole-based ligand such as bis[2-(2-hydroxyphenyl)-benzoxazolato]zinc (hereinafter referred to as "$Zn(BOX)_2$") or bis[2-(2-hydroxyphenyl)-benzothiazolato]zinc (hereinafter referred to as "$Zn(BTZ)_2$") is given. Further, other than the metal complexes, oxadiazole derivatives such as 2-(4-biphenylyl)-5-(4-tert-butylphenyl)-1,3,4-oxadiazole (hereinafter referred to as "PBD") or OXD-7, triazole derivatives such as TAZ, 3-(4-tert-butylphenyl)-4-(4-ethylphenyl)-5-(4-biphenylyl)-1,2,4-triazole (hereinafter referred to as "p-EtTAZ"), and phenanthroline derivatives such as bathophenanthroline (hereinafter referred to as "BPhen") or BCP have electron transporting properties.

As an electron injecting material, the aforementioned electron transporting materials can be used. In addition, an ultra thin film of an insulator such as metal halide such as calcium fluoride, lithium fluoride, or cesium fluoride, or alkali metal-oxide such as lithium oxide, is often used. Further, an alkali-metal complex such as lithium acetyl acetonate (hereinafter referred to as "Li(acac)") or 8-quinolinolato-lithium (hereinafter referred to as "Liq") is also efficient.

As a light emitting material, other than the aforementioned metal complexes such as $Alq_3$, Almq, BeBq, BAlq, $Zn(BOX)_2$, and $Zn(BTZ)_2$, various fluorescent dyes are efficient. The fluorescent dyes include 4,4'-bis(2,2-diphenyl-vinyl)-biphenyl which is blue, 4-(dicyanomethylene)-2-methyl-6-(p-dimethylaminostyryl)-4H-pyran which is red-orange, and the like. In addition, a triplet light emitting material is available, which is mainly a complex with platinum or iridium as a central metal. As the triplet light emitting material, tris(2-phenylpyridine)iridium, bis(2-(4'-tryl)pyridinato-N,$C^{2'}$)acetylacetonato iridium (hereinafter referred to as "$acacIr(tpy)_2$"), 2,3,7,8,12,13,17,18-octaethyl-21H, 23H porphyrin-platinum, and the like are known.

Materials having the aforementioned functions are combined with one another, then, a light emitting element with high reliability can be made.

Further, a light emitting element in which layers are formed in the opposite order to that of FIG. 63 can also be used. In other words, the light emitting element has an element structure of stacking over the substrate 7301 the cathode 7308, the electron injecting layer 7307 including an electron injecting material, the electron transporting layer 7306 including an electron transporting material, the light emitting layer 7305, the hole transporting layer 7304 including a hole transporting material, the hole injecting layer 7303 including a hole injecting material, and the anode 7302.

In addition, to obtain light emission, at least one of the anode and the cathode of the light emitting element may be transparent. A transistor and a light emitting element are formed over a substrate. A light emitting element may have a top emission structure in which light is emitted from the surface opposite to the substrate, a bottom emission structure in which light is emitted from the substrate side, or a dual emission structure in which light is emitted from both the substrate side and the surface opposite to the substrate. The pixel configuration of the present invention can be applied to a light emitting element having any emission structure.

Figure 64A:
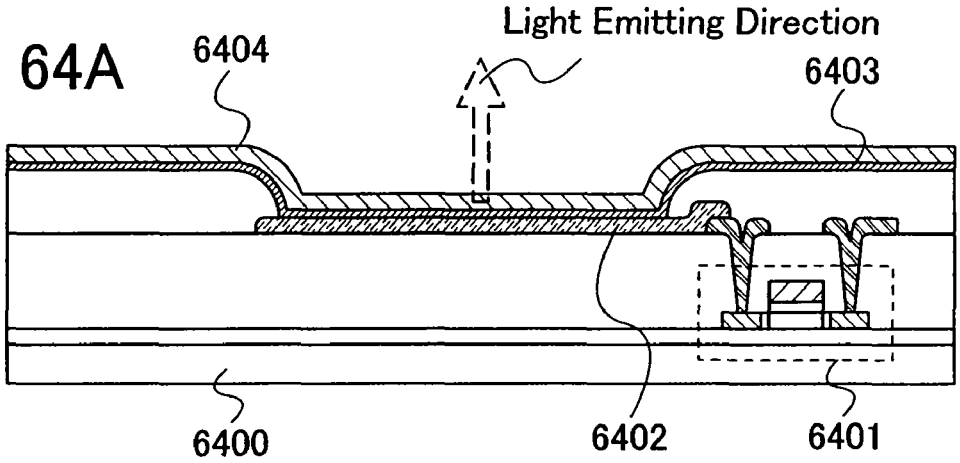
FIGS. 64A to 64C each show an example of a structure of a display device of the present invention.

First, description is made with reference to FIG. 64A on a light emitting element having the top emission structure.

A driving transistor 6401 is formed over a substrate 6400, and a first electrode 6402 is formed in contact with a source electrode of the driving transistor 6401. A layer containing an organic compound 6403 and a second electrode 6404 are formed thereover.

Further, the first electrode 6402 is an anode of the light emitting element and the second electrode 6404 is a cathode of the light emitting element. That is, a portion in which the layer containing an organic compound 6403 is sandwiched between the first electrode 6402 and the second electrode 6404 is the light emitting element.

Here, a material used for the first electrode 6402 which functions as the anode is desirably a material with a high work function. For example, a single layer film such as a titanium nitride film, a chromium film, a tungsten film, a Zn film, and a Pt film, a stacked layer of a titanium nitride film and a film mainly containing aluminum, a three-layer structure of a titanium nitride film, a film mainly containing aluminum, and a titanium nitride film, and the like can be used. Note that in the case of a stacked-layer structure, resistance as a wiring is low and good ohmic contact is obtained. In addition, the stacked-layer structure can function as an anode. When a metal film which reflects light is used, an anode which does not transmit light can be formed.

Further, as a material used for the second electrode 6404 which functions as the cathode, a stacked layer of a metal thin film including a low work function material (Al, Ag, Li, Ca, or an alloy of these such as MgAg, MgIn, AlLi, $CaF_2$, or calcium nitride) and a transparent conductive film (ITO (indium tin oxide), indium zinc oxide (IZO), zinc oxide (ZnO) or the like) may be used. Thus, when a thin metal film and a transparent conductive film having a light transmitting property are used, a cathode capable of transmitting light can be formed.

Thus, as shown by an arrow in FIG. 64A, light from the light emitting element can be obtained from the top surface. That is, in the case of applying the light emitting element to the display panel in FIGS. 62A and 62B, light is emitted to the sealing substrate 6204 side. Accordingly, in the case where a light emitting element having a top emission structure is used for a display device, a substrate having a light transmitting property is used for the sealing substrate 6204.

In addition, in the case of providing an optical film, an optical film may be provided over the sealing substrate 6204.

Note that the fist electrode 6402 can be formed using a metal film including a low work function material such as MgAg, MgIn, and AlLi which functions as the cathode. In this case, a transparent conductive film such as an ITO (indium tin oxide) film or an indium zinc oxide (IZO) film can be used for the second electrode 6404. Therefore, according to this structure, transmissivity of top emission can be improved.

Subsequently, description is made on a light emitting element having the bottom emission structure with reference to FIG. 64B. Other than a light emission structure, the light emitting element has a similar structure to that in FIG. 64A; therefore the same reference numerals are used to make the description.

Here, as a material used for the first electrode 6402 which functions as the anode, a high work function material is desirably used. For example, a transparent conductive film such as an ITO (indium tin oxide) film or an indium zinc oxide (IZO) film can be used. An anode capable of transmitting light can be formed by using a transparent conductive film having a light transmitting property.

Further, as a material used for the second electrode 6404 which functions as the cathode, a metal film including a low work function material (Al, Ag, Li, Ca, or an alloy of these such as MgAg, MgIn, AlLi, $CaF_2$, or calcium nitride) can be used. Thus, when a metal film which reflects light is used, a cathode which does not transmit light can be formed.

Figure 64B:
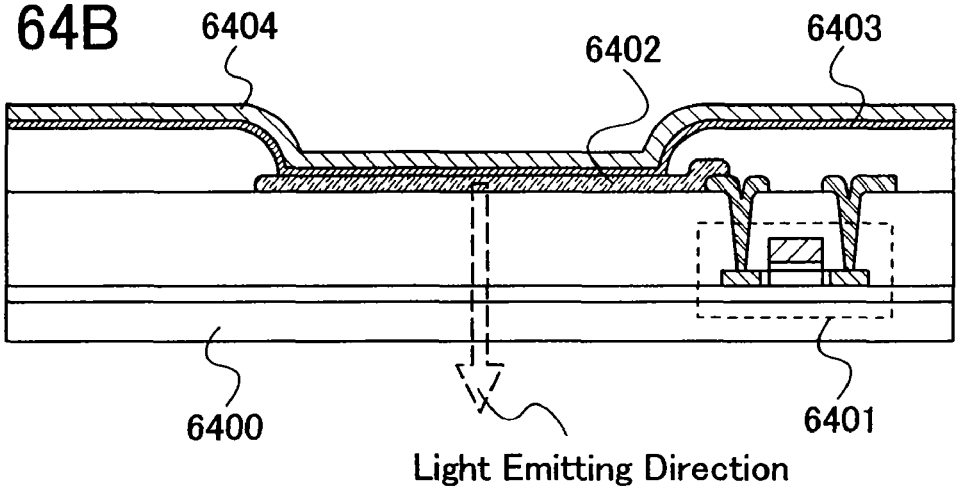

In this manner, as shown by an arrow in FIG. 64B, light from the light emitting element can be obtained from a bottom surface. That is, in the case of applying the light emitting element to the display panel in FIGS. 62A and 62B, light is emitted to the substrate 6210 side. Accordingly, in the case where a light emitting element having a bottom emission structure is used for a display device, a substrate having a light transmitting property is used for the substrate 6210.

In addition, in the case of providing an optical film, an optical film may be provided over the substrate 6210.

Figure 64C:
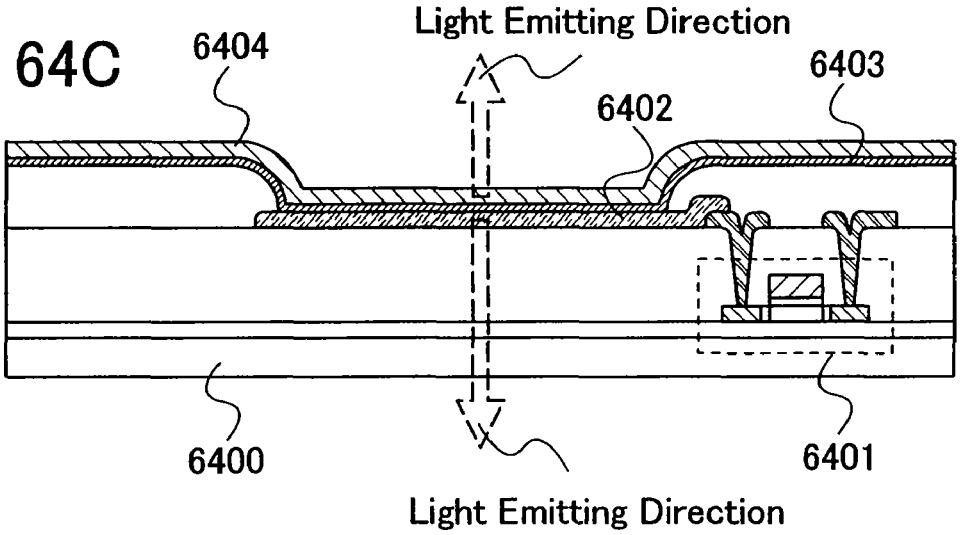

Description is made on a light emitting element having the dual emission structure with reference to FIG. 64C. Other than a light emission structure, the light emitting element has a similar structure to that in FIG. 64A; therefore the same reference numerals are used to make a description.

Here, as a material used for the first electrode 6402 which functions as the anode, a high work function material is desirably used. For example, a transparent conductive film such as an ITO (indium tin oxide) film or an indium zinc oxide (IZO) film can be used. An anode capable of transmitting light can be formed by using a transparent conductive film having a light transmitting property.

Further, as a material used for the second electrode 6404 which functions as the cathode, a stacked layer of a metal thin film including a low work function material (Al, Ag, Li, Ca, or an alloy of these such as MgAg, MgIn, AlLi, $CaF_2$, or calcium nitride) and a transparent conductive film (ITO (indium tin oxide), an indium oxide-zinc oxide alloy ($In_2O_3$—ZnO), zinc oxide (ZnO), or the like) may be used. Thus, when a metal thin film and a transparent conductive film having a transparent property are used, a cathode capable of transmitting light can be formed.

Thus, as shown by an arrow in FIG. 64C, light from the light emitting element can be obtained from both surfaces. That is, in the case of applying the light emitting element to the display panel in FIGS. 62A and 62B, light is emitted to the substrate 6210 side and the sealing substrate 6204 side. Accordingly, in the case where a light emitting element having a dual emission structure is used for a display device, a substrate having a light transmitting property is used for both the substrate 6210 and the sealing substrate 6204.

In addition, in the case of providing an optical film, an optical film may be provided over both the substrate 6210 and the sealing substrate 6204.

Moreover, the present invention can be applied to a display device for realizing a full color display by using a white-color light emitting element and a color filter.

Figure 65:
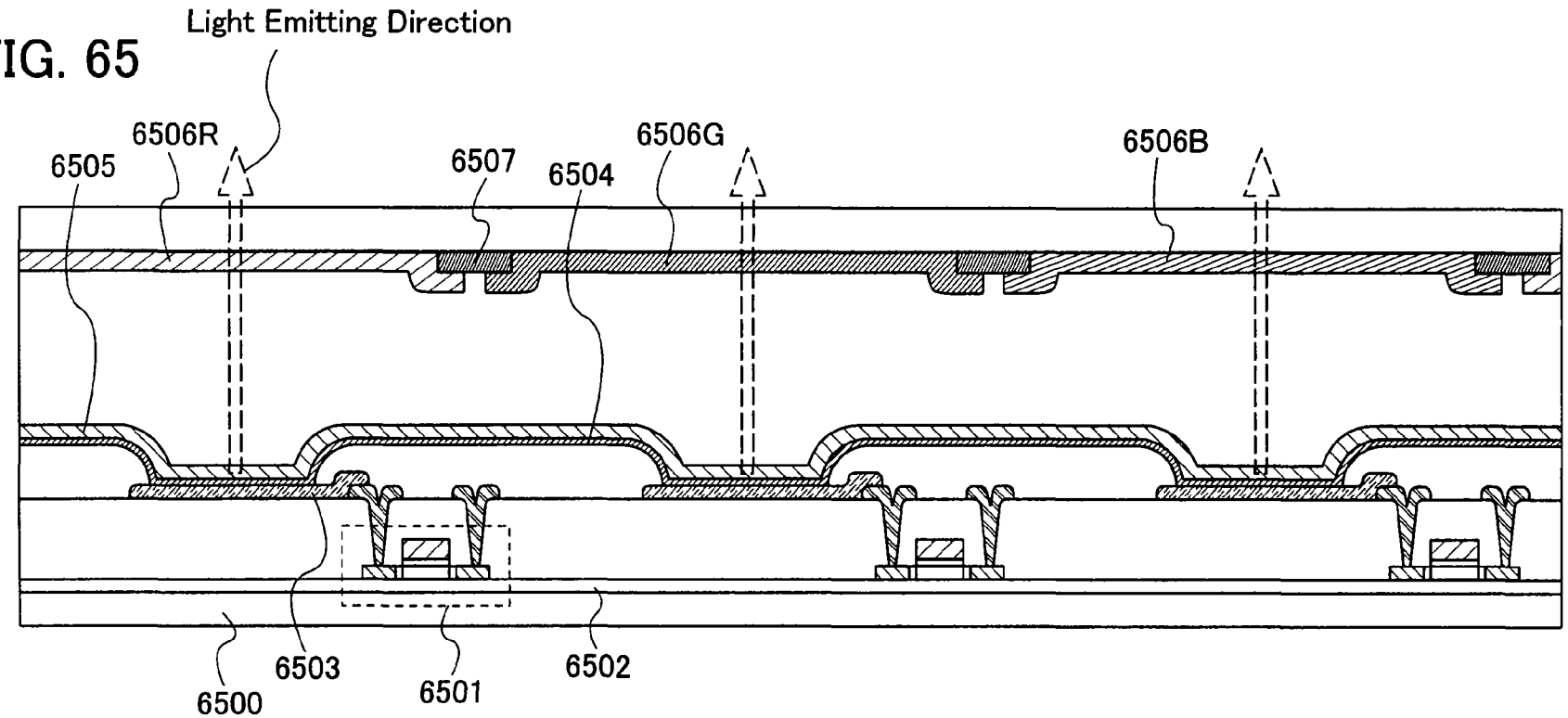
FIG. 65 shows an example of a structure of a display device of the present invention.

As shown in FIG. 65, a base film 6502 is formed over a substrate 6500, a driving transistor 6501 is formed thereover, a first electrode 6503 is formed in contact with a source electrode of the driving transistor 6501, and a layer containing an organic compound 6504 and a second electrode 6505 are formed thereover.

Further, the first electrode 6503 is an anode of a light emitting element and the second electrode 6505 is a cathode of the light emitting element. That is, a portion in which the layer containing an organic compound 6504 is sandwiched between the first electrode 6503 and the second electrode 6505 is the light emitting element. White light is emitted in the structure in HG 65. Then, a red color filter 6506R, a green color filter 6506G, and a blue color filter 6506B are provided over the light emitting element, therefore, a full color display can be performed. In addition, a black matrix (also called BM) 6507 to isolate these color filters is provided.

The aforementioned structures of the light emitting element can be combined to be appropriately used for a display device of the present invention. In addition, the aforementioned structure of the display panel and the light emitting element are examples, and they can be applied to a display device having another structure.

Next, a partial cross-sectional diagram of a pixel portion of a display panel is shown.

First, description is made with reference to FIGS. 66A to 67B on a case where a polysilicon (p-Si) film is used for a semiconductor layer of a transistor.

Here, for the semiconductor layer, for example, an amorphous silicon (a-Si) film is formed over a substrate by a known deposition method. Note that it is not limited to an amorphous silicon film, and a semiconductor film having an amorphous structure (including microcrystalline semiconductor film) may be used. Furthermore, a compound semiconductor film having an amorphous structure such as an amorphous silicon germanium film may be used.

Then, the amorphous silicon film is crystallized by a laser crystallization method, a thermal crystallization method using RTA or an annealing furnace, a thermal crystallization method using a metal element for promoting crystallization, or the like. It is needless to say that these may be combined.

By the aforementioned crystallization, a region which is partially crystallized is formed in an amorphous semiconductor film.

Moreover, a crystalline semiconductor film in which crystallinity is partially increased is patterned in a desired shape to form an island-shape semiconductor film from the crystallized region. This semiconductor film is used for the semiconductor layer of the transistor.

Figure 66A:
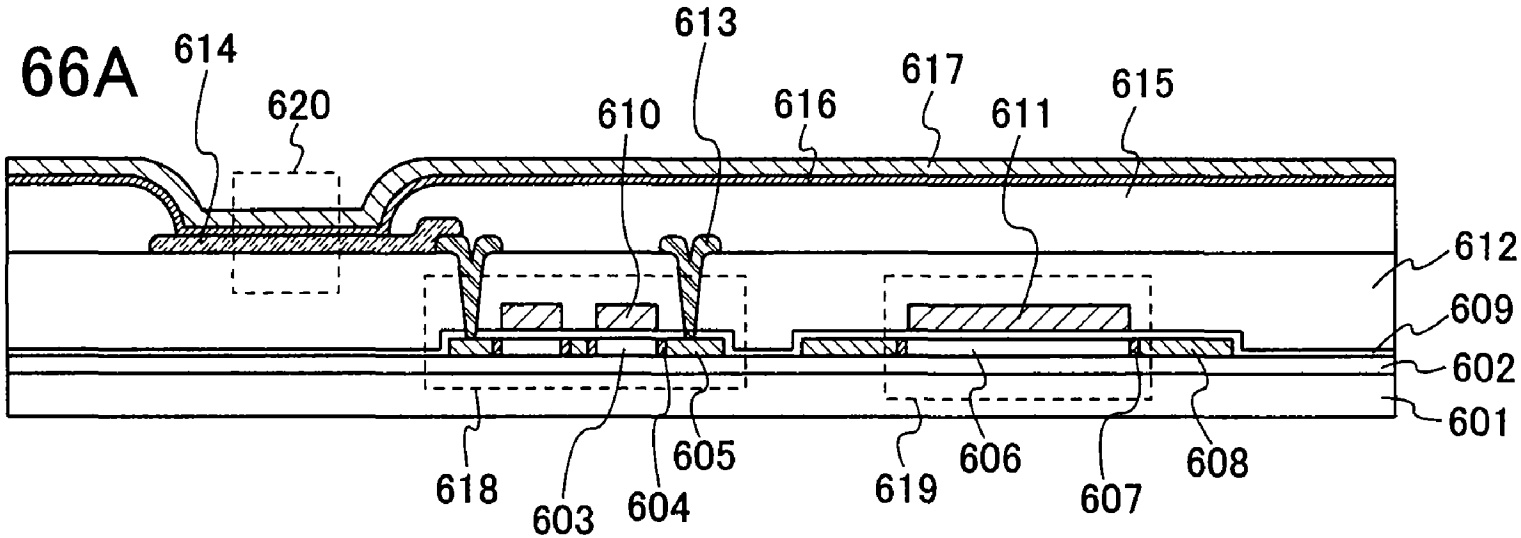
FIGS. 66A and 66B each show an example of a structure of a display device of the present invention.

As shown in FIG. 66A, a base film 602 is formed over a substrate 601 and a semiconductor layer is formed thereover. The semiconductor layer includes a channel forming region 603, an LDD region 604, and an impurity region 605 to be a source or drain region, that are of a driving transistor 618; along with a channel forming region 606 to be a bottom electrode, an LDD region 607, and an impurity region 608, that are of a capacitor 619. Note that channel doping may be performed on the channel forming region 603 and the channel forming region 606.

A glass substrate, a quartz substrate, a ceramic substrate, or the like can be used for the substrate. In addition, as the base film 602, a single layer of aluminum nitride (AlN), silicon oxide ($SiO_2$), silicon oxynitride ($SiO_xN_y$), or the like, or a stacked layer of these can be used.

Over the semiconductor layer, a gate electrode 610, and an upper electrode 611 of the capacitor 619 are formed with a gate insulating film 609 interposed therebetween.

An interlayer insulating film 612 is formed covering the driving transistor 618 and the capacitor 619, and a wiring 613 is formed over the interlayer insulating film 612 to be in contact with the impurity region 605 through a contact hole. A pixel electrode 614 is formed in contact with the wiring 613, and an insulator 615 is formed covering an end portion of the pixel electrode 614 and the wiring 613. Here, a positive type photosensitive acrylic resin film is used. Then, a layer containing an organic compound 616 and an opposite electrode 617 are formed over the pixel electrode 614, and in a region in which the layer containing an organic compound 616 is sandwiched between the pixel electrode 614 and the opposite electrode 617, a light emitting element 620 is formed.

Figure 66B:
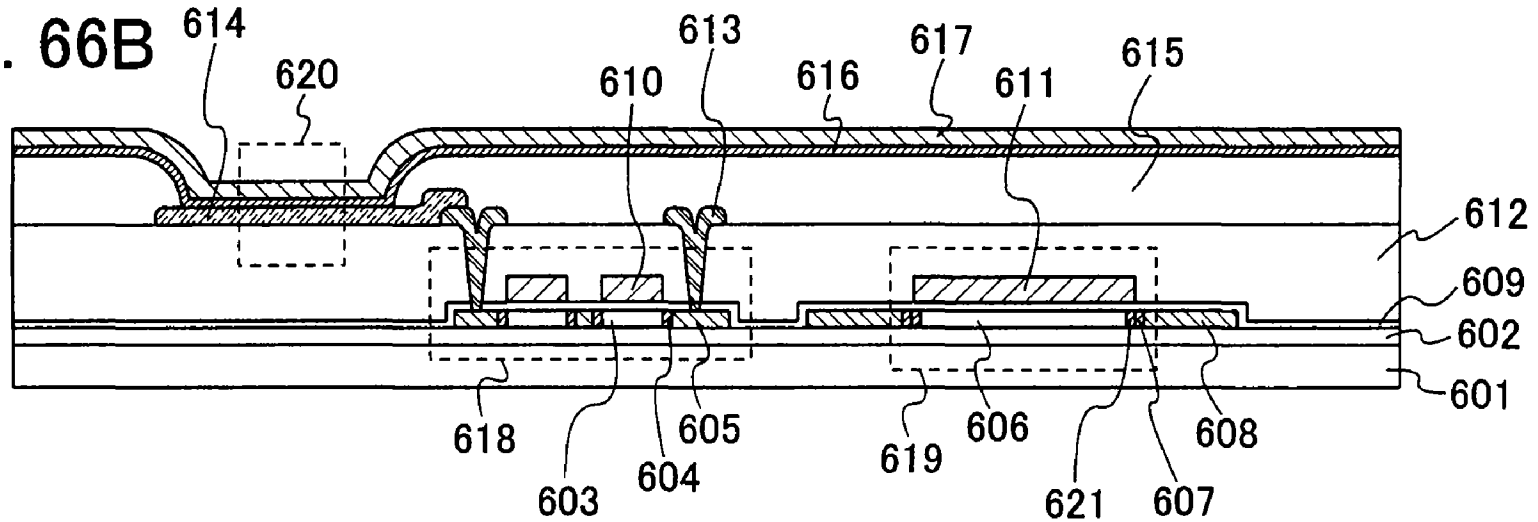

In addition, as shown in FIG. 66B, a region 621 may be provided in which an upper electrode 611 of the capacitor 619 overlaps with an LDD region forming a part of a bottom electrode of the capacitor 619. Note that common portions with FIG. 66A are denoted by the same reference numerals and description thereof is omitted.

Figure 67A:
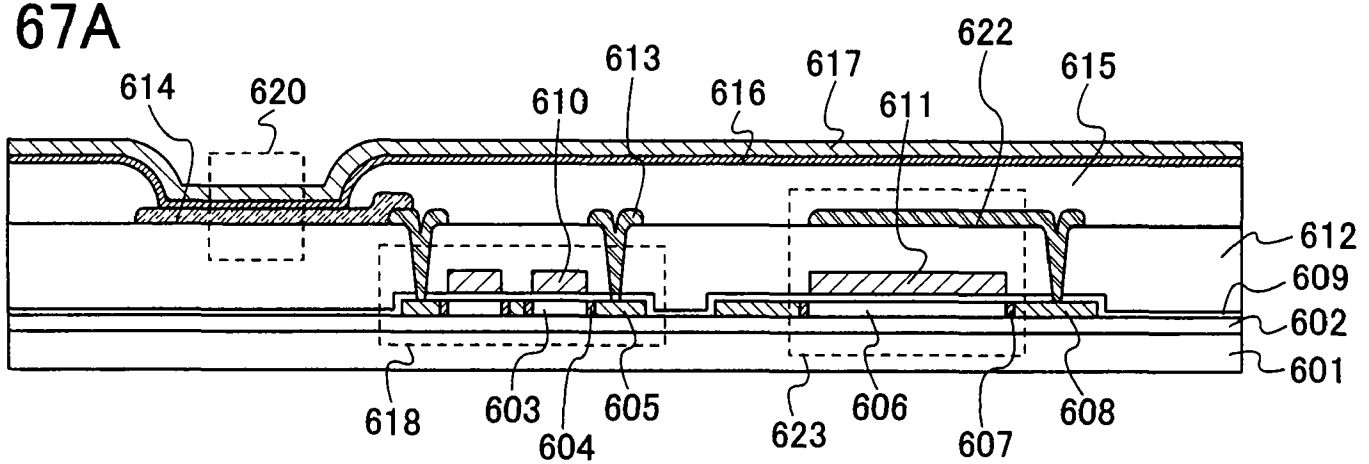
FIGS. 67A and 67B each show an example of a structure of a display device of the present invention.

In addition, as shown in FIG. 67A, the capacitor 623 may include a second upper electrode 622 formed in the same layer as the wiring 613 that is in contact with the impurity region 605 of the driving transistor 618. Note that common portions with FIG. 66A are denoted by the same reference numerals and description thereof is omitted. Since the second upper electrode 622 and the impurity region 608 are in contact with each other, a first capacitor formed by sandwiching the gate insulating film 609 between the upper electrode 611 and the channel forming region 606 is connected in parallel to a second capacitor formed by sandwiching the interlayer insulating film 612 between the upper electrode 611 and the second upper electrode 622, thereby the capacitor 623 including the first capacitor and the second capacitor is formed. The capacitance of this capacitor 623 is combined capacitance of the first capacitor and the second capacitor; therefore, a capacitor with a small area and a large capacitance can be formed. In other words, an improvement in aperture ratio can be realized by using the capacitor as a capacitor of the pixel configuration of the present invention.

Figure 67B:
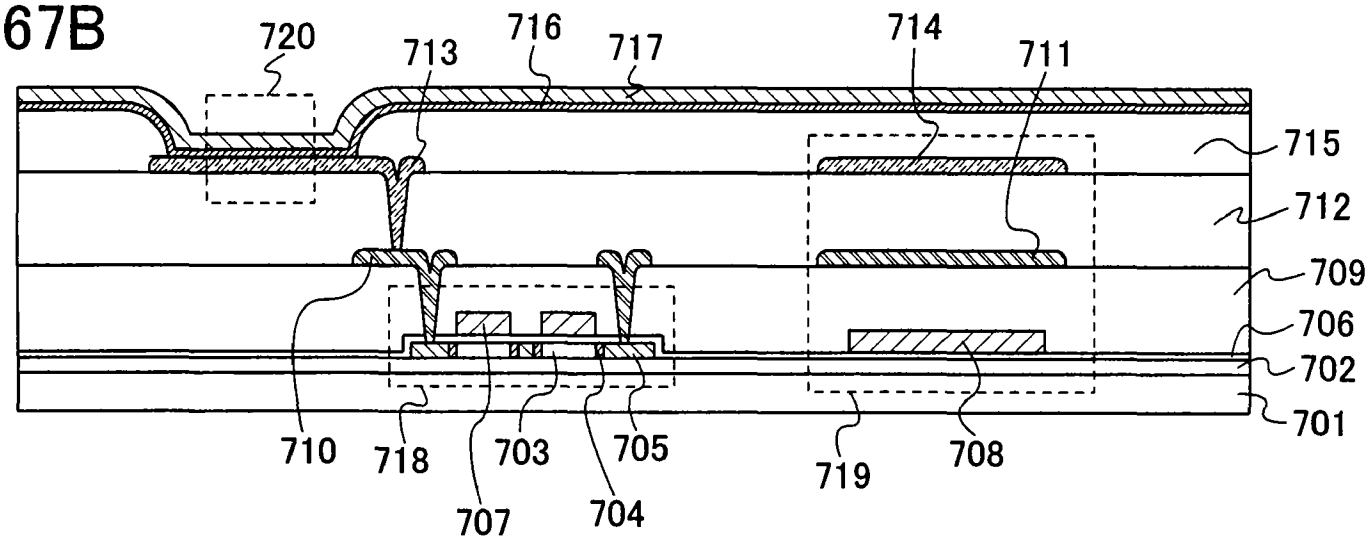

In addition, a capacitor may have a structure as shown in FIG. 67B. A base film 702 is formed over a substrate 701 and a semiconductor layer is formed thereover. The semiconductor layer includes a channel forming region 703, an LDD region 704, and an impurity region 705 to be a source or drain region, that are of a driving transistor 718. Note that channel doping may be performed on the channel forming region 703.

A glass substrate, a quartz substrate, a ceramic substrate, or the like can be used for the substrate. In addition, as the base film 702, a single layer of aluminum nitride (AlN), silicon oxide ($SiO_2$), silicon oxynitride ($SiO_xN_y$), or the like, or a stacked layer of these can be used.

Over the semiconductor layer, a gate electrode 707 and a first electrode 708 are formed with a gate insulating film 706 interposed therebetween.

A first interlayer insulating film 709 is formed covering the driving transistor 718 and the first electrode 708, and a wiring 710 formed over the first interlayer insulating film 709 to be in contact with the impurity region 705 through a contact hole. In addition, a second electrode 711 including the same material as that of the wiring 710 is formed in the same layer as the wiring 710.

A second interlayer insulating film 712 is formed covering the wiring 710 and the second electrode 711, and a pixel electrode 713 is formed over the second interlayer insulating film 712 to be in contact with the wiring 710 through a contact hole. In addition, a third electrode 714 including the same material as that of the pixel electrode 713 is formed in the same layer as the pixel electrode 713. Here, a capacitor 719 formed of the first electrode 708, the second electrode 711, and the third electrode 714 is formed.

A layer containing an organic compound 716 and an opposite electrode 717 are formed over the pixel electrode 713, and in a region in which the layer containing an organic compound 716 is sandwiched between the pixel electrode 713 and the opposite electrode 716, a light emitting element 720 is formed.

As described above, the transistor in which a crystalline semiconductor film is used for a semiconductor layer can have the structures as shown in FIGS. 66A to 67B. Note that the structures of the transistor shown in FIGS. 66A to 67B are examples of a transistor having a top gate structure. That is, an LDD region may be overlapped with a gate electrode, may not be overlapped with the gate electrode, or a part of the LDD region may be overlapped with the gate electrode. In addition, the gate electrode may be a tapered shape, and an LDD region may be provided in a self-aligned manner under the tapered portion of the gate electrode. In addition, the number of the gate electrodes is not limited to two, and a multi-gate structure having three or more gate electrodes may be used, or only one gate electrode may be provided as well.

When a crystalline semiconductor film is used for a semiconductor layer (a channel forming region, a source region, a drain region, or the like) of a transistor forming pixels of the present invention, a scanning line driver circuit and a signal line driver circuit are integrally formed with a pixel portion easily. In addition, a part of the signal line driver circuit may be integrally formed with the pixel portion and another part may be formed over an IC chip to be mounted by COG or the like as shown in the display panel in FIGS. 62A and 62B. In this manner, manufacturing cost can be reduced.

Further, as a structure of a transistor using polysilicon (p-Si) for a semiconductor layer, a structure in which a gate electrode is sandwiched between a substrate and the semiconductor layer, that is, a bottom gate transistor in which the gate electrode is located under the semiconductor layer, may be applied. Here, FIGS. 68A and 68B show partial cross-sectional diagrams of a pixel portion of a display panel to which the bottom gate transistor is applied.

Figure 68A:
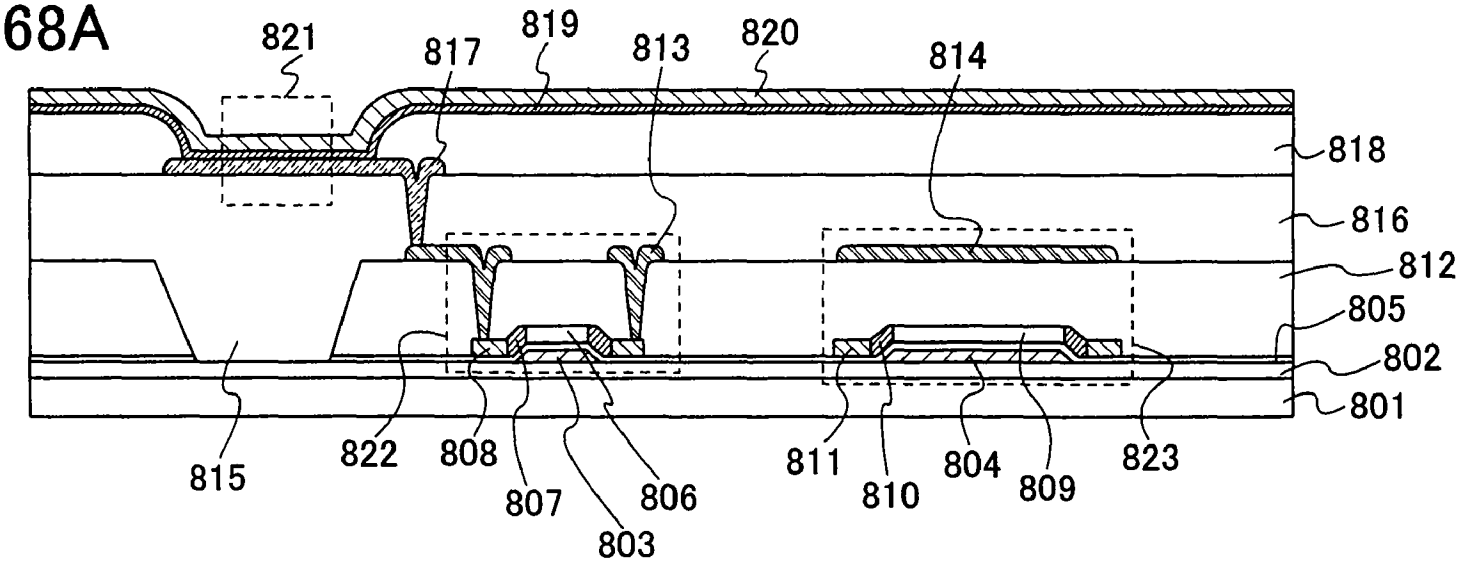
FIGS. 68A and 68B each show an example of a structure of a display device of the present invention.
Figure 68B:
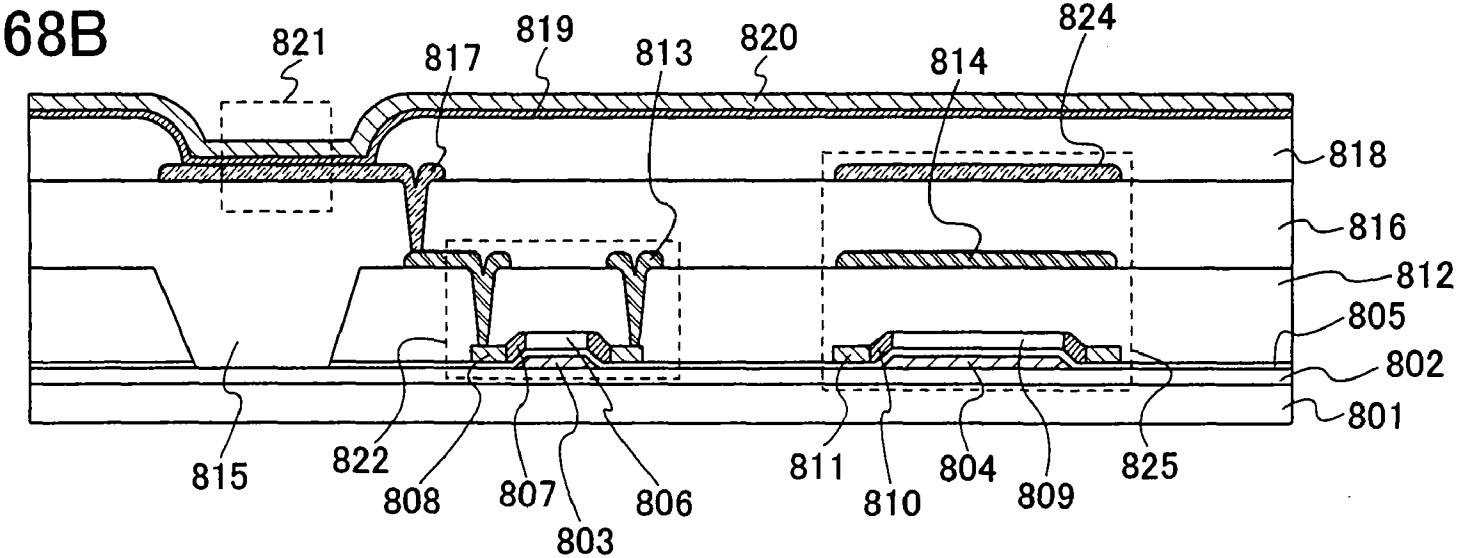

As shown in FIG. 68A, a base film 802 is formed over a substrate 801 and a gate electrode 803 is formed over the base film 802. In addition, a first electrode 804 including the same material as that of the gate electrode 803 is formed in the same layer as the gate electrode 803. As a material for the gate electrode 803, polycrystalline silicon to which phosphorus is added can be used. Other than polycrystalline silicon, silicide which is a compound of a metal and silicon may be used as well.

Moreover, a gate insulating film 805 is formed covering the gate electrode 803 and the first electrode 804. As the gate insulating film 805, a silicon oxide film, a silicon nitride film, or the like is used.

In addition, over the gate insulating film 805, a semiconductor layer is formed. The semiconductor layer includes a channel forming region 806, an LDD region 807, an impurity region 808 to be a source or drain region, that are of a driving transistor 822; along with a channel forming region 809 to be a second electrode, an LDD region 810, and an impurity region 811, that are of a capacitor 823. Note that channel doping may be performed on the channel forming region 806 and the channel forming region 809.

A glass substrate, a quartz substrate, a ceramic substrate, and the like can be used for the substrate. In addition, as the base film 802, a single layer of aluminum nitride (AlN), silicon oxide ($SiO_2$), silicon oxynitride ($SiO_xN_y$), or the like, or a stacked layer of these can be used.

A first interlayer insulating film 812 is formed covering the semiconductor layer, and a wiring 813 is formed over the first interlayer insulating film 812 to be in contact with the impurity region 808 through a contact hole. In addition, a third electrode 814 including the same material as that of the wiring 813 is formed in the same layer as the wiring 813. A capacitor 823 is formed of the first electrode 804, the second electrode, and the third electrode 814.

Further, an opening 815 is formed in the first interlayer insulating film 812. A second interlayer insulating film 816 is formed covering the driving transistor 822, the capacitor 823, and the opening 815. A pixel electrode 817 is formed through a contact hole over the second interlayer insulating film 816. An insulator 818 is formed covering an end portion of the pixel electrode 817. For example, a positive type photosensitive acrylic resin film can be used. Then, a layer containing an organic compound 819 and an opposite electrode 820 are formed over the pixel electrode 817, and in a region in which the layer containing an organic compound 819 is sandwiched between the pixel electrode 817 and the opposite electrode 820, a light emitting element 821 is formed. In addition, the opening 815 is located under the light emitting element 821. That is, when light emission from the light emitting element 821 is obtained from a substrate side, transmissivity can be improved by providing the opening 815.

In addition, a fourth electrode 824 using the same material as that of the pixel electrode 817 may be formed in the same layer as the pixel electrode 817 in FIG. 68A to be a structure as shown in FIG. 68B. Then, a capacitor 825 formed of the first electrode 804, the second electrode, the third electrode 814, and the fourth electrode 824 can be formed.

Next, description is made with reference to FIGS. 44A to 46B on a case where an amorphous silicon (a-Si) film is used for a semiconductor layer of a transistor.

Figure 44A:
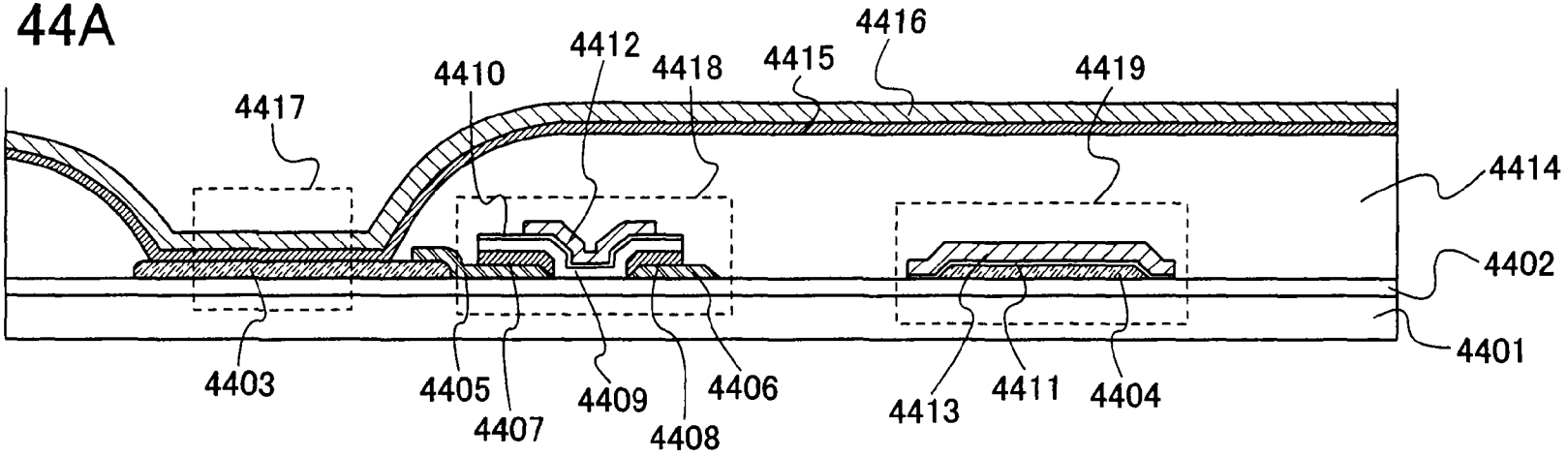
FIGS. 44A and 44B each show an example of a structure of a display device of the present invention.
Figure 44B:
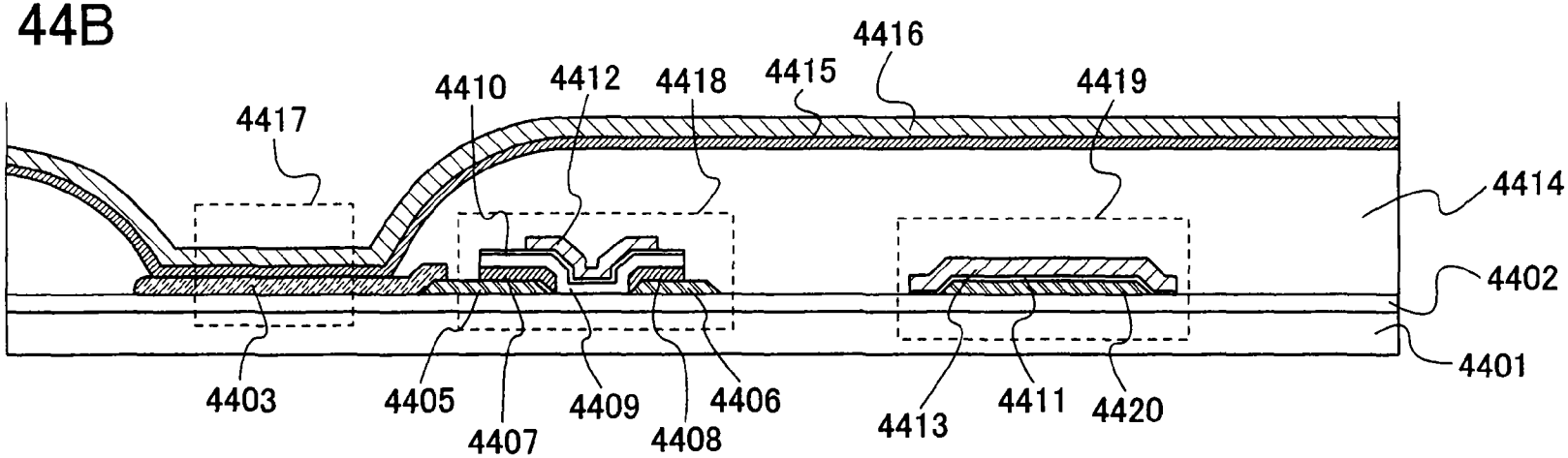

FIGS. 44A and 44B show partial cross-sectional diagrams of a pixel portion of a display panel to which a top gate transistor using amorphous silicon in a semiconductor layer is applied. As shown in FIG. 44A, a base film 4402 is formed over a substrate 4401. Further, a pixel electrode 4403 is formed over the base film 4402. Also, a first electrode 4404 including the same material as that of the pixel electrode 4403 is formed in the same layer as the pixel electrode 4403.

A glass substrate, a quartz substrate, a ceramic substrate, and the like can be used for the substrate. In addition, as the base film 4402, a single layer of aluminum nitride (AlN), silicon oxide ($SiO_2$), silicon oxynitride ($SiO_xN_y$), or the like, or a stacked layer of these can be used.

Moreover, a wiring 4405 and a wiring 4406 are formed over the base film 4402, and an end portion of the pixel electrode 4403 is covered with the wiring 4405. Over the wiring 4405 and the wiring 4406, an N-type semiconductor layer 4407 and an N-type semiconductor layer 4408 each having N-type conductivity are formed. In addition, between the wiring 4405 and the wiring 4406, a semiconductor layer 4409 is formed over the base film 4402. Then, a part of the semiconductor layer 4409 is extended over the N-type semiconductor layer 4407 and the N-type semiconductor layer 4408. Note that, this semiconductor layer 4409 is formed of a non-crystalline semiconductor film such as amorphous silicon (a-Si) and microcrystalline semiconductor (μ-Si).

A gate insulating film 4410 is formed over the semiconductor layer 4409, and an insulating film 4411 including the same material as that of the gate insulating film 4410, which is formed in the same layer as the gate insulating film 4410 is formed over the first electrode 4404. Note that for the gate insulating film 4410, a silicon oxide film, a silicon nitride film, or the like is used.

Moreover, over the gate insulating film 4410, a gate electrode 4412 is formed. A second electrode 4413 including the same material as that of the gate electrode 4412, which is formed in the same layer as the gate electrode 4412 is formed over the first electrode 4404 with the insulating film 4411 interposed therebetween. As a result, a capacitor 4419 in which the insulating film 4411 is sandwiched between the first electrode 4404 and the second electrode 4413 is formed. Further, an interlayer insulating film 4414 is formed covering an end portion of the pixel electrode 4403, a driving transistor 4418, and the capacitor 4419.

A layer containing an organic compound 4415 and an opposite electrode 4416 are formed over the interlayer insulating film 4414 and the pixel electrode 4403 located at an opening potion thereof, and in a region in which the layer containing an organic compound 4415 is sandwiched between the pixel electrode 4403 and the opposite electrode 4416, a light emitting element 4417 is formed.

In addition, the first electrode 4404 shown in FIG. 44A may be formed to be a first electrode 4420 as shown in FIG. 44B. The first electrode 4420 with the same material as that of the wirings 4405 and 4406 is formed in the same layer as the wirings 4405 and 4406.

Further, FIGS. 45A to 46B show partial cross-sectional diagrams of a pixel portion of a display panel to which a bottom gate transistor using amorphous silicon in a semiconductor layer is applied.

Figure 45A:
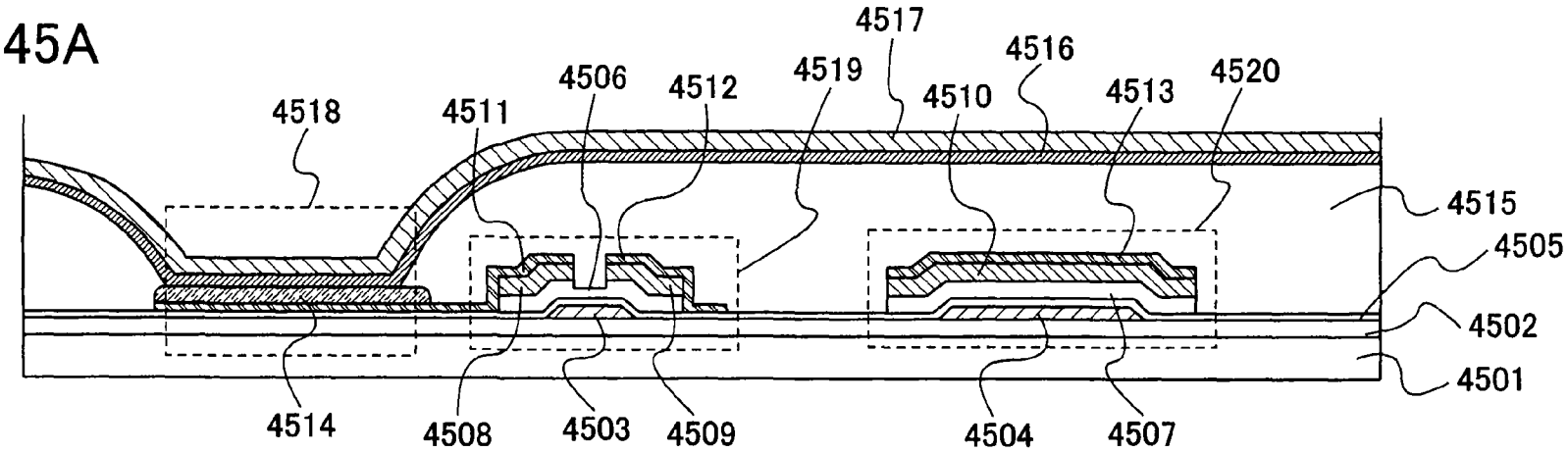
FIGS. 45A and 45B each show an example of a structure of a display device of the present invention.

As shown in FIG. 45A, a base film 4502 is formed over a substrate 4501 and a gate electrode 4503 is formed over the base film 4502. In addition, a first electrode 4504 including the same material as that of the gate electrode 4503 is formed in the same layer as the gate electrode 4503. For a material of the gate electrode 4503, polycrystalline silicon to which phosphorus is added can be used. Other than polycrystalline silicon, silicide which is a compound of a metal and silicon may be used as well.

Moreover, a gate insulating film 4505 is formed covering the gate electrode 4503 and the first electrode 4504. As the gate insulating film 4505, a silicon oxide film, a silicon nitride film, or the like is used.

In addition, over the gate insulating film 4505, a semiconductor layer 4506 is formed. A semiconductor layer 4507 including the same material as that of the semiconductor layer 4506 is formed in the same layer as the semiconductor layer 4506.

A glass substrate, a quartz substrate, a ceramic substrate, and the like can be used for the substrate. In addition, as the base film 4502, a single layer of aluminum nitride (AlN), silicon oxide ($SiO_2$), silicon oxynitride ($SiO_xN_y$), or the like, or a stacked layer of these can be used.

Over the semiconductor layer 4506, N-type semiconductor layers 4508 and 4509 each having N-type conductivity are formed while an N-type semiconductor layer 4510 is formed over the semiconductor layer 4507.

Over the N-type semiconductor layers 4508 and 4509, wirings 4511 and 4512 are formed respectively while over the N-type semiconductor layer 4510, a conductive layer 4513 including the same material as that of the wirings 4511 and 4512 is formed in the same layer as the wirings 4511 and 4512.

Accordingly, a second electrode including the semiconductor layer 4507, the N-type semiconductor layer 4510, and the conductive layer 4513 is formed. Note that a capacitor 4520 having a structure in which the gate insulating film 4505 is sandwiched between this second electrode and the first electrode 4504 is formed.

Moreover, one end portion of the wiring 4511 is extended, and a pixel electrode 4514 is formed in contact with the upper portion of the extended wiring 4511.

Moreover, an insulator 4515 is formed covering an end portion of the pixel electrode 4514, a driving transistor 4519, and the capacitor 4520.

A layer containing an organic compound 4516 and an opposite electrode 4517 are formed over the pixel electrode 4514 and the insulator 4515, and in a region in which the layer containing an organic compound 4516 is sandwiched between the pixel electrode 4514 and the opposite electrode 4517, a light emitting element 4518 is formed.

The semiconductor layer 4507 and the N-type semiconductor layer 4510 each of which is to be a part of the second electrode of the capacitor 4520 are necessarily provided. That is, the second electrode of the capacitor 4520 may be substituted by the conductive layer 4513, and the capacitor 4520 may have a structure in which the gate insulating film is sandwiched between the first electrode 4504 and the conductive layer 4513.

Note that in FIG. 45A, by forming the pixel electrode 4514 before forming the wiring 4511, a second electrode 4521 including the same material as that of the pixel electrode 4514 can be formed in the same layer as the pixel electrode 4514. Accordingly, a capacitor 4522 having a structure in which the gate insulating film 4505 is sandwiched between the first electrode 4504 and the second electrode 4521 can be formed.

Figure 45B:
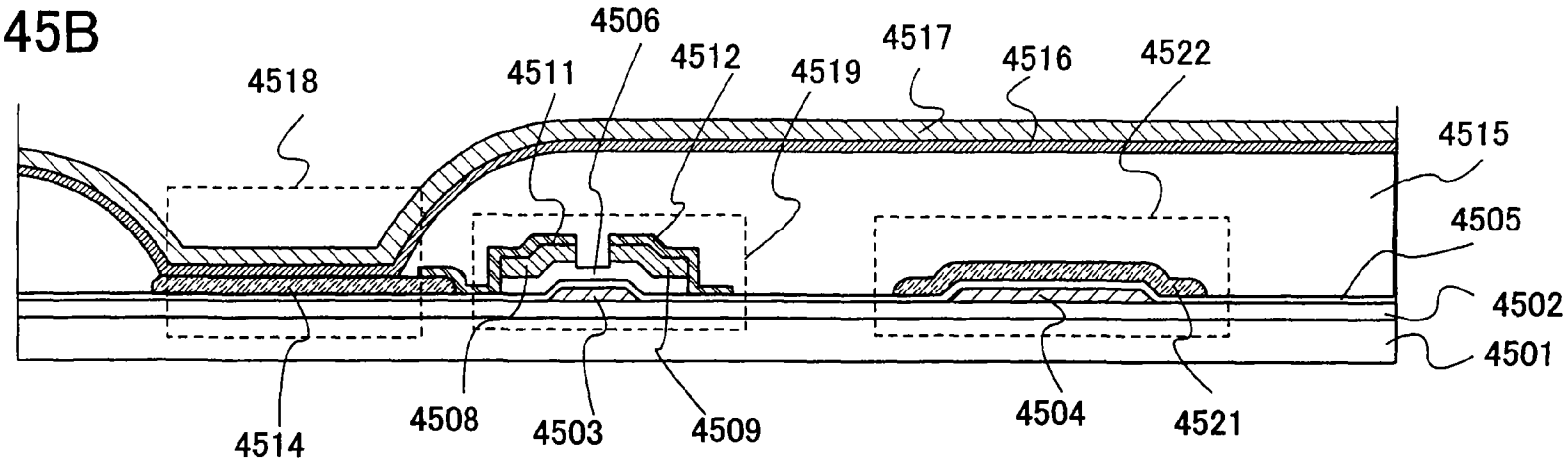

Note that in FIGS. 45A and 45B, although description is made on an inversely staggered channel etch type transistor, it is needless to say that a channel protection type transistor may be used as well. Description is made on a case of a channel protection type transistor with reference to FIGS. 46A and 46B.

Figure 46A:
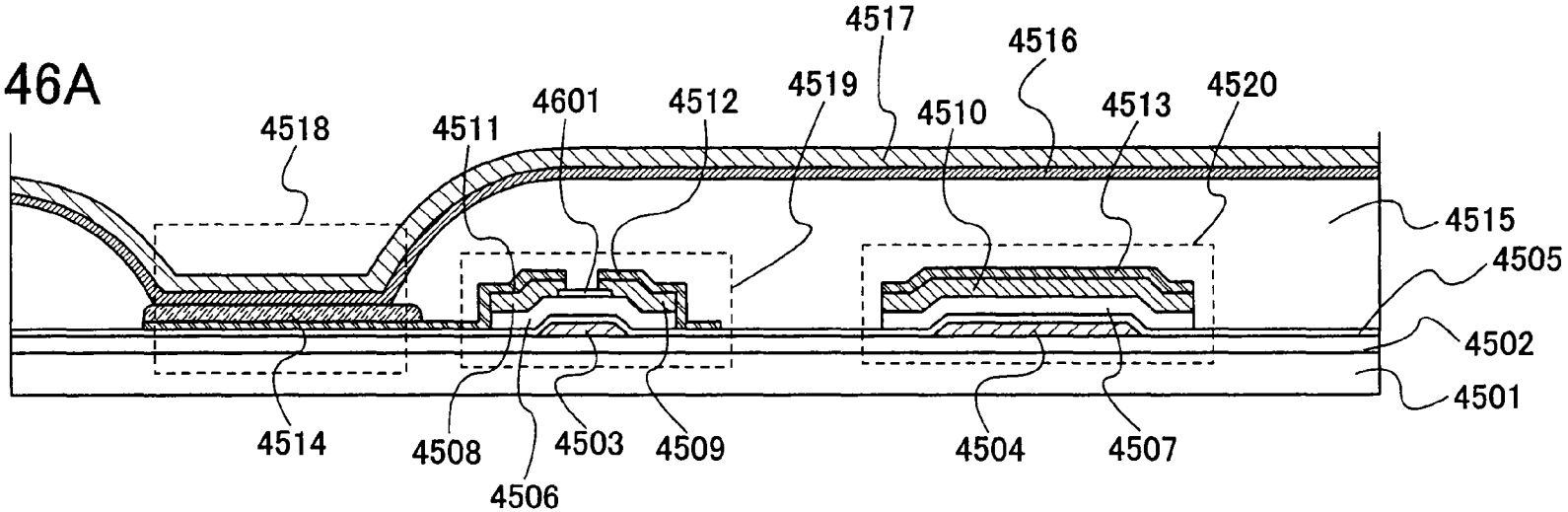
FIGS. 46 A and 46B each show an example of a structure of a display device of the present invention.

A channel protection type transistor shown in FIG. 46A is different from the channel etch type driving transistor 4519 shown in FIG. 45A in that over a region including a channel of the semiconductor layer 4506 an insulator 4601 to be an etching mask is provided. However, common reference numerals are used for other common portions.

Figure 46B:
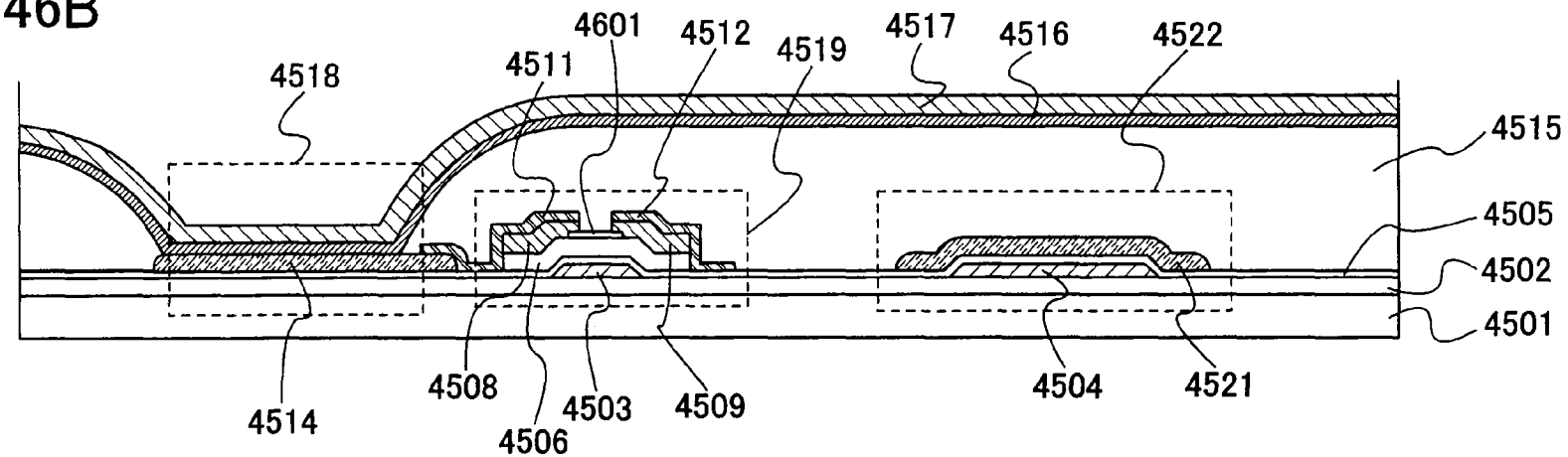

Similarly, a channel protection type transistor shown in FIG. 46B is different from the channel etch type driving transistor 4519 shown in FIG. 45B in that over a region including a channel of the semiconductor layer 4506 an insulator 4601 to be an etching mask is provided. However, common reference numerals are used for other common portions.

When an amorphous semiconductor film is used for a semiconductor layer (a channel forming region, a source region, a drain region, or the like) of a transistor forming pixels of the present invention, manufacturing cost can be reduced.

Note that a structure of a transistor and a structure of a capacitor that can be applied to a pixel portion of a display device of the present invention are not limited to the foregoing structures, and a variety of transistor structures and capacitor structures can be used.

Note that the content described in this embodiment mode can be implemented by being freely combined with the contents described in Embodiment Modes 1 to 5.

Embodiment Mode 7

This embodiment mode will explain a method for manufacturing a semiconductor device using plasma treatment as a method for manufacturing a semiconductor device such as a transistor.

Figure 47A:
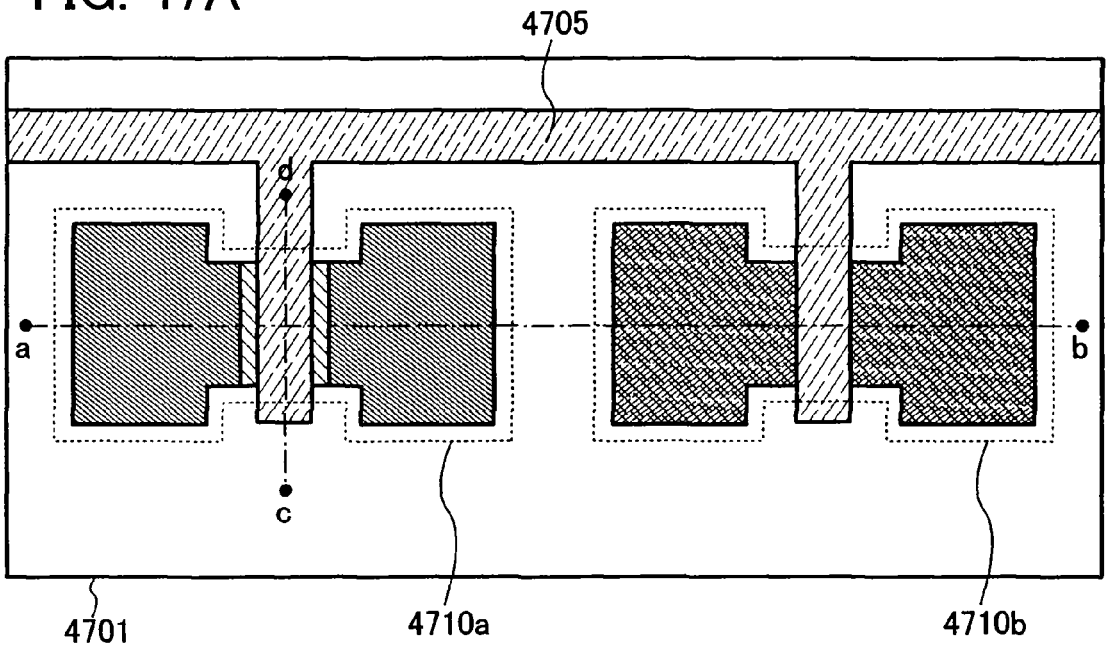
FIGS. 47A to 47C each show a structure of a transistor used in a display device of the present invention.
Figure 47B:
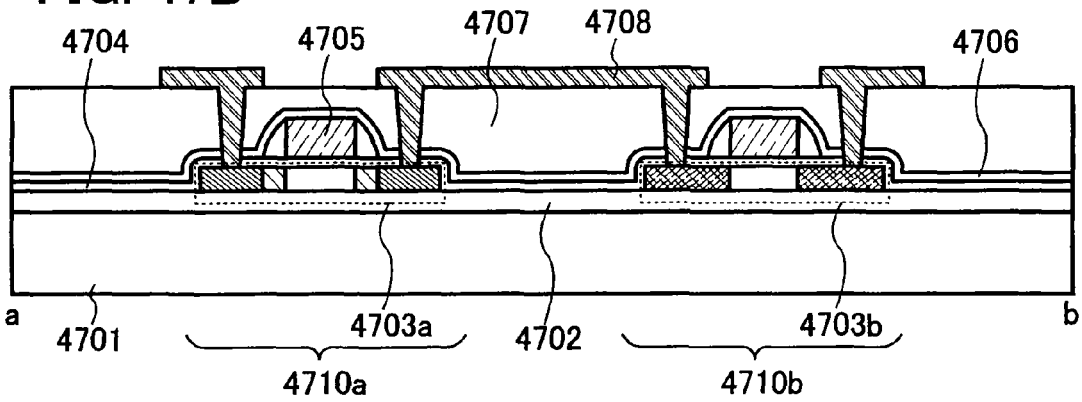
Figure 47C:
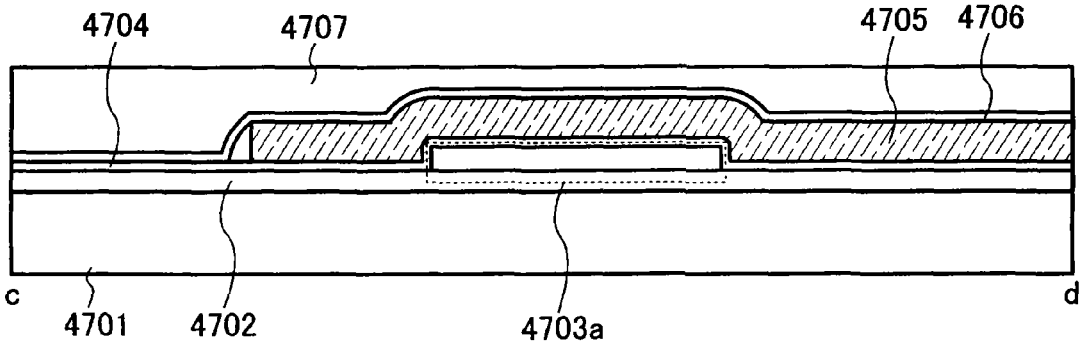

FIGS. 47A to 47C are diagrams each showing a structural example of a semiconductor device including a transistor. Note that, in FIGS. 47A to 47C, FIG. 47B corresponds to a cross-sectional view taken along a line a-b of the figure in FIG. 47A, and FIG. 47C corresponds to a cross-sectional view taken along a line c-d of the figure in FIG. 47A.

A semiconductor device shown in FIGS. 47A to 47C includes semiconductor films 4703*a* and 4703*b* provided over a substrate 4701 with an insulating film 4702 interposed therebetween, a gate electrode 4705 provided over the semiconductor films 4703*a* and 4703*b* with a gate insulating film 4704 interposed therebetween, insulating films 4706 and 4707 provided to cover the gate electrode, and a conductive film 4708 which is electrically connected to a source or drain region of the semiconductor films 4703*a* and 4703*b* and provided over the insulating film 4707. Note that FIGS. 47A to 47C each show a case of providing an N-channel transistor 4710*a* using a part of the semiconductor film 4703*a* as a channel region and a P-channel transistor 4710*b* using a part of the semiconductor film 4703*b* as a channel region; however, the present invention is not limited to this structure. For example, in FIGS. 47A to 47C, although an LDD region is provided in the N-channel transistor 4710*a* and not provided in the P-channel transistor 4710*b*, an LDD region can be provided in both of the transistors or neither of the transistors.

Note that, in this embodiment mode, the semiconductor device shown in FIGS. 47A to 47C is manufactured by oxidizing or nitriding at least one of the substrate 4701, the insulating film 4702, the semiconductor films 4703*a* and 4703*b*, the gate insulating film 4704, the insulating film 4706, and the insulating film 4707 by plasma treatment, so that the semiconductor film or the insulating film is oxidized or nitrided. In this manner, by oxidizing or nitriding the semiconductor film or the insulating film by plasma treatment, the surface of the semiconductor film or the insulating film is modified. Consequently, a denser insulating film can be formed as compared to an insulating film formed by a CVD method or a sputtering method. Therefore, defects such as a pinhole can be suppressed and the characteristics or the like of the semiconductor device can be improved.

In this embodiment mode, a method for manufacturing a semiconductor device by performing plasma treatment to the aforementioned semiconductor film 4703*a* and the semiconductor film 4703*b*, or the gate insulating film 4704 in FIGS. 47A to 47C and oxidizing or nitriding the semiconductor film 4703*a* and the semiconductor film 4703*b*, or the gate insulating film 4704 will be explained with reference to the drawings.

First, a case of providing an edge portion of an island-shaped semiconductor film over a substrate so as to have nearly a right angle is shown.

First, the island-shaped semiconductor films 4703*a* and 4703*b* are formed over the substrate 4701 (FIGS. 48(A-1) and 48(A-2)). The island-shaped semiconductor films 4703*a* and 4703*b* are formed by forming an amorphous semiconductor film using a material mainly containing silicon (Si) ($Si_xGe_{1-x}$ or the like) over the insulating film 4702, which is formed in advance over the substrate 4701, by a sputtering method, an LPCVD method, a plasma CVD method, or the like; and then the amorphous semiconductor film is crystallized and selectively etched. Note that the amorphous semiconductor film can be crystallized by a crystallization method such as a laser crystallization method, a thermal crystallization method using RTA or an annealing furnace, a thermal crystallization method using a metal element which promotes crystallization, or a method using these methods in combination. Note that, in FIGS. 48(A-1) to 48(D-2), each of the edge portions of the island-shaped semiconductor films 4703*a* and 4703*b* are formed to have nearly a right angle ($\theta$=85 to 100°).

Next, the semiconductor films 4703*a* and 4703*b* are oxidized or nitrided by plasma treatment to form oxide films or nitride films 4721*a* and 4721*b* (hereinafter, also referred to as insulating films 4721*a* and 4721*b*) on the surfaces of the semiconductor films 4703*a* and 4703*b*, respectively (FIGS. 48(B-1) and 48(B-2)). In a case of using Si for the semiconductor films 4703*a* and 4703*b*, for example, silicon oxide or silicon nitride is formed as the insulating films 4721*a* and 4721*b*. In addition, after oxidizing the semiconductor films 4703*a* and 4703*b* by plasma treatment, they may be nitrided by performing plasma treatment again. In this case, silicon oxide is formed in contact with the semiconductor films 4703*a* and 4703*b* and silicon nitride oxide ($SiN_xO_y$) (x>y) is formed on the surface of the silicon oxide. Note that, in the case of oxidizing the semiconductor films by plasma treatment, plasma treatment is performed under an oxygen atmosphere (for example, under an atmosphere containing oxygen ($O_2$) and a rare gas (at least one of He, Ne, Ar, Kr, and Xe), an atmosphere containing oxygen, hydrogen ($H_2$), and a rare gas, or an atmosphere containing dinitrogen monoxide and a rare gas). On the other hand, in the case of nitriding the semiconductor films by plasma treatment, plasma treatment is performed under a nitrogen atmosphere (for example, under an atmosphere containing nitrogen ($N_2$) and a rare gas (at least one of He, Ne, Ar, Kr, and Xe), an atmosphere containing nitrogen, hydrogen, and a rare gas, or an atmosphere containing $NH_3$ and a rare gas). As a rare gas, for example, Ar can be used. A gas in which Ar and Kr are mixed may also be used as well. Accordingly, the insulating films 4721*a* and 4721*b* contain the rare gas (containing at least one of He, Ne, Ar, Kr, and Xe) used for the plasma treatment. When Ar is used, the insulating films 4721*a* and 4721*b* contain Ar.

In addition, the plasma treatment is performed with an electron density of $1\times10^{11}$ $cm^{-3}$ or more and $1\times10^{13}$ $cm^{-3}$ or less and an electron temperature of plasma of 0.5 eV or more and 1.5 eV or less in the atmosphere containing the gas described above. The electron density of plasma is high and the electron temperature around an object (here, the semiconductor films 4703*a* and 4703*b*) formed over the substrate 4701 is low. Thus, plasma damages to the object can be avoided. In addition, since the electron density of plasma is as high as $1\times10^{11}$ $cm^{-3}$ or more, the oxide film or the nitride film formed by oxidizing or nitriding the object by the plasma treatment has a superior evenness in film thickness as compared to a film formed by a CVD method, a sputtering method, or the like, and thus, can be a dense film. Moreover, since the electron temperature of plasma is as low as 1 eV or lower, the oxidation treatment or the nitriding treatment can be performed at a lower temperature than conventional plasma treatment or a thermal oxidation method. For example, the oxidation treatment or the nitriding treatment can be performed sufficiently even when the plasma treatment is performed at a lower temperature by at least 100° C. than a distortion point of a glass substrate. As the frequency for producing plasma, a high frequency wave such as a microwave (2.45 GHz) can be employed. Hereinafter, the plasma treatment is performed with the above conditions unless otherwise noted.

Next, the gate insulating film 4704 is formed to cover the insulating films 4721*a* and 4721*b* (FIGS. 48(C-1) and 48(C-2)). The gate insulating film 4704 can be formed to have a single layer structure or a stacked-layer structure of insulating films containing nitrogen or oxygen such as silicon oxide, silicon nitride, silicon oxynitride ($SiO_xN_y$) (x>y), or silicon nitride oxide ($SiN_xO_y$) ($x\leqq y$) by a sputtering method, an LPCVD method, a plasma CVD method, or the like. For example, when Si is used for the semiconductor films 4703*a* and 4703*b*, and silicon is oxidized by the plasma treatment, silicon oxide is formed as the insulating films 4721*a* and 4721*b* on the surfaces of the semiconductor films 4703*a* and 4703*b*. In this case, silicon oxide ($SiO_x$) is formed as the gate insulating film over the insulating films 4721*a* and 4721*b*. In addition, in FIGS. 48(B-1) and 48(B-2), if thicknesses of the insulating films 4721*a* and 4721*b* are sufficient, it is possible that the insulating films 4721*a* and 4721*b* which are formed by oxidizing or nitriding the semiconductor films 4703*a* and 4703*b* by the plasma treatment, are used as the gate insulating films.

Then, by forming the gate electrode 4705 or the like over the gate insulating film 4704, it is possible to manufacture a semiconductor device having the N-channel transistor 4710*a* and the P-channel transistor 4710*b* using the island-shaped semiconductor films 4703*a* and 4703*b*, respectively as channel regions (FIGS. 48(D-1) and 48(D-2)).

In this manner, before forming the gate insulating film 4704 over the semiconductor films 4703*a* and 4703*b*, the surface of each of the semiconductor films 4703*a* and 4703*b* is oxidized or nitrided by the plasma treatment. Consequently, a short-circuit or the like between the gate electrode and the semiconductor film due to a coverage defect of the gate insulating film 4704 in end portions 4751*a* and 4751*b* of the channel regions can be prevented. In other words, in a case where each of the end portions of the island-shaped semiconductor films is formed to have nearly a right angle (θ=85 to 100°), when the gate insulating film is formed to cover the semiconductor films by a CVD method, a sputtering method or the like, there is a risk of a coverage defect due to breakage of the gate insulating film, or the like at the end portions of the semiconductor films. However, when the plasma treatment is performed on the surfaces of the semiconductor films to oxide or nitride the surfaces, coverage defects and the like of the gate insulating film at the end portions of the semiconductor films can be prevented.

In FIGS. 48(A-1) to 48(D-2), the gate insulating film 4704 may be oxidized or nitrided by performing plasma treatment after forming the gate insulating film 4704. In this case, plasma treatment is performed on the gate insulating film 4704 which is formed to cover the semiconductor films 4703*a* and 4703*b* (FIGS. 49(A-1) and 49(A-2)), the gate insulating film 4704 is oxidized or nitrided. As a result, an oxide film or a nitride film 4805 (hereinafter also referred to as an insulating film 4805) is formed on the surface of the gate insulating film 4704 (FIGS. 49(B-1) and 49(B-2)). The plasma treatment can be performed under similar conditions to those of FIGS. 48(B-1) and 48(B-2). In addition, the insulating film 4805 contains a rare gas used in the plasma treatment, and for example, in a case of using Ar, Ar is contained in the insulating film 4805.

Figures 1, 2, 49A, 49B, 49C:
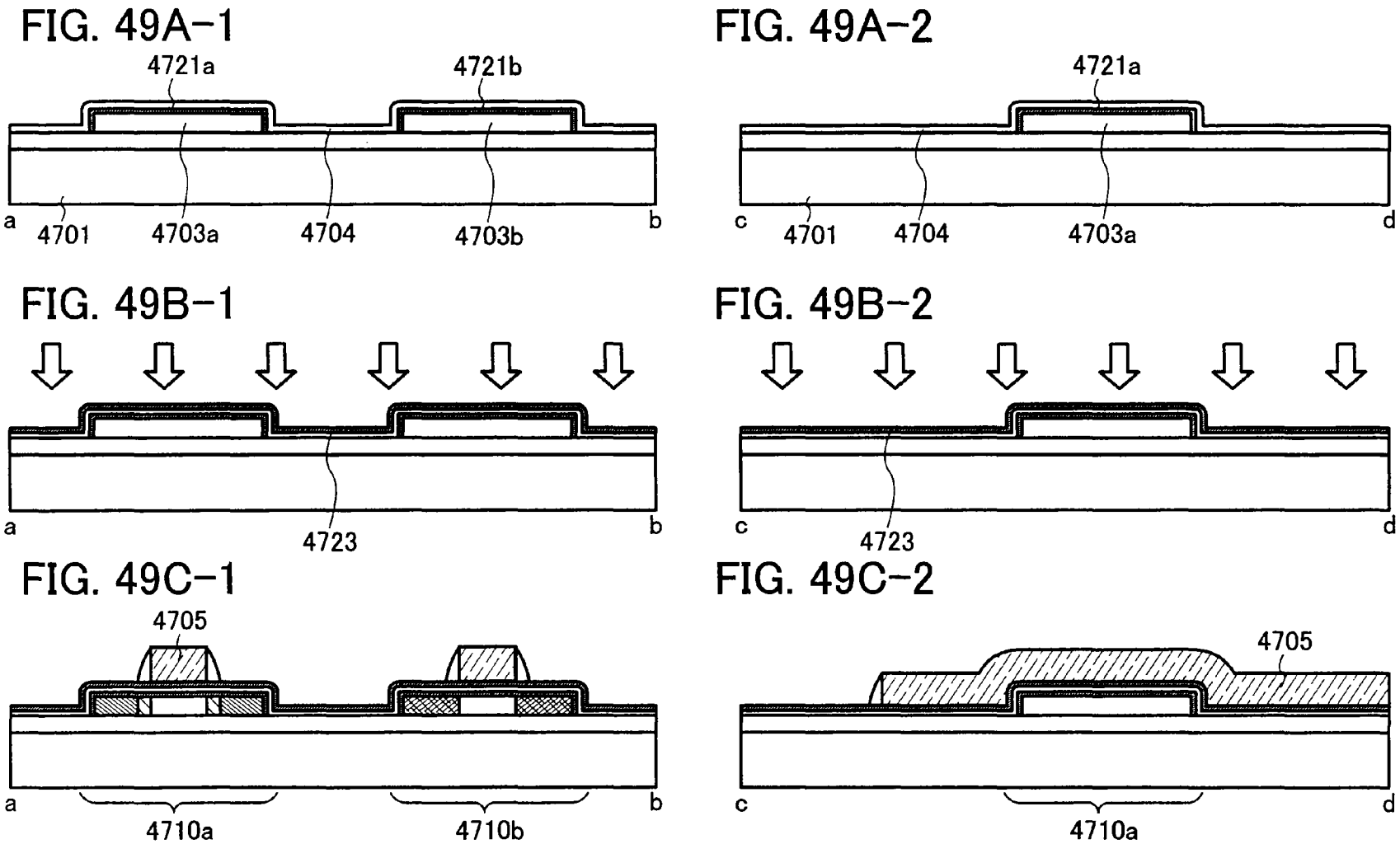

In FIGS. 49(B-1) and 49(B-2), after the plasma treatment is performed in an atmosphere containing oxygen to oxidize the gate insulating film 4704, plasma treatment may be performed again in an atmosphere containing nitrogen to nitride the gate insulating film 4704. In this case, silicon oxide or silicon oxynitride ($SiO_xN_y$) (x>y) is formed over the semiconductor films 4703*a* and 4703*b*, and silicon nitride oxide ($SiN_xO_y$) (x>y) is formed in contact with the gate electrode 4705. Thereafter, by forming the gate electrode 4705 or the like over the insulating film 4805, it is possible to manufacture a semiconductor device having the N-channel transistor 4710*a* and the P-channel transistor 4710*b* using the island-shaped semiconductor films 4703*a* and 4703*b*, respectively, as channel regions (FIGS. 49(C-1) and 49(C-2)). In this manner, by performing the plasma treatment on the gate insulating film, the surface of the gate insulating film is oxidized or nitrided to be enhanced in its film quality, and a dense film can be obtained. The insulating film obtained by the plasma treatment is denser and has fewer defects such as pinholes as compared to an insulating film formed by a CVD method or a sputtering method, and thus, the characteristics of a transistor can be enhanced.

In FIGS. 49(A-1) to 49(D-2), the case is described, where the plasma treatment is performed on the semiconductor films 4703*a* and 4703*b* in advance, so that the surfaces of the semiconductor films 4703*a* and 4703*b* are oxidized or nitrided. However, a method may be employed, in which plasma treatment is performed after forming the gate insulating film 4704 without performing the plasma treatment on the semiconductor films 4703*a* and 4703*b*. In this manner, by performing the plasma treatment before forming the gate electrode, even when coverage defects due to breakage of the gate insulating film occur at the end portions of the semiconductor films, the semiconductor film exposed due to the coverage defects can be oxidized or nitrided, and thus, a short-circuit between the gate electrode and the semiconductor film caused by the coverage defects of the gate insulating film at the end portions of the semiconductor films, or the like can be prevented.

As described above, even when the end portions of the island-shaped semiconductor films are each formed so as to have nearly a right angle, the plasma treatment is performed on the semiconductor films or the gate insulating film to oxidize or nitride the semiconductor films or the gate insulating film, thereby avoiding a short-circuit between the gate electrode and the semiconductor films caused by coverage defects of the gate insulating film at the end portions of the semiconductor films.

Next, a case will be described where the end portion of the island-shaped semiconductor film has a tapered shape (θ=30 to 85°) in the island-shaped semiconductor film provided over the substrate.

Figures 1, 2, 50A, 50B, 50C, 50D:
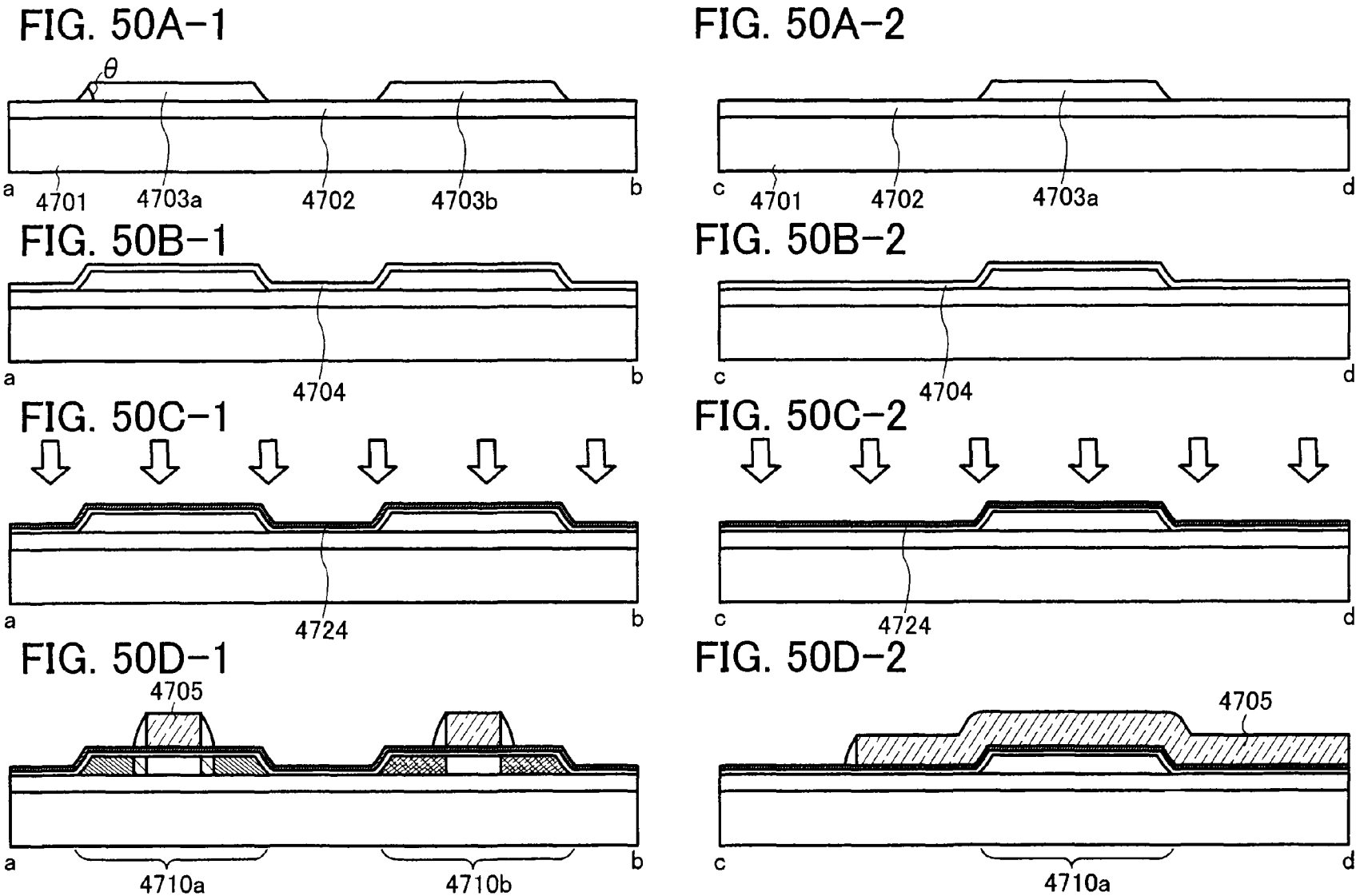

First, the island-shaped semiconductor films 4703*a* and 4703*b* are formed over the substrate 4701 (FIGS. 50(A-1) and 50(A-2)). In order to obtain the island-shaped semiconductor films 4703*a* and 4703*b*, an amorphous semiconductor film using a material mainly containing silicon (Si) (for example, $Si_xGe_{1-x}$, or the like) is formed by a sputtering method, an LPCVD method, a plasma CVD method, or the like over the insulating film 4702 which is formed over the substrate 4701 in advance. Then, the amorphous semiconductor film is crystallized by a crystallization method such as a laser crystallization method, a thermal crystallization method using RTA or an annealing furnace, or a thermal crystallization method using a metal element promoting crystallization. Then, the semiconductor film is selectively etched and removed. In FIGS. 50(A-1) to 50(D-2), the end portions of the island-shaped semiconductor films 4703*a* and 4703*b* are tapered (θ=30 to 85°).

Next, a gate insulating film 4704 is formed to cover the semiconductor films 4703*a* and 4703*b* (FIGS. 50(B-1) and 50(B-2)). The gate insulating film 4704 can be formed to have a single layer structure or a stacked-layer structure of an insulating film containing nitrogen or oxygen such as silicon oxide, silicon nitride, silicon oxynitride ($SiO_xN_y$) (x>y), or silicon nitride oxide ($SiN_xO_y$) (x>y) by a sputtering method, an LPCVD method, a plasma CVD method, or the like.

Then, the gate insulating film 4704 is oxidized or nitrided by plasma treatment, and thus, an oxide film or a nitride film 4724 (hereinafter also referred to as an insulating film 4724) is formed on the surface of the gate insulating film 4704 (FIGS. 50(C-1) and 50(C-2)). Note that the plasma treatment can be performed under similar conditions to those described above. For example, when silicon oxide or silicon oxynitride ($SiO_xN_y$) (x≦y) is used as the gate insulating film 4704, plasma treatment is performed in an atmosphere containing oxygen to oxidize the gate insulating film 4704. The film obtained on the surface of the gate insulating film by the plasma treatment is dense and has fewer defects such as pinholes as compared with a gate insulating film formed by a CVD method, a sputtering method, or the like. On the other hand, when plasma treatment is performed in an atmosphere containing nitrogen to nitride the gate insulating film 4704, silicon nitride oxide ($SiN_xO_y$) (x>y) can be provided as the insulating film 4724 on the surface of the gate insulating film 4704. In addition, after plasma treatment is performed in an atmosphere containing oxygen to oxidize the gate insulating film 4704, plasma treatment may be performed again in an atmosphere containing nitrogen to nitride the gate insulating film 4704. In addition, the insulating film 4724 contains a rare gas used in the plasma treatment, and for example, in a case of using Ar, Ar is contained in the insulating film 4724.

Next, by forming the gate electrode 4705 or the like over the gate insulating film 4704, it is possible to manufacture a semiconductor device having the N-channel transistor 4710*a* and the P-channel transistor 4710*b* using the island-shaped semiconductor films 4703*a* and 4703*b*, respectively, as channel regions (FIGS. 50(D-1) and 50(D-2)).

In this manner, by performing the plasma treatment to the gate insulating film, an insulating film formed of an oxide film or a nitride film is formed on the surface of the gate insulating film, and the surface of the gate insulating film can be enhanced in its film quality. The insulating film oxidized or nitrided by the plasma treatment is denser and has fewer defects such as pinholes as compared to a gate insulating film formed by a CVD method or a sputtering method, and thus, the characteristics of a transistor can be enhanced. Further, it is possible to suppress a short-circuit or the like between the gate electrode and the semiconductor film caused by the coverage defect of the gate insulating film or the like at the end portion of the semiconductor film by forming the end portion of the semiconductor film into a tapered shape. However, by performing the plasma treatment after forming the gate insulating film, a short-circuit or the like between the gate electrode and the semiconductor film can further be prevented.

A manufacturing method of a semiconductor device which is different from that in FIGS. 50(A-1) to 50(D-2) will be explained with reference to the drawings. Specifically, a case is described where plasma treatment is selectively conducted to an end portion of a semiconductor film having a tapered shape.

Figures 1, 2, 51A, 51B, 51C, 51D:
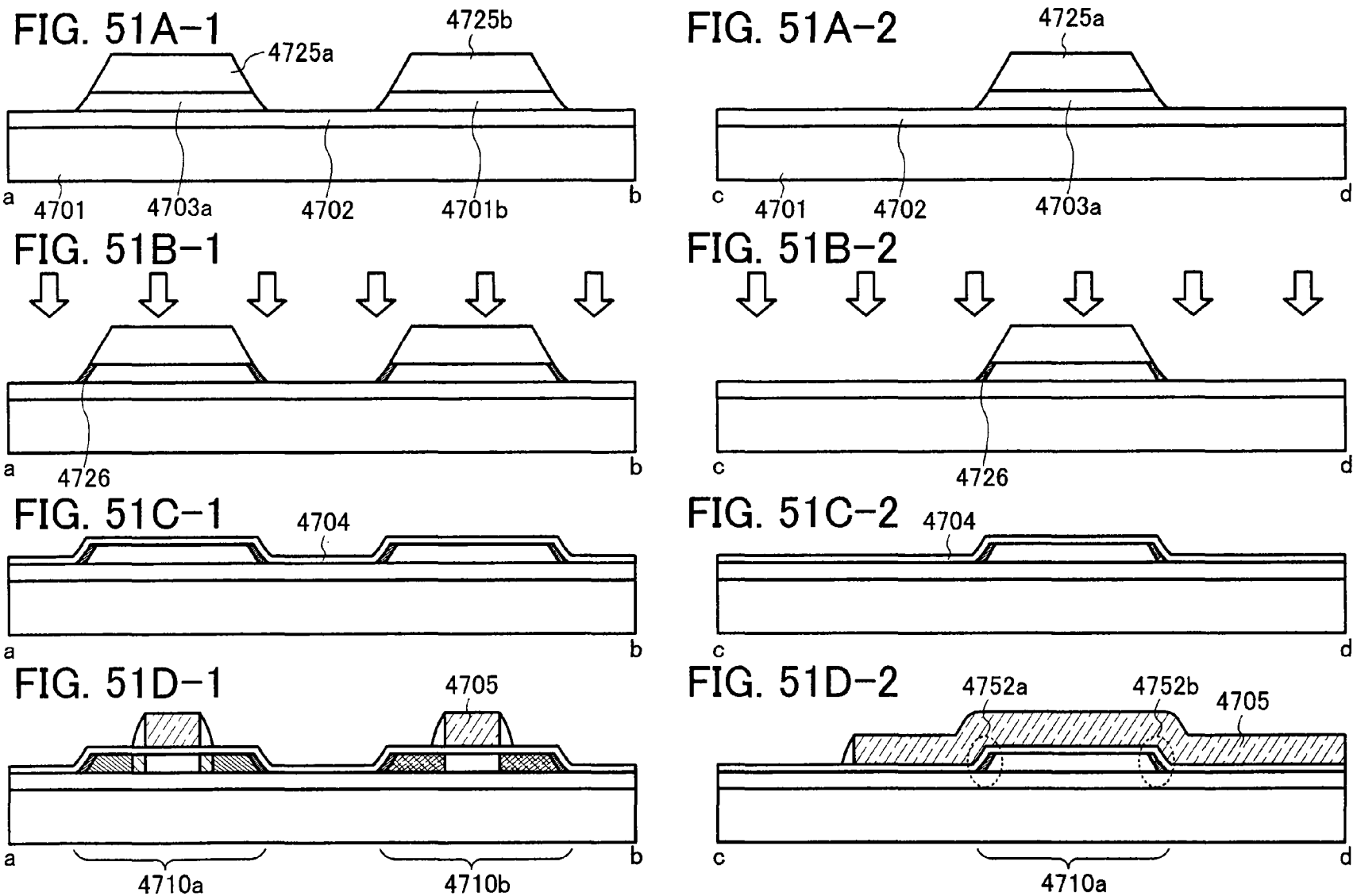

First, the island-shaped semiconductor films 4703*a* and 4703*b* are formed over the substrate 4701 (FIGS. 51(A-1) and 51(A-2)). In order to obtain the island-shaped semiconductor films 4703*a* and 4703*b*, an amorphous semiconductor film using a material mainly containing silicon (Si) (e.g., $Si_xGe_{1-x}$ etc.) is formed by a sputtering method, an LPCVD method, a plasma CVD method, or the like over an insulating film 4702 which is formed over the substrate 4701 in advance. Then, the amorphous semiconductor film is crystallized and the semiconductor film is selectively etched using resists 4725*a* and 4725*b* as masks. A crystallization method such as a laser crystallization method, a thermal crystallization method using RTA or an annealing furnace, a thermal crystallization method using a metal element promoting crystallization, or a combination of the methods can be adopted to crystallize the amorphous semiconductor film.

Next, before removing the resists 4725*a* and 4725*b* used for etching the semiconductor film, plasma treatment is performed to selectively oxidize or nitride the end portions of the island-shaped semiconductor films 4703*a* and 4703*b*. An oxide film or a nitride film 4726 (hereinafter, also referred to as an insulating film 4726) is formed at each end portion of the semiconductor films 4703*a* and 4703*b* (FIGS. 51(B-1) and 51(B-2)). The plasma treatment is performed under the above conditions. In addition, the insulating film 4726 contains a rare gas used in the plasma treatment.

Then, a gate insulating film 4704 is formed to cover the semiconductor films 4703*a* and 4703*b* (FIGS. 51(C-1) and 51(C-2)). The gate insulating film 4704 can be formed similarly as described above.

Next, by forming the gate electrode 4705 or the like over the gate insulating film 4704, it is possible to manufacture a semiconductor device having the N-channel transistor 4710*a* and the P-channel transistor 4710*b* using the island-shaped semiconductor films 4703*a* and 4703*b*, respectively, as channel regions (FIGS. 51(D-1) and 51(D-2)).

When the end portions of the semiconductor films 4703*a* and 4703*b* are tapered, end portions 4752*a* and 4752*b* of the channel regions formed in part of the semiconductor films 4703*a* and 4703*b* are also tapered. Thus, the thickness of the semiconductor film or the gate insulating film varies as compared to the center portion, and there is a risk that the characteristics of transistors are affected. Thus, by selectively oxidizing or nitriding the end portions of the channel regions by the plasma treatment, an insulating film is formed in the semiconductor film which becomes the end portions of the channel regions. Thus, the effect on the transistors due to the end portions of the channel regions can be reduced.

FIGS. 51(A-1) to 51(D-2) show an example in which the plasma treatment is performed on only the end portions of the semiconductor films 4703*a* and 4703*b* for oxidation or nitridation. Needless to say, as shown in FIGS. 50(A-1) to 50(D-2), the plasma treatment can also be performed on the gate insulating film 4704 for oxidation or nitridation (FIGS. 53(A-1) and 53(A-2)).

Next, a manufacturing method of a semiconductor device which is different from the foregoing is described with reference to the drawings. Specifically, plasma treatment is applied to a semiconductor film having a tapered shape.

First, island-shaped semiconductor films 4703*a* and 4703*b* are formed over the substrate 4701 similarly as described above (FIGS. 52(A-1) and 52(A-2)).

Next, the semiconductor films 4703*a* and 4703*b* are oxidized or nitrided by plasma treatment, and oxide films or nitride films 4727*a* and 4727*b* (hereinafter, also referred to as insulating films 4727*a* and 4727*b*) are formed on surfaces of the semiconductor films 4703*a* and 4703*b* (FIGS. 52(B-1) and 52(B-2)). The plasma treatment can be performed under the above conditions. For example, when Si is used for the semiconductor films 4703*a* and 4703*b*, silicon oxide ($SiO_x$) or silicon nitride ($SiN_x$) is formed as the insulating films 4727*a* and 4727*b*. In addition, after oxidizing the semiconductor films 4703*a* and 4703*b* by plasma treatment, plasma treatment may be performed again to nitride the semiconductor films 4703*a* and 4703*b*. In this case, silicon oxide ($SiO_x$) or silicon oxynitride ($SiO_xN_y$) (x>y) is formed in contact with the semiconductor films 4703*a* and 4703*b*, and silicon nitride oxide ($SiN_xO_y$) (x>y) is formed on the surface of the silicon oxide. Therefore, the insulating films 4727*a* and 4727*b* contain a rare gas used for the plasma treatment. By the plasma treatment, the end portions of the semiconductor films 4703*a* and 4703*b* are oxidized or nitrided at the same time.

Figures 1, 2, 52A, 52B, 52C, 52D:
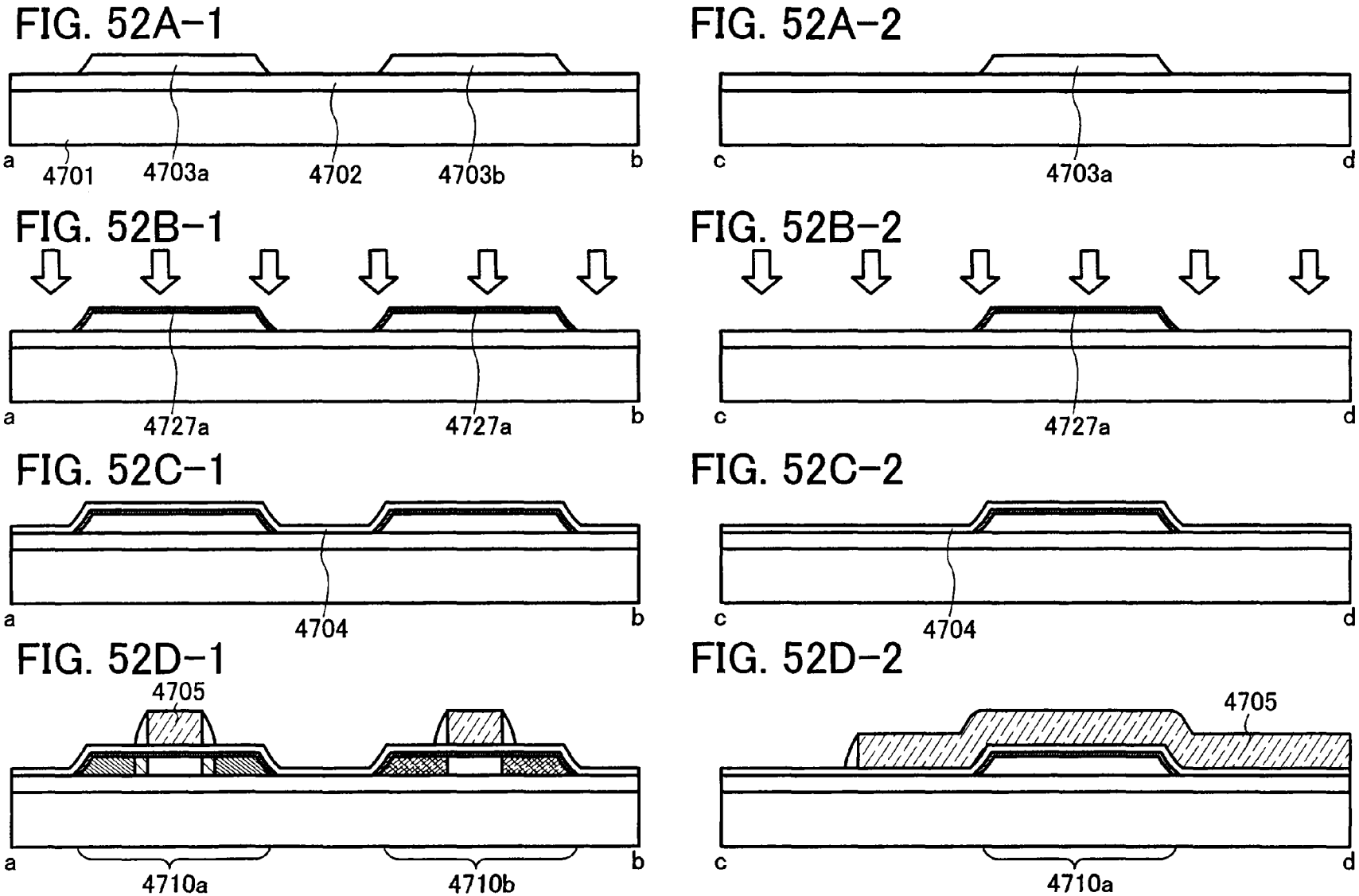
Figures 1, 53A:
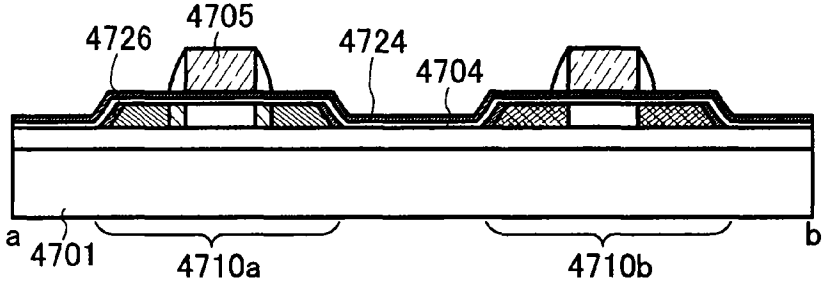
Figures 2, 53A:
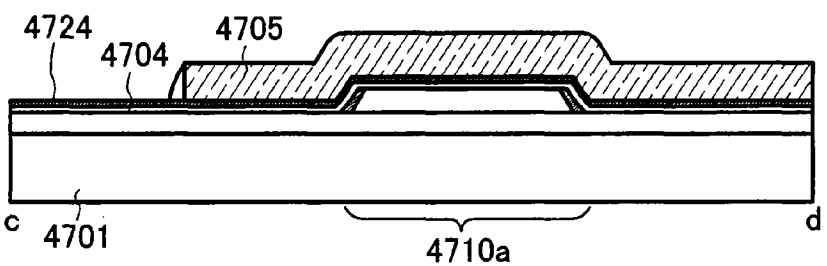
Figures 1, 53B:
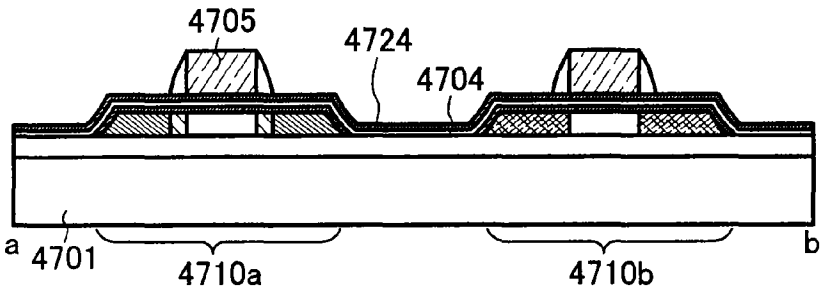
Figures 2, 53B:
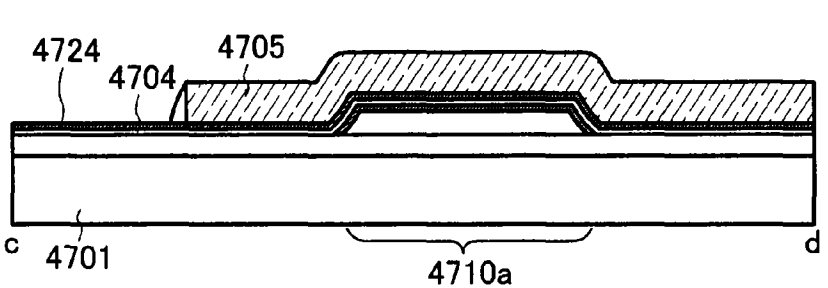

Then, a gate insulating film 4704 is formed to cover the insulating films 4727*a* and 4727*b* (FIGS. 52(C-1) and 52(C-2)). As the gate insulating film 4704, a single layer structure or a stacked-layer structure of insulating films containing nitrogen or oxygen such as silicon oxide, silicon nitride, silicon oxynitride ($SiO_xN_y$) (x>y), or silicon nitride oxide ($SiN_xO_y$) (x>y) can be employed by a sputtering method, an LPCVD method, a plasma CVD method, or the like. For example, in a case where the semiconductor films 4703*a* and 4703*b* using Si are oxidized by plasma treatment to form silicon oxide as the insulating films 4727*a* and 4727*b* on the surfaces of the semiconductor films 4703*a* and 4703*b*, silicon oxide is formed as the gate insulating film over the insulating films 4727*a* and 4727*b*.

Next, by forming the gate electrode 4705 or the like over the gate insulating film 4704, it is possible to manufacture a semiconductor device having the N-channel transistor 4710*a* and the P-channel transistor 4710*b* using the island-shaped semiconductor films 4703*a* and 4703*b*, respectively, as channel regions (FIGS. 52(D-1) and 52(D-2)).

When the end portions of the semiconductor films are tapered, end portions 4753*a* and 4753*b* of the channel regions formed in a portion of the semiconductor films are also tapered. Thus, there is a risk that the characteristics of a semiconductor element are affected. By oxidizing or nitriding the end portions of the channel regions as a result of oxidizing or nitriding the semiconductor films by the plasma treatment, the effect on the semiconductor element can be reduced.

In FIGS. 52(A-1) to 52(D-2), the example is shown in which only the semiconductor films 4703*a* and 4703*b* are subjected to oxidation or nitridation by plasma treatment; however, as shown in FIGS. 50(A-1) to 50(D-2), the plasma treatment can also be performed to the gate insulating film 4704 for oxidation or nitridation (FIGS. 53(B-1) and 53(B-2)). In this case, after the plasma treatment is performed in an atmosphere containing oxygen to oxidize the gate insulating film 4704, plasma treatment may be performed again in an atmosphere containing nitrogen to nitride the gate insulating film 4704. In this case, silicon oxide or silicon oxynitride ($SiO_xN_y$) (x>y) is formed in the semiconductor films 4703*a* and 4703*b*, and silicon nitride oxide ($SiN_xO_y$) (x>y) is formed in contact with the gate electrode 4705.

As described above, by modifying the film quality of the surface of the semiconductor film or the gate insulating film by oxidation or nitridation by the plasma treatment, a dense insulating film having good film quality can be formed. Consequently, even when the insulating film is formed thinner, defects such as pinholes can be avoided, and miniaturization and higher performance of a semiconductor element such as a transistor can be realized.

Note that, in this embodiment mode, plasma treatment is performed on the above described semiconductor films 4703*a* and 4703*b* or the gate insulating film 4704 in the above FIGS. 47A to 47C to oxidize or nitride the semiconductor films 4703*a* and 4703*b* or the gate insulating film 4704; however, a layer that is oxidized or nitrided by plasma treatment is not limited thereto. For example, plasma treatment may be performed on the substrate 4701 or the insulating film 4702, or plasma treatment may be performed on the insulating film 4706 or 4707.

Note that the content described in this embodiment mode can be implemented by being freely combined with the contents described in Embodiment Modes 1 to 6.

Embodiment Mode 8

This embodiment mode will make description on hardware for controlling the driving methods described in Embodiment Modes 1 to 5.

Figure 54:
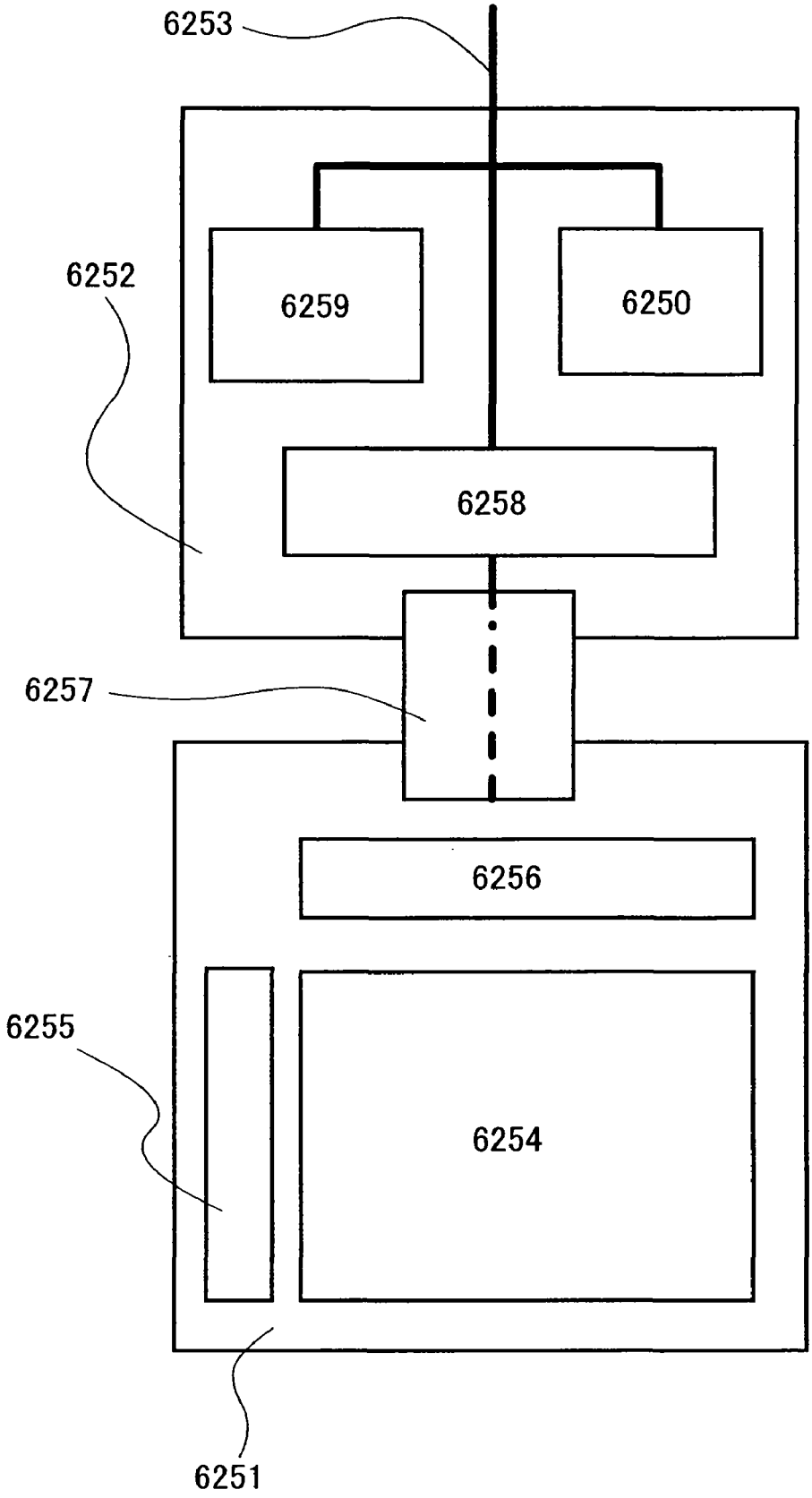
FIG. 54 shows an example of a hardware controlling a driving method of the present invention.

FIG. 54 shows a rough configuration diagram. A pixel portion 6254, a signal line driver circuit 6256, and a scanning line driver circuit 6255 are arranged over a substrate 6251. In addition, a power supply circuit, a pre-charge circuit, a timing generation circuit, or the like may be arranged. There is also a case where the signal line driver circuit 6256 and the scanning line driver circuit 6255 are not necessarily arranged. In this case, a circuit which is not provided over the substrate 6251 may be formed on an IC. The IC may be placed over the substrate 6251 by COG (Chip On Glass). Alternatively, the IC may be placed over a connecting substrate 6257 which connects a peripheral circuit substrate 6252 and the substrate 6251.

A signal 6253 is inputted to the peripheral circuit substrate 6252, and a controller 6258 controls to store the signal in a memory 6259, a memory 6250, or the like. In a case where the signal 6253 is an analog signal, the signal is stored in the memory 6259, the memory 6250, or the like in many cases after analog-digital conversion is performed. Then, the controller 6258 outputs a signal to the substrate 6251 by using the signal stored in the memory 6259, the memory 6250, or the like.

In order to realize the driving methods described in Embodiment Modes 1 to 5, the controller 6258 controls the appearance order or the like of sub-frames and outputs a signal to the substrate 6251.

Note that the content described in this embodiment mode can be implemented by being freely combined with the contents described in Embodiment Modes 1 to 7.

Embodiment Mode 9

This embodiment mode will explain a structural example of an EL module and an EL television receiver using a display device of the present invention.

Figure 55:
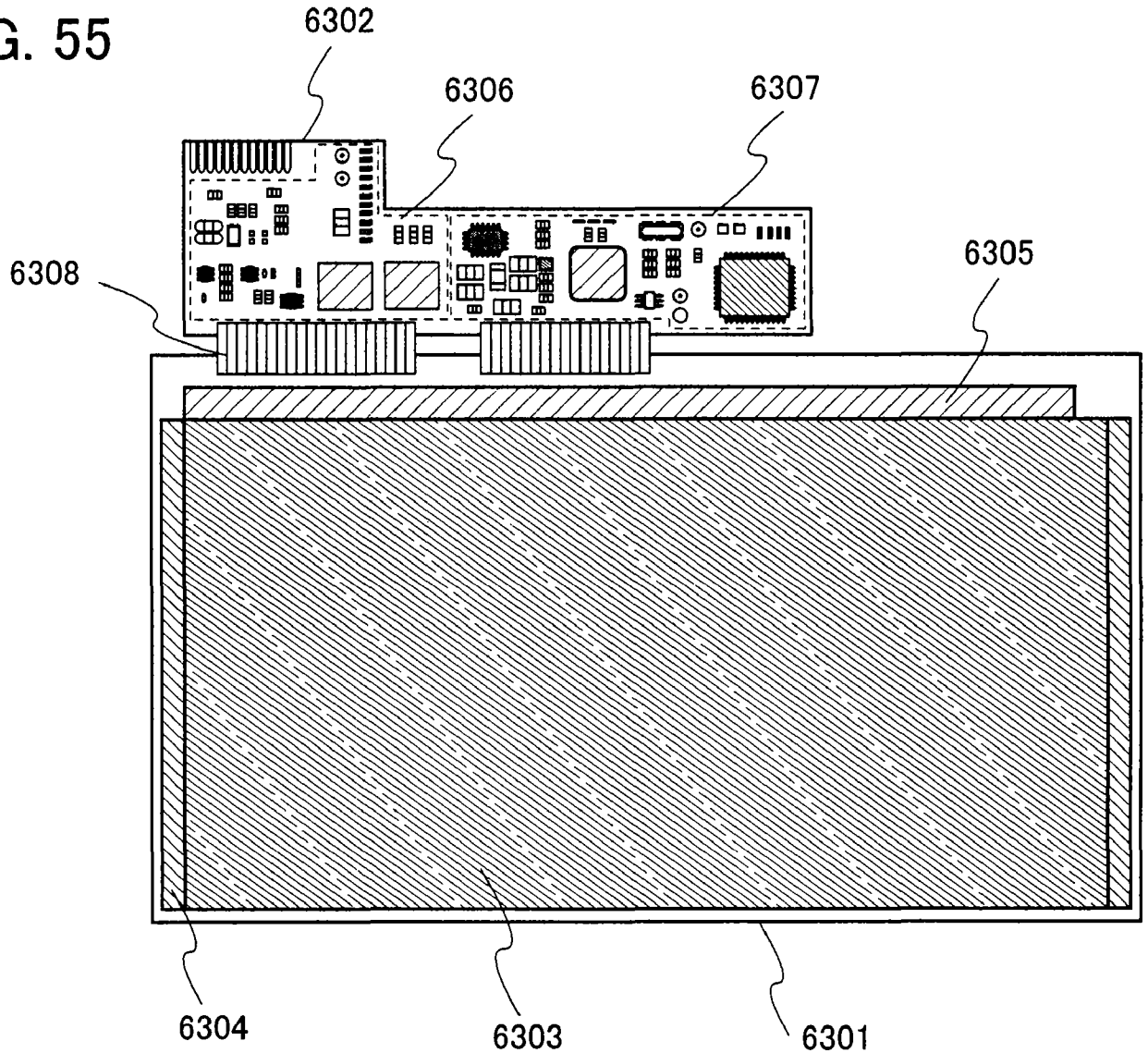
FIG. 55 shows an example of an EL module using a driving method of the present invention.

FIG. 55 shows an EL module in which a display panel 6301 and a circuit board 6302 are combined. The display panel 6301 includes a pixel portion 6303, a scanning line driver circuit 6304, and a signal line driver circuit 6305. Over the circuit board 6302, for example, a control circuit 6306, a signal dividing circuit 6307, and the like are formed. The display panel 6301 and the circuit board 6302 are connected to each other by a connection wiring 6308. As the connection wiring, an FPC or the like can be used.

The control circuit 6306 corresponds to the controller 6208, the memory 6209, the memory 6210, and the like in Embodiment Mode 8. Mainly in the control circuit 6306, the appearance order or the like of sub-frames is controlled.

In the display panel 6301, the pixel portion and a part of peripheral driver circuits (a driver circuit having a low operation frequency among a plurality of driver circuits) may be integrally formed using a transistor over the same substrate, and another part of the peripheral driver circuits (a driver circuit having a high operation frequency among the plurality of driver circuits) may be formed on an IC chip. The IC chip may be mounted on the display panel 6301 by COG (Chip On Glass) or the like. The IC chip may alternatively be mounted on the display panel 6301 by using TAB (Tape Automated Bonding) or a printed wiring board.

In addition, by converting the impedance of a signal set to a scanning line or a signal line by using a buffer, a writing time for pixels of each row can be shortened. Accordingly, a high-definition display device can be provided.

Moreover, in order to further reduce power consumption, a pixel portion may be formed using a transistor over a glass substrate, and all signal line driver circuits may be formed on an IC chip, which may be mounted on a display panel by COG (Chip On Glass) or the like.

Figure 56:
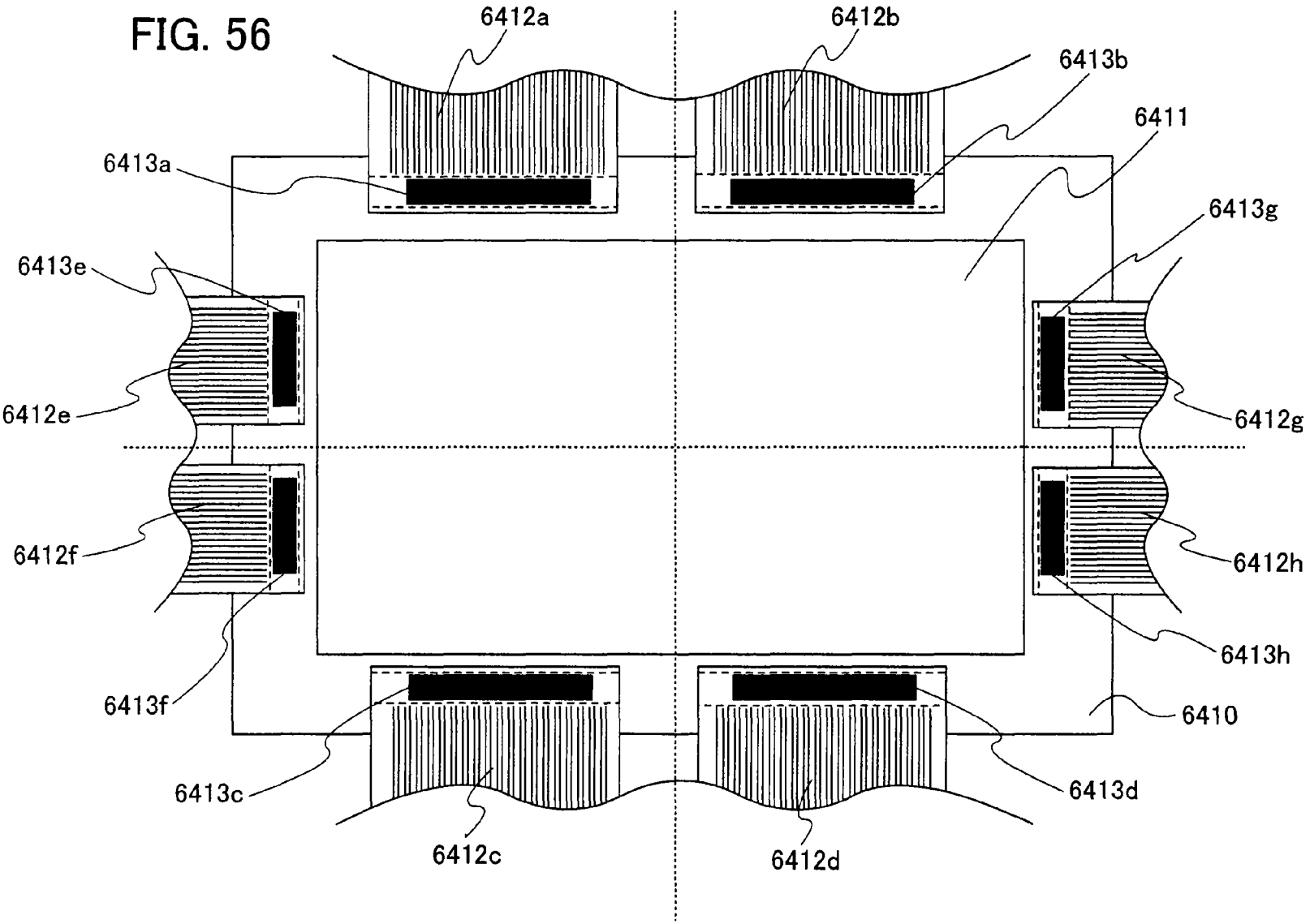
FIG. 56 shows a structural example of a display panel using a driving method of the present invention.

For example, the entire screen of the display panel may be divided into several regions, and an IC chip where a part or all of the peripheral driver circuits (the signal line driver circuit, the scanning line driver circuit, and the like) are formed may be arranged in each region to be mounted on the display panel by COG (Chip On Glass) or the like. FIG. 56 shows a structure of the display panel of this case.

FIG. 56 shows an example of driving by dividing the entire screen into four regions and using eight IC chips. A display panel includes, as its structure, a substrate 6410, a pixel portion 6411, FPCs 6412*a* to 6412*h*, and IC chips 6413*a* to 6413*h*. Among the eight IC chips, a signal line driver circuit is formed in each of the IC chips 6413*a* to 6413*d*, and a scanning line driver circuit is formed in each of the IC chips 6413*e* to 6413*h*. Then, it becomes possible to drive only an arbitrary screen region of the four screen regions by driving arbitrary IC chips. For example, when only the IC chips 6413*a* and 6413*e* are driven, just the upper left region of the four screen regions can be driven. Accordingly, it is possible to reduce power consumption.

Figure 57:
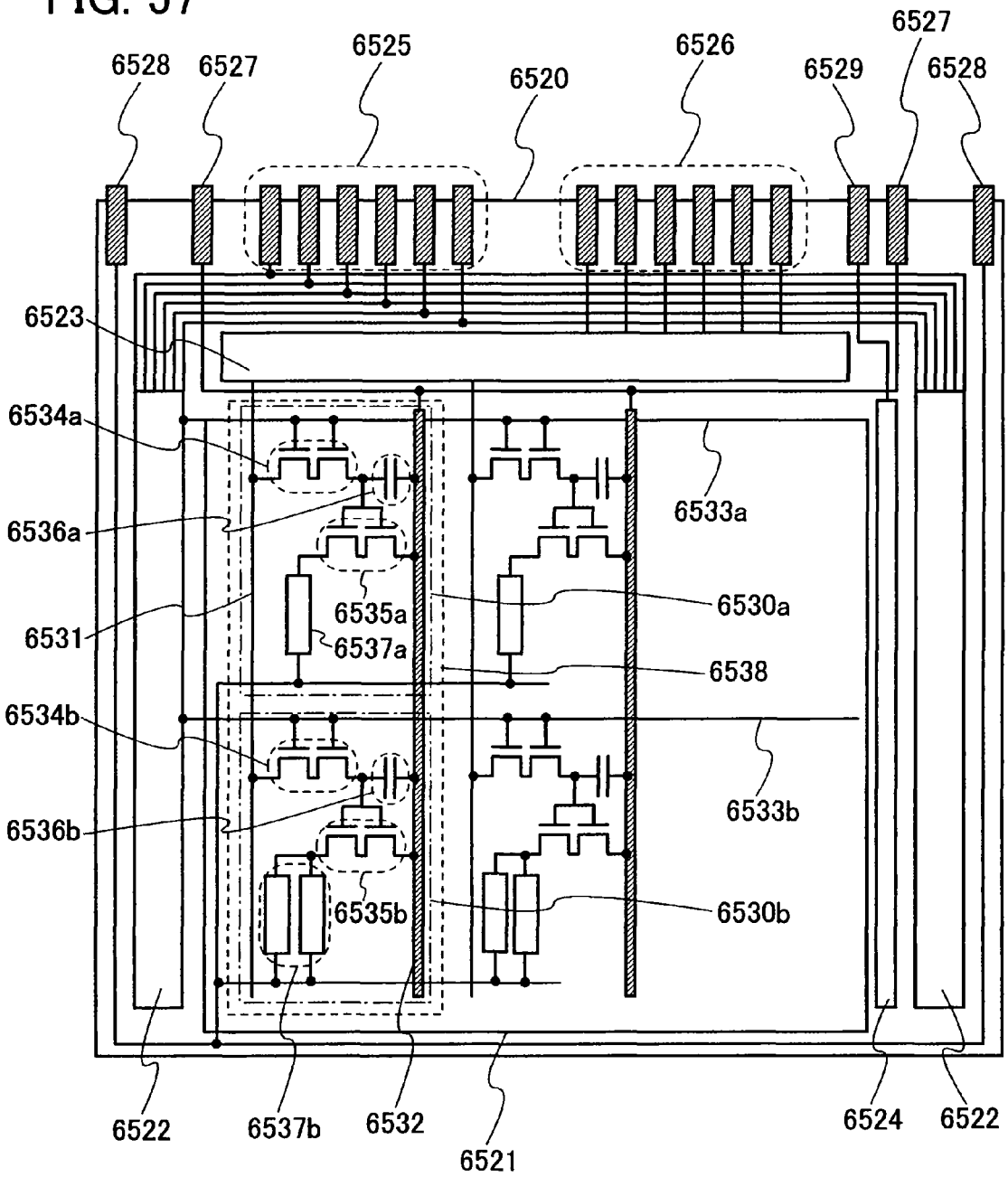
FIG. 57 shows a structural example of a display panel using a driving method of the present invention.

FIG. 57 shows an example of a display panel having a different structure. A display panel of FIG. 57 has a pixel portion 6521 where a plurality of pixels 6538 including sub-pixels 6530*a* and 6530*b* are arranged, a scanning line driver circuit 6522 that controls signals of scanning lines 6533*a* and 6533*b*, and a signal line driver circuit 6523 that controls a signal of a signal line 6531 over a substrate 6520. In addition, a monitor circuit 6524 to correct changes in luminance of light emitting elements 6537*a* and 6537*b* included in the sub-pixels 6530*a* and 6530*b*, respectively, may also be provided. The light emitting elements 6537*a* and 6537*b* and a light emitting element included in the monitor circuit 6524 have the same structure. Each of the light emitting elements 6537*a* and 6537*b* has a structure in which a layer containing a material that exhibits electroluminescence is sandwiched between a pair of electrodes.

The peripheral portion of the substrate 6520 has an input terminal 6525 to input a signal from an external circuit to the scanning line driver circuit 6522, an input terminal 6526 to input a signal from an external circuit to the signal line driver circuit 6523, and an input terminal 6529 to input a signal to the monitor circuit 6524.

The sub-pixels 6530*a* and 6530*b* include transistors 6534*a* and 6534*b*, respectively, which are connected to the signal line 6531. The sub-pixels 6530*a* and 6530*b* also include transistors 6535*a* and 6535*b*, respectively, which are connected in series to a power supply line 6532 and the light emitting elements 6537*a* and 6537*b* respectively. Gates of the transistors 6534*a* and 6534*b* are connected to the scanning lines 6533*a* and 6533*b*, respectively, and when selected by a scanning signal, a signal of the signal line 6531 is inputted to each of the sub-pixels 6530*a* and 6530*b*. The inputted signals are each provided to a gate of each of the transistors 6535*a* and 6535*b*, and the signals also charge holding capacitor portions 6536*a* and 6536*b*. In response to these signals, the power supply line 6532 and the light emitting elements 6537*a* and 6537*b* are brought into a conductive state, and the light emitting elements 6537*a* and 6537*b* emit light.

In order to make the light emitting elements 6537*a* and 6537*b* provided in the sub-pixels 6530*a* and 6530*b*, respectively, to emit light, it is necessary to supply power from an external circuit. The power supply line 6532 provided in the pixel portion 6521 is connected to the external circuit through an input terminal 6527. Since resistance loss occurs in the power supply line 6532 depending on a length of a wiring to be provided, it is preferable to provide a plurality of input terminals 6527 in a peripheral portion of the substrate 6520. The input terminals 6527 are provided in both end portions of the substrate 6520, and they are arranged so that unevenness of luminance within a surface of the pixel portion 6521 is hardly noticeable. In other words, one side of an inside of a screen being bright and the other side being dark are prevented. Also, in the light emitting elements 6537*a* and 6537*b* which are each provided with a pair of electrodes, electrodes on the opposite side of electrodes connected to the power supply line 6532 are formed as common electrodes which are shared by a plurality of pixels 6538. In order to reduce resistance loss of these electrodes, a plurality of terminals 6528 are provided.

In such a display panel, a power supply line is formed from a low resistance material such as Cu and is especially effective when a screen size is increased. For example, in a case where a screen size is 13 inches, the length of a diagonal line is 340 mm, whereas 1500 mm or more in a case of 60 inches. In such a case, since wiring resistance cannot be ignored, it is preferable to use a low resistance material such as Cu for a wiring. In addition, in consideration of wiring delay, a signal line or a scanning line may be formed in the same manner.

Figure 58:
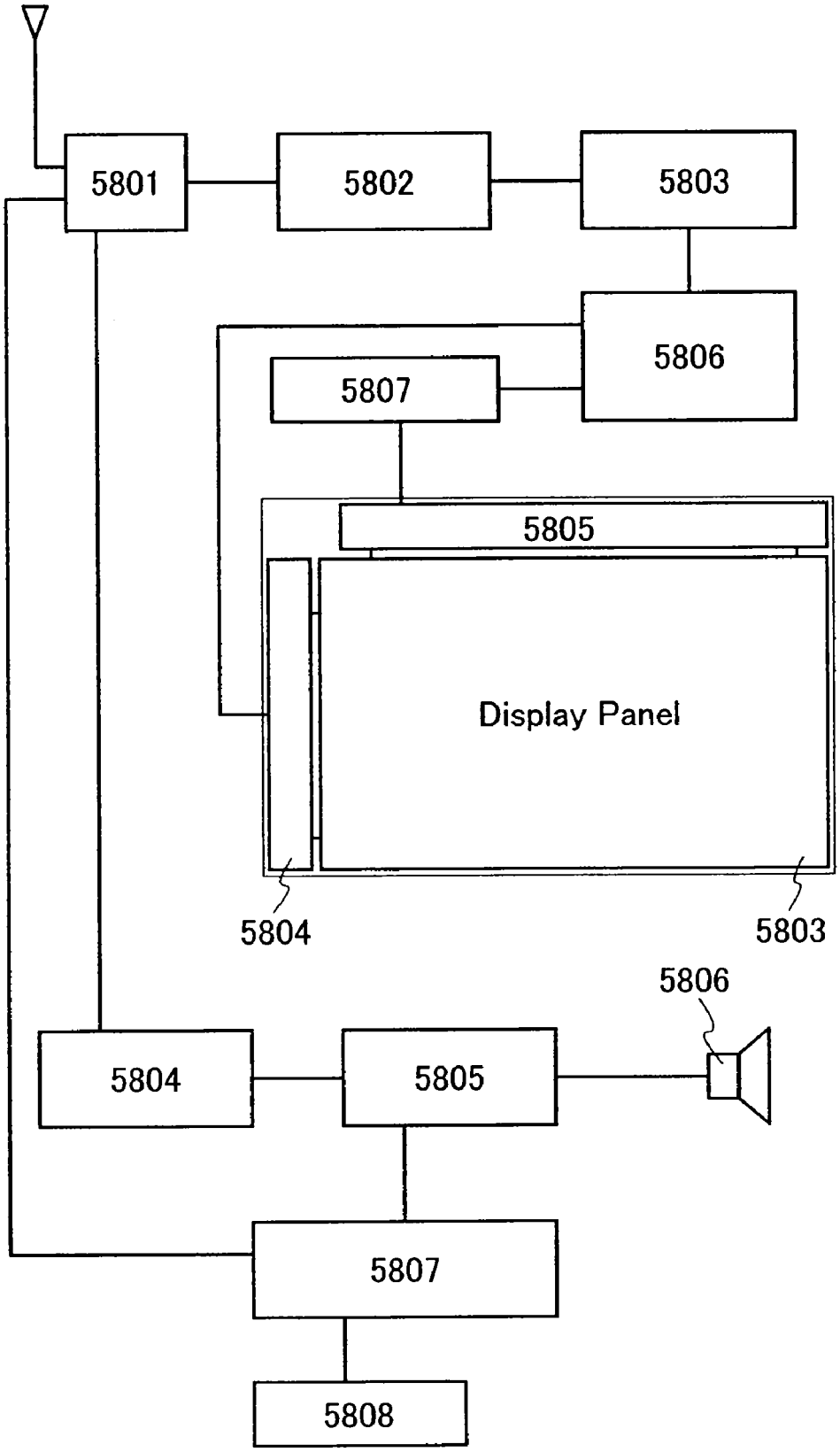
FIG. 58 shows an example of an EL television receiver using a driving method of the present invention.

With such an EL module provided with the panel configuration as described above, an EL television receiver can be completed. FIG. 58 is a block diagram showing the main configuration of an EL television receiver. A tuner 6601 receives video signals and audio signals. The video signals are processed by a video signal amplifier circuit 6602, a video signal processing circuit 6603 for converting a signal outputted from the video signal amplifier circuit 6602 into a color signal corresponding to each color of red, green, and blue, and a control circuit 6306 for converting the video signal to be inputted to a driver circuit. The control circuit 6306 outputs signals to each of a scanning line side and a signal line side. In a case of performing digital drive, a signal dividing circuit 6307 may be provided on the signal line side, so as to divide an input digital signal into m signals before being supplied to a pixel portion.

Among the signals received by the tuner 6601, audio signals are transmitted to an audio signal amplifier circuit 6604, and an output thereof is supplied to a speaker 6606 through an audio signal processing circuit 6605. A control circuit 6607 receives control data on a receiving station (reception frequency) or sound volume from an input portion 6608 and transmits signals to the tuner 6601 as well as the audio signal processing circuit 6605.

By incorporating the EL module into a housing, a television receiver can be completed. A display portion of the television receiver is formed with such an EL module. In addition, a speaker, a video input terminal, and the like are appropriately provided.

It is needless to mention that the present invention is not limited to the television receiver, and can be applied to various objects as a display medium such as a monitor of a personal computer, as well as a display medium specifically with a large area, such as an information display board in a train station, an airport, or the like, or an advertisement display board on a street.

By using a display device of the present invention and a driving method thereof, clear images can be displayed with reduced pseudo contour. Accordingly, even an image having subtle changes in gray scales such as human skin can be displayed clearly.

Note that the content described in this embodiment mode can be implemented by being freely combined with the contents described in Embodiment Modes 1 to 8.

Embodiment Mode 10

As an exemplary electronic device using a display device of the present invention, the followings can be given: a camera such as a video camera or a digital camera, a goggle display (a head-mounted display), a navigation system, an audio reproducing device (a car audio, an audio component, or the like), a laptop computer, a game machine, a portable information terminal (a mobile computer, a cellular phone, a game machine, an electronic book, or the like), an image reproducing device provided with a recording medium (specifically, a device which can reproduce a recording medium such as a digital versatile disc (DVD) and includes a display capable of displaying the image), and the like. FIGS. 59A to 59H show specific examples of such electronic devices.

Figure 59A:
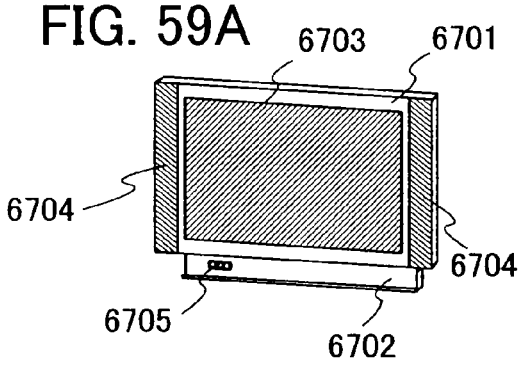
FIGS. 59A to 59H each show an example of an electronic device to which a driving method of the present invention is applied.

FIG. 59A shows a light emitting device, which includes a housing 6701, a supporting stand 6702, a display portion 6703, a speaker portion 6704, a video input terminal 6705, and the like. The present invention can be used for a display device which constitutes the display portion 6703. By the present invention, clear images can be displayed with reduced pseudo contour. Since the light emitting device is a self-luminous type, no backlight is required, and a display portion thinner than a liquid crystal display can be obtained. Note that the light emitting device includes all display devices for information display, for example, for a personal computer, for TV broadcast reception, or for advertisement display.

Figure 59B:
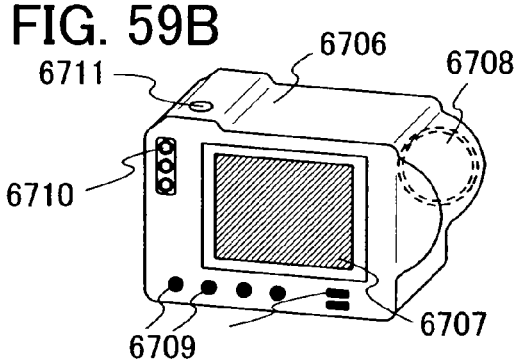

FIG. 59B shows a digital still camera, which includes a main body 6706, a display portion 6707, an image receiving portion 6708, operation keys 6709, an external connection port 6710, a shutter 6711, and the like. The present invention can be used for a display device which constitutes the display portion 6707. By the present invention, clear images can be displayed with reduced pseudo contour.

Figure 59C:
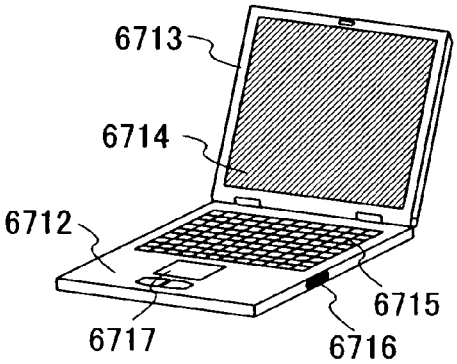

FIG. 59C shows a laptop computer, which includes a main body 6712, a housing 6713, a display portion 6714, a keyboard 6715, an external connection port 6716, a pointing mouse 6717, and the like. The present invention can be used for a display device which constitutes the display portion 6714. By the present invention, clear images can be displayed with reduced pseudo contour.

Figure 59D:
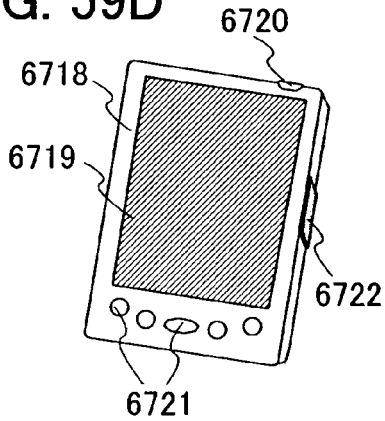

FIG. 59D shows a mobile computer, which includes a main body 6718, a display portion 6719, a switch 6720, operation keys 6721, an infrared port 6722, and the like. The present invention can be used for a display device which constitutes the display portion 6719. By the present invention, clear images can be displayed with reduced pseudo contour.

Figure 59E:
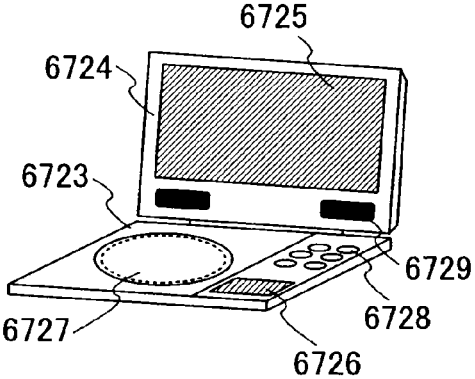

FIG. 59E shows a portable image reproducing device provided with a recording medium (specifically, a DVD reproducing device), which includes a main body 6723, a housing 6724, a display portion A 6725, a display portion B 6726, a recording medium (DVD or the like) reading portion 6727, an operation key 6728, a speaker portion 6729, and the like. The display portion A 6725 mainly displays image data, while the display portion B 6726 mainly displays text data. The present invention can be used for display devices which constitute the display portion A 6725 and the display portion B 6726. By the present invention, clear images can be displayed with reduced pseudo contour. Note that the image reproducing device provided with a recording medium also includes a home-use game machine and the like.

Figure 59F:
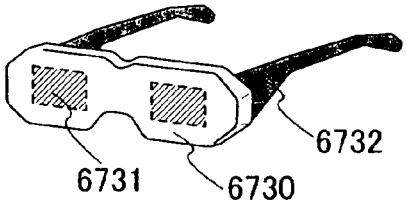

FIG. 59F shows a goggle display (a head-mounted display), which includes a main body 6730, a display portion 6731, an arm portion 6732, and the like. The present invention can be used for a display device which constitutes the display portion 6731. By the present invention, clear images can be displayed with reduced pseudo contour.

Figure 59G:
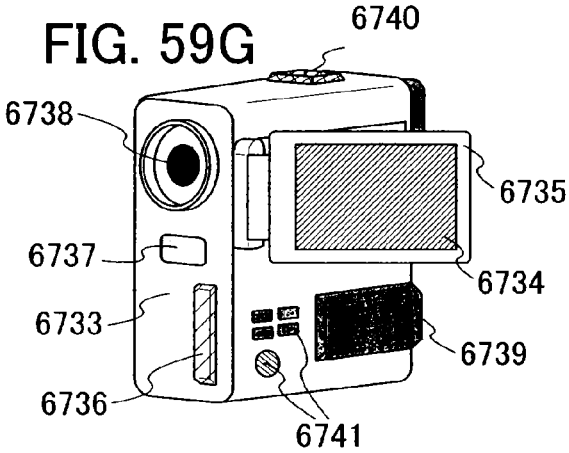

FIG. 59G shows a video camera, which includes a main body 6733, a display portion 6734, a housing 6735, an external connection port 6736, a remote control receiving portion 6737, an image receiving portion 6738, a battery 6739, an audio input portion 6740, operation keys 6741, and the like. The present invention can be used for a display device which constitutes the display portion 6734. By the present invention, clear images can be displayed with reduced pseudo contour.

Figure 59H:
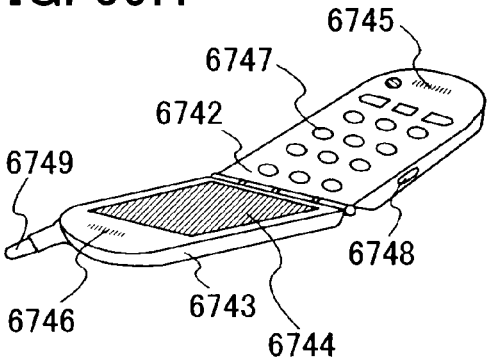
Figure 60A:
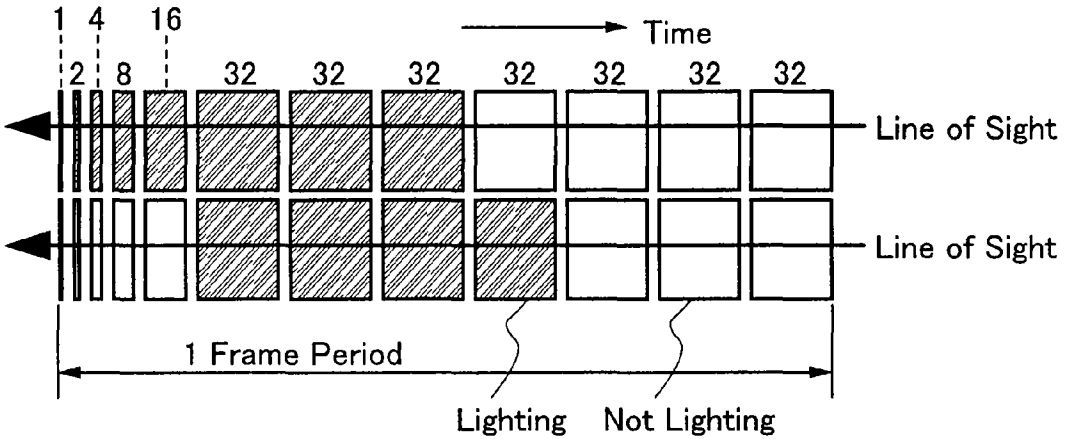
FIGS. 60A and 60B each show a state of an occurrence of pseudo contour in a conventional driving method.
Figure 60B:
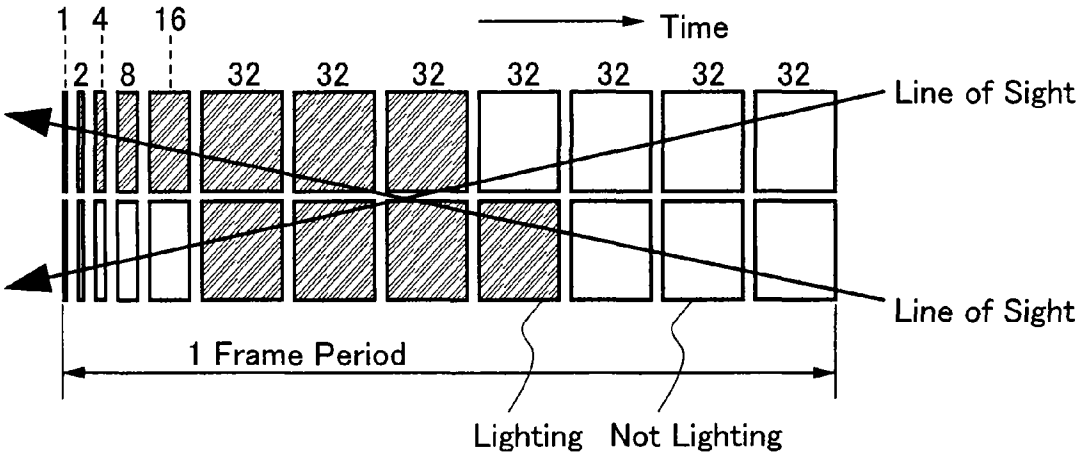
Figure 61:
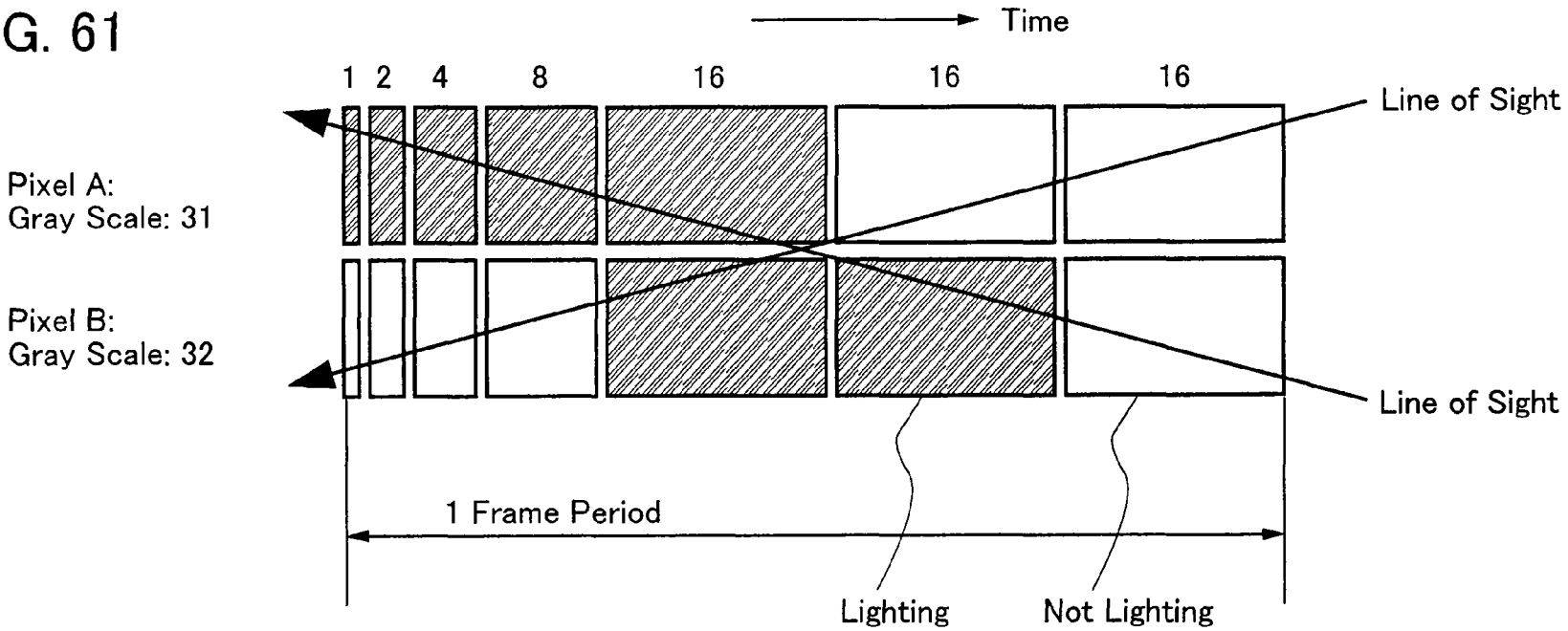
FIG. 61 shows a state of an occurrence of pseudo contour in a conventional driving method.

FIG. 59H shows a cellular phone, which includes a main body 6742, a housing 6743, a display portion 6744, an audio input portion 6745, an audio output portion 6746, operation keys 6747, an external connection port 6748, an antenna 6749, and the like. The present invention can be used for a display device which constitutes the display portion 6744. Note that current consumption of the cellular phone can be reduced if white text is displayed with a black background on the display portion 6744. By the present invention, clear images can be displayed with reduced pseudo contour.

Note that, if a light emitting material with high luminance is used, the present invention can be applied to a front or rear projector which projects an image by magnifying light including the outputted image data with a lens or the like.

Moreover, the above electronic devices have often been used for displaying data distributed through telecommunication lines such as the Internet or a CATV (Cable TV), and in particular, opportunity to display moving image data has been increased. Since a light emitting material has an extremely high response speed, a light emitting device is suitable for displaying moving images.

Since a light emitting device consumes power in its light emitting portion, it is desirable to display data by utilizing as small a light emitting portion as possible. Therefore, in a case of using a light emitting device for a display portion of a portable information terminal which mainly displays text data, such as a cellular phone or an audio reproducing device in particular, it is desirable to drive the light emitting device in such a manner that text data is displayed with a light emitting portion while using a non-light emitting portion as a background.

As described above, the application range of the present invention is so wide that the present invention can be applied to electronic devices of various fields. In addition, the electronic devices in this embodiment mode may employ a display device having any of the structures described in Embodiment Modes 1 to 9.

What is claimed is:

1. A driving method of a display device including a plurality of pixels each including m (m is an integer of m≧2) sub-pixels which are each provided with a light emitting element, comprising:

setting an area ratio of the m sub-pixels to be $2^0:2^1:2^2:\ldots:2^{m-3}:2^{m-2}:2^{m-1}$;

providing one frame with k (k is an integer of k≧2) sub-frame groups including a plurality of sub-frames in a lighting period of each of the m sub-pixels, along with providing n (n is an integer of n≧2) sub-frames in each of the k sub-frame groups so that a ratio of lighting period lengths is $2^0:2^m:2^{2m}:\ldots:2^{(n-3)m}:2^{(n-2)m}:2^{(n-1)m}$;

setting the sub-frames in the k sub-frame groups so that a same lighting pattern is repeated in each sub-frame group of the one frame, wherein the same lighting pattern being repeated in each sub-frame group comprises a same selection of sub-pixels being lit for a same amount of time in each sub-frame group of the one frame; and expressing a gray scale of the pixel by selecting a lighting state or a non-lighting state of the m sub-pixels in the sub-frames.

2. A driving method of a display device including a plurality of pixels each including m (m is an integer of m≧2) sub-pixels which are each provided with a light emitting element, comprising:

setting an area ratio of the m sub-pixels to be $2^0:2^1:2^2:\ldots:2^{m-3}:2^{m-2}:2^{-1}$;

providing one frame with k (k is an integer of k≧2) sub-frame groups including a plurality of sub-frames in a lighting period of each of the m sub-pixels, along with dividing the one frame into n (n is an integer of n≧2) first sub-frames of which a ratio of lighting period lengths is $2^0:2^m:2^{2m}:\ldots:2^{(n-3)m}:2^{(n-2)m}:2^{(n-1)m}$;

dividing each of the n first sub-frames into k second sub-frames having a lighting period length of about 1/k of the first sub-frame;

placing each of the k second sub-frames in each of the k sub-frame groups so that a same lighting pattern is repeated in each sub-frame group of the one frame, wherein the same lighting pattern being repeated in each sub-frame group comprises a same selection of sub-pixels being lit for a same amount of time in each sub-frame group of the one frame; and expressing a gray scale of the pixel by selecting a lighting state or a non-lighting state of the m sub-pixels in each of the second sub-frames.

3. The driving method of a display device according to claim 2, wherein in each of the k sub-frame groups, the second sub-frames included in each of the sub-frame groups are arranged in an ascending order lighting periods.

4. The driving method of a display device according to claim 2, wherein in the k sub-frame groups, the second sub-frames included in each of the sub-frame groups are arranged in an descending order of lighting periods.

5. The driving method of a display device according to claim 2, wherein in the k sub-frame groups, among the second sub-frames included in each of the sub-frame groups, an order of at least one sub-frame in the second sub-frame having the longest lighting period and the second sub-frame having the second longest lighting period is reversed.

6. The driving method of a display device according to claim 2, wherein luminance of the pixel and the gray scale has a proportional relationship, and when the gray scale is a high gray scale in one gray scale region, and luminance of the pixel and the gray scale has a non-linear relationship in another gray scale region.

7. A driving method of a display device including a plurality of pixels each including m (m is an integer of m≧2) sub-pixels which are each provided with a light emitting element, comprising:

setting an area ratio of the m sub-pixels to be $2^0:2^1:2^2:\ldots:2^{m-3}:2^{m-2}:2^{m-1}$;

providing one frame with k (k is an integer of k≧2) sub-frame groups each including a plurality of sub-frames in a lighting period of each of the m sub-pixels, along with dividing the one frame into n (n is an integer of n≧2) first sub-frames of which a ratio of lighting period lengths is $2^0:2^m:2^{2m}:\ldots:2^{(n-3)m}:2^{(n-2)m}:2^{(n-1)m}$;

dividing at least one first sub-frame of the n first sub-frames into (a×k) second sub-frames having a lighting period length that is about 1/(a×k) (a is an integer of a≧2) of the first sub-frame;

placing a of the (a×k) second sub-frames obtained by dividing each of the n first sub-frames in each of the k sub-frame groups;

dividing each of the remaining first sub-frames of the n first sub-frames into k second sub-frames each having a lighting period length that is about 1/k of the first sub-frame;

placing each of the k second sub-frames obtained by dividing each of the remaining first sub-frames in each of the k sub-frame groups;

placing each of the second sub-frames in each of the k sub-frame groups so that a same lighting pattern is repeated in each sub-frame group of the one frame, wherein the same lighting pattern being repeated in each sub-frame group comprises a same selection of sub-pixels being lit for a same amount of time in each sub-frame group of the one frame; and expressing a gray scale of the pixel by selecting a lighting state or a non-lighting state of the m sub-pixels in each of the second sub-frames.

8. The driving method of a display device according to claim 7, wherein each the second sub-frames having a lighting period length that is about 1/(a×k) of the first sub-frame is a sub-frame having the longest lighting period among the n first sub-frames.

9. The driving method of a display device according to claim 7, wherein in each of the k sub-frame groups, the second sub-frames included in each of the sub-frame groups are arranged in an ascending order lighting periods.

10. The driving method of a display device according to claim 7, wherein in the k sub-frame groups, the second sub-frames included in each of the sub-frame groups are arranged in an descending order of lighting periods.

11. The driving method of a display device according to claim 7, wherein in the k sub-frame groups, among the second sub-frames included in each of the sub-frame groups, an order of at least one sub-frame in the second sub-frame having the longest lighting period and the second sub-frame having the second longest lighting period is reversed.

12. The driving method of a display device according to claim 7, wherein luminance of the pixel and the gray scale has a proportional relationship, and when the gray scale is a high gray scale in one gray scale region, and luminance of the pixel and the gray scale has a non-linear relationship in another gray scale region.

13. A display device comprising:

a plurality of pixels each including m (m is an integer of m≧2) sub-pixels of which an area ratio is $2^0:2^1:2^2:\ldots:2^{m-3}:2^{m-2}:2^{m-1}$; and a light emitting element, a signal line, a scanning line, a first power supply line, a second power supply line, a selection transistor, and a driving transistor, which are formed in each of the m sub-pixels;

wherein one of a source or drain electrode of the selection transistor is electrically connected to the signal line and the other is electrically connected to a gate electrode of the driving transistor;

wherein one of a source or drain electrode of the driving transistor is electrically connected to the first power supply line;

wherein the light emitting element includes a first electrode and a second electrode, in which the first electrode is electrically connected to the other source or drain electrode of the driving transistor and the second electrode is connected to the second power supply line;

wherein k (k is an integer of k≧2) sub-frame groups each including a plurality of sub-frames are provided in one frame, and the one frame is divided into n (n is an integer of n≧2) first sub-frames of which a ratio of lighting period lengths is $2^0:2^m:2^{2m}:\ldots:2^{(n-3)m}:2^{(n-2)m}:2^{(n-1)m}$, in a lighting period of ech of the m sub-pixels;

wherein each of the remaining first sub-frames of the n first sub-frames are divided into k second sub-frames each having a lighting period length that is about 1/k of the first sub-frame;

wherein each of the k second sub-frames are placed in each of the k sub-frame groups so that a same lighting pattern is repeated in each sub-frame group of the one frame, wherein the same lighting pattern being repeated in each sub-frame group comprises a same selection of sub-pixels being lit for a same amount of time in each sub-frame group of the one frame; and wherein a gray scale of the pixel is expressed by selecting a lighting state or a non-lighting state of the m sub-pixels in each of the second sub-frames.

14. The display device according to claim 13, wherein the signal line is shared by the m sub-pixels.

15. The display device according to claim 13, wherein the scanning line is shared by the m sub-pixels.

16. The display device according to claim 13, wherein at least one of the first power supply line and the second power supply line is shared by the m sub-pixels.

17. The display device according to claim 13, wherein the number of the signal lines included in the pixel is 2 or more and m or less; and wherein the selection transistor included in any one sub-pixel of the m sub-pixels is electrically connected to the signal line different from that connected to the selection transistor included in another sub-pixel.

18. The display device according to claim 13, wherein the number of the scanning lines included in the pixel is 2 or more; and wherein the selection transistor included in any one sub-pixel of the m sub-pixels is electrically connected to the scanning line different from that connected to the selection transistor included in another sub-pixel.

19. The display device according to claim 13, wherein the number of the first power supply lines included in the pixel is 2 or more and m or less;

wherein the driving transistor included in any one sub-pixel of the m sub-pixels is electrically connected to the first power supply line difference from that connected to the driving transistor included in another sub-pixel.

20. An electronic device comprising the display device according to claim 13.

21. A display device comprising:

a plurality of pixels each including m (m is an integer of m≧2) sub-pixels of which an area ratio is $2^0:2^1:2^2:\ldots:2^{m-3}:2^{m-2}:2^{m-1}$; and a light emitting element, a signal line, a scanning line, a first power supply line, a second power supply line, a selection transistor, and a driving transistor, which are formed in each of the m sub-pixels, wherein one of a source or drain electrode of the selection transistor is electrically connected to the signal line and the other is electrically connected to a gate electrode of the driving transistor;

wherein one of a source or drain electrode of the driving transistor is electrically connected to the first power supply line;

wherein the light emitting element includes a first electrode and a second electrode, in which the first electrode is electrically connected to the other source or drain electrode of the driving transistor and the second electrode is connected to the second power supply line;

wherein k (k is an integer of k≧2) sub-frame groups each including a plurality of sub-frames are provided in one frame, and the one frame is divided into n (n is an integer of n≧2) first sub-frames of which a ratio of lighting period lengths is $2^0:2^m:2^{2m}:\ldots:2^{(n-3)m}:2^{(n-2)n}:2^{(n-1)m}$, in a lighting period of each of the m sub-pixels;

wherein at least one first sub-frame of the n first sub-frames is divided into (a×k) second sub-frames having a lighting period length that is about 1/(a×k) (a is an integer of a ≧2) of the first sub-frame;

wherein a of the (a×k) second sub-frames obtained by dividing each of the n first sub-frames are placed in each of the k sub-frame groups;

wherein each of the remaining first sub-frames of the n first sub-frames are divided into k second sub-frames each having a lighting period length that is about 1/k of the first sub-frame;

wherein each of the k second sub-frames obtained by dividing each of the remaining first sub-frames are placed in each of the k sub-frame groups;

wherein each of the second sub-frames are placed in each of the k sub-frame groups so that a same lighting pattern is repeated in each sub-frame group of the one frame, wherein the same lighting pattern being repeated in each sub-frame group comprises a same selection of sub-pixels being lit for a same amount of time in each sub-frame group of the one frame; and wherein a gray scale of the pixel is expressed by selecting a lighting state or a non-lighting state of the m sub-pixels in each of the second sub-frames.

22. The display device according to claim 21, wherein the signal line is shared by the m sub-pixels.

23. The display device according to claim 21, wherein the scanning line is shared by the m sub-pixels.

24. The display device according to claim 21, wherein at least one of the first power supply line and the second power supply line is shared by the m sub-pixels.

25. The display device according to claim 21, wherein the number of the signal lines included in the pixel is 2 or more and m or less; and wherein the selection transistor included in any one sub-pixel of the m sub-pixels is electrically connected to the signal line different from that connected to the selection transistor included in another sub-pixel.

26. The display device according to claim 21, wherein the number of the scanning lines included in the pixel is 2 or more; and wherein the selection transistor included in any one sub-pixel of the m sub-pixels is electrically connected to the scanning line different from that connected to the selection transistor included in another sub-pixel.

27. The display device according to claim 21, wherein the number of the first power supply lines included in the pixel is 2 or more and m or less;

wherein the driving transistor included in any one sub-pixel of the m sub-pixels is electrically connected to the first power supply line difference from that connected to the driving transistor included in another sub-pixel.

28. An electronic device comprising the display device according to claim 21.

* * * * *

UNITED STATES PATENT AND TRADEMARK OFFICE

CERTIFICATE OF CORRECTION

PATENT NO. : 7,928,929 B2
APPLICATION NO. : 11/467072
DATED : April 19, 2011
INVENTOR(S) : Hideaki Shishido It is certified that error appears in the above-identified patent and that said Letters Patent is hereby corrected as shown below:

Column 29, line 36, replace “HG” with --FIG--.

Column 45, line 66, replace “HG” with --FIG--.

Column 65, line 58, replace “ech” with --each--.

Signed and Sealed this
Third Day of January, 2012

David J. Kappos

David J. Kappos
*Director of the United States Patent and Trademark Office*